US007592981B2

(12) United States Patent
Maeda

(10) Patent No.: US 7,592,981 B2
(45) Date of Patent: Sep. 22, 2009

(54) CIRCUIT FOR DRIVING SELF-LUMINOUS DISPLAY DEVICE AND METHOD FOR DRIVING THE SAME

(75) Inventor: Tomoyuki Maeda, Osaka (JP)

(73) Assignee: Toshiba Matsushita Display Technology Co., Ltd., Tokyo (JP)

( * ) Notice: Subject to any disclaimer, the term of this patent is extended or adjusted under 35 U.S.C. 154(b) by 412 days.

(21) Appl. No.: 10/567,405

(22) PCT Filed: Aug. 3, 2004

(86) PCT No.: PCT/JP2004/011416

§ 371 (c)(1),
(2), (4) Date: Feb. 6, 2006

(87) PCT Pub. No.: WO2005/013249

PCT Pub. Date: Feb. 10, 2005

(65) Prior Publication Data

US 2007/0152934 A1 Jul. 5, 2007

(30) Foreign Application Priority Data

Aug. 5, 2003 (JP) ..... 2003-287214
Jan. 26, 2004 (JP) ..... 2004-017653

(51) Int. Cl.
*G09G 3/30* (2006.01)

(52) U.S. Cl. ..... 345/76; 345/75.2

(58) Field of Classification Search ..... 345/37–39, 345/41–42, 45–51, 60, 64, 74.1, 75.2, 76–87, 345/100, 204, 214; 315/169.3, 169.4
See application file for complete search history.

(56) References Cited

U.S. PATENT DOCUMENTS

| | | | | |
|---|---|---|---|---|
| 6,654,028 | B1 | 11/2003 | Yamakawa | |
| 7,113,154 | B1 | 9/2006 | Inukai | |
| 7,355,574 | B1 * | 4/2008 | Leon et al. | 345/82 |
| 2002/0036716 | A1 | 3/2002 | Ito et al. | |
| 2002/0057234 | A1 | 5/2002 | Ishizuka et al. | |
| 2003/0098828 | A1 * | 5/2003 | Hunter et al. | 345/76 |

FOREIGN PATENT DOCUMENTS

| | | |
|---|---|---|
| EP | 1 061 497 A1 | 12/2000 |
| EP | 1 424 674 A1 | 6/2004 |
| EP | 1 469 448 A1 | 10/2004 |
| JP | 11-327496 | 11/1999 |
| JP | 2000-221945 | 8/2000 |
| JP | 2000-276091 | 10/2000 |
| JP | 2001-60076 | 3/2001 |
| JP | 2003-150104 | 5/2003 |
| JP | 2003-228331 | 8/2003 |

(Continued)

*Primary Examiner*—Richard Hjerpe
*Assistant Examiner*—Mansour M Said
(74) *Attorney, Agent, or Firm*—Oblon, Spivak, McClelland, Maier & Neustadt, L.L.P.

(57) ABSTRACT

A driving method of a self-luminous display apparatus having a plurality of self-luminous elements including each of pixels placed like a matrix in a pixel row direction and a pixel line direction and driving a display portion by passing a current between an anode and a cathode of each of the self-luminous elements and thereby emitting light from each of the pixels.

27 Claims, 134 Drawing Sheets

FOREIGN PATENT DOCUMENTS

| | | |
|---|---|---|
| JP | 2004-093682 | 3/2004 |
| KR | 2001-0052029 | 6/2001 |
| WO | WO 03/023750 A1 | 3/2003 |
| WO | 03/058593 | 7/2003 |
| WO | WO 03/058593 A1 | 7/2003 |

* cited by examiner

Gate signal line 17a
1H
1F
Vgh
Vgl
Time t

Gate signal line 17b
1F/N
Vgh
Vgl
Time t

Light emitting luminance
N
O
Time t

Gate signal line 17a
1H
1F
Vgh
Vgl
Time t

Gate signal line 17b
1F/(N·K)
1F/(N·K)
Vgh
Vgl
Time t

Light emitting luminance
N
O
Time t

Fig. 19 (a1)
Fig. 19 (a2)
Fig. 19 (a3)
Fig. 19 (b1)
Fig. 19 (b2)
Fig. 19 (b3)
Fig. 19 (c1)
Fig. 19 (c2)
Fig. 19 (c3)
50
52
53 still_pics data_div meta pics_cnt

CIRCUIT FOR DRIVING SELF-LUMINOUS DISPLAY DEVICE AND METHOD FOR DRIVING THE SAME

TECHNICAL FIELD

The present invention relates to a self-luminous display panel such as an EL display panel which employs organic or inorganic electroluminescent (EL) elements as well as to a drive circuit (IC) for the display panel. Also, it relates to an information display apparatus and the like which employ the EL display panel, etc., a drive method for the EL display panel, and the drive circuit for the EL display panel, etc.

BACKGROUND ART

Generally, active-matrix display apparatus display images by arranging a large number of pixels in a matrix and controlling the light intensity of each pixel according to a video signal. For example, if liquid crystals are used as an electrochemical substance, the transmittance of each pixel changes according to a voltage written into the pixel. With active-matrix display apparatus which employ an organic electroluminescent (EL) material as an electrochemical substance, emission brightness changes according to current written into pixels.

In a liquid crystal display panel, each pixel works as a shutter, and images are displayed as a backlight is blocked off and revealed by the pixels or shutters. An organic EL display panel is of a self-luminous type in which each pixel has a light-emitting element. Consequently, organic EL display panels have the advantages of being more viewable than liquid crystal display panels, requiring no backlighting, having high response speed, etc.

Brightness of each light-emitting element (pixel) in an organic EL display panel is controlled by an amount of current. That is, organic EL display panels differ greatly from liquid crystal display panels in that light-emitting elements are driven or controlled by current.

A construction of organic EL display panels can be either a simple-matrix type or active-matrix type. It is difficult to implement a large high-resolution display panel of the former type although the former type is simple in structure and inexpensive. The latter type allows a large high-resolution display panel to be implemented, but involves a problem that it is a technically difficult control method and is relatively expensive. Currently, active-matrix type display panels are developed intensively. In the active-matrix type display panel, current flowing through the light-emitting elements provided in each pixel is controlled by thin-film transistors (transistors) installed in the pixels.

In this active-matrix type organic EL display panel, a pixel 16 consists of an EL element 15 which is a light-emitting element, a first transistor 11*a*, a second transistor 11*b*, and a storage capacitance 19. The light-emitting element 15 is an organic electroluminescent (EL) element. According to the present invention, the transistor 11*a* which supplies (controls) current to the EL element 15 is referred to as a driver transistor 11.

The organic EL element 15, in many cases, may be referred to as an OLED (organic light-emitting diode) because of its rectification. In FIG. 1 or the like, a diode symbol is used for the lgiht-emitting element 15.

Incidentally, the light-emitting element 15 according to the present invention is not limited to an OLED. It may be of any type as long as its brightness is controlled by the amount of current flowing through the element 15. Examples include an inorganic EL element, a white light-emitting diode consisting of a semiconductor, a typical light-emitting diode, and a light-emitting transistor. Rectification is not necessarily required of the light-emitting element 15. Bidirectional diodes are also available. The EL element 15 according to the present invention may be any of the above elements.

The organic EL has a problem of element life. Causes of the element life include a temperature, an amount of current and so on. As for a display using an organic EL element, light is emitted by using a current so that an amount of light emission of a screen is proportional to the amount of current passing through a device. Therefore, there are problems that an image of a large amount of light emission has a large current passing through the device causing deterioration of the element and that a high-capacity power supply is required in order to pass a maximum amount of current.

DISCLOSURE OF THE INVENTION

As for a display using an organic EL element, an amount of light emission of a screen is proportional to an amount of current passing through a device. Therefore, the higher a maximum amount of light emission of the element is set, the larger a current becomes when all the elements of the screen emit maximum light. If the maximum amount of light emission of the element is suppressed, the entire screen becomes darker. For that reason, a drive to control the amount of light emission of the element is performed according to a display status of the screen.

A first aspect of the present invention is a driving method of a self-luminous display apparatus having a plurality of self-luminous elements comprising each of pixels placed like a matrix in a pixel row direction and a pixel line direction and driving a display portion by passing a current between an anode and a cathode of each of the self-luminous elements and thereby emitting light from each of the pixels, the driving method comprising:

a first process of acquiring a first amount of current to be passed between the anode and the cathode correspondingly to video data inputted from outside, and acquiring a predetermined single value as the first amount of current irrespective of a status of video data value distribution around the video data;

a second process of acquiring a second amount of current to be passed between the anode and the cathode correspondingly to the video data inputted from outside, where, regarding the second amount of current, a value, which has the first amount of current suppressed at a predetermined ratio according to the status of video data value distribution around the video data, is prepared, and of performing a processing in which the ratio of suppression is variable according to the status of video data value distribution, wherein the amount of current passing through each pixel line is controlled based on a result of the first or second processing instrument so as to emit light from the display portion.

A second aspect of the present invention is the driving method of a self-luminous display apparatus according to the first aspect of the present invention, wherein the first amount of current applied between the anode and the cathode of each of the corresponding self-luminous elements is determined by the first process when a gradation value of the video data inputted from outside is on a lower gradation side of performing a black display than a first predetermined gradation value.

A third aspect of the present invention is the driving method of a self-luminous display apparatus according to the first aspect of the present invention, wherein the second amount of current x applied between the anode and the cathode of each of the corresponding self-luminous elements is determined by the second process when a gradation value of the video data inputted from outside is on a higher gradation side of performing a white display than a first predetermined gradation value, and if the first amount of current in the case of performing the first process to the gradation value is y, the following relation holds between the first amount of current y and the second amount of current x:

$$0.20y \leqq x \leqq 0.60y.$$

A fourth aspect of the present invention is the driving method of a self-luminous display apparatus according to the first aspect of the present invention, wherein the applied amount of current is determined by acquiring a current value i1 which is a maximum value of the image data inputted from outside in a first period, acquiring a proper current value i2 by calculation from the image data inputted in a second period, and sequentially calculating the amount of current applied to each of the pixels displayed based on the predetermined image data inputted in the second period based on a ratio i2/i1.

A fifth aspect of the present invention is the driving method of a self-luminous display apparatus according to the first aspect of the present invention, wherein the applied amount of current is determined by acquiring a third current value i3 which is a maximum value of the inputted image data, actually applying a current between the anode and the cathode of each of the self-luminous display elements, acquiring an optimum value as a second current value i4 and multiplying the inputted image data by a ratio i4/i3 and thereby sequentially calculating the amount of current applied to each of the pixels displayed based on the predetermined image data.

A sixth aspect of the present invention is the driving method of a self-luminous display apparatus according to the first aspect of the present invention, wherein the gradation value of the video data inputted from outside is on a higher gradation side of performing a white display than the first predetermined gradation value, and the amount of current applied between the anode and the cathode of each of the self-luminous elements is controlled by a black insertion rate.

A seventh aspect of the present invention is the driving method of a self-luminous display apparatus according to the sixth aspect of the present invention, wherein the black insertion is performed from a first line to a terminal line in turn, and a black area is collectively inserted in one frame.

An eighth aspect of the present invention is the driving method of a self-luminous display apparatus according to the seventh aspect of the present invention, wherein the black insertion is performed from the first line to the terminal line, and the black area is inserted into a plurality of areas divided in the one frame.

A ninth aspect of the present invention is the driving method of a self-luminous display apparatus according to the sixth aspect of the present invention, wherein the black insertion is performed into a plurality of areas divided in the one frame while interchanging the turn instead of performing it from the first line to the terminal line in turn.

A tenth aspect of the present invention is the driving method of a self-luminous display apparatus according to the first aspect of the present invention, wherein the gradation value of the video data inputted from outside is on a higher gradation side of performing a white display than the first predetermined gradation value, and the amount of current applied between the anode and the cathode of each of the self-luminous elements is controlled by adjusting the amount of current passing through a group of source lines.

An eleventh aspect of the present invention is the driving method of a self-luminous display apparatus according to the tenth aspect of the present invention, wherein the adjustment of the amount of current passing through the group of source lines is performed by increasing and decreasing a reference current value.

A twelfth aspect of the present invention is the driving method of a self-luminous display apparatus according to the tenth aspect of the present invention, wherein the adjustment of the amount of current passing through the group of source lines is performed by increasing and decreasing the number of gradations.

A thirteenth aspect of the present invention is the driving method of a self-luminous display apparatus according to the first aspect of the present invention, wherein a difference between a first current passing between the anode and the cathode of each of the self-luminous elements in a first frame period and a second current passing in a second frame period following the first frame period is acquired, an n difference current value of which difference value is 1/n (n is a number of 1 or more) is calculated, and a selection value of a pixel line is determined from the n difference current value.

A fourteenth aspect of the present invention is the driving method of a self-luminous display apparatus according to the thirteenth aspect of the present invention, wherein the value n is $4 \leqq n \leqq 256$.

A fifteenth aspect of the present invention is the driving method of a self-luminous display apparatus according to the first aspect of the present invention, wherein a $\gamma$ constant is corrected to be optimum by the amount of current passing between the anode and the cathode of each of the self-luminous elements.

A sixteenth aspect of the present invention is the driving method of a self-luminous display apparatus according to the fifteenth aspect of the present invention, wherein the $\gamma$ constant is a set of points on a curve configured by sequentially combining intermediate values of a plurality of $\gamma$ curves.

A seventeenth aspect of the present invention is the driving method of a self-luminous display apparatus according to the fifteenth aspect of the present invention, wherein increase and decrease in the $\gamma$ constant is adjusted based on whether a light emission period of the self-luminous display element is long or short.

An eighteenth aspect of the present invention is the driving method of a self-luminous display apparatus according to the first aspect of the present invention, wherein on and off of the second process is controlled by placing switching instrument for the second processing instrument so as to determine the amount of current passing between the anode and the cathode of each of the self-luminous element by combining the first process and the second process when turned on and determine it only by the first process when turned off.

A nineteenth aspect of the present invention is a driving circuit of a self-luminous display apparatus having multiple self-luminous elements constituting each pixel placed like a matrix in a pixel row direction and a pixel line direction and driving a display portion by passing a current between an anode and a cathode of each self-luminous element and thereby emitting light from the pixels, the driving circuit comprising:

first light emitting instrument which has light emitted by each of the self-luminous elements at a first luminance preset correspondingly to image data inputted from outside;

second light emitting instrument which has light emitted by each of the self-luminous elements at a second luminance adjusted to suppress the first luminance preset correspondingly to the image data inputted from outside in conformance with light emitting luminance distribution of the pixels in surroundings.

A twentieth aspect of the present invention is a driving circuit of a self-luminous display apparatus having multiple self-luminous elements constituting each pixel placed like a matrix in a pixel row direction and a pixel line direction and driving a display portion by passing a current between an anode and a cathode of each self-luminous element and thereby emitting light from the pixels, the driving circuit comprising:

first processing instrument which performs processing of setting a first amount of current which should pass between the anode and the cathode correspondingly to image data inputted from outside and setting the first amount of current at a predetermined single value independently of an image data value distribution status in the vicinity of the image data; and second processing instrument which performs processing of setting a second amount of current which should pass between the anode and the cathode correspondingly to the image data inputted from outside and having one value of the second amount of current prepared which is a value of the first amount of current suppressed at a predetermined ratio according to the image data value distribution status in the vicinity of the image data, where the ratio of suppressing is variable according to the image data value distribution status; and control instrument which controls the amount of current passing through each of the pixel lines based on results of the first and second processing instrument.

A twenty-first aspect of the present invention is the driving circuit of the self-luminous display apparatus according to the twentieth aspect of the present invention, in which the second processing circuit performs processing of deciding the second amount of current for each of the pixel lines by arithmetic processing based on the image data inputted from outside.

A twenty-second aspect of the present invention is the driving circuit of the self-luminous display apparatus according to the twenty-first aspect of the present invention, in which the arithmetic processing is a process of obtaining a current value i1 which is a maximum value of the image data inputted from outside in a first period, acquiring a proper current value i2 by calculation from the image data inputted from outside in a second period, and sequentially calculating an amount of current applied to each of the pixels displayed based on the predetermined image data inputted from outside in the second period based on a ratio i2/i1.

A twenty-third aspect of the present invention is the driving circuit of the self-luminous display apparatus according to the twentieth aspect of the present invention, in which the second processing circuit has instrument which measures the image data inputted from outside and performs the arithmetic processing of deciding the second amount of current for each of the pixel lines based on the measurement result.

A twenty-fourth aspect of the present invention is the driving circuit of the self-luminous display apparatus according to the twenty-third aspect of the present invention, in which the arithmetic processing is a process of obtaining a third current value i3 which is a maximum value of the image data inputted from outside, actually applying a current between the anode and the cathode of each of the self-luminous display elements, and acquiring an optimum value as a second current value i4 and multiplying the inputted image data by a ratio i4/i3 so as to sequentially calculate the amount of current applied to each of the pixels displayed based on the predetermined image data.

A twenty-fifth aspect of the present invention is the driving circuit of the self-luminous display apparatus according to the nineteenth aspect of the present invention, comprising switching instrument for the second processing instrument which has operations effected only by the first processing instrument.

A twenty-sixth aspect of the invention is the driving circuit of the self-luminous display apparatus according to the twentieth aspect of the present invention, comprising switching instrument for the second processing instrument which has operations effected only by the first processing instrument.

A twenty-seventh aspect of the present invention is the controller of the self-luminous display apparatus having the driving circuit according to the nineteenth aspect of the present invention.

A twenty-eighth aspect of the invention is the controller of the self-luminous display apparatus having the driving circuit according to the twentieth aspect of the present invention.

A twenty-ninth aspect of the present invention is the self-luminous display apparatus comprising the driving circuit according to the nineteenth aspect of the present invention, in which the self-luminous elements are formed or placed like a matrix in the pixel row direction and the pixel line direction.

A thirtieth aspect of the invention is the self-luminous display apparatus comprising the driving circuit according to the twentieth aspect of the present invention, in which the self-luminous elements are formed or placed like a matrix in the pixel row direction and the pixel line direction.

A thirty-first aspect of the present invention is a driving method of a self-luminous display apparatus having a plurality of self-luminous elements comprising each of pixels placed like a matrix in a pixel row direction and a pixel line direction and driving a display portion by passing a current between an anode and a cathode of each of the self-luminous elements and thereby emitting light from each of the pixels, wherein:

the light is emitted from the display portion by controlling an amount of current passing each of pixel lines based on results of (1) a first process of acquiring a first amount of current to be passed between the anode and the cathode correspondingly to video data inputted from outside, and acciuiring a predetermined single value as the first amount of current irrespective of a status of video data value distribution around the video data or (2) a second process of acquiring a second amount of current to be passed between the anode and the cathode correspondingly to the video data inputted from outside; and preparing as the second amount of current a value having the first amount of current suppressed at a predetermined ratio according to the status of video data value distribution around the video data while the ratio of suppression being variable according to the status of video data value distribution, and in the case where the amount of current eciuivalent to displaying white is represented as 100, and if a gradation of a low-current region having the predetermined amount of current represented as 30 or less is given a positive number which is N1<1, N2<0 and N1≦N2 as a coefficient, W as the predetermined amount of current, I org as a current value at the time, and T org as a light emitting period, the amount of current satisfying the current value of I org×N1 and the light emitting period of T org×1/N2 is applied instead of the predetermined amount of current.

BRIEF DESCRIPTION OF THE DRAWINGS

FIG. 120 is a circuit block diagram of the present invention;

FIG. 121 is a circuit block diagram of the present invention;

FIG. 122 is a diagram showing a conversion method of a data converter;

FIG. 123 are diagrams showing the relationship between the input data and the amount of current;

FIG. 124 is a circuit block diagram of the present invention;

FIG. 125 are diagrams showing the relationship between the input data and the maximum number of gradations;

FIG. 126 is a diagram showing conversion of the gamma curve;

FIG. 127 is a diagram showing the relationship when suppressing the amount of current by combining control of the maximum number of gradations and control of the lighting rate;

FIG. 128 is a circuit block diagram of the present invention;

FIG. 129 is a diagram showing a data conversion method of the present invention;

FIG. 130 is a diagram showing the input data, a display lighting rate and classification thereof;

FIG. 131 is a circuit block diagram of the present invention;

Figure 132:
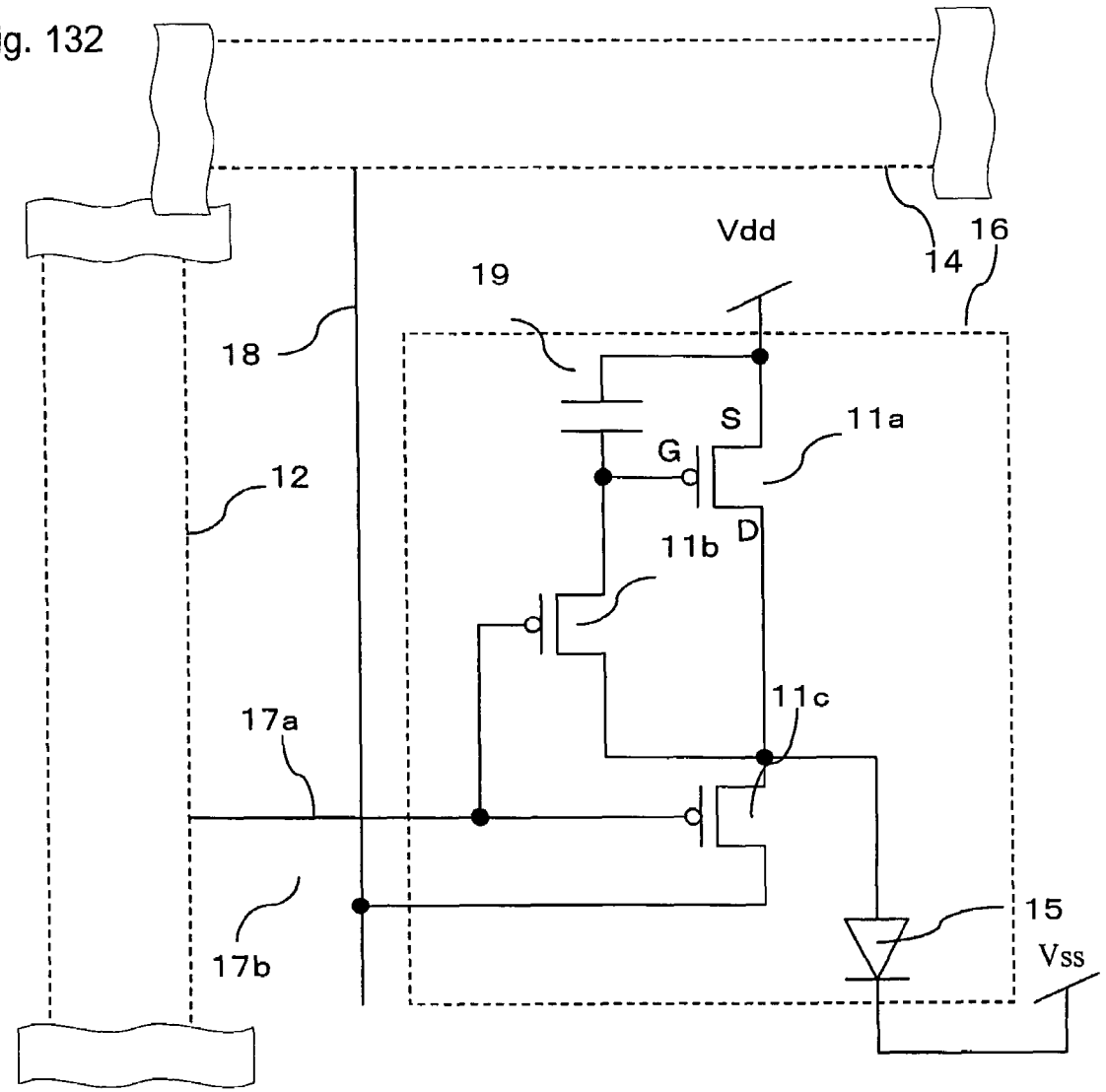
Figure 133:
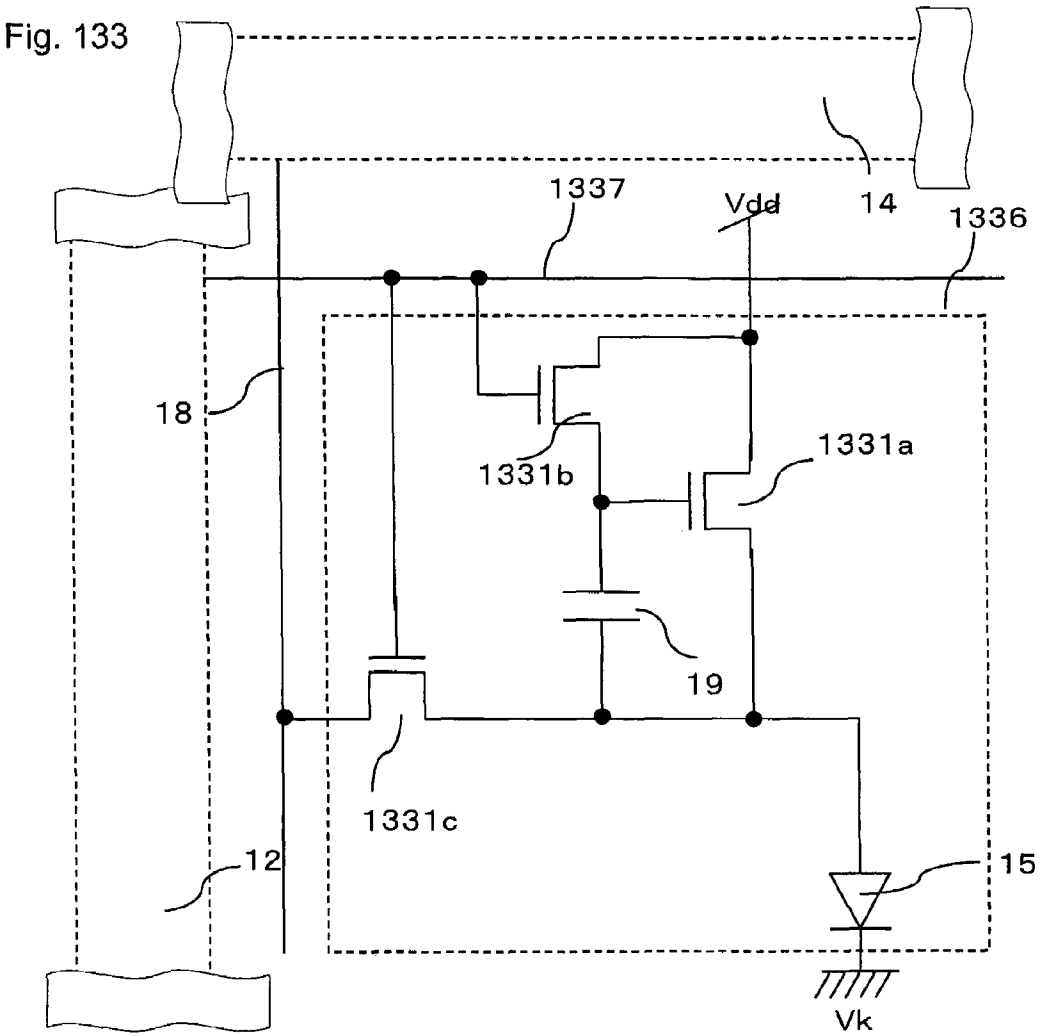
Figure 134:
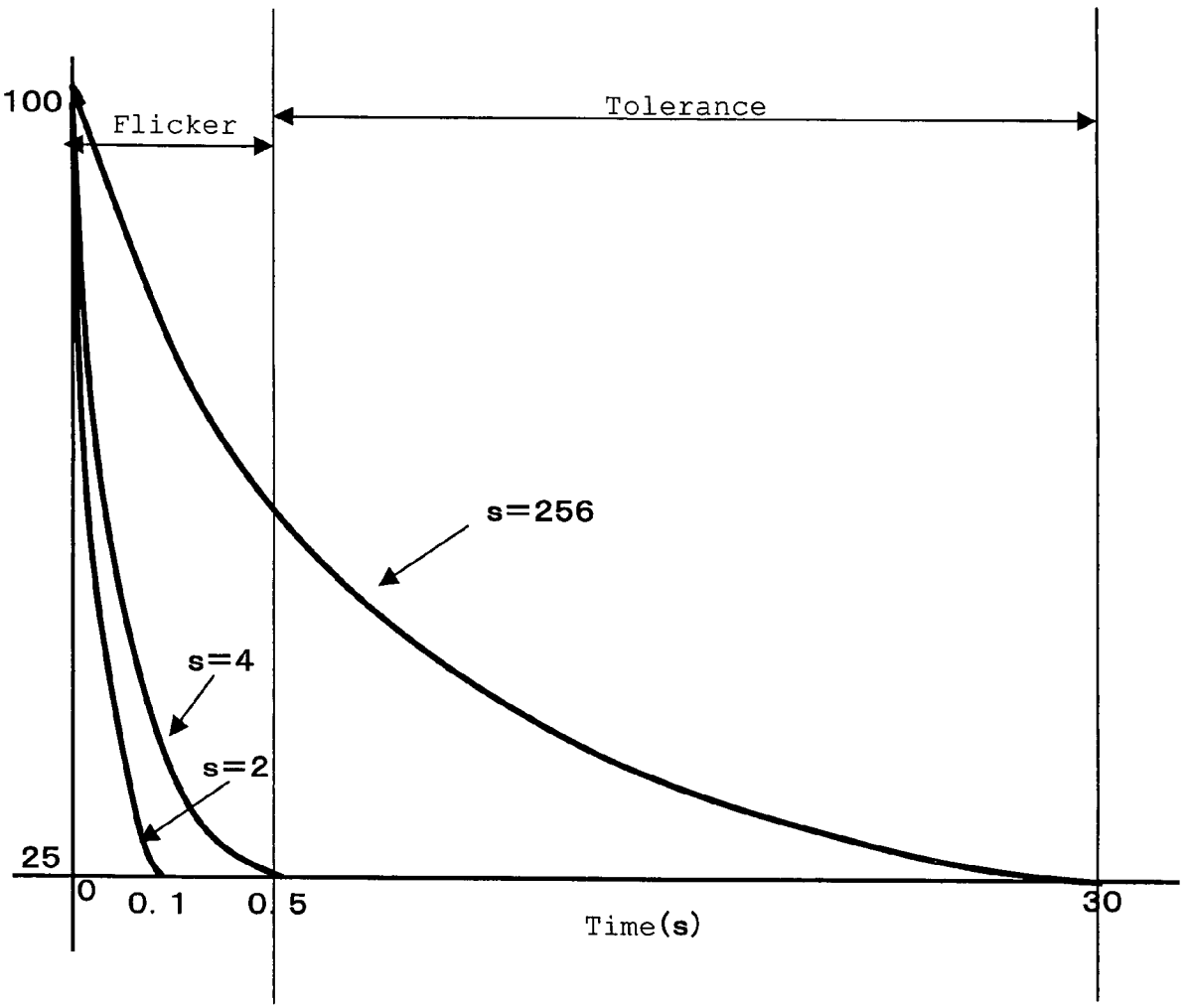

FIG. 132 is a pixel block diagram of the display panel according to the present invention;

FIG. 133 is a pixel block diagram of the display panel according to the present invention; and FIG. 134 is a diagram showing a delay in change of the lighting rate.

DESCRIPTION OF SYMBOLS

11, 1331 Transistor (thin-film transistor, TFT)
12 Gate driver (gate driver IC circuit)
14 Source driver (source driver IC circuit)
15 EL element (light-emitting element)
16, 1336 Pixel
17, 1337 Gate signal line
18 Source signal line
19 Storage capacitance (additional capacitor, additional capacitance)
50 Display screen
51 Write pixel (write pixel row)
52 Non-display pixel (non-display area, non-illuminated area)
53 Display pixel (display area, illuminated area)
61 Shift register
62 Inverter (OEV signal line)
63 Output buffer
65 OR circuit
71 Array board (display panel)
72 Laser irradiation range (excimer laser spot)
73 Positioning marker
74 Glass substrate (array board)
81 Control IC (control IC circuit)
82 Power supply IC (power Supply IC circuit)
83 Printed board
84 Flexible board
85 Sealing lid

86 Cathode wiring
87 Anode wiring (Vdd)
88 Data signal line
89 Gate control signal line
91, 451 Stray capacitance
101 Bank (rib)
102 Interlayer insulating film
104 Contact connector
105 Pixel electrode
106 Cathode electrode
107 Desiccant
108 λ/4 plate
109 Polarizing plate
111 Thin encapsulation film
271 Dummy pixel (dummy pixel line)
341 Eye ring
342 Magnifying lens
343 Convex lens
452 Current source
481*a* Horizontal synchronizing signal HD
482*a*, 483*a* Gate control signal
521 Supporting point (pivot point)
522 Taking lens
523 Storage section
524 Switch
531 Body
532 Photographic section
533 Shutter switch
541 Mounting frame
542 Leg
543 Mount
544 Fixed part
621 Resistance
622 Operational amplifier
623 Transistor
624 Resistance
625 Voltage adjustment portion
626 Power wire
627 Switching instrument (switch)
628 Control data
629 Reference current line

BEST MODE FOR CARRYING OUT THE INVENTION

Some parts of drawings herein are omitted and/or enlarged/reduced herein for ease of understanding and/or illustration. For example, in a sectional view of a display panel shown in FIG. 11, an encapsulation film 111 and the like are shown as being fairly thick. On the other hand, in FIG. 10, a sealing lid 85 is shown as being thin. For instance, a phase film of preventing reflection of unnecessary light is omitted as for the display panel of the present invention. It is desirable, however, to add it at the right time. This also applies to the drawings below. Besides, the same or similar forms, materials, functions, or operations are denoted by the same reference numbers or characters.

Incidentally, what is described with reference to drawings or the like can be combined with other examples or the like even if not noted specifically. For example, a touch panel or the like can be attached to a display panel in FIG. 8 to provide an information display apparatus shown in FIGS. 34 and 52 to 54. Also, a magnifying lens 342 can be mounted to configure a view finder (see FIG. 34) used for a video camera (see FIG. 52, etc.) or the like. Also, drive methods described with reference to FIG. 4, 15, 18, 21, 23, etc. can be applied to any display apparatus or display panel according to the present invention. To be more specific, the driving method according to this specification may be applied to the display panel of the present invention. The present invention mainly describes an active matrix type display panel having transistors formed on each pixel. It goes without saying, however, that the present invention is not limited thereto but may also be applied to a simple matrix type.

Thus, it is possible, even if not exemplified in the specification in particular, to list in claims any combination of matters, contents and specifications listed or described in the specification and drawings. It is because all the combinations cannot be described in the specification and so on.

In recent years, attention is directed toward an organic EL display panel configured by arranging multiple organic electroluminescence (EL) elements like a matrix as the display panel of low power consumption and high display quality and capable of further becoming low-profile.

Figure 10:
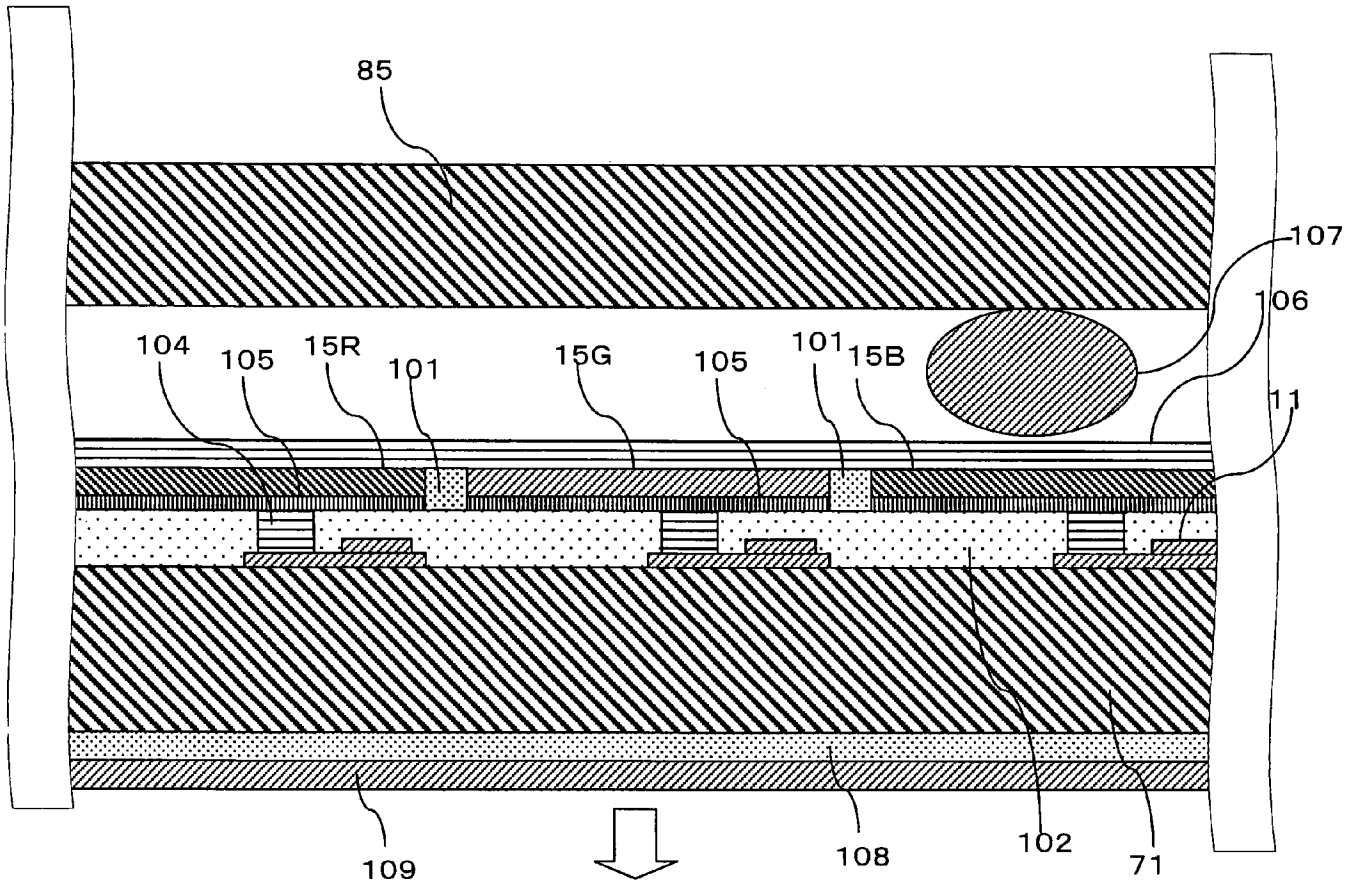
FIG. 10 is a sectional view of the display panel of the present invention.
Figure 11:
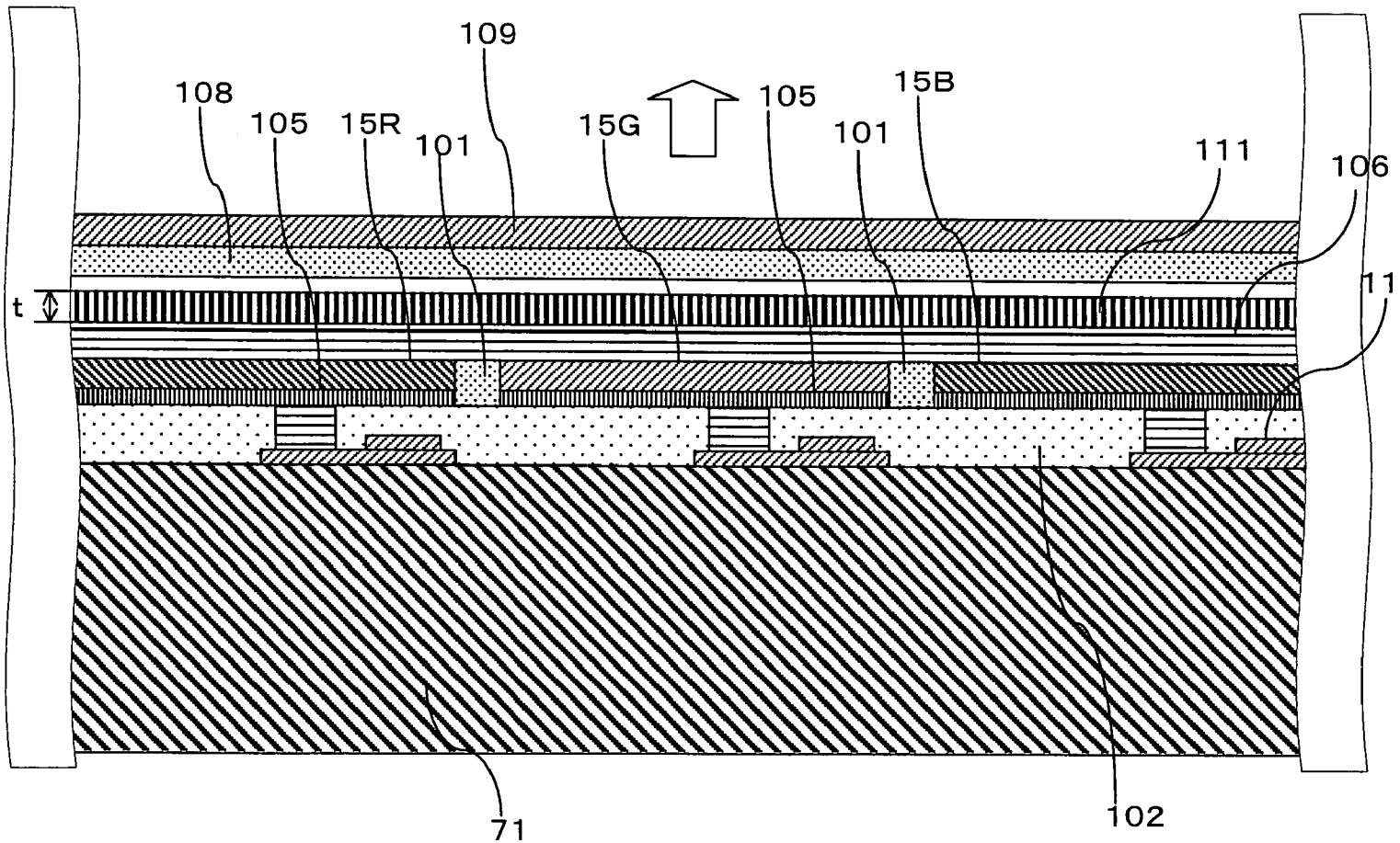
FIG. 11 is a sectional view of the display panel of the present invention.

As shown in FIG. 10, an organic EL display panel consists of a glass substrate (array board) 71, transparent electrodes 105 formed as pixel electrodes, at least one organic functional layer (EL layer) 15, and a metal electrode (reflective film) (cathode) 106, which are stacked one on top of another, where the organic functional layer consists of an electron transport layer, light-emitting layer, positive hole transport layer, etc.

The organic functional layer (EL layer) 15 emits light when a positive voltage is applied to the anode or transparent electrodes (pixel electrodes) 105 and a negative voltage is applied to the cathode or metal electrode (reflective electrode) 106, i.e., when a direct current is applied between the transparent electrodes 105 and metal electrode 106. The EL display panel is rendered practically usable by using an organic compound from which a good luminescence property is expectable for an organic functional layer. The present invention will be described by taking the organic EL display panel as an example. However, the present invention is not limited thereto but may also be applied to a display using inorganic EL and a display using a self-luminous element such as FED or SED. As for its structure, circuits and so on, there are matters also applicable to other display panels such as a TN liquid crystal display panel and an STN liquid crystal display panel.

Hereunder, a detailed description will be given as to a manufacturing method and the structure of the EL display panel of the present invention. First, transistors 11 of driving the pixels are formed on an array board 71. One pixel is comprised of two or more transistors, preferably four or five transistors. The pixel is current-programmed, and a programmed current is supplied to an EL element 15. A current-programmed value is normally held in a storage capacitance 19 as a voltage value. A description will be given later as to pixel configuration such as combination of the transistors 11. Next, pixel electrodes as hole injection electrodes are formed on the transistors 11. Pixel electrodes 105 are rendered as a pattern by photolithography. The transistors 11 have a light shielding film formed or placed in their lower layer or upper layer in order to prevent picture degradation due to a photoconductor phenomenon caused by having light incident on the transistors 11.

Current programming instrument which applies a programmed current to the pixel from a source driver 14 (or absorbs it from the pixel to the source driver 14) so as to have a signal value equivalent to this current held by the pixel. A current corresponding to the held signal value is passed to the EL element 15 (or passed from the EL element 15). To be more specific, it programs the current and passes the current equivalent (corresponding) to the programmed current to the EL element 15.

Voltage programming instrument which applies a programmed voltage to the pixel from the source driver 14 so as to have a signal value equivalent to this voltage held by the pixel. A current corresponding to the held voltage is passed to the EL element 15. To be more specific, it programs the voltage, converts the voltage to a current value in the pixel and passes the current equivalent (corresponding) to the programmed voltage to the EL element 15.

First, an organic EL display panel of active-matrix type must satisfy two conditions: (1) it is capable of selecting a specific pixel and give necessary display information; and (2) it is capable of passing current through the EL element throughout one frame period.

Figure 76:
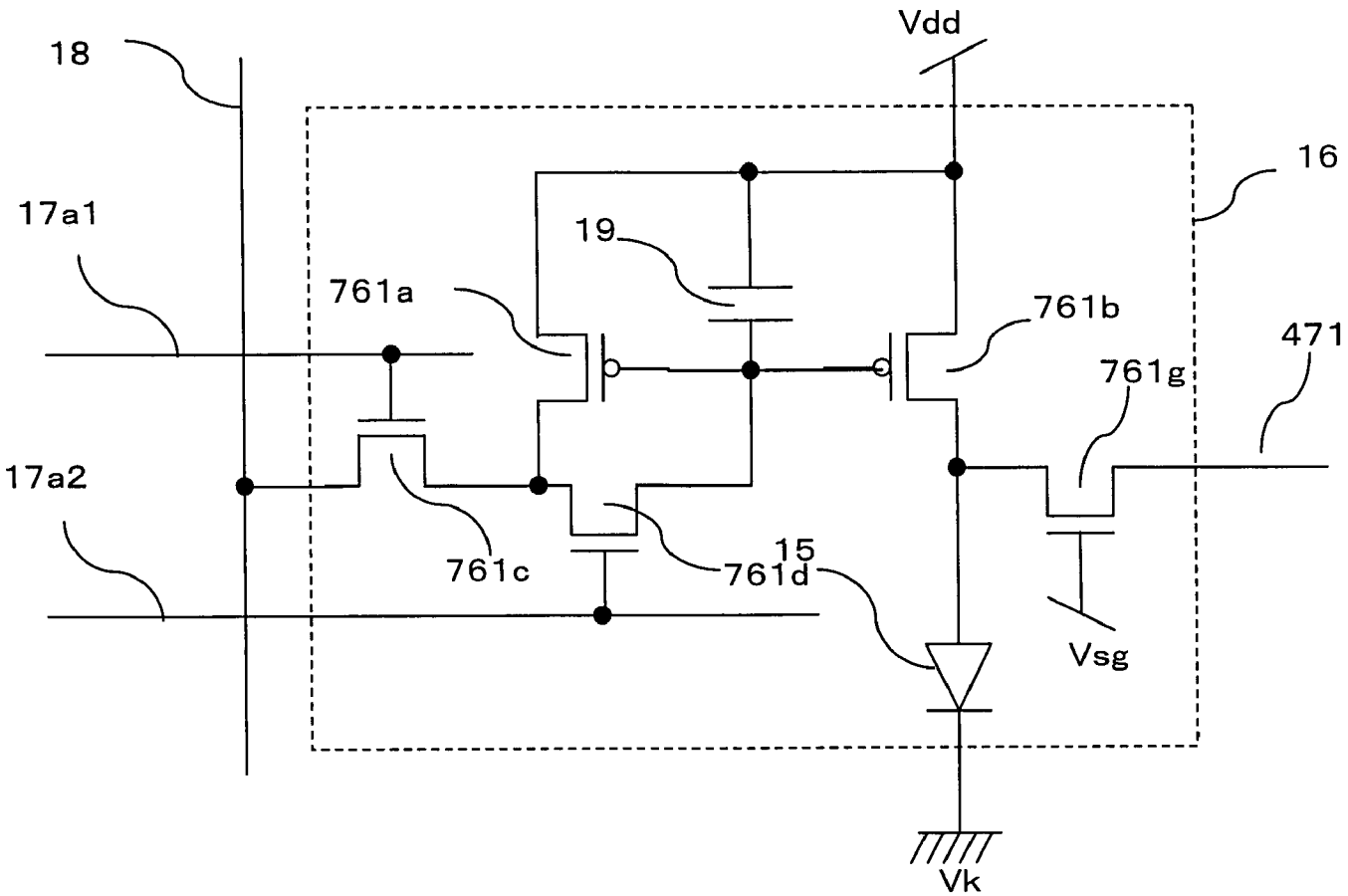
FIG. 76 is a pixel block diagram of the present invention.

To satisfy the two conditions, in a conventional organic EL pixel configuration shown in FIG. 76, a switching transistor is used as a first transistor 11*b* to select the pixel and a driver transistor is used as a second transistor 11*a* to supply current to an EL element (EL film) 15.

Compared to the active matrix method used for the liquid crystal here, the switching transistor 11*b* is also necessary for the liquid crystal while the driving transistor 11*a* is necessary to light up the EL element 15. This is because the liquid crystal can keep an on state by applying the voltage while the EL element 15 cannot maintain a lit-up state of a pixel 16 unless it keeps passing the current.

Therefore, the EL display panel must keep the transistor 11*a* on in order to keep passing the current. First, if both scanning lines and data lines are on, electric charge is accumulated in the storage capacitance 19 through the switching transistor 11*b*. As the storage capacitance 19 continues to apply the voltage to a gate of the driving transistor 11*a*, the current keeps passing from a current supply line (Vdd) even if the switching transistor 11*b* becomes off so that the pixel 16 can be on over one frame period.

To display a gradation using this configuration, a voltage corresponding to the gradation must be applied the gate of the driver transistor 11*a*. Consequently, variations in a turn-on current of the driver transistor 11*a* appear directly in display.

The turn-on current of a transistor is extremely uniform if the transistor is monocrystalline. However, in the case of a low-temperature polycrystalline transistor formed on an inexpensive glass substrate by low-temperature polysilicon technology at a temperature not higher than 450, its threshold varies in a range of ±0.2 V to 0.5 V. The turn-on current flowing through the driver transistor 11*a* varies accordingly, causing display irregularities. The irregularities are caused not only by variations in the threshold voltage, but also by mobility of the transistor and thickness of a gate insulating film. Characteristics also change due to degradation of the transistor 11.

It is not limited to a low-temperature polysilicon technology but may also be configured by using a high-temperature polysilicon technology of which process temperature is 450 degrees C. or higher or using TFT formed with a solid-phase (CGS) grown semiconductor film. Organic TFT may also be used.

The panel is configured by using a TFT array formed by an amorphous silicon technology. This specification will mainly describe the TFT formed by the low-temperature polysilicon technology. However, the problem such as occurrence of variations of the TFT is the same in the cases of other methods.

Therefore, in the case of the method of displaying the gradations in an analog fashion, it is necessary to strictly control a device property in order to obtain an even display. A current low-temperature polycrystalline polysilicon transistor cannot satisfy a specification of suppressing these variations within a predetermined range. To solve this problem, there are thinkable methods, such as a method of providing four or more transistors in one pixel and having variations of threshold voltage compensated for by the capacitor so as to obtain an even current and a method of forming a constant-current circuit for each pixel so as to render the current even.

As for these methods, however, the current to be programmed is programmed through the EL element 15. Therefore, the transistor controlling a driving current becomes a source follower against the switching transistor connected to a power supply line in the case where a current path changes so that a driving margin becomes narrow. Thus, there is a problem that a drive voltage becomes high.

There is also a problem that it is necessary to use the switching transistor connected to the power supply in an area of low impedance and this operation range is influenced by a property change of the EL element 15. In addition, there is a problem that a stored current value varies in the case where a kink current is generated to a volt-ampere characteristic in a saturation region and in the case where a threshold voltage of the transistor varies.

As for the EL element structure of the present invention, it is a configuration in which, as against the problems, the transistors 11 controlling the current passing through the EL element 15 do not have a source follower configuration, and it is possible, even if the transistors have the kink current, to minimize influence thereof and reduce the variation of the stored current value.

Figure 1:
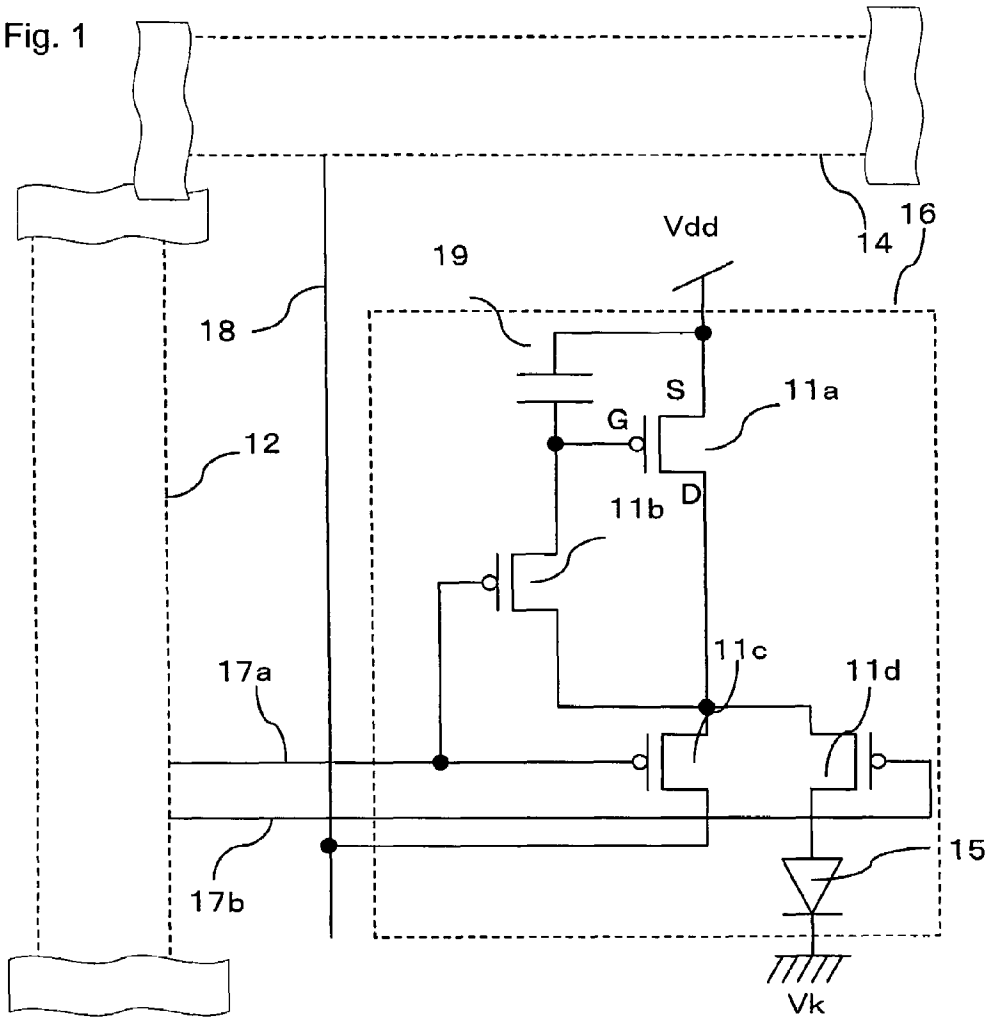
FIG. 1 is a pixel block diagram of a display panel according to the present invention.

Each pixel structure in an EL display panel according to the present invention comprises at least four transistors 11 and an EL element as shown concretely in FIG. 1. Incidentally, pixel electrodes are configured to overlap with a source signal line. Specifically, the pixel electrodes 105 are formed on an insulating film or planarized acrylic film formed on the source signal line 18 for insulation. A structure in which pixel electrodes overlap with the source signal line 18 is known as a high aperture (HA) structure.

When the gate signal line (first scanning line) 17*a* is activated (a turn-on voltage is applied), a current to be passed through the EL element 15 is delivered from the source driver circuit 14 via the driver transistor (transistor or switching element) 11*a* and the transistor (transistor or switching element) 11*c* of the EL element 15. Also, upon activation of (application of a turn-on voltage to) the gate signal line 17*a*, the transistor 11*b* opens to cause a short circuit between gate and drain of the transistor 11*a* and gate voltage (or drain voltage) of the transistor 11*a* is stored as said current value passes in a capacitor (storage capacitance, additional capacitance) 19 connected between the gate and drain of the transistor 11*a* (see FIG. 3(*a*)).

The storage capacitance 19 (capacitor) between a source (S) and a gate (G) of the transistor 11*a* should desirably have a capacity of 0.2 pF or more. Another configuration of forming the capacitor 19 separately is also exemplified. To be more specific, it is a configuration of forming a storage capacitance from a capacitor electrode layer, a gate insulating film and a gate metal. Such a configuration of separately forming the capacitor is preferable from viewpoints of preventing reduction in luminance due to a leak of the transistor 11*c* and stabilizing display operation. Preferably, the capacitor (storage capacitance) 19 should be from 0.2 pF to 2 pF both inclusive. More preferably, the capacitor (storage capacitance) 19 should be from 0.4 pF to 1.2 pF both inclusive.

It is desirable that the capacitor 19 be basically formed in a nondisplay area between adjacent pixels. In general, when creating a full-color organic EL 15, the organic EL layer 15 is formed by mask deposition with a metal mask so that mask displacement occurs to a position of forming an EL layer. If the displacement occurs, there is a danger that the organic EL layers 15 of the colors (15R, 15G and 15B) may overlap. For that reason, the nondisplay areas between the adjacent pixels of the colors must be apart by 10 μ or more. This is a portion not contributing to the light emitting. Therefore, forming the storage capacitance 19 in this area is effective instrument which improves an aperture ratio.

The metal mask is made of a magnetic material, and is stuck fast by magnetism of a magnet from a backside of the board 71. The metal mask is stuck fast to the board with no gap by the magnetism. The matters relating to the manufacturing method described above are also applicable to other manufacturing methods of the present invention.

Figure 3:
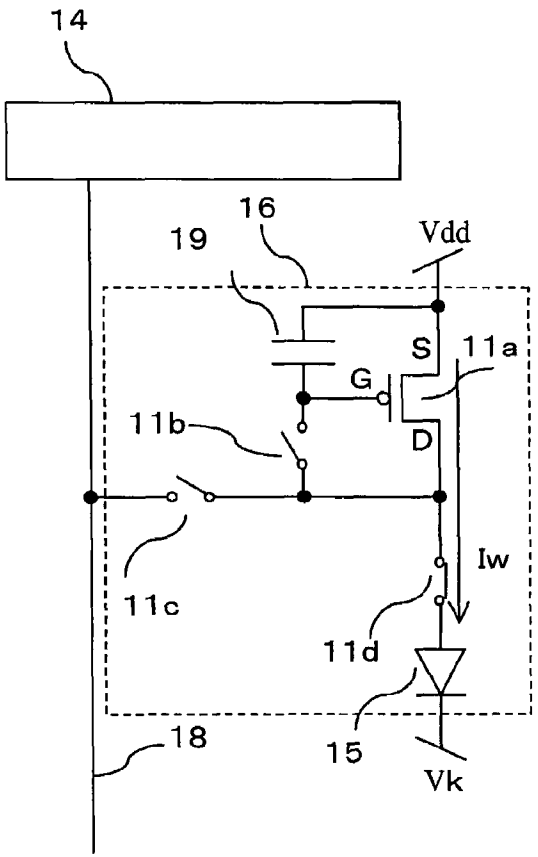
FIG. 3 are diagrams showing a flow on driving according to the present invention.
Figure 3:
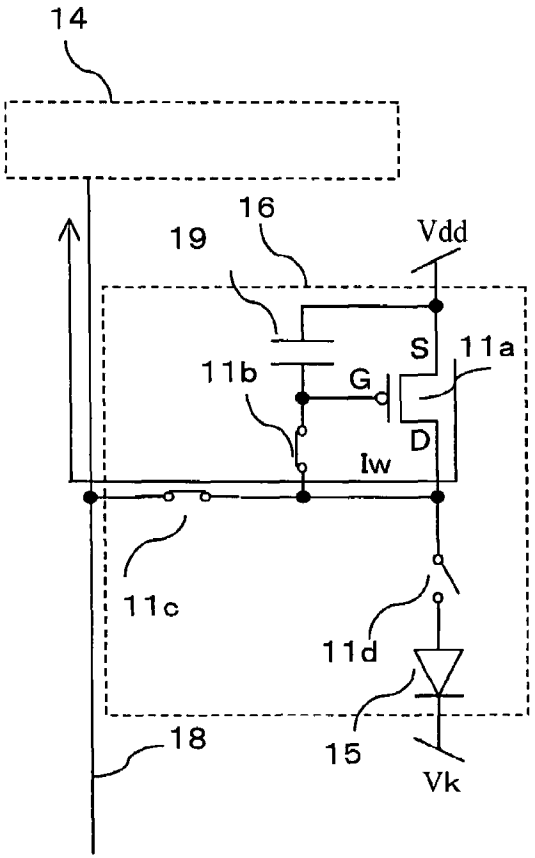

Next, the gate signal line 17*a* is deactivated (a turn-off voltage is applied), a gate signal line 17*b* is activated, and a current path is switched to a path which includes the first transistor 11*a*, a transistor 11*d* connected to the EL element 15, and the EL element 15 to deliver the stored current to the EL element 15 (see FIG. 3(*b*)).

In this circuit, a single pixel contains four transistors 11. The gate of the transistor 11*a* is connected to the source of the transistor 11*b*. The gates of the transistors 11*b* and 11*c* are connected to the gate signal line 17*a*. The drain of the transistor 11*b* is connected to the source of the transistor 11*c* and source of the transistor 11*d*. The drain of the transistor 11*c* is connected to the source signal line 18. The gate of the transistor 11*d* is connected to the gate signal line 17*b* and the drain of the transistor 11*d* is connected to the anode electrode of the EL element 15.

Incidentally, all the transistors in FIG. 1 are P-channel transistors. Compared to N-channel transistors, P-channel transistors have more or less lower mobility, but they are preferable because they are more resistant to voltage and degradation. However, the EL element according to the present invention is not limited to P-channel transistors and the present invention may employ N-channel transistors alone. Also, the present invention may employ both N-channel and P-channel transistors.

In FIG. 1, it is desirable that the transistors 11*c* and 11*b* be configured with the same polarity and configured with the N channels while configuring the transistors 11*a* and 11*d* with the P channels. Compared to the N-channel transistors, the P-channel transistors are generally characterized by having high reliability and little kink current. Rendering the transistor 11*a* as the P channel is very effective to the EL element 15 of obtaining target emission intensity by controlling the current. Optimally, P-channel transistors should be used for all the TFT 11 composing pixels as well as for the built-in gate driver 12. By composing an array solely of P-channel TFT, it is possible to reduce the number of masks to 5, resulting in low costs and high yields.

To facilitate understanding of the present invention, the configuration of the EL element according to the present invention will be described below with reference to FIG. 3. The EL element according to the present invention is controlled using two timings. The first timing is the one when required current values are stored. Turning on the transistor 11*b* and transistor 11*c* with this timing provides an equivalent circuit shown in FIG. 3(*a*). A predetermined current Iw is applied from signal lines. This makes the gate and drain of the transistor 11*a* connected, allowing the current Iw to flow through the transistor 11*a* and transistor 11*c*. Thus, the gate-source voltage V1 of the transistor 11*a* is such that allows I1 to flow.

The second timing is the one when the transistor 11*a* and transistor 11*c* are closed and the transistor 11*d* is opened. The equivalent circuit available at this time is shown in FIG. 3(*b*). The source-gate voltage of the transistor 11*a* is maintained. In this case, since the transistor 11*a* always operates in a saturation region, the current Iw remains constant.

Figure 5:
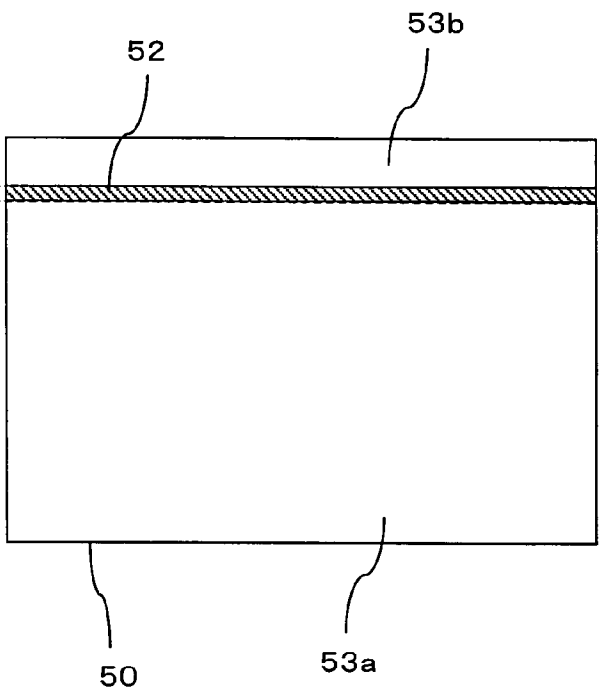
FIG. 5 are schematic diagrams of a display area of the display panel according to the present invention.
Figure 5:
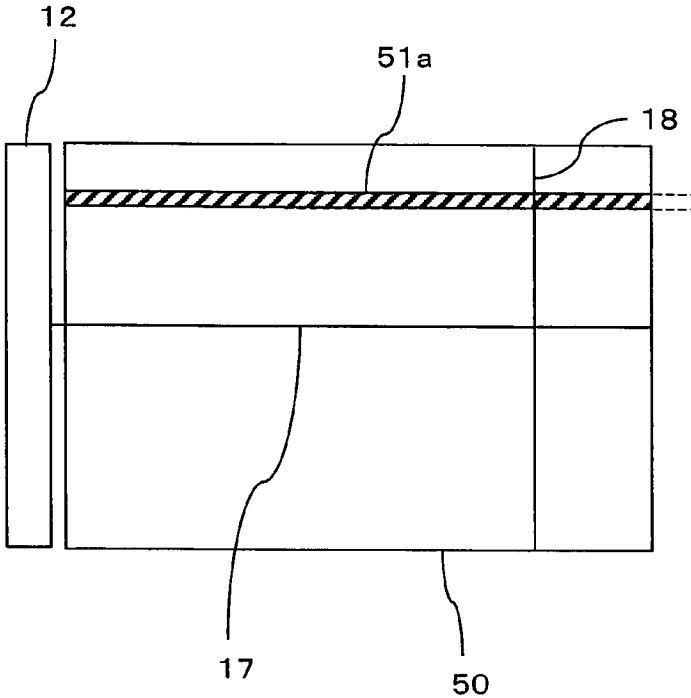

Results of this operation are shown in FIG. 5. Specifically, reference numeral 51*a* in FIG. 5(*a*) denotes a pixel (row) (write pixel row) programmed with current at a certain time point in a display screen 50. The pixel row 51*a* is non-illuminated (non-display pixel (row)) as illustrated in FIG. 5(*b*). Other pixels (rows) are display pixels (rows) 53 (current flows through the EL elements 15 of the non-pixels 53, causing the EL elements 15 to emit light).

In the pixel configuration in FIG. 1, the programming current Iw flows through the source signal line 18 during current programming as shown in FIG. 3(*a*). The current Iw flows through the transistor 11*a* and voltage is set (programmed) in the capacitor 19 in such a way as to maintain the current Iw. At this time, the transistor 11*d* is open (off).

During a period when the current flows through the EL element 15, the transistors 11*c* and 11*b* turn off and the transistor 11*d* turns on as shown in FIG. 3(*b*). Specifically, a turn-off voltage (Vgh) is applied to the gate signal line 17*a*, turning off the transistors 11*b* and 11*c*. On the other hand, a turn-on voltage (Vgl) is applied to the gate signal line 17*b*, turning on the transistor 11*d*.

Figure 4:
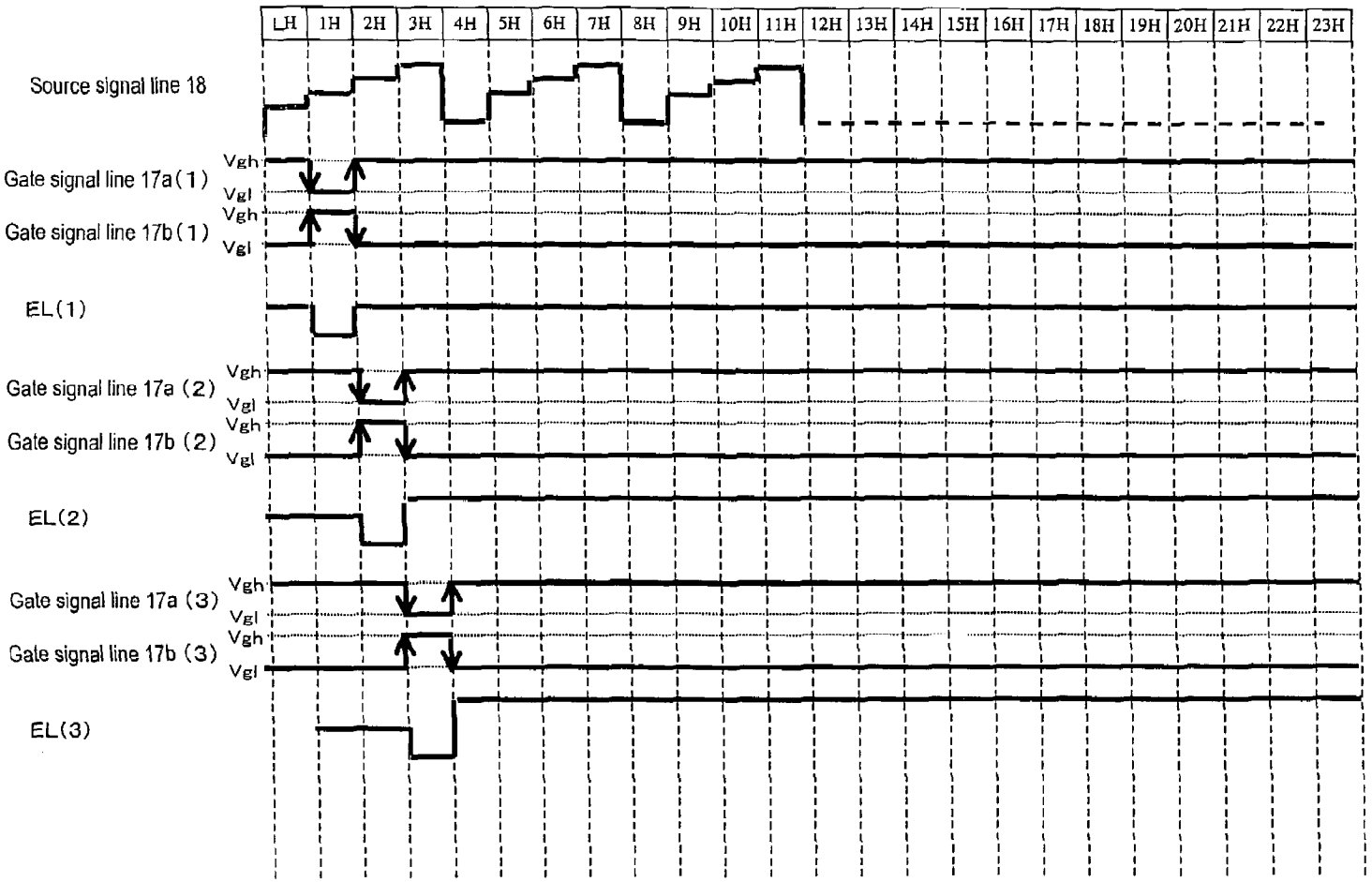
FIG. 4 is a diagram showing a drive waveform according to the present invention.

A timing chart is shown in FIG. 4. The subscripts in brackets in FIG. 4 (e.g., (1)) indicate pixel row numbers. Specifically, a gate signal line 17*a* (1) denotes a gate signal line 17*a* in a pixel row (1). Also, *H in the top row in FIG. 4 indicates a horizontal scanning period. Specifically, 1H is a first horizontal scanning period. Incidentally, the items (1H number, 1-H cycle, order of pixel row numbers, etc.) described above are intended to facilitate explanation and are not intended to be restrictive.

As can be seen from FIG. 4, in each selected pixel row (it is assumed that the selection period is 1H), when a turn-on voltage is applied to the gate signal line 17*a*, a turn-off voltage is applied to the gate signal line 17*b*. During this period, no current flows through the EL element 15 (non-illuminated). In non-selected pixel rows, a turn-off voltage is applied to the gate signal line 17*a* and a turn-on voltage is applied to the gate signal line 17*b*. During this period, a current flows through the EL element 15 (illuminated).

Incidentally, the gate of the transistor 11*b* and gate of the transistor 11*c* are connected to the same gate signal line 17*a*. However, the gate of the transistor 11*b* and gate of the transistor 11*c* may be connected to different gate signal lines 17. Then, one pixel will have three gate signal lines (two in the configuration in FIG. 1). By controlling ON/OFF timing of the gate of the transistor 11*b* and ON/OFF timing of the gate of the transistor 11*c* separately, it is possible to further reduce variations in the current value of the EL element 15 due to variations in the transistor 11*a*.

By sharing the gate signal line 17*a* and gate signal line 17*b* and using different conductivity types (N-channel and P-channel) for the transistors 11*c* and 11*d*, it is possible to simplify the drive circuit and improve the aperture ratio of pixels.

With this configuration, a write paths from signal lines are turned off according to operation timing of the present invention. That is, when a predetermined current is stored, an accurate current value is not stored in a capacitance (capacitor) between the source (S) and gate (G) of the transistor 11*a* if a current path is branched. By using different conductivity types for the transistors 11*c* and 11*d* and controlling their thresholds, it is possible to ensure that when scanning lines are switched, the transistor 11*d* is turned on after the transistor 11*c* is turned off.

An object of the present invention is to propose a circuit configuration in which variations in transistor characteristics do not affect display. Four or more transistors are required for that. When determining circuit constants using transistor characteristics, it is difficult to determine appropriate circuit constants unless the characteristics of the four transistors are not consistent. Both thresholds of transistor characteristics and mobility of the transistors vary depending on whether the channel direction is horizontal or vertical with respect to the longitudinal axis of laser irradiation. Incidentally, variations are more of the same in both cases. However, the mobility and average threshold vary between the horizontal direction and vertical direction. Thus, it is desirable that all the transistors in a pixel have the same channel direction.

Figure 27:
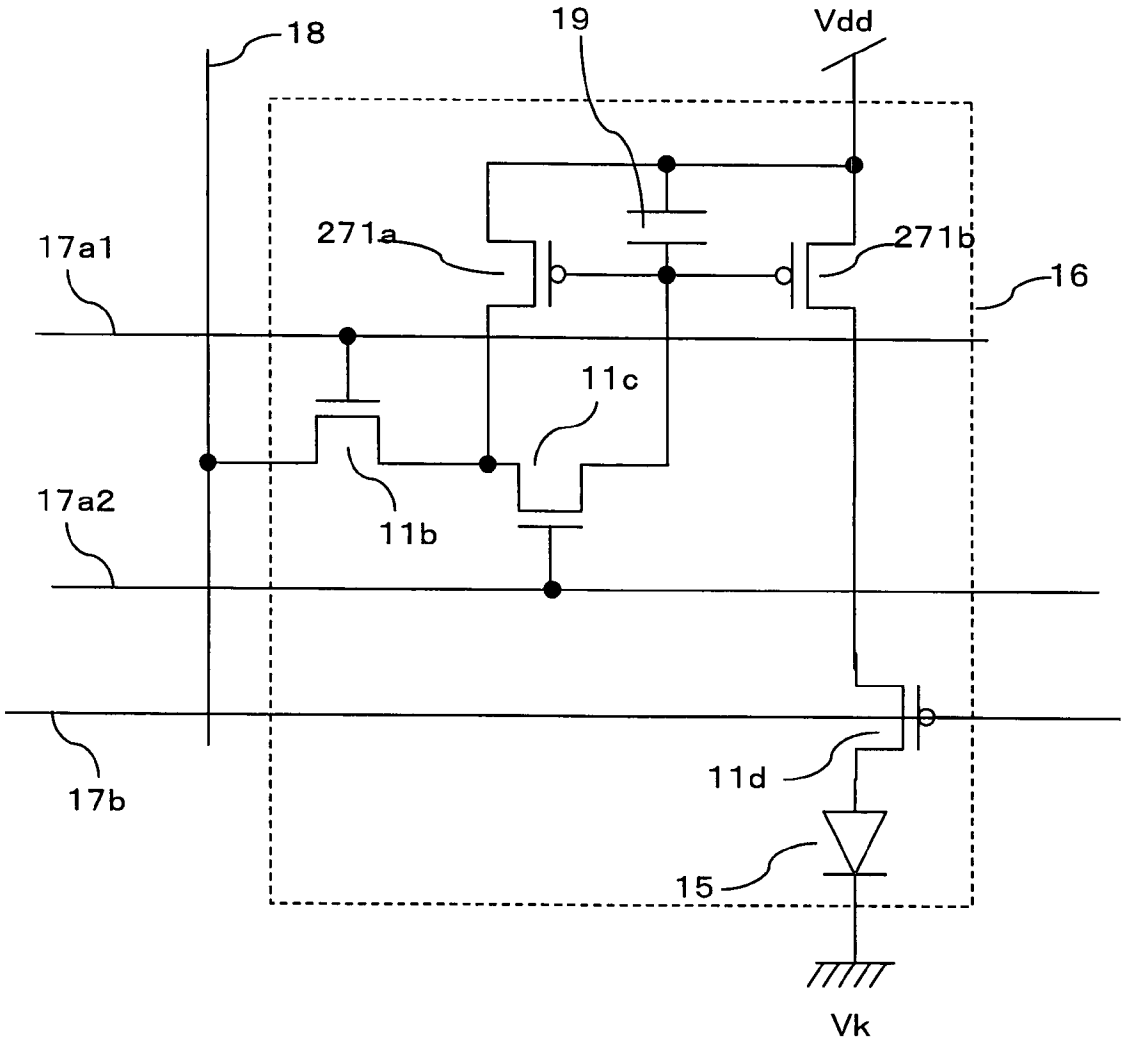
FIG. 27 is a circuit block diagram of the present invention.

In FIG. 27, when setting the current passing through the EL element 15, a signal current to pass through a transistor 271*a* is Iw, and a voltage between the gate and the source consequently generated to the transistor 271*a* is Vgs. As a short circuit occurs between the gate and the drain of the transistor 271*a* by the transistor 11*c* on writing, the transistor 271*a* operates in the saturation region. Therefore, Iw is given by the following formula.

$$Iw=\mu 1\cdot Cox1\cdot\{W1/(2\cdot L1)\}\cdot(Vgs-Vth1)^2 \quad \text{(Formula 1)}$$

Here, Cox is a gate capacity per unit area, and is given by Cox=ϵ0·ϵr/d. Vth is a threshold of the transistor, μ is mobility of a carrier, W is a channel width, L is a channel length, ϵ0 is mobility of vacuum, ϵr is a specific inductive capacity of the gate insulating film, and d is a thickness of the gate insulating film. If the current passing through the EL element 15 is Idd, a current level of Idd is controlled by a transistor 271*b* serially connected to the EL element 15. According to the present invention, the voltage between the gate and the source matches with Vgs of (Formula 1). Therefore, the following formula holds on the assumption that the transistor 1*b* operates in the saturation region.

$$Idrv=\mu 2\cdot Cox2\cdot\{W2/(2\cdot L2)\}\cdot(Vgs-Vth2)^2 \quad \text{(Formula 2)}$$

A condition for a thin-film transistor (transistor) of an insulated gate field effect type to operate in the saturation region is generally given by the following formula in which Vds is a voltage between the drain and the source.

$$|Vds|>|Vgs-Vth| \quad \text{(Formula 3)}$$

Here, the transistor 271*a* and transistor 271*b* are formed in proximity inside a small pixel so that it is approximately μ1=μ2 and Cox1=Cox2, where it is supposedly Vth1=Vth2 unless a special twist is given. Then, the following formula is easily derived from (Formula 1) and (Formula 2).

$$Idrv/Iw=(W2/L2)/(W1/L1) \quad \text{(Formula 4)}$$

Here, it should be noted that, in (Formula 1) and (Formula 2), the values themselves of μ, Cox and Vth vary as to each pixel, each product or each production lot whereas (Formula 4) does not include these parameters and so the value of Idrv/Iw is not dependent on their variations.

If designed as W1=W2, L1=L2, it becomes Idrv/Iw=1, that is, Iw and Idrv become the same value. To be more specific, the driving current Idd passing through the EL element 15 is exactly the same as the signal current Iw irrespective of property variations of the transistors so that the light emitting luminance of the EL element 15 can be accurately controlled as a result.

As described above, Vth1 of the driving transistor 271*a* and Vth2 of the driving transistor 271*b* are basically the same. Therefore, if a signal voltage of a cut off level is applied to the gate at a mutually common potential of both the transistors, both the transistors 271*a* and 271*b* should be in a nonconductive status. In reality, however, there are the cases where Vth2 becomes lower than Vth1 inside the pixel due to a factor such as variations of parameters. In this case, a leakage current of a subthreshold level passes through the driving transistor 271*b* and so the EL element 15 emits light minutely. This minute light emitting lowers contrast of the screen and spoils display properties.

The present invention, in particular, ensures that a voltage threshold Vth2 of the driver transistor 271*b* will not fall below a voltage threshold Vth1 of the corresponding driver transistor 271*a* in the pixel. For example, gate length L2 of the transistor 271*b* is made longer than gate length L1 of the transistor 271*a* so that Vth2 will not fall below Vth1 even if process parameters of these thin-film transistors change. This makes it possible to suppress subtle current leakage. The above matters are also applicable to the relationship between the transistor 271*a* and the transistor 11*c* of FIG. 1.

As shown in FIG. 27, the pixel consists of a driver transistor 271*a* through which a signal current flows, a driver transistor 271*b* which controls drive current flowing through a light-emitting element such as an EL element 15, a transistor 11*b* which connects or disconnects a pixel circuit and data line "data" by controlling a gate signal line 17*a*1, a switching transistor 11*c* which shorts the gate and drain of the transistor 271*a* during a write period by controlling a gate signal line 17*a*2, a capacitance C19 which holds gate-source voltage of the transistor 271*a* after application of voltage, the EL element 15 serving as a light-emitting element, etc.

In FIG. 27, the transistors 11*b* and 11*c* are N-channel MOS (NMOS) and other transistors are P-channel MOS (NMOS), but this is only exemplary and are not restrictive. A capacitance C has its one end connected to the gate of the transistor 271*a*, and the other end to Vdd (power supply potential), but it may be connected to any fixed potential instead of Vdd. The cathode (negative pole) of the EL element 15 is connected to the ground potential. Therefore, it goes without saying that the above matters are also applicable to FIG. 1 and so on.

The Vdd voltages of FIG. 1 and so on should desirably be lower than an off voltage of the transistor 271*b* (when the transistor is on the P channel). To be more precise, Vgh (off voltage of the gate) should be at least higher than Vdd−0.5 (V). If lower than this, an off leak of the transistor occurs and shot irregularity of laser annealing becomes noticeable. It should also be lower than Vdd+4 (V). If too high, the off leak amount increases conversely.

Therefore, the off voltage of the gate (Vgh, that is, a voltage side closer to the power supply voltage in FIG. 1) should be the range of −0.5 (V) to +4 (V) to the power supply voltage (Vdd of FIG. 1). More desirably, it should be the range of 0 (V) to +2 (V) to the power supply voltage (Vdd of FIG. 1). To be more specific, the off voltage of the transistor applied to the gate signal line should be sufficiently off. In the case where the transistor is on the N channel, Vg1 becomes the off voltage. Therefore, Vg1 should be in the range of −4 (V) to 0.5 (V) to the GND voltage. More desirably, it should be in the range of −2 (V) to 0 (V).

The above described the pixel configuration of the current programming of FIG. 1. However, it goes without saying that it is not limited thereto but may also be applied to the pixel configuration of the voltage programming. It is desirable that a Vt offset cancel of the voltage programming be individually compensated as to each of R, G and B.

The driving transistor 271*b* accepts the voltage level held by the capacitor 19 to the gate, and passes the driving current of the current level corresponding thereto through the EL element 15 via the channel. The gates of the transistor 271*a* and transistor 271*b* are directly connected to form a current mirror circuit so that the current level of the signal current Iw and that of the driving current are in a proportional relationship.

The transistor 271*b* operates in the saturation region, and passes through the EL element 15 the driving current according to a difference between the voltage level applied to the gate and the threshold voltage.

The transistor 271*b* is set so that its threshold voltage will not become lower than the threshold voltage of the transistor 271*a* corresponding thereto in the pixel. To be more precise, the transistor 271*b* is set so that its gate length will not become shorter than that of the transistor 271*a*. The transistor 271*b* may also be set so that its gate insulating film will not become thinner than that of the transistor 271*a*.

The transistor 271*b* may also be set by adjusting high-impurity concentration injected into its channel so that its threshold voltage will not become lower than the threshold voltage of the transistor 271*a* corresponding thereto in the pixel. If the threshold voltages of the transistor 271*a* and transistor 271*b* are set to be the same, both the transistor 271*a* and transistor 271*b* should be in the off state when the signal voltage of a cutoff level is applied to the gates of the commonly connected transistors. In reality, however, there are slight variations of process parameters in the pixel, and there are the cases where the threshold voltage of the transistor 271*b* becomes lower than the threshold voltage of the transistor 271*a*.

In this case, a weak current of a subthreshold level passes through the driving transistor 271*b* even at the signal voltage of the cutoff level or lower, and so the EL element 15 emits light minutely and the contrast of the screen is lowered. Thus, the gate length of the transistor 271*b* is rendered longer than that of the transistor 271*a*. It is thereby possible, even if the process parameters of the transistor 11 vary in the pixel, to prevent the threshold voltage of the transistor 271*b* from becoming lower than that of the transistor 271*a*.

In a short channel effect region A of which gate length L is relatively short, Vth rises in conjunction with increase in the gate length L. In a suppression region B of which gate length L is relatively long, Vth is almost constant irrespective of the gate length L. This characteristic is used to render the gate length of the transistor 271*b* longer than that of the transistor 271*a*. For instance, in the case where the gate length of the transistor 271*a* is 7 μ, the gate length of the transistor 271*b* should be 10 μm or so.

It is also feasible to have the gate length of the transistor 271*b* belong to the suppression region B while the gate length of the transistor 271*a* belongs to the short channel effect region A. It is thereby possible to suppress a short channel effect on the transistor 271*b* and also suppress reduction in the threshold voltage due to the variations of process parameters. It is possible, as described above, to suppress the leakage current of the subthreshold level passing through the transistor 271*b* and suppress the minute light emitting of the EL element 15 so as to improve the contrast.

Figure 2:
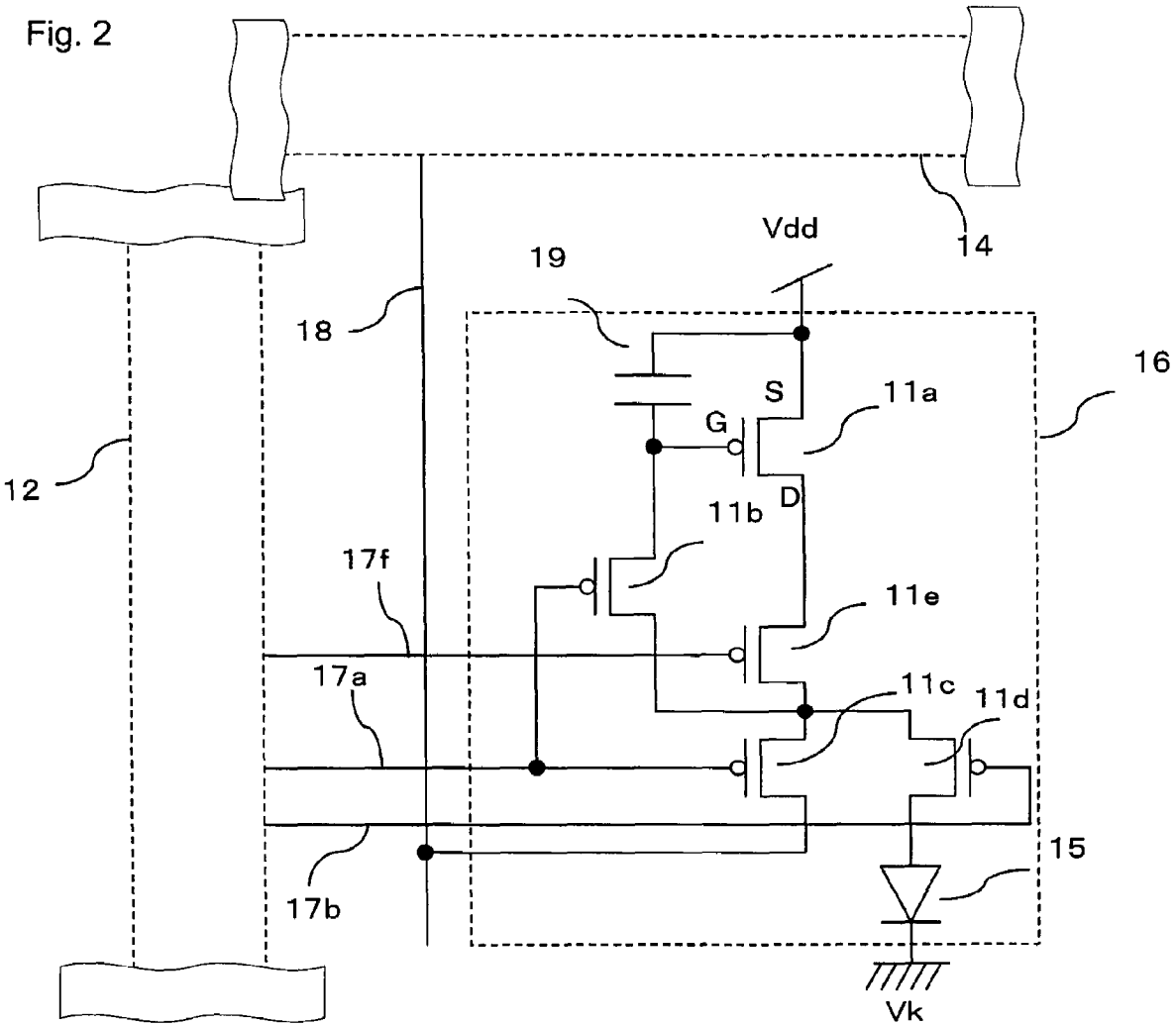
FIG. 2 is a pixel block diagram of the display panel according to the present invention.

The EL element 15 thus made and described in FIGS. 1, 2 and 27 was continuously driven at a constant current density of 10 mA/cm$^2$ by applying a DC voltage thereto. It was confirmed that an EL structure emitted light in green (emission maximum wavelength λmax=460 nm) at 7.0 V and 200 cd/cm$^2$. As for luminescent colors obtained, a blue light emitting portion has luminance of 100 cd/cm$^2$ and color coordinates of x=0.129 and y=0.105, a green light emitting portion has luminance of 200 cd/cm$^2$ and color coordinates of x=0.340 and y=0.625, and a red light emitting portion has luminance of 100 cd/cm$^2$ and color coordinates of x=0.649 and y=0.338.

As for a full-color organic EL display panel, improvement in the aperture ratio is an important development objective. It is because a higher aperture ratio improves usability of light, which leads to higher luminance and longer life. To improve the aperture ratio, the area of the transistors of obscuring the light from the organic EL layer should be reduced. A low-temperature polycrystalline Si-transistor has performance 10 to 100 times higher than an amorphous silicon, and is able to reduce the size of the transistor significantly because of its high current supply capacity. Therefore, as to the organic EL display panel, it is desirable to manufacture pixel transistors and surrounding driving circuits by the low-temperature polysilicon technology and high-temperature polysilicon technology. As a matter of course, it is possible to manufacture them by the amorphous silicon technology. In that case, however, the pixel aperture ratio becomes considerably low.

It is possible to reduce the resistance which is especially problematic on a current-driven organic EL display panel by forming the driving circuit such as the gate driver circuit IC 12 or the source driver circuit 14 on a glass substrate 71. Thus, TCP connection resistance is eliminated, and an outgoing line from the electrode becomes shorter than the case of TCP connection by 2 to 3 mm so as to reduce wiring resistance. Furthermore, there are advantages that there is no longer a process for the TCP connection and material cost is reduced.

Figure 6:
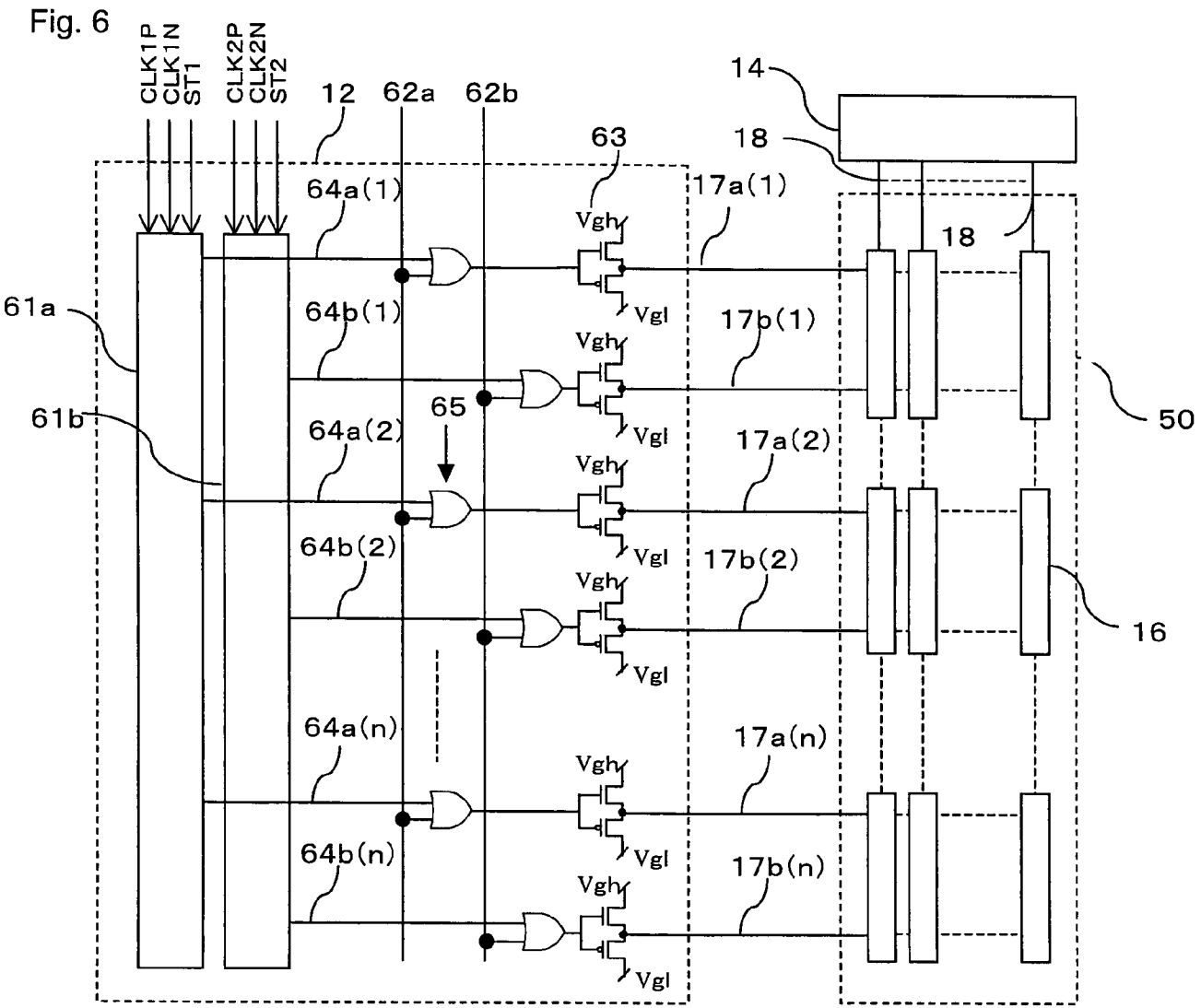
FIG. 6 is a pixel block diagram of the display panel according to the present invention.
Figure 7:
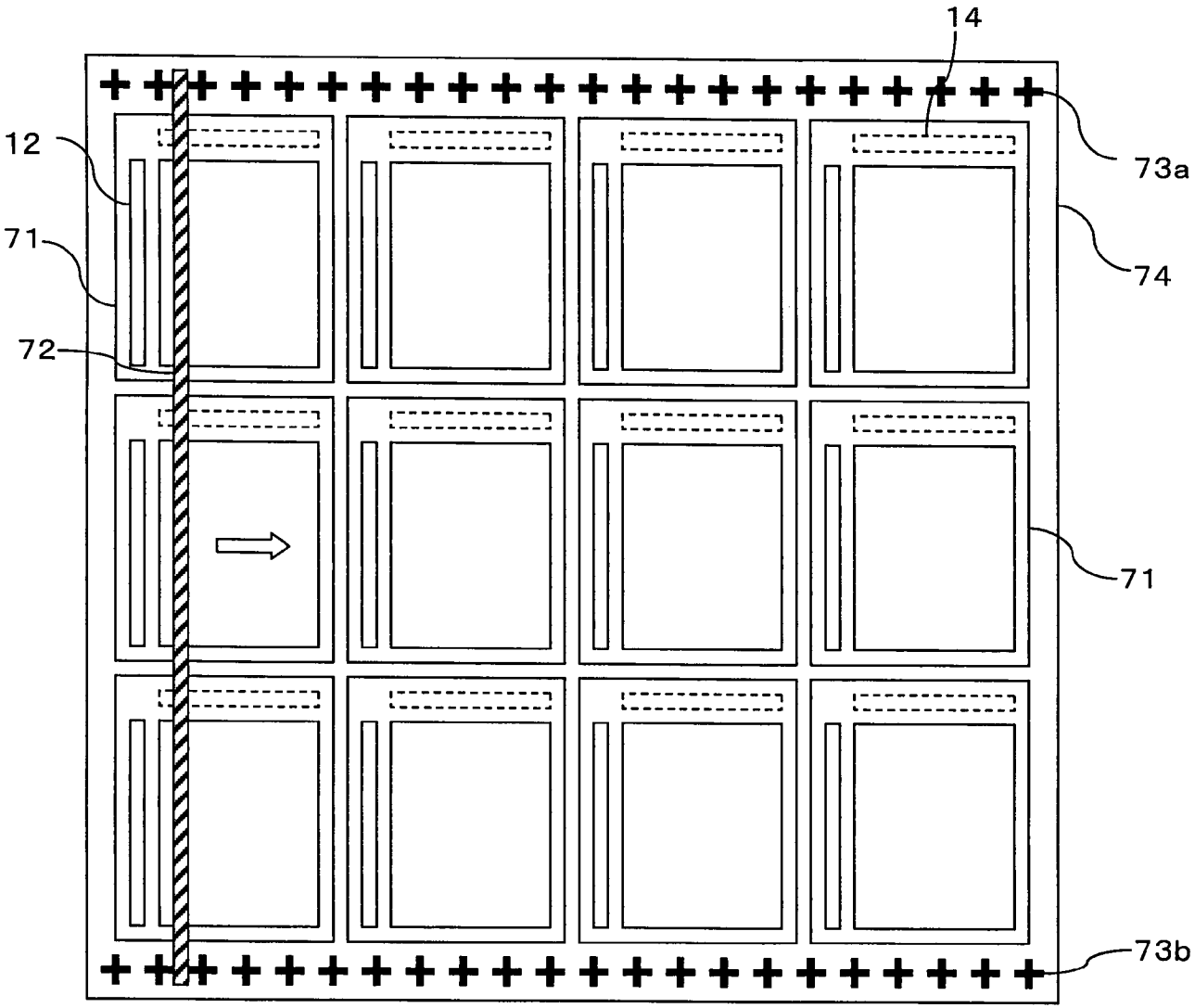
FIG. 7 is a schematic diagram of a manufacturing method of the display panel according to the present invention.

Next, the EL display panel or EL display apparatus of the present invention will be described. FIG. 6 is an explanatory diagram which mainly illustrates a circuit of the EL display apparatus. Pixels 16 are arranged or formed in a matrix. Each pixel 16 is connected with a source driver circuit 14 which outputs current for use in current programming of the pixel. In an output stage of the source driver circuit 14 are current mirror circuits (described later) corresponding to the bit count of a video signal. For example, if 64 gradations are used, 63 current mirror circuits are formed on respective source signal lines so as to apply desired current to the source signal lines 18 when an appropriate number of current mirror circuits is selected.

A minimum output current of one unit transistor of one current mirror circuit is 10 nA to 50 nA. Preferably, the minimum output current of the current mirror circuit should be from 15 nA to 35 nA (both inclusive) to secure accuracy of the transistors composing the current mirror circuit in the source driver IC 14.

Besides, a precharge or discharge circuit is incorporated to charge or discharge the source signal line 18 forcibly. Preferably, voltage (current) output values of the precharge or discharge circuit which charges or discharges the source signal line 18 forcibly can be set separately for R, G, and B. It is because the threshold of the EL element 15 is different among R, G and B.

It goes without saying that the pixel configuration, array configuration and panel configuration described above are applied to the configuration, method and apparatus described below. It also goes without saying that the configuration, method and apparatus described below have the pixel configuration, array configuration and panel configuration already described applied thereto.

The gate driver 12 incorporates a shift register circuit 61*a* for a gate signal line 17*a* and a shift register circuit 61*b* for a gate signal line 17*b*. The shift register circuits 61 are controlled by positive-phase and negative-phase clock signals (CLKxP and CLKxN) and a start pulse (STx). Besides, it is preferable to add an enable (ENABL) signal which controls output and non-output from the gate signal line and an up-down (UPDWN) signal which turns a shift direction upside down. Also, it is preferable to install an output terminal to ensure that the start pulse is shifted by the shift register and is outputted.

Incidentally, shift timings of the shift registers are controlled by a control signal from a control IC 81. Also, it incorporates a level shift circuit which level-shifts external data. It also has a built-in inspection circuit.

Figure 8:
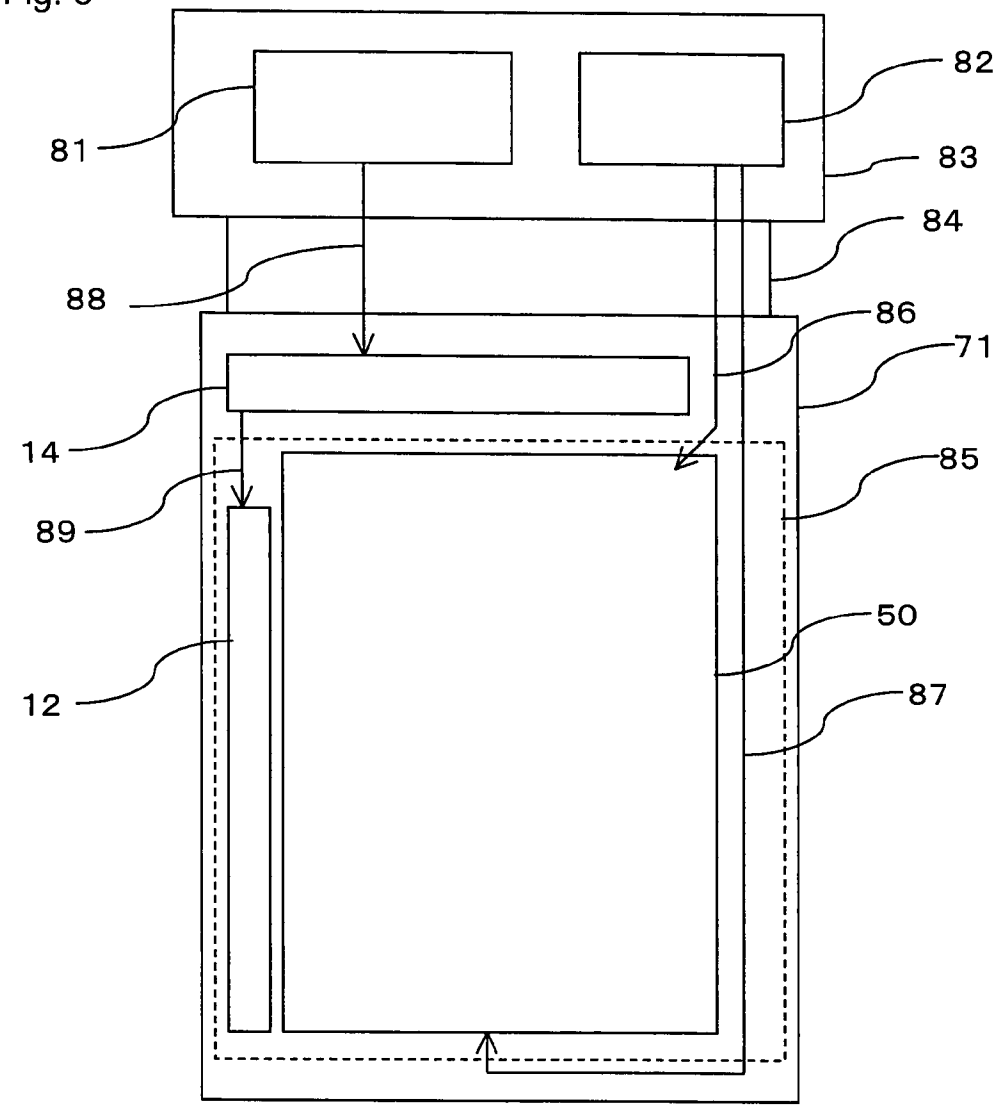
FIG. 8 is a block diagram of the panel of the present invention.

FIG. 8 is a block diagram of signal and voltage supplies on a display apparatus according to the present invention or a block diagram of the display apparatus. Signals (power supply wiring, data wiring, etc.) are supplied from the control IC 81 to a source driver circuit 14*a* via a flexible board 84.

In FIG. 8, a control signal for the gate driver 12 is generated by the control IC, level-shifted by the source driver 14, and applied to the gate driver 12. Since drive voltage of the source driver 14 is 4 to 8 (V), the control signal with an amplitude of 3.3 (V) outputted from the control IC 81 can be converted into a signal with an amplitude of 5 (V) which can be received by the gate driver 12.

Figure 12:
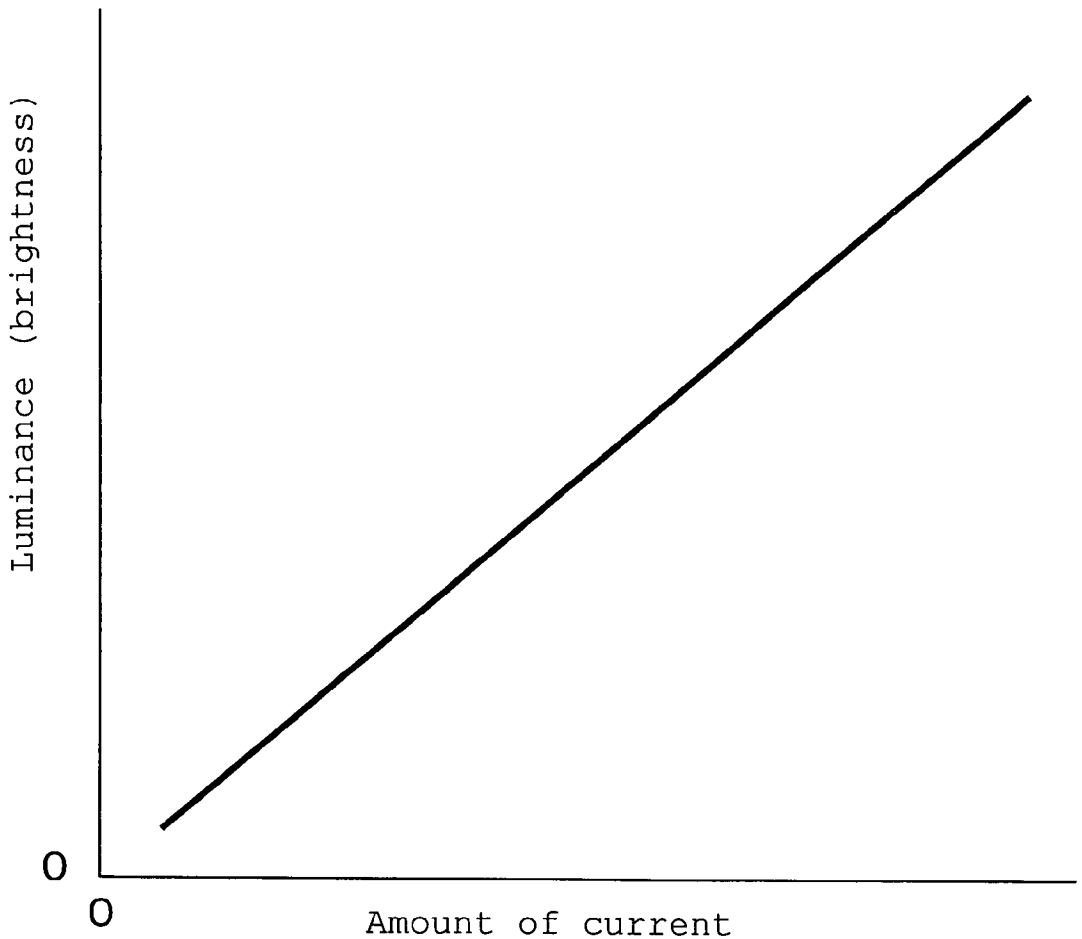
FIG. 12 is a diagram showing a relationship between an amount of current of a source line and brightness of the panel.
Figure 24:
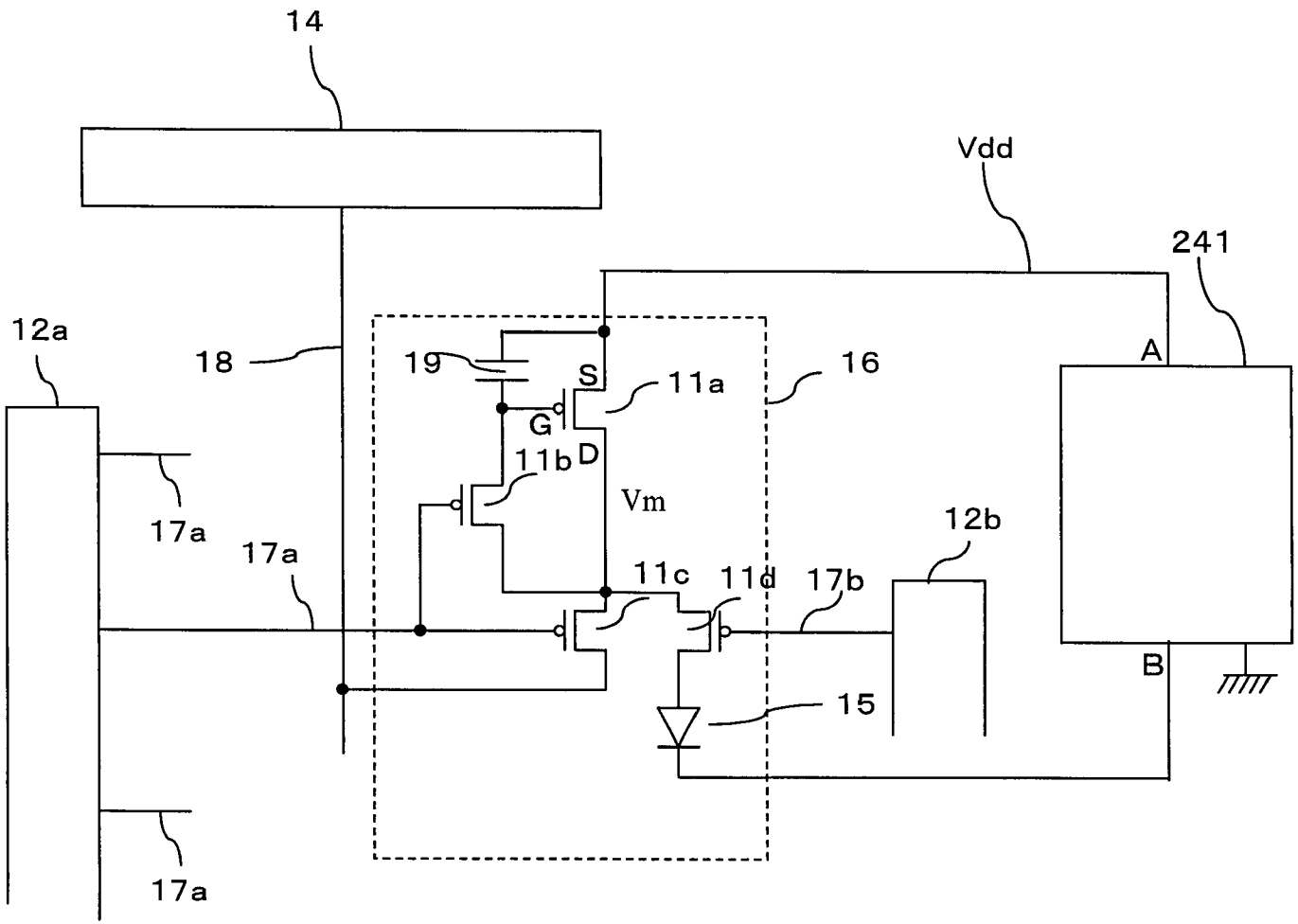
FIG. 24 is a diagram showing a relationship between a pixel configuration and a battery.

Hereunder, the driving method of the present invention will be described. The present invention is a luminance adjustment drive specializing in driving of the organic EL panel. The organic EL element emits light in proportion to the electric charge accumulated in the storage capacitance 19 and the amount of current passed by the driving transistor 11*a* according to Vdd. For that reason, the relationship between total currents passing through the panel and brightness of the panel becomes linear as shown in FIG. 12. The voltage Vdd of passing the current through the organic EL element is supplied by a battery 241 as shown in FIG. 24.

Figure 25:
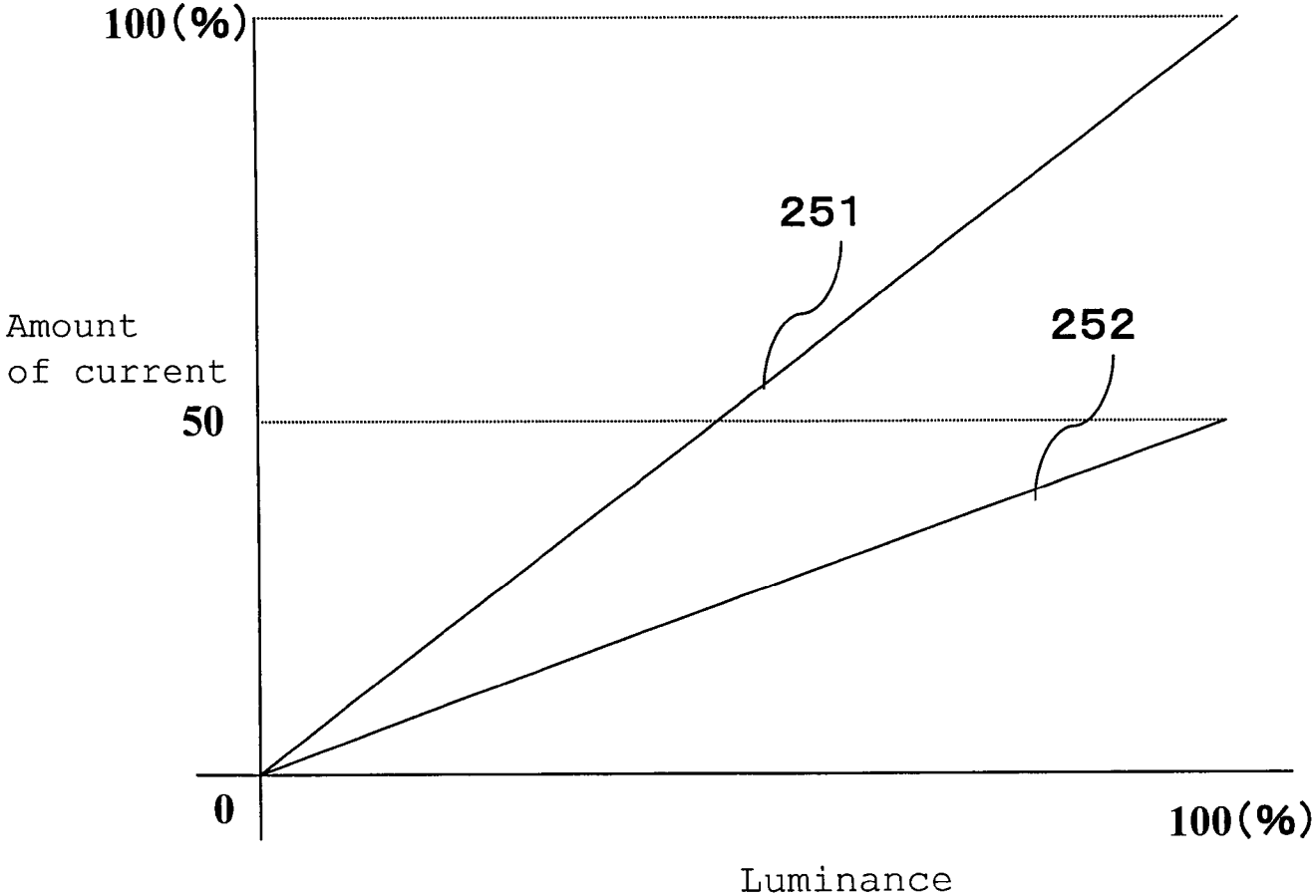
FIG. 25 is a diagram showing a relationship between a luminance and an amount of current of the display area.

The battery 241 is limited as to its capacity. In particular, a passable amount of current becomes small in the case of using it on a small module. It is assumed that the battery 241 can pass only up to 50 percent of the power consumed by the organic EL panel as shown in FIG. 25. Here, if the relationship between the brightness emitted by the organic EL (total white display is 100 percent) and the power is determined by the straight line indicated by reference numeral 251, the maximum amount of current passable by the battery is exceeded in the area of high brightness so that there is a possibility that the battery may be destroyed.

Inversely, if the relationship between the brightness and the power is determined by giving the same value to the amount of current passing on maximum luminescence of the organic EL panel and the maximum amount of current passable by the battery 241 as indicated by reference numeral 252, it becomes impossible to pass the current in a low-luminance portion. In general, it is said that there is a lot of image data at around 30 percent when the total white display is 100 percent. In the case of the relationship between the brightness and the amount of current as indicated by reference numeral 252, it becomes impossible to pass the current in the area having a lot of image data so that the image becomes unspectacular.

Figure 26:
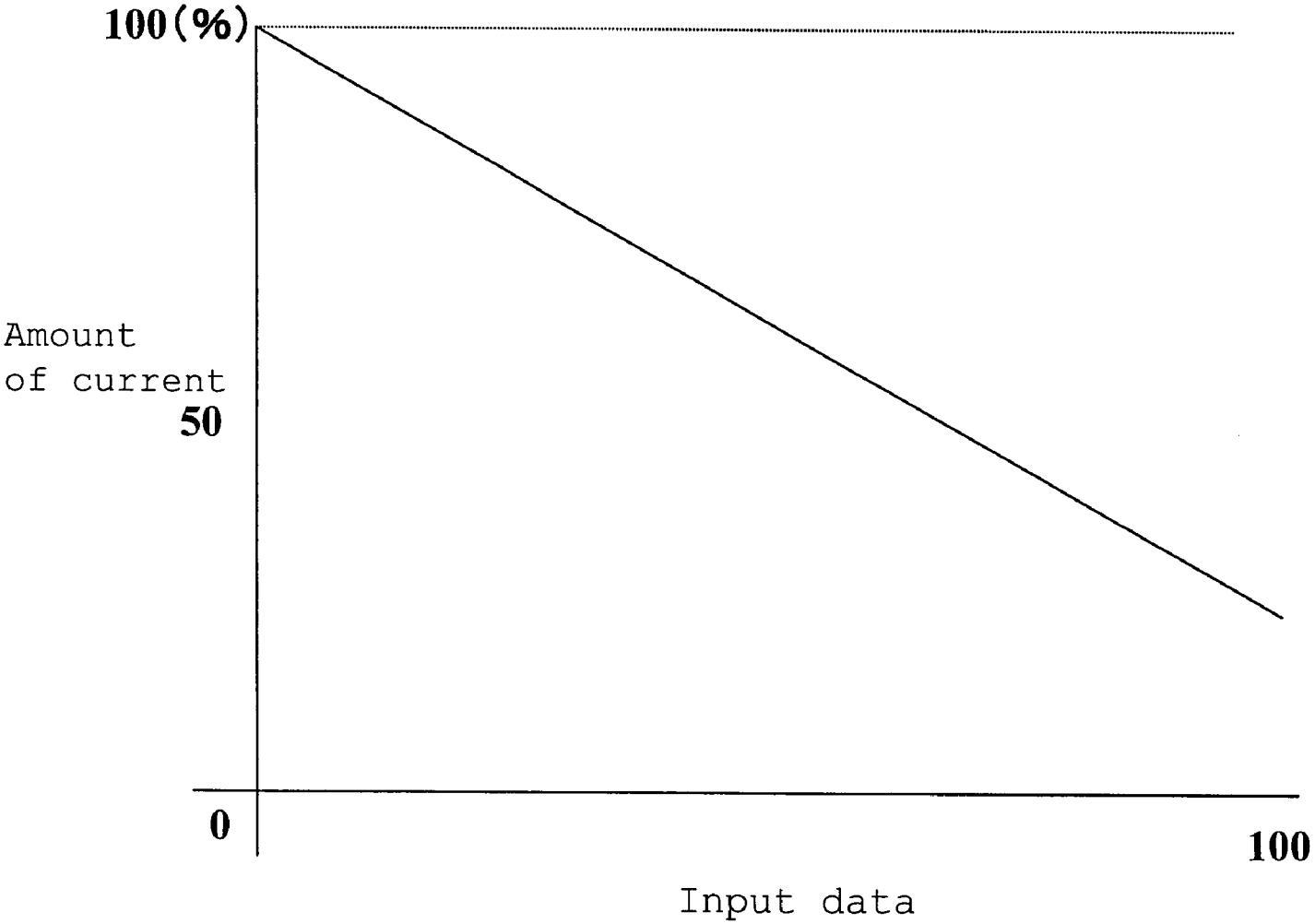
FIG. 26 is a diagram showing a relationship between input data and an amount of current according to the present invention.

Thus, the present invention proposes a drive whereby, as shown in FIG. 26, specific input data is set and the amount of current passing through the organic EL panel is adjusted according to the data. It is the driving method of suppressing the current value in the area possibly exceeding a limit value of the battery and increasing the amount of current in the area passing little current. If this driving method is realized, the relationship between the brightness and the amount of current of the organic EL panel becomes as indicated by reference numeral 282. And it becomes possible, even if there is a capacity limit of the battery, to pass the current in the area having a lot of image data so that a highly attractive image can be created. The contents of the present invention have two kinds of driving method combined. The driving methods and applicable circuit configurations will be described hereunder. As with a conventional general driving method, in the case of the first driving method, the relationship between inputted image data from outside and the luminance of the screen of the display apparatus using the self-luminous element or the amount of current passing between the anode and the cathode of the self-luminous element corresponds to 1:1. To be more specific, a possible value of the amount of current for a piece of the inputted image data is one predetermined value, and each display pixel emits light at a first luminance according to an inputted video signal from outside. They are in a proportional relationship, and are ideally in linear proportion. The present invention will describe the case of applying it to the drive on a low-tone side (black display side) in particular.

As for a second driving method, the relationship between inputted image data from outside and the luminance of the screen of the display apparatus using the self-luminous element or the amount of current passing between the anode and the cathode of the self-luminous element does not correspond to 1:1. The amount of current is determined by considering a distribution status of the inputted image data in the vicinity. To be more specific, it is determined to be a certain predetermined value out of variable values. Therefore, unlike the first driving mentioned previously, the relationship is not necessarily in linear proportion but often becomes nonlinear. In this case, each display pixel emits light at a second luminance having suppressed the first luminance according to the inputted video signal from outside at a predetermined ratio. Therefore, unlike the first driving mentioned previously, the relationship is not necessarily in linear proportion but often becomes nonlinear.

In the case of the second driving method, when the amount of current is 1 on performing the first driving method to the inputted image data from outside, it is possible, first, to obtain the value of the amount of current as an amount of current suppressed by multiplying it by a predetermined constant (a number of 1 or less). The value of the constant is determined according to the distribution status of the inputted image data in the vicinity each time. It is desirable to pass a lot of current in the area having a lot of image data as previously described. Therefore, it is the driving method characterized in that, if the power or the amount of current for the maximum input data is 1 in the case of performing no suppression process, the power or the amount of current is adjusted so that a power value x becomes $0.2 \leqq x \leqq 0.6$ in the area to which the second driving is applied. It is possible, by providing switching instrument to the circuit of performing the second driving to control on and off of second driving instrument, to perform the driving method of the present invention when turning on the second driving instrument and becoming compatible with the conventional driving method when turning off the second driving instrument.

Two methods are proposed as the methods of adjusting the current value. One of them is a method of reducing the amount of current passed through a source signal line 18 and adjusting the amount of current passing through the organic EL element itself. As for this method, however, it is necessary to reduce the amount of current passed through the source signal line 18 when suppressing the amount of current. As previously indicated, the organic EL element emits light according to the charge accumulated in the storage capacitance 19. To have the inputted data emit light properly, it is necessary to accumulate the charge capable of passing a correct current value in the storage capacitance 19.

However, a stray capacitance 451 actually exists on the source signal line 18. To change the source signal line voltage from V2 to V1, it is necessary to draw out the charge of the stray capacitance. The time ΔT required to draw it out is ΔQ (charge of the stray capacitance)=I (current passing through the source signal line)×ΔT=C (stray capacitance value)×ΔV. For this reason, if the current value I is reduced, it becomes impossible to accumulate correct charge in the storage capacitance 19. If the current value is reduced, gradation representation becomes difficult. To represent the gradations with 1024 gradations, it is necessary to divide a difference between the current value of representing black and the current value of representing white into 1024. For that reason, if the current value of representing white is reduced, a current change amount per gradation becomes smaller and accuracy of representing the gradations becomes high so that it becomes difficult to realize it.

First, display data of determining video will be described. The display data is derived from the image data or a consumption current (current passing between the anode and the cathode) of the panel. The present invention indicates the display data in percent figures. 100 percent is the maximum value of the display data, that is, a status in which all the pixels emit light with the highest gradation while 0 percent is a status in which all the pixels emit light with the lowest gradation.

When the image data of one screen is large as a whole, a total sum of the image data becomes large. For instance, a white raster is 63 as the image data in the case of 64-gradation display, and so the total sum of the image data is the number of pixels of the screen 50×63. In the case of a white window display of 1/100 of which white display portion has the maximum luminance, the total sum of the image data is the number of pixels of the screen 50×(1/100)×63 (maximum value of the data sum).

The present invention acquires the value capable of estimating the total sum of the image data or the consumption amount of current of the screen, and performs the drive of suppressing the amount of current passing between the anode and the cathode of the self-luminous element by means of the total sum or the value.

However, the present invention is not limited to acquiring the total sum of the image data. For instance, it is also possible to acquire an average level of one frame of the image data and use it. In the case of analog signals, the average level can be obtained by filtering analog image signals with the capacitor. It is also possible to extract a DC level for analog video signals via a filter and AD-convert the DC level so as to obtain the total sum of the image data. In this case, the image data may also be referred to as an APL level.

The display data is sometimes described as the input data in the present invention. However, they are synonyms.

It is not necessary to add all the data on the image constituting the screen. It is also possible to pick up and extract 1/W (W is a value larger than 1) of the screen and acquire the total sum of the picked-up data.

The sum of data/maximum value is synonymous with the ratio of the display data (input data). If the sum of data/maximum value is 1, the input data is 100 percent (basically a maximum white raster display). If the sum of data/maximum value is 0, the input data is 0 percent (basically a complete black raster display). The sum of data/maximum value is acquired from the sum of video data. In the case where the inputted video signals are Y, U and V, it may be acquired from a Y (luminance) signal. In the case of the EL panel, however, light emission efficiency is different among R, G and B and so the value acquired from the Y signal cannot be the power consumption. Therefore, it is desirable, in the case of the Y, U and V signals, to convert them to the R, G and B signals once and multiply them by a coefficient for conversion to a current according R, G or B so as to acquire the consumption current (power consumption). It may also be considered, however, that a circuit process becomes easier by simply acquiring the consumption current from the Y signal.

To acquire the ratio of the display data accurately, the calculation should be performed. The calculation includes addition, subtraction, multiplication and division.

It is also possible to adopt a method of measuring the current value passing through the organic EL panel on an external circuit and feeding it back so as to determine it. Likewise, it is also possible to use the data obtained by building a temperature sensor or a photo sensor such as a thermistor or a thermocouple into the organic EL panel.

The display data is converted to the current passing through the panel, that is, the amount of current passing between the anode and the cathode of the self-luminous element. It is because, as the EL display panel has low light emission efficiency of B, the power consumption increases at once if a display of the sea or something similar is performed. Therefore, the maximum value is the maximum value of power supply capacity. The sum of data is not a simple additional value of the video data but the video data converted to the power consumption. Therefore, the lighting rate is also acquired from the current used for each image against a maximum current.

Figure 14:
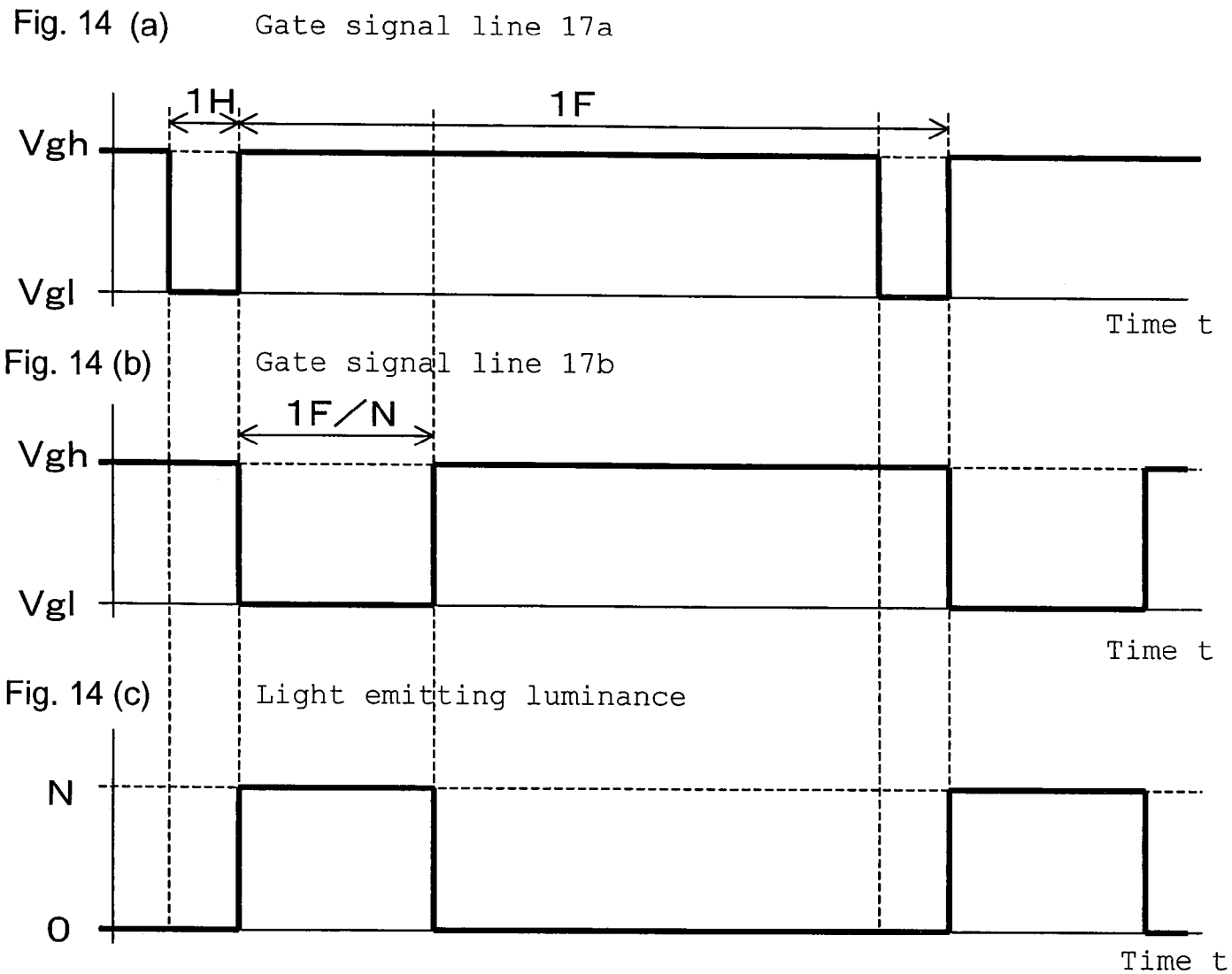
FIG. 14 is a diagram showing the drive waveform according to the present invention.
Figure 15:
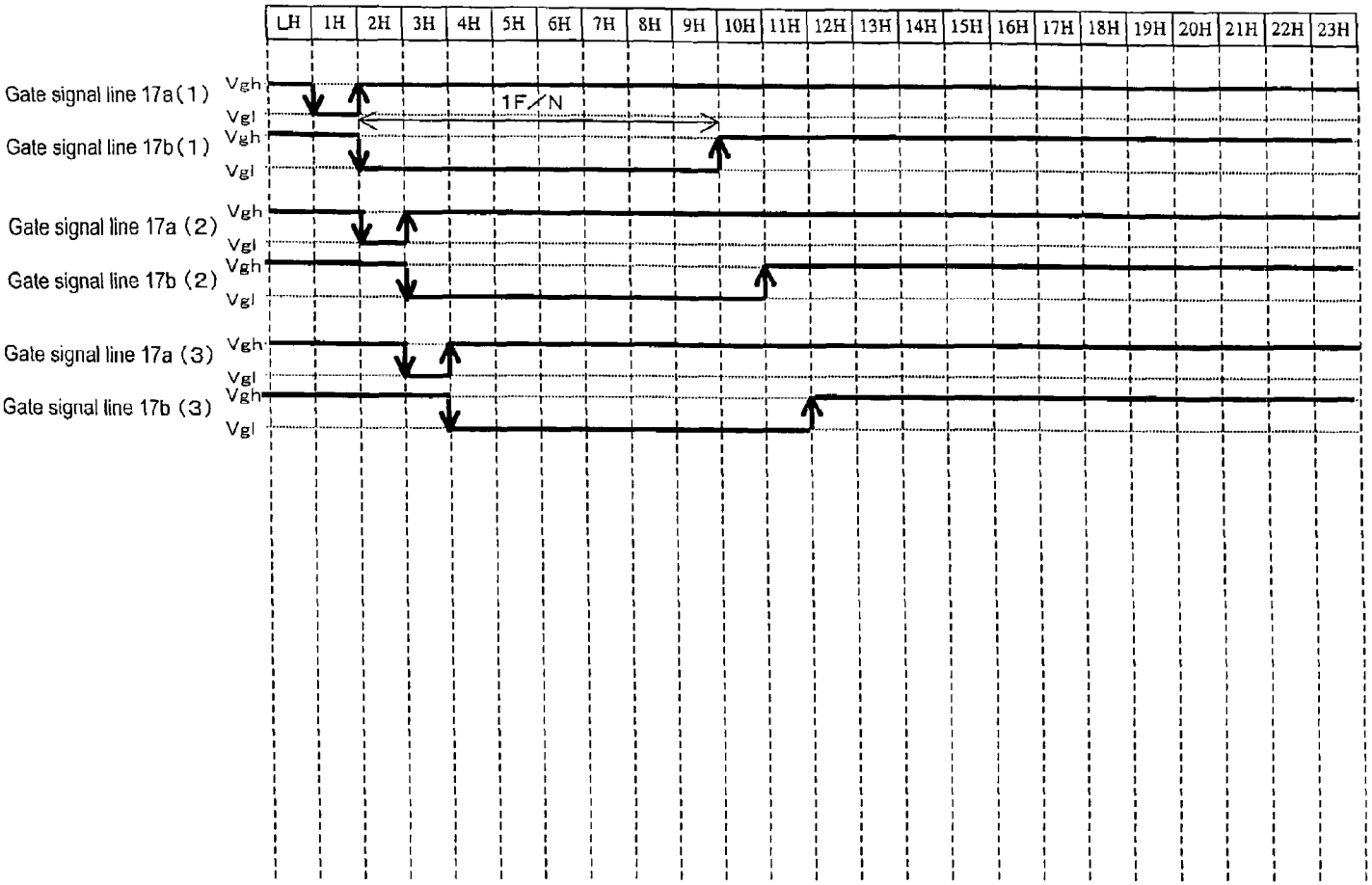
FIG. 15 is a diagram showing the drive waveform according to the present invention.
Figure 16B:
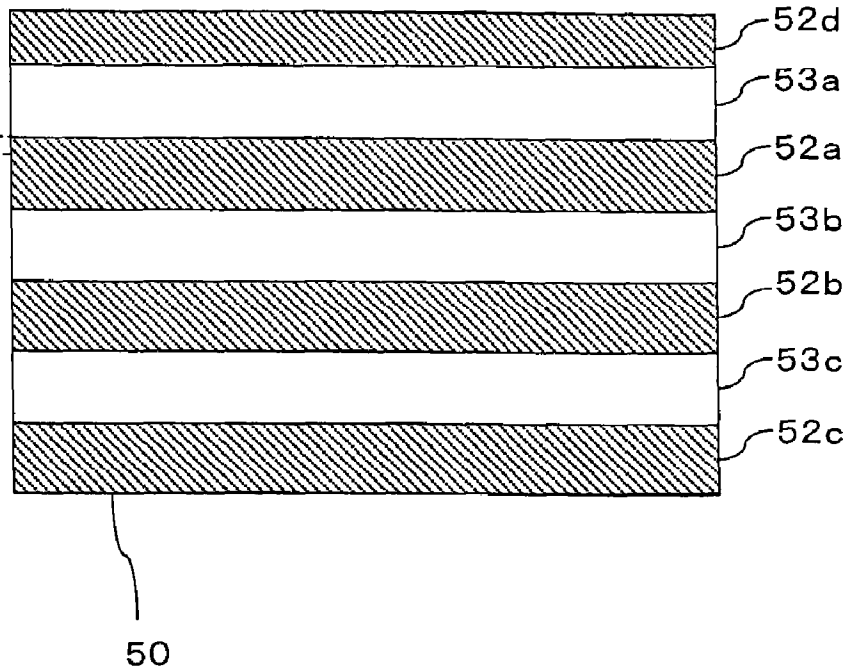
FIG. 16 are schematic diagrams of the display state of the display panel.
Figure 16A:
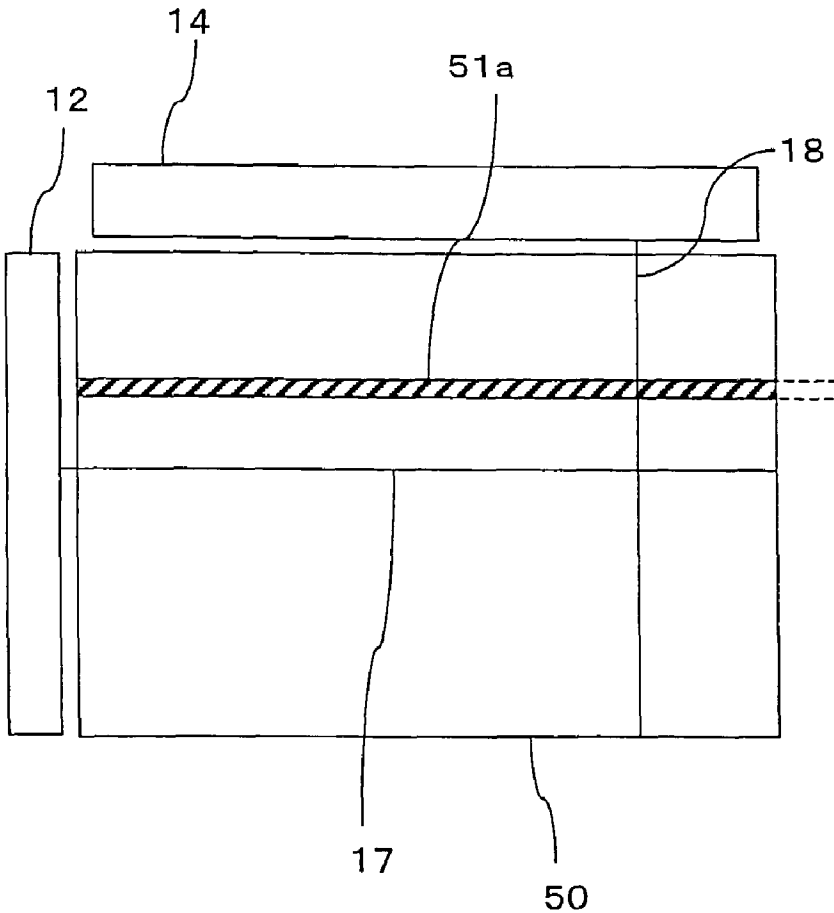
Figure 17:
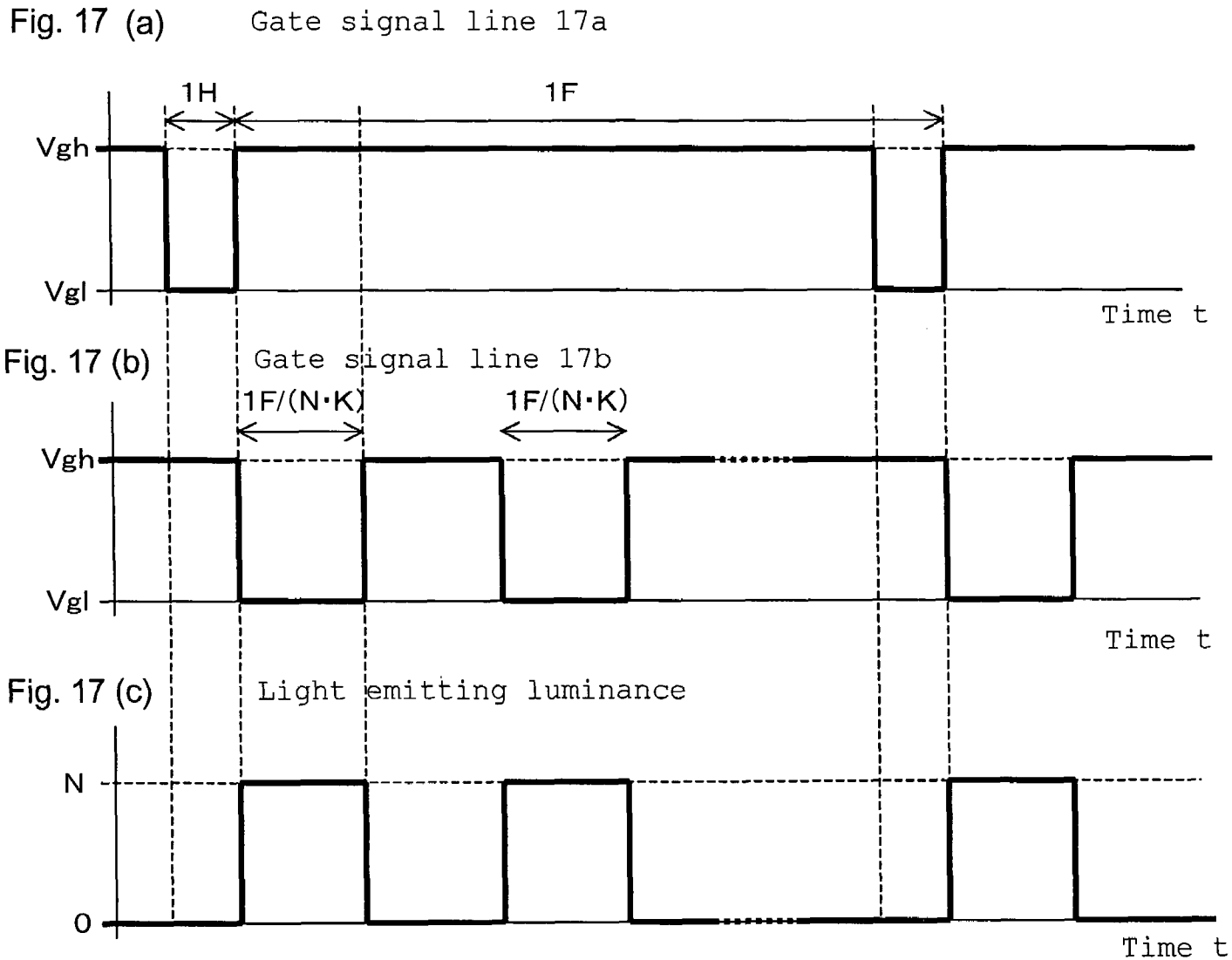
FIG. 17 is a diagram showing the drive waveform according to the present invention.
Figure 18:
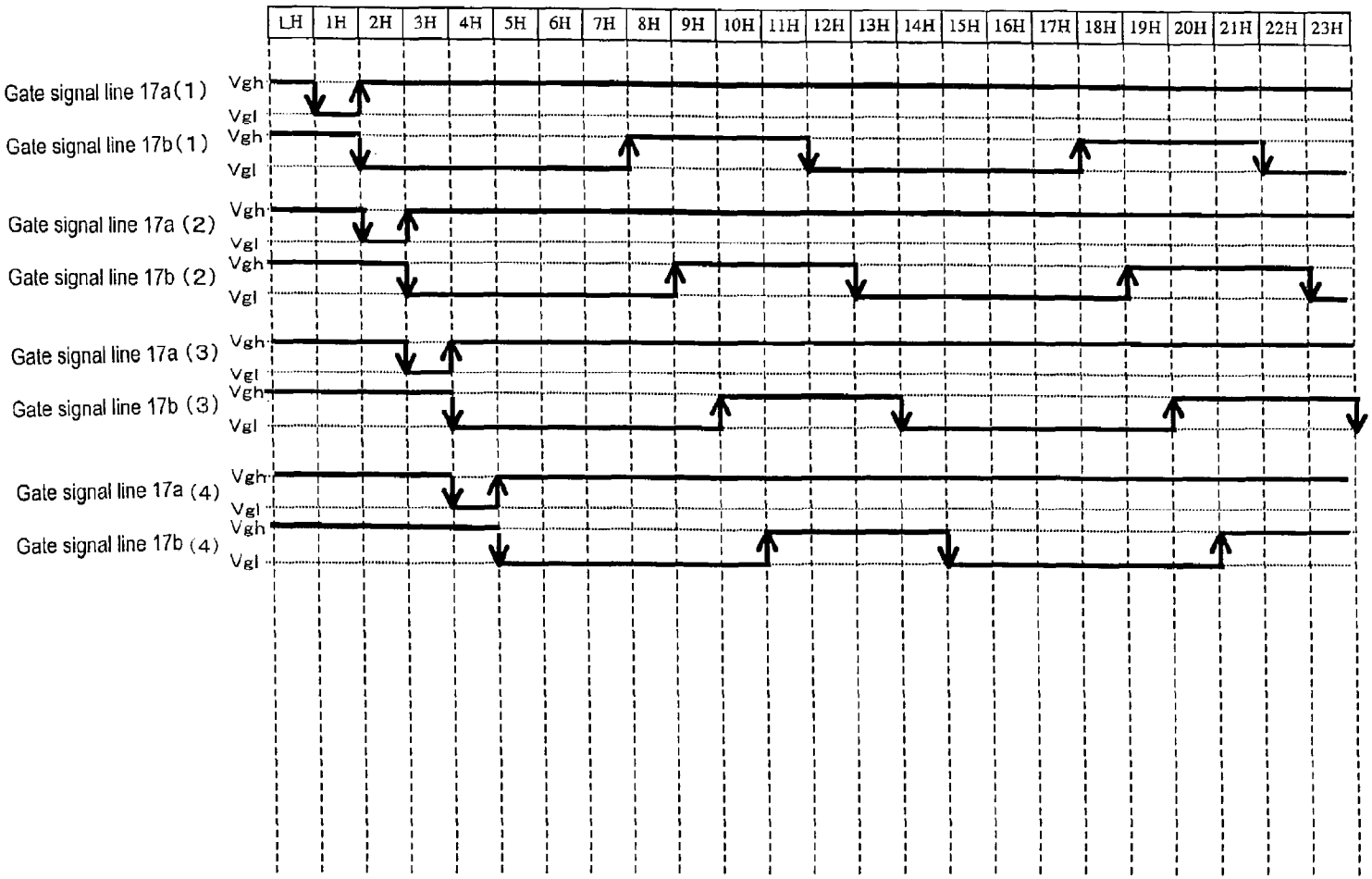
FIG. 18 is a diagram showing the drive waveform according to the present invention.

Secondly, the brightness is controlled by changing the number of horizontal scanning lines lit up on one screen (lighting rate) while leaving the current value I passed through the source signal line. The organic EL panel can control lighting time in one frame of the horizontal scanning lines by controlling ON time of the transistor 11*d*. As shown in FIG. 14, if the drive is performed by controlling a gate driver 12 and lighting only 1/N period of one frame, the brightness is 1/N to the brightness in the case of constantly having all the horizontal scanning lines lit up. It is possible to adjust the brightness by this method. As this method controls the brightness by the period of light emission, the accuracy required of the current value passing through the source signal line of implementing the gradation representation is not different even if the amount of light emission is controlled so that the gradation representation can be easily implemented. For that reason, the present invention proposes the driving method of controlling the lighting rate and thereby suppressing the amount of current passing through the organic EL panel.

Figure 29:
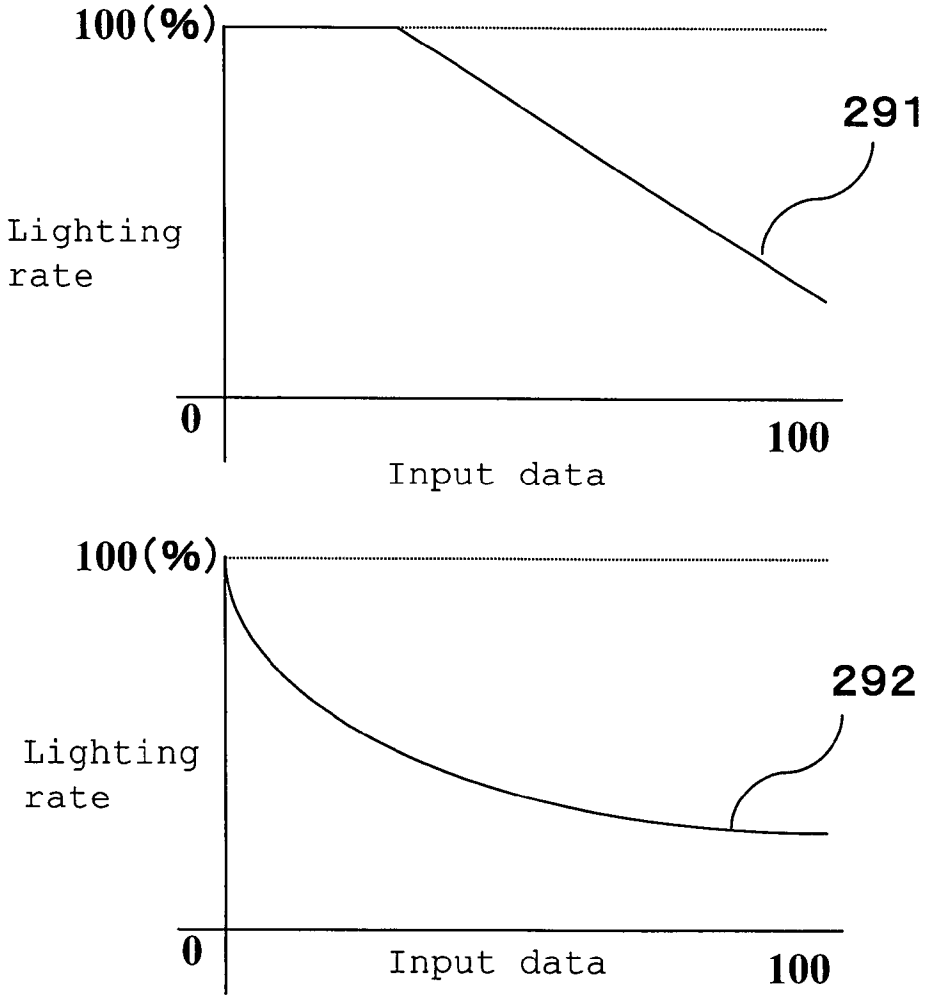
FIG. 29 are diagrams of a control method of the lighting rate control drive.

The relationship between the lighting rate and the input data is not limited to the proportional relationship. It may be a curve or a line plot as shown in FIG. 29. As for the form of maintaining a status of a high lighting rate for a certain period and lowering the lighting rate according to the data thereafter indicated by reference numeral 291, it is effective considering that there is generally a lot of video data at the brightness of around 30 percent (total white display is 10 percent). If the capacity of the battery 241 allows up to 50 percent of the maximum amount of current passable through the organic EL panel to be passed, the battery is not destroyed even if the lighting rate is maximized up to the area in which the input data is 50 percent as the maximum.

It is not always necessary to completely turn off the transistor 11*d* in order to control the brightness. It is possible to suppress the brightness even in a state in which a small amount of current is passing through the transistor 11*d* and the organic EL element 15 is emitting light minutely.

A non-light emission period or a minute light emission period renders the EL element 15 non-light emitting or a minutely light emitting, which is not limited to that generated by turning the transistor 11*d* on and off. For instance, even in the configuration having no transistor 11*d* as shown in FIG. 132 or 133, it is possible to generate the non-light emission period or the minute light emission period by increasing or decreasing anode voltage or cathode voltage.

As the present invention controls the current applied to the EL element 15, reference character 761*g* is controlled likewise even in the circuit configuration shown in FIG. 76.

The non-light emission portion of controlling the brightness is not limited to the horizontal scanning lines, that is, the pixel line direction. It is possible to control a source driver IC 14 and create the non-light emission or minute light emission period in the pixel row direction so as to control the brightness.

It is possible, by creating the minute light emission or non-light emission period, to perform a minutely light emitting or a non-light emitting display in the pixel row direction or pixel line direction in displayed video. Inserting such a minutely light emitting or non-light emitting display in the displayed video is called black insertion.

Figure 30:
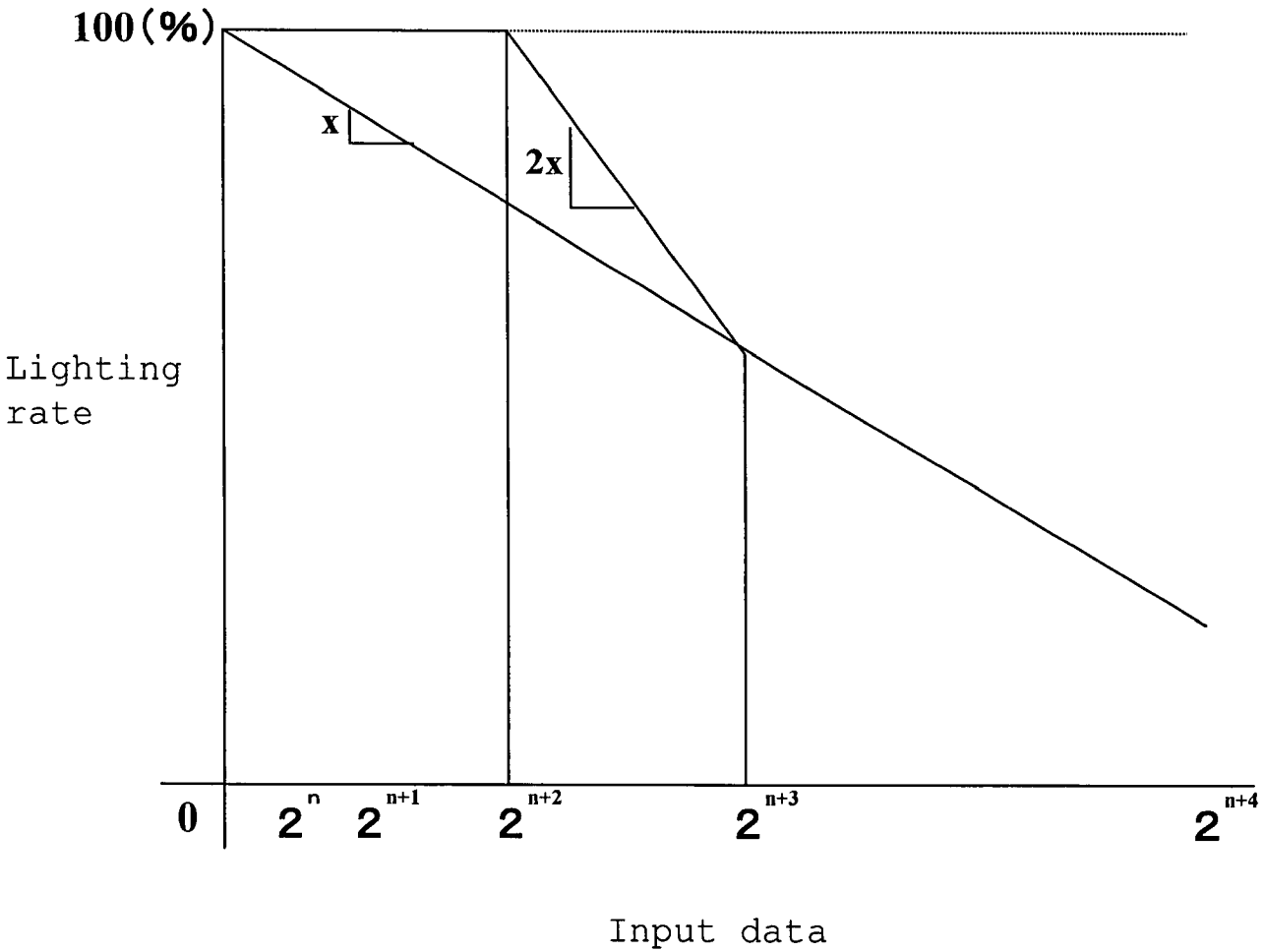
FIG. 30 is a diagram of the control method of the lighting rate control drive.

It is also desirable to increment the input data by 2 raised to n-th power between the minimum and the maximum. For instance, it is a method whereby total white lighting is 256 (2 raised to 8-th power) if total black lighting is 0. To acquire a change amount when calculating a change in the lighting rate, it is necessary to divide a maximum lighting rate and a minimum lighting rate by the input data. Incorporating a dividing circuit in semiconductor design is a very large load in the circuit configuration. When doing so, it is possible, by defining the total white display as 2 raised to n-th power, to acquire inclination just by shifting the difference between the maximum lighting rate and the minimum lighting rate by 8 bits as a binary number. Therefore, it is no longer necessary to incorporate the dividing circuit considering it from a view point of the semiconductor design so that circuit design becomes very easy. When implementing a waveform of gradually lowering the lighting rate after keeping the maximum lighting rate for a certain period as indicated by reference numeral 291, the waveform of which lighting rate becomes maximum in the period from the minimum to 2 raised to n'-th power of the input data as shown in FIG. 30 intersects with a dotted linear graph if, when the inclination is x, the inclination is 2x only in the period from 2 raised to n'-th power to 2 raised to (n'+1-th power). Using this structure, it is no longer necessary, just by acquiring the linear inclination, to acquire the inclination again on rendering it as a line plot. Therefore, it is possible to create various line plots without enlarging a circuit scale. This has a merit of constituting a small circuit scale in the circuit design.

Figure 55:
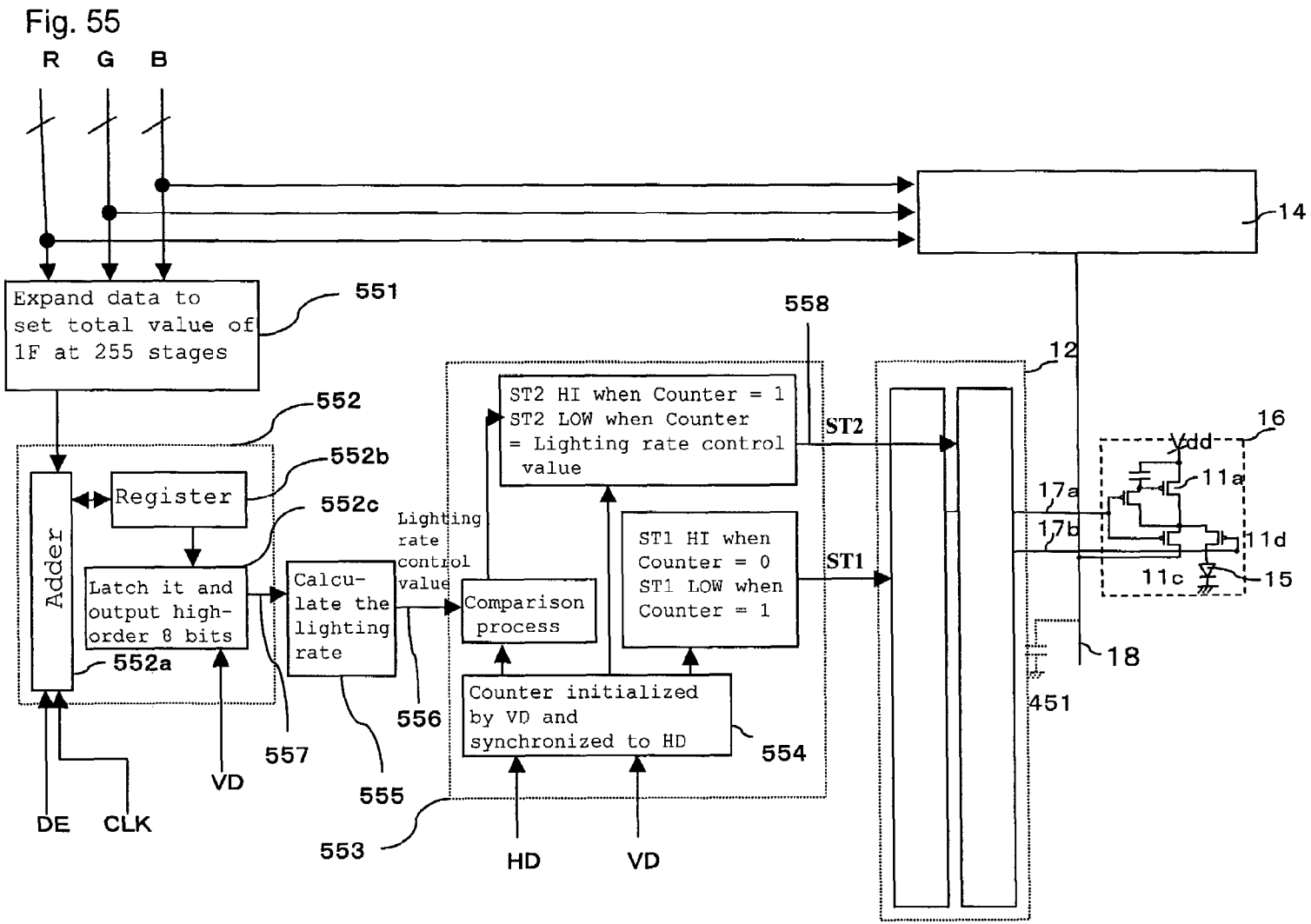
FIG. 55 is a circuit block diagram of the lighting rate control drive.

Subsequently, a description will be given by using FIG. 55 as to the circuit configuration of implementing this drive. First, color data of RGB is inputted to 551 by a video source. The same data is inputted to the source driver IC 14 after undergoing image processing such as a γ process. FIG. 55 describes the color data of RGB. However, it is not limited to RGB. It maybe the signal of YUV or may be temperature data or luminance data obtained from the aforementioned thermistor and photo sensor. After expanding the data in 551, the data is inputted to a module 552 of collecting the data. Expansion of the data in 551 will be described later. In the module 552, the data is inputted to an adder 552*a* first. However, the data is not always there, but indefinite data other than the image data may be there in some cases. For that reason, the adder 552*a* decides whether or not to perform addition depending on an enable signal (DE) of whether or not the data is there and a clock (CLK). However, the enable signal is not necessary in the case of the circuit configuration in which no data other than the image data is inputted. The added data is stored in a register 552*b*. And 552*c* latches it with a vertical synchronizing signal (VD) and outputs high-order 8 bits of the data (binary number) of the register. The size of the register is not defined. The larger the size of the register is, the larger the circuit scale becomes while the accuracy of the additional data is improved. The outputted data is not fixed to 8 bits. The outputted data may be 9 bits or more when controlling the lighting rate in a finer range, and may be 7 bits or less when accuracy is not required. The maximum value of the outputted values is an increment of the inputted data. In the case where the maximum value of the outputted 8 bits is 100, the inputted data is determined by dividing it into 100. It is desirable to increment the input data by 2 raised to n-th power in order to reduce the circuit scale as previously mentioned. Thus, in 551, the data is expanded in order to make it easy to equally divide the data obtained among 1F into 255. If the outputted value becomes 100 at the maximum when the data is inputted as-is to 552, the input data itself is multiplied by 2.55 in 551 and then inputted so that the maximum outputted value can become 255 (256 (2 raised to 8-th power) including 0).

A value of 8 bits outputted next is inputted to a module 555 of calculating the lighting rate. The value inputted to 555 is calculated and outputted as a lighting rate control value 556.

The lighting rate control value 556 is inputted to a gate control block 553. The gate control block 553 has a counter 554 which is initialized in synchronization with VD and counts up by means of a horizontal synchronizing signal (HD).

Figure 56:
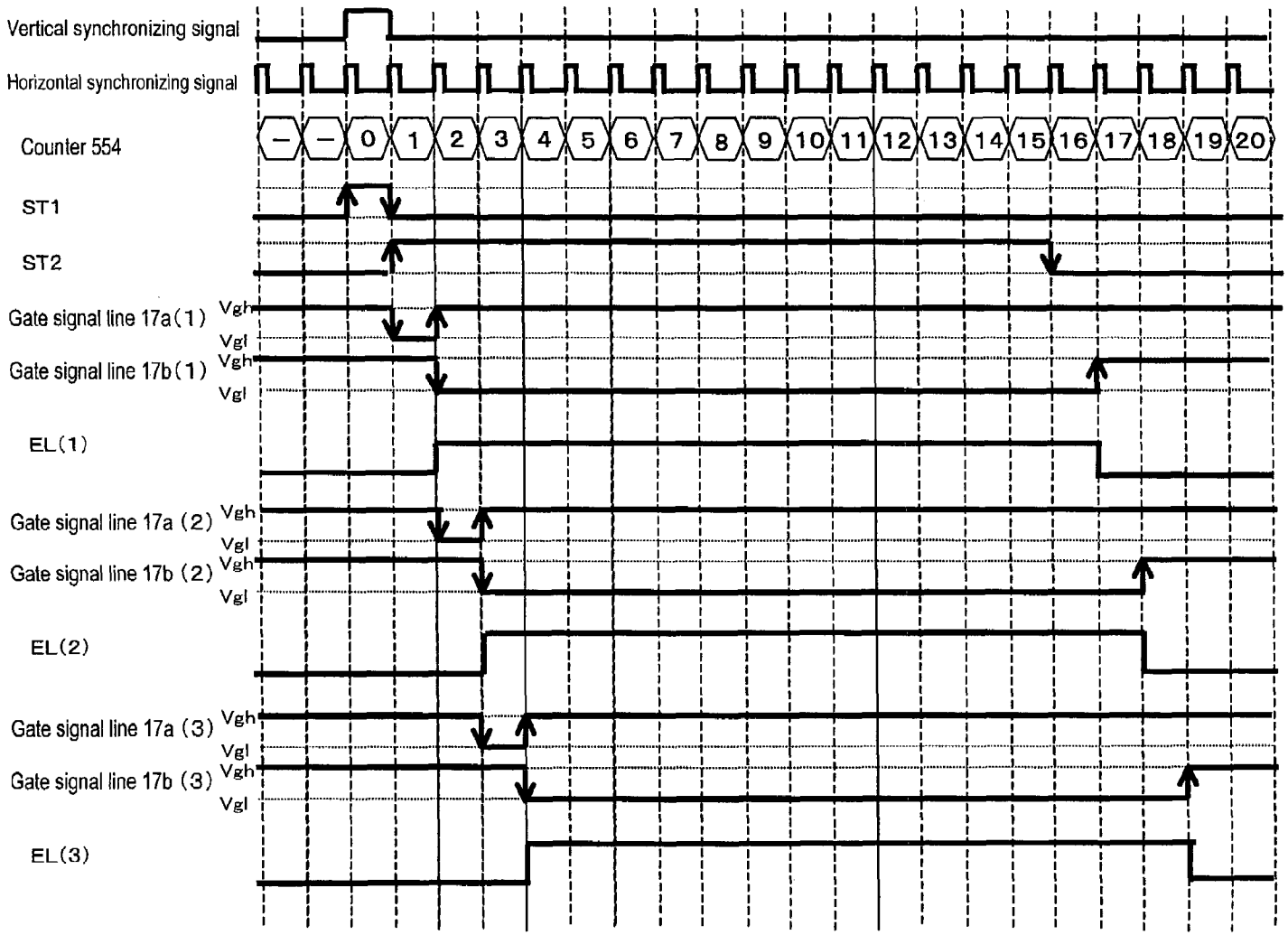
FIG. 56 is a timing chart of the lighting rate control drive.
Figure 57:
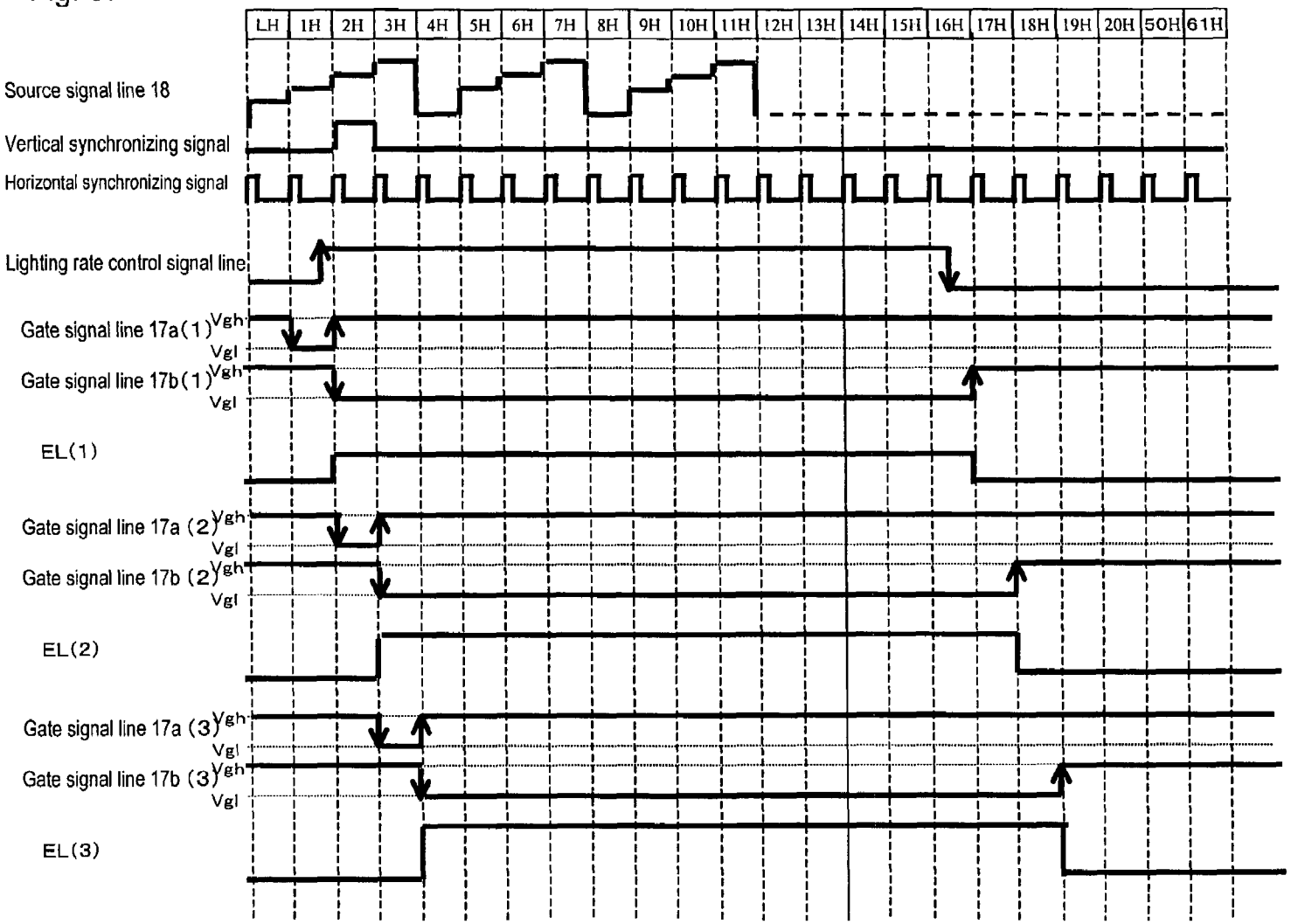
FIG. 57 is a timing chart of the lighting rate control drive.

FIG. 56 shows a time chart of the gate control block 553 when the lighting rate control value 556 is 15. When the counter 554 is 0, ST1 becomes HI (turning on the switching transistors 11*b* and 11*c*). ST1 is a start pulse of controlling a gate signal line 17*a*, and the switching transistors 11*b* and 11*c* are turned on and off by the gate signal line 17*a*. When the counter 554 is 1, ST1 becomes LOW and ST2 becomes HI. ST2 is a start pulse of controlling a gate signal line 17*d*, and the switching transistors 11*d* is turned on and off by a gate signal line 17*b*. To be more specific, the length of an HI period of ST2 is directly related to light emission time of the EL element 15. Thus, if ST2 becomes LOW when the value of a lighting rate control signal has the same value as the counter 554, it is possible to adjust the amount of light emission of the EL element 15 with the value of the lighting rate control signal. When the lighting rate control value 556 is 255 and when it is 1, the lighting rate is 1/255 and so the amount of light emission is 1/255. It is thereby possible to control the brightness. The counter values which make ST1 and 2 HI are not fixed to 0 and 1. They may be larger values in consideration of delay of the image data and so on. In FIG. 55, the lighting rate control signal has a value of 8 bits. As shown in FIG. 57, the lighting rate control signal may be a 1-bit signal line having an HI period equivalent to the time of the lighting rate inside 552. In the case of FIG. 57, it is possible to control the lighting time by performing logical operation of the signal line of ST2 and a lighting rate control signal line. There are also the cases where the logic of the gate signal line inverts depending on the switching transistors 11*b*, 11*c* and 11*d* of the pixel configuration.

Figure 38:
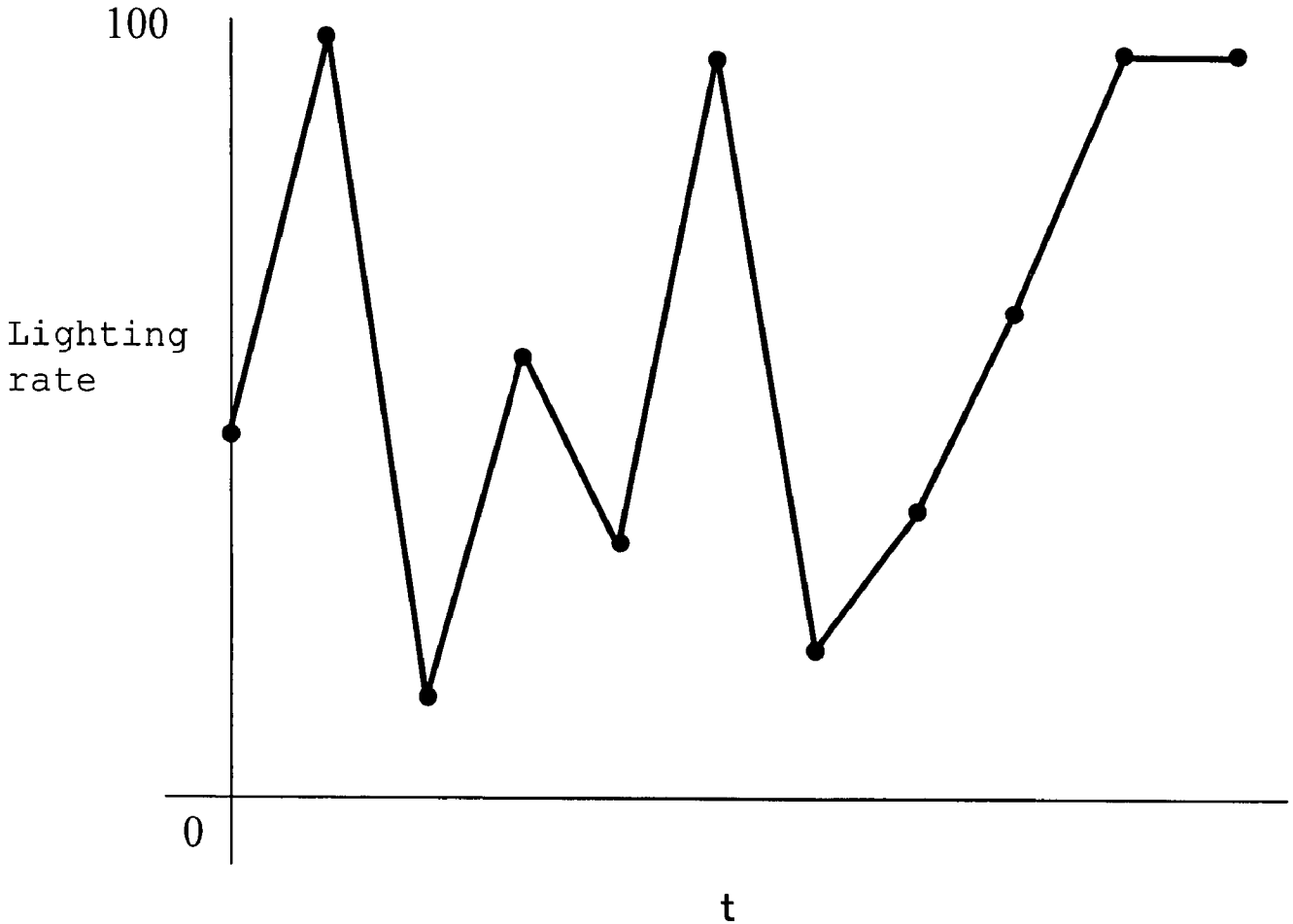
FIG. 38 is a diagram showing a shift of the lighting rate when the input data is significantly swung.
Figure 39:
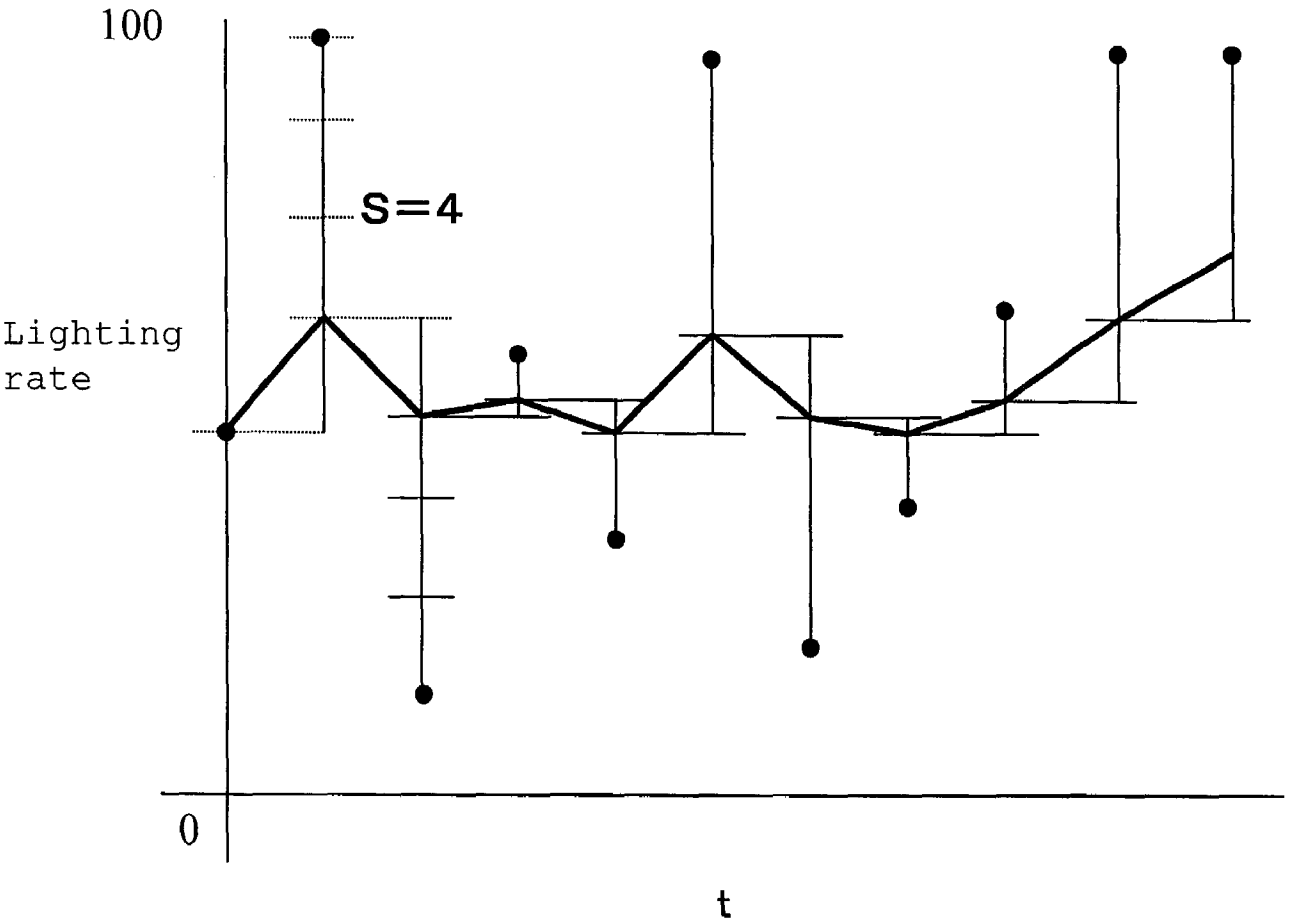
FIG. 39 is a schematic diagram of a method of a counter measure against a flicker according to the present invention.

Subsequently, a method of delaying a change in the lighting rate on performing the drive of the present invention is proposed. As shown in FIG. 38, if the input data changes significantly against a time axis t (t=0, 1, 2 . . . ), the lighting rate changes significantly. In such a situation, the brightness in the screen frequently changes and a flicker occurs. Therefore, as shown in FIG. 39, a difference between a current lighting rate and the lighting rate to be shifted to in the next frame is taken. And the input data is changed only by several percent of the difference so as to slacken the ratio of change. If rendered as a formula, it is as follows when the lighting rate at time t is Y(t) and the lighting rate calculated from the input data at time t is Y'(t)

$$Y(t+1)=Y(t)+(Y'(t)-Y(t))/s(s\neq 0) \quad (5)$$

In the case of changing the lighting rate in this formula, the change amount becomes large if the difference in the lighting rate is large, and it becomes small if the difference is small. For that reason, if s becomes too large, the time necessary for the lighting rate to change becomes long.

Figure 59:
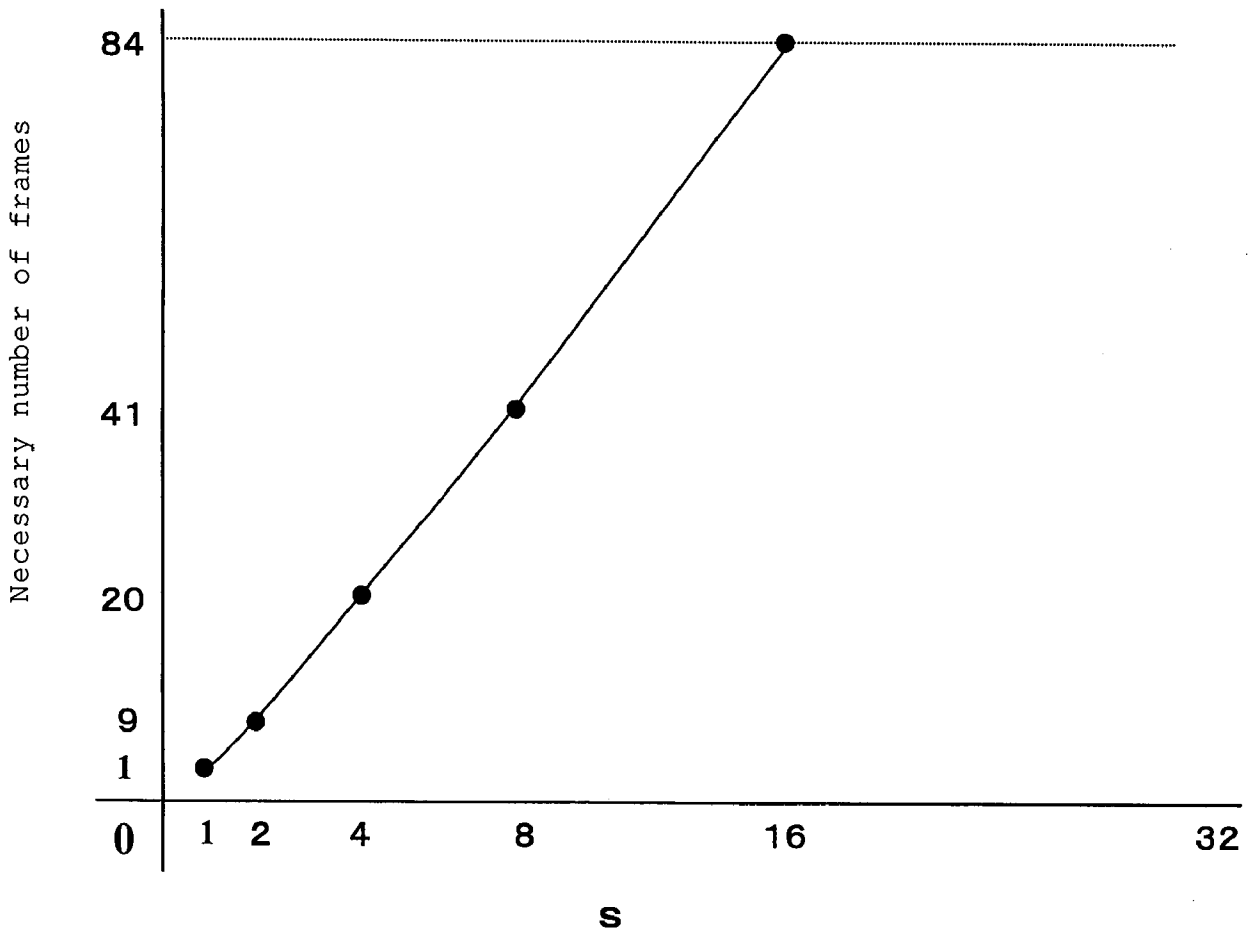
FIG. 59 is a graph of a delay rate and the number of necessary frames.

FIG. 59 shows the relationship between the number of necessary frames and s when the lighting rate shifts from 0 to 100. In the case where the video shows at a frequency of 60 Hz, it requires approximately 200 frames at s 32 until the lighting rate shifts to 100 percent from 0 percent, which takes about 3 seconds. If the change takes longer than this, the change in brightness cannot be smoothly seen on the contrary. If s is small, the flicker cannot be improved. As the data is described as binary numbers in the circuit design, the dividing circuit requires a lot of logic. Therefore, implementation thereof is not realistic. When dividing by 2 raised to n-th power, however, the circuit configuration becomes very easy because the same effect as division can be obtained just by shifting to the right by n bits if a leftmost bit of the data described as binary numbers is the highest-order bit and a rightmost bit thereof is the lowest-order bit. From the aforementioned viewpoint, s should be 2 raised to n-th power. FIG. 134 shows the change of the lighting rate on shifting from a total black display status to a total white display. As a result of examination, there is little improvement effect in the case of s=2 while the flicker is improved in the case of s=4. If it exceeds s=256, the change takes such a long time that it no longer works as a suppression function. Considering the above, the range of s is $4 \leqq s \leqq 256$ according to the present invention. It should preferably be $4 \leqq s \leqq 32$. It was thereby possible to obtain a good display with no flicker. Apart from the circuit design, s is not limited to 2 raised to n-th power. When multiplying the numerator (Y'(t)−Y(t)) of (Y'(t)−Y(t))/s of formula (5) by r, the range of s is also multiplied.

s does not have to be always constant. As there is little flicker in an area of a high lighting rate, there is also a method of rendering s smaller than 4. Therefore, s may be varied between the area of a high lighting rate and the area of a low lighting rate. For instance, it is desirable to exert control by $2 \leqq s \leqq 16$ when the lighting rate is over 50 percent, and it is desirable to exert control by $4 \leqq s \leqq 32$ when the lighting rate is 50 percent or lower.

When changing speed between the case of decreasing the lighting rate and the case of increasing the lighting rate, it is effective to change the value of s according to magnitude correlation of Y'(t) and Y(t).

Figure 58:
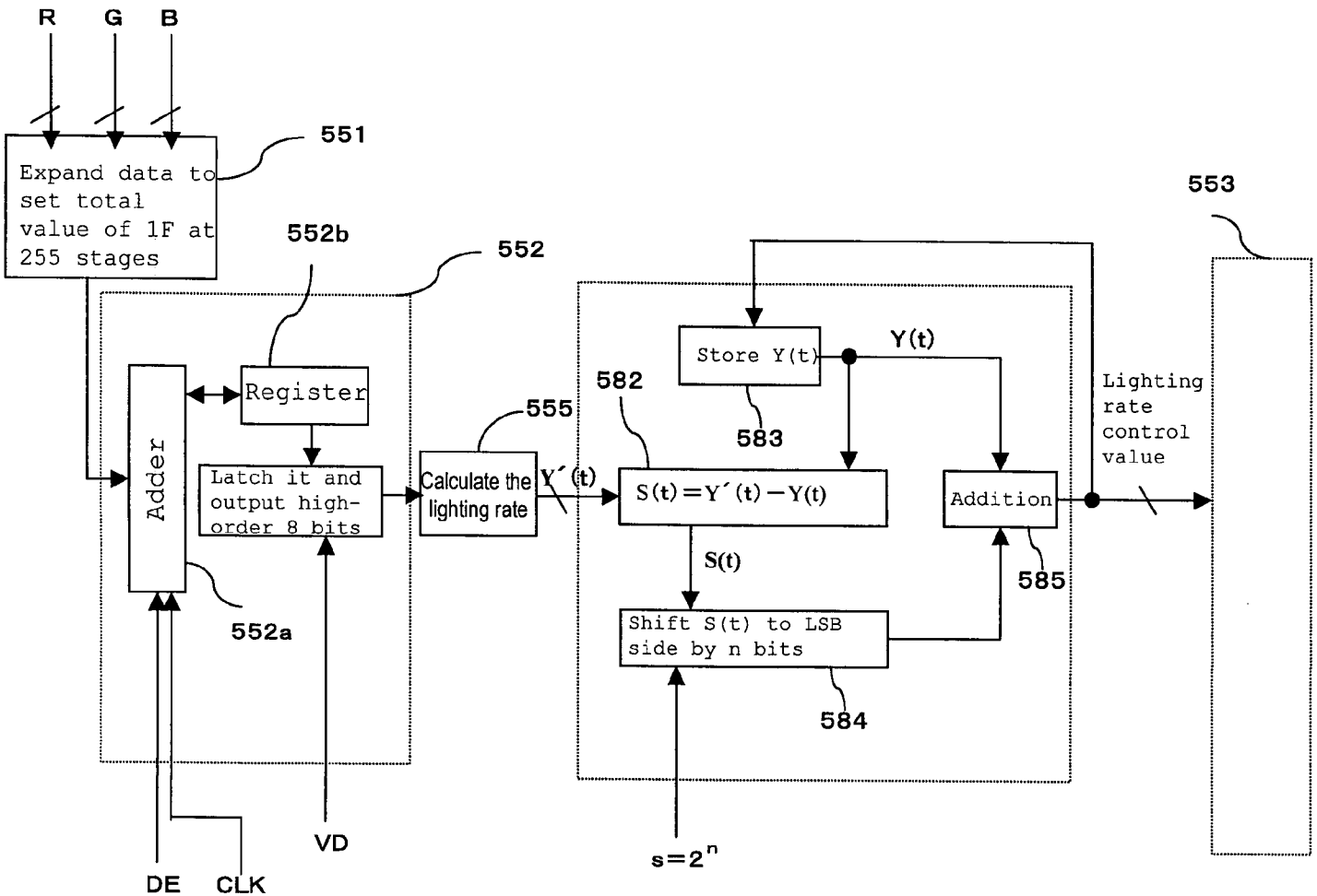
FIG. 58 is a circuit block diagram of a lighting rate delay adding circuit.

FIG. 58 shows a circuit configuration of the driving method of delaying the change of the lighting rate. As previously described, the data outputted from 551 is added by the adder 552*a*, and is stored in the register 552*b*. The value of 8 bits outputted in synchronization with VD is calculated by a calculation module so as to derive a lighting rate control value Y'(t). Y'(t) is inputted to a subtraction module 582. In the subtraction module 582, a subtraction is performed between a lighting rate control value Y(t) obtained from a register 583 holding a current lighting rate control value and the lighting rate control value Y'(t) derived from the current input data so as to acquire a difference S(t) between the two. Next, S(t) is divided by the value of inputted s inside 584. As previously described, the division requires complicated logic. Therefore, the inputted s is raised to n-th power, and it thereby becomes possible to divide S(t) by shifting to the lowest-order bit (LSB) side by n bits.

S(t) which is divided is added to the current lighting rate control value Y(t) held by the register 583 in an addition module 585. The value added by the addition module 585 becomes the lighting rate control value 556 and is inputted to the gate control block 553. The lighting rate control value 556 is inputted to the register 583 so as to be reflected on the next frame.

Figure 61:
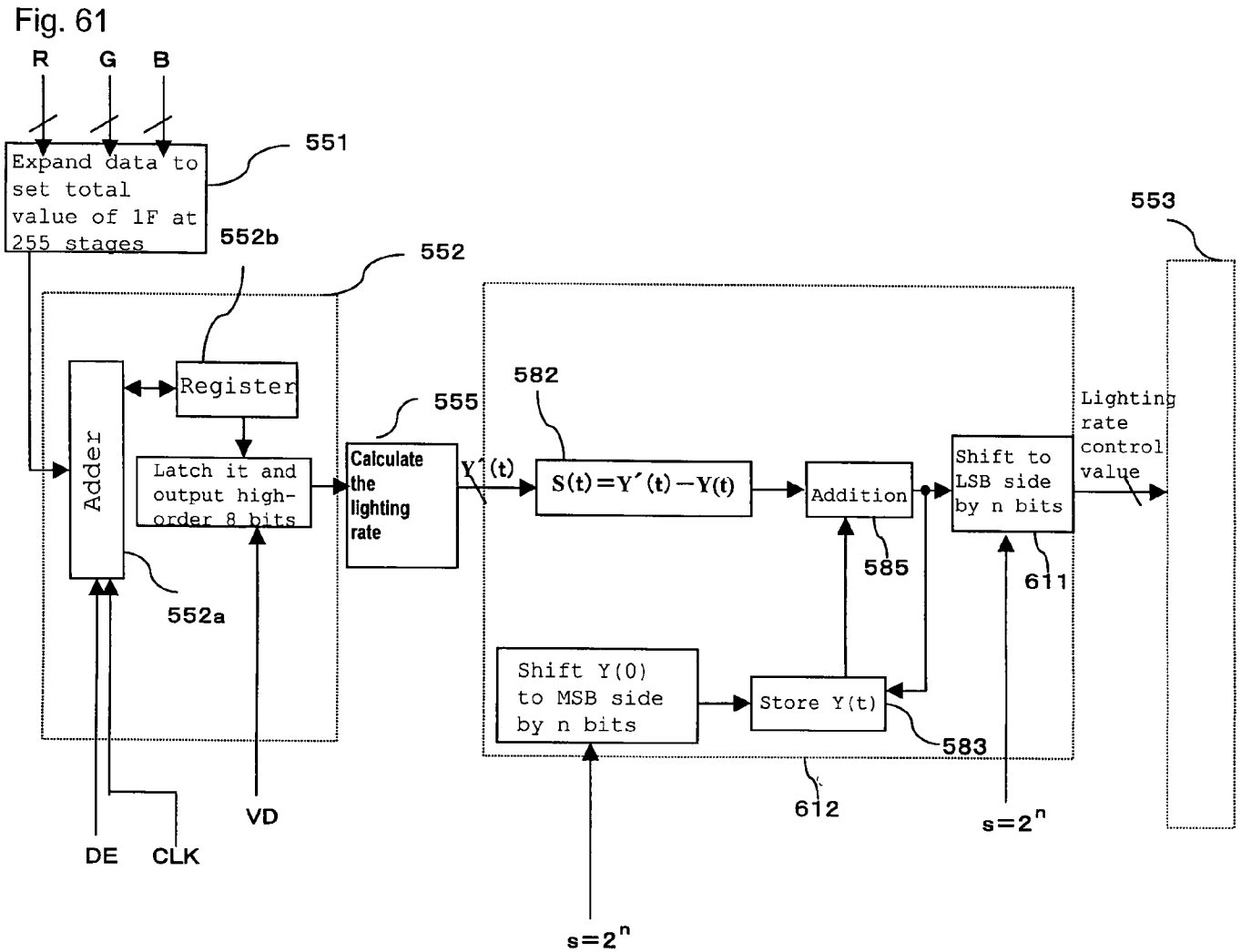
FIG. 61 is a circuit block diagram of the lighting rate delay adding circuit.

In the case of the method of FIG. 58, however, the data equivalent to the amount of the shift is discarded on shifting S(t) by n bits and so there arises a problem as to the accuracy. To be more precise, in the case of s=8, it is n=3 so that S(t) is shifted by 3 bits. In the case where S(t) is a numerical value of 7 or less, however, it becomes 0 if shifted to the LSB side by 3 bits. To avoid this, both S(t) and Y(t) are shifted to the highest-order (MSB) bit side by n bits in advance, and on outputting, output data is shifted to the LSB side by n bits and then outputted. Or else, an initial value Y(0) is shifted to the MSB side by n bits and then stored in the register 583 as shown in FIG. 61. And the data on adding S(t) is stored in the register 583 while the output data is shifted to the LSB side by n bits and then outputted. As the initial value is shifted to the MSB side by n bits, S(t) which is added can have the same effect as being shifted to the LSB side by n bits. Furthermore, the data to be stored in the register 583 has no data to be discarded by the shift. Thus, the accuracy is improved.

Figure 40:
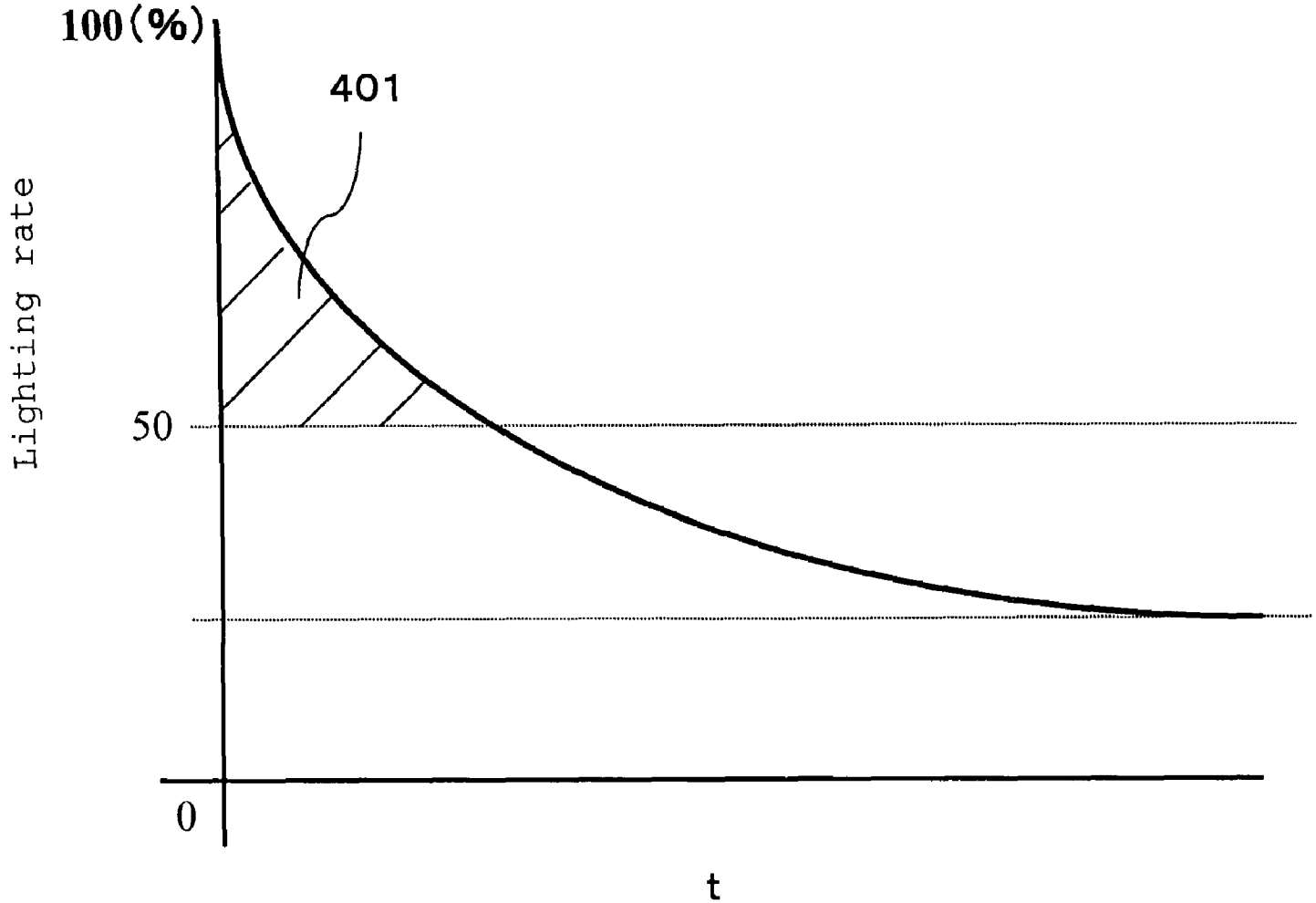
FIG. 40 is a diagram showing intergradation of the current in the case of a special image pattern.
Figure 41:
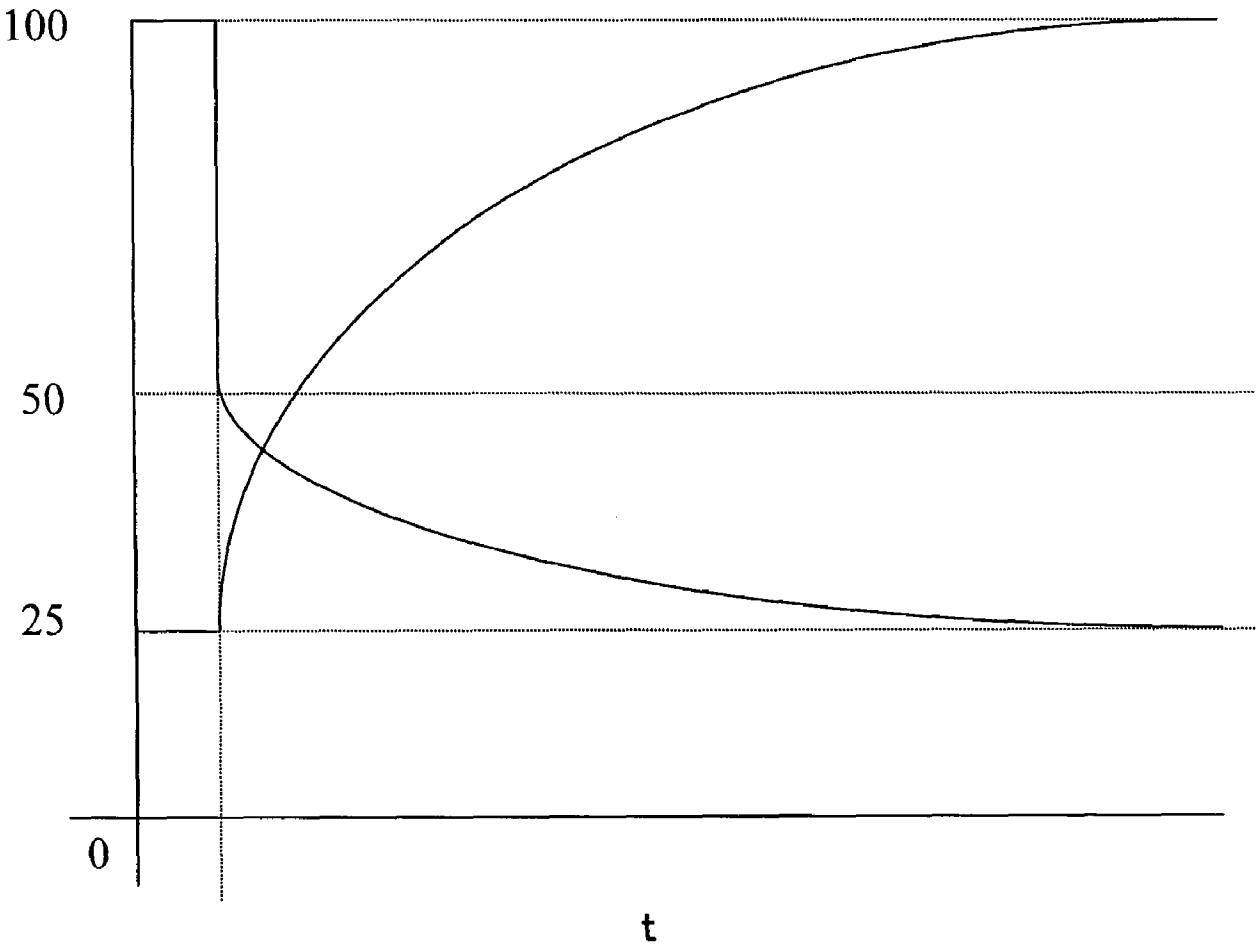
FIG. 41 is a diagram showing a drive for battery protection according to the present invention.

FIG. 40 shows the change of the lighting rate when the input data is shifted from the minimum to the maximum. If the lighting rate is changed by the aforementioned method, the lighting rate changes by drawing a curve. In this case, however, the limit value of the power supply capacity is exceeded in the area shown in 401 so that there is a possibility of destroying the power supply. Thus, as shown in FIG. 41, a method of differentiating the change between the case of an increasing lighting rate and the case of a decreasing lighting rate is proposed. It flickers if the lighting rate is significantly changed in the area of a low lighting rate. However, it does not flicker even if the lighting rate is significantly changed in the area of a high lighting rate.

This is because the ratio of the black display (nondisplay portion) occupying the screen is large in the area of a low lighting rate. In the area of a high lighting rate with a small ratio of the black display portion, image quality is not influenced even if the lighting rate is significantly decreased. Thus, in the case of the area where Y' calculated from the input data is less than 50 percent when the lighting rate is 50 percent or more, the lighting rate is decreased to 50 percent without using the aforementioned driving method of slackening the speed of change.

In the case where the limit value of the power supply capacity is larger than 50 percent, however, it should be kept at the lighting rate according to a limit capacity rather than decreasing it to 50 percent. It should preferably be 75 percent. In the case where the limit capacity of the power supply is less than 50 percent, there is still a possibility of exceeding the limit capacity even if the lighting rate is decreased to 50 percent. However, it is not desirable, from a viewpoint of the flicker, to decrease the lighting rate to less than 50 percent at once.

Figure 42:
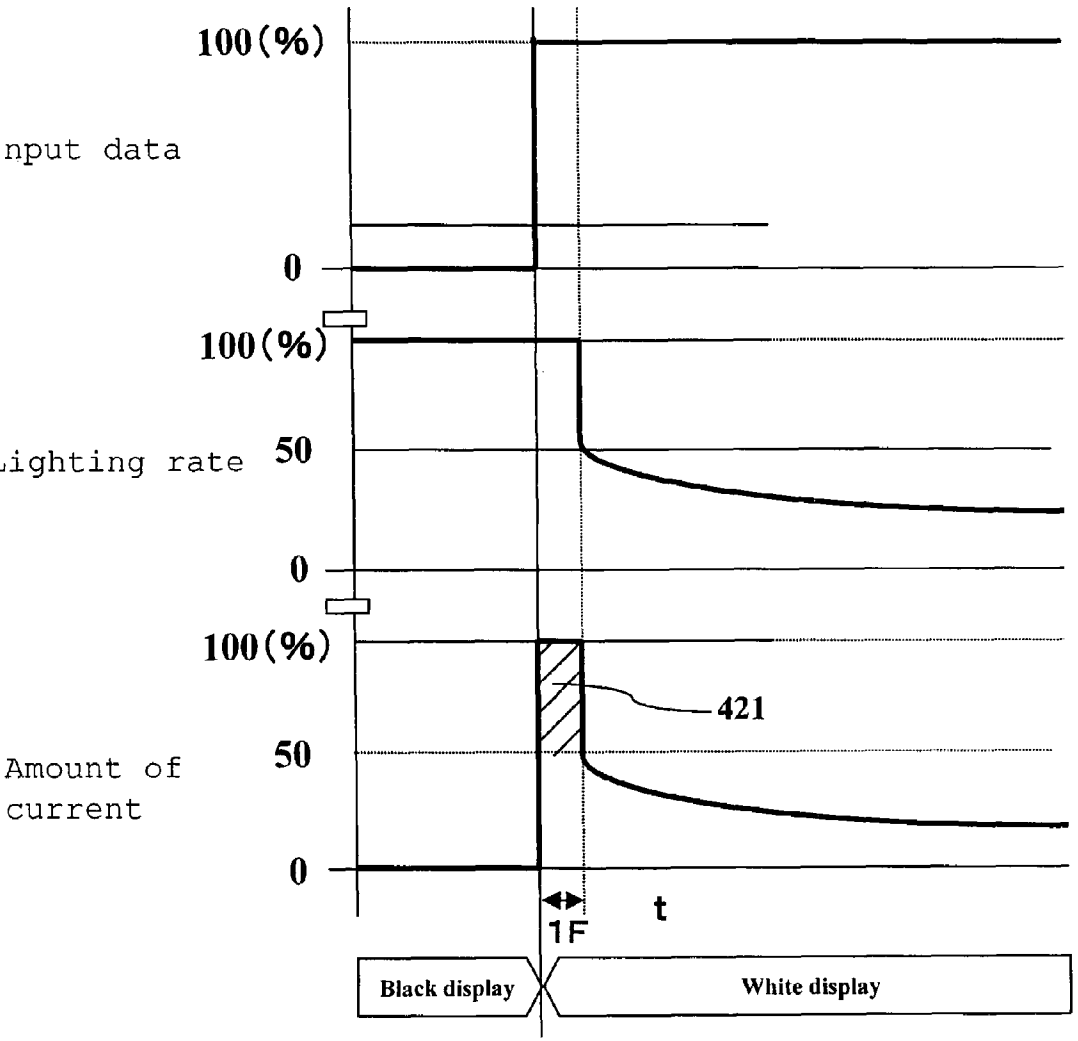
FIG. 42 is a diagram showing a relationship of the amount of current on changing from a black display to a white display.

Even if this method is used, there are the cases where the limit value of the power supply capacity is exceeded in one inter-frame area because the lighting rate changes after determining the input data. For instance, in the case of the input data=luminance data on the video of the organic EL panel as shown in FIG. 42, the lighting rate becomes maximum if the black display lasts for a while because the input data is small. If it suddenly turns to the total white display then, it may turn to the total white display in that frame as-is at the maximum lighting rate. In this case, the amount of current passing through the organic EL panel is in the area indicated by 421, and is exceeding the limit capacity of the power supply.

There are two methods of avoiding this phenomenon. One is to have a frame memory in the circuit. It is possible to store the image data in the frame memory once and then display it so as to reduce the lighting rate before performing the white display. However, there is a demerit that the circuit scale becomes significantly large in the case of having the frame memory in the circuit.

Figure 43:
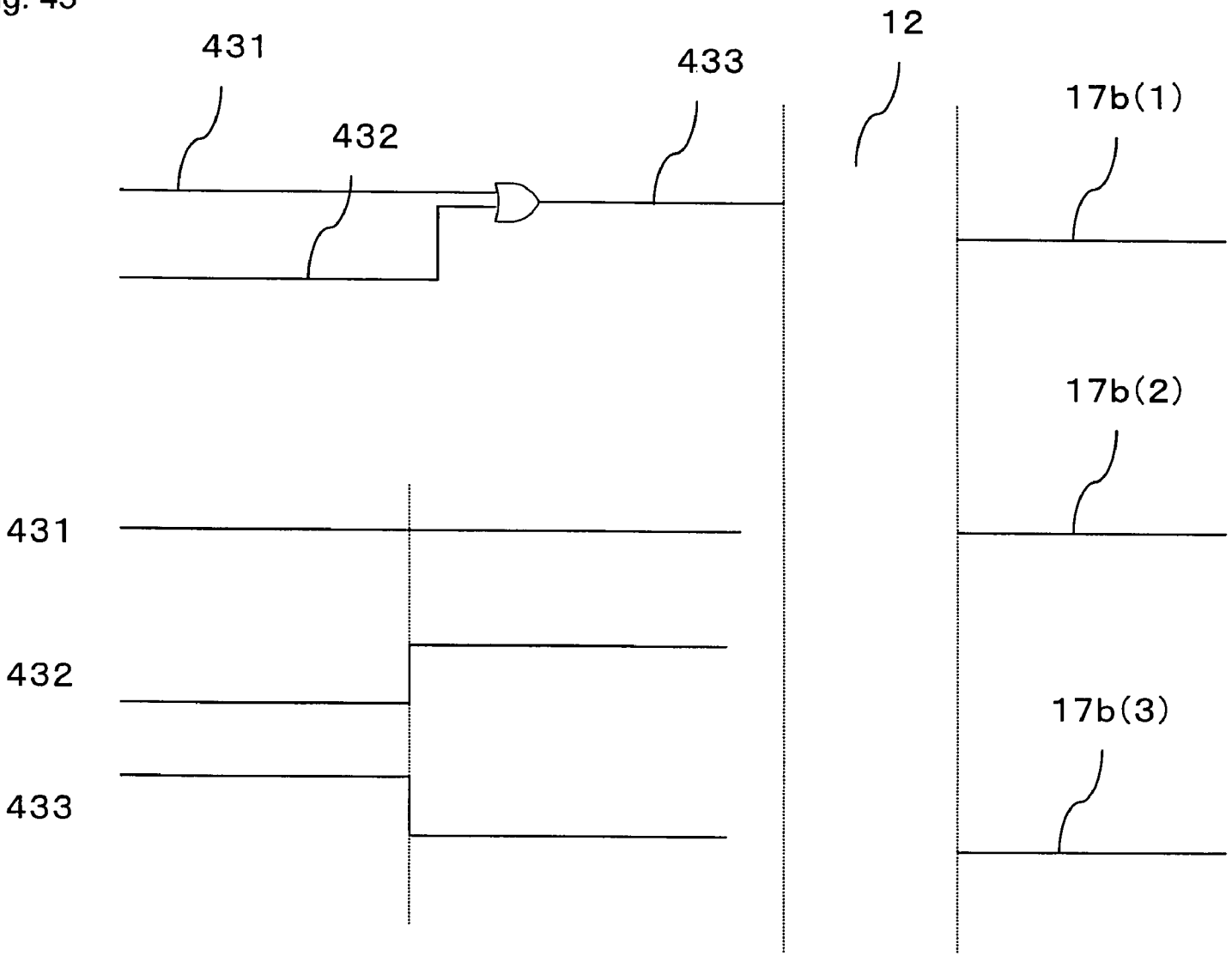
FIG. 43 is a circuit block diagram of the present invention.

Thus, a method of avoiding this phenomenon without using the frame memory is proposed. As shown in FIG. 43, a signal line 432 is added to a gate signal line 431 of inputting to the gate driver IC 12 so as to AND the two signal lines. Thus, when the signal line 432 is HI, the transistor 11*d* of the organic EL panel is turned on and off according to the gate signal line 431. And when the signal line 432 is LOW, the transistor lid of the organic EL panel is turned off irrespective of the gate signal line 431.

As a matter of course, there is no problem if a logical operation other than AND is performed to change combination of the two signal lines. Here, a description will be given as to the case where the logical operation is performed by AND and the transistor lid of the organic EL panel is turned off when the gate signal line 17 is LOW. First, the limit value of the input data is calculated from the lighting rate. If the Limit value of the power supply capacity is 50 percent in the status in which the lighting rate is 100 percent, it reaches the limit when the input data is 50 percent. If the limit capacity of the power supply is 50 percent in the status in which the lighting rate is 70 percent, it reaches the limit when the input data is 71 percent. When the input data reaches the limit value, the signal line 432 is reduced to LOW.

Figure 44:
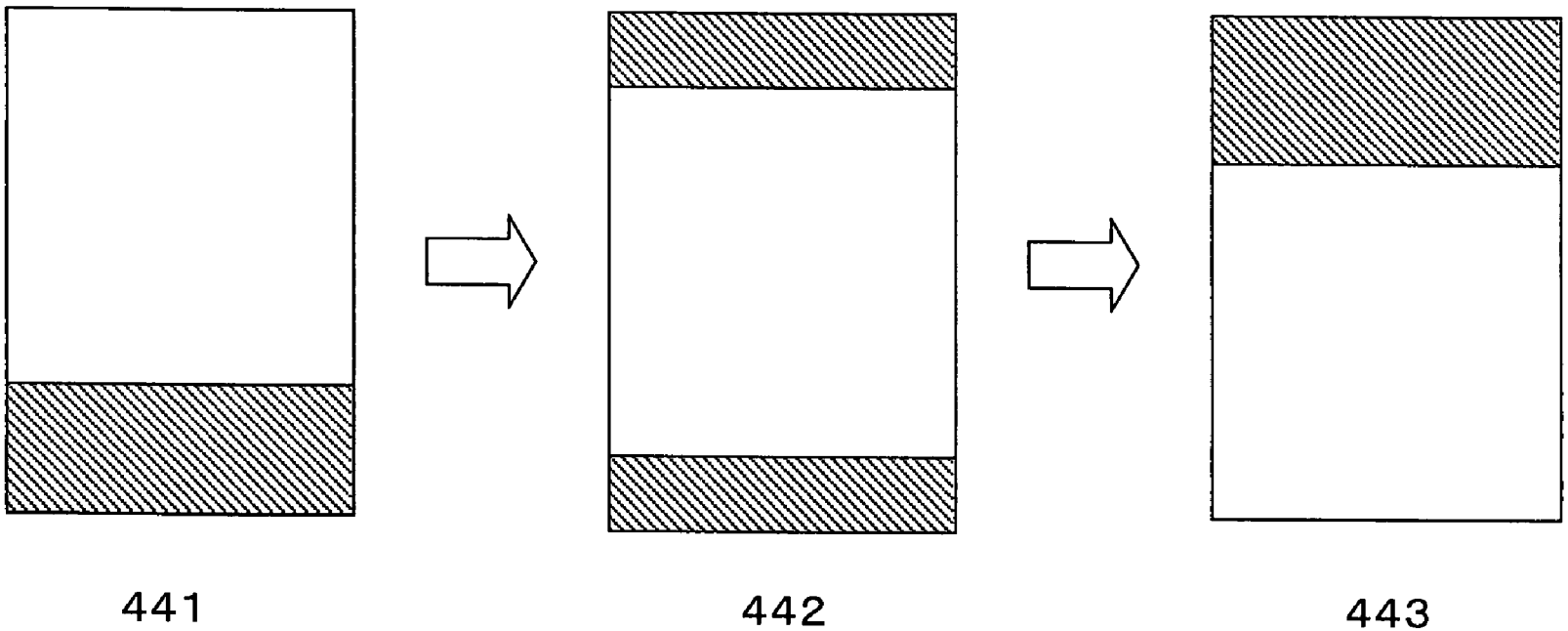
FIG. 44 are schematic diagrams of the display state of the present invention.

Then, the gate signal lines 17 become LOW, and the transistor lid of the organic EL panel is turned off. FIG. 44 show the change of the display area in this case. If it reaches the limit value at the time of 441, the signal line 432 becomes LOW, and the gate signal line 17*a* (1) operating the transistor 11*d* of a first line becomes LOW. Thus, the first line is put in a non-lit-up status, and continues the non-lit-up status until the gate signal line 17*a* (1) becomes HI next. After the first line is put in a non-lit-up status, 17*b* (2), 17*b* (3) and so on become LOW in turn and a second line, a third line and so on are put in a non-lit-up status in turn at each H. If this condition is represented in drawings, it is in order of 441, 442 and 443 and lighting time of each line remains unchanged. Therefore, the image is not influenced even if such a process is performed in the middle of one frame. It was possible, by using this method, to suppress the amount of current so as not to exceed the limit capacity of the power supply without using the frame memory.

Figure 13:
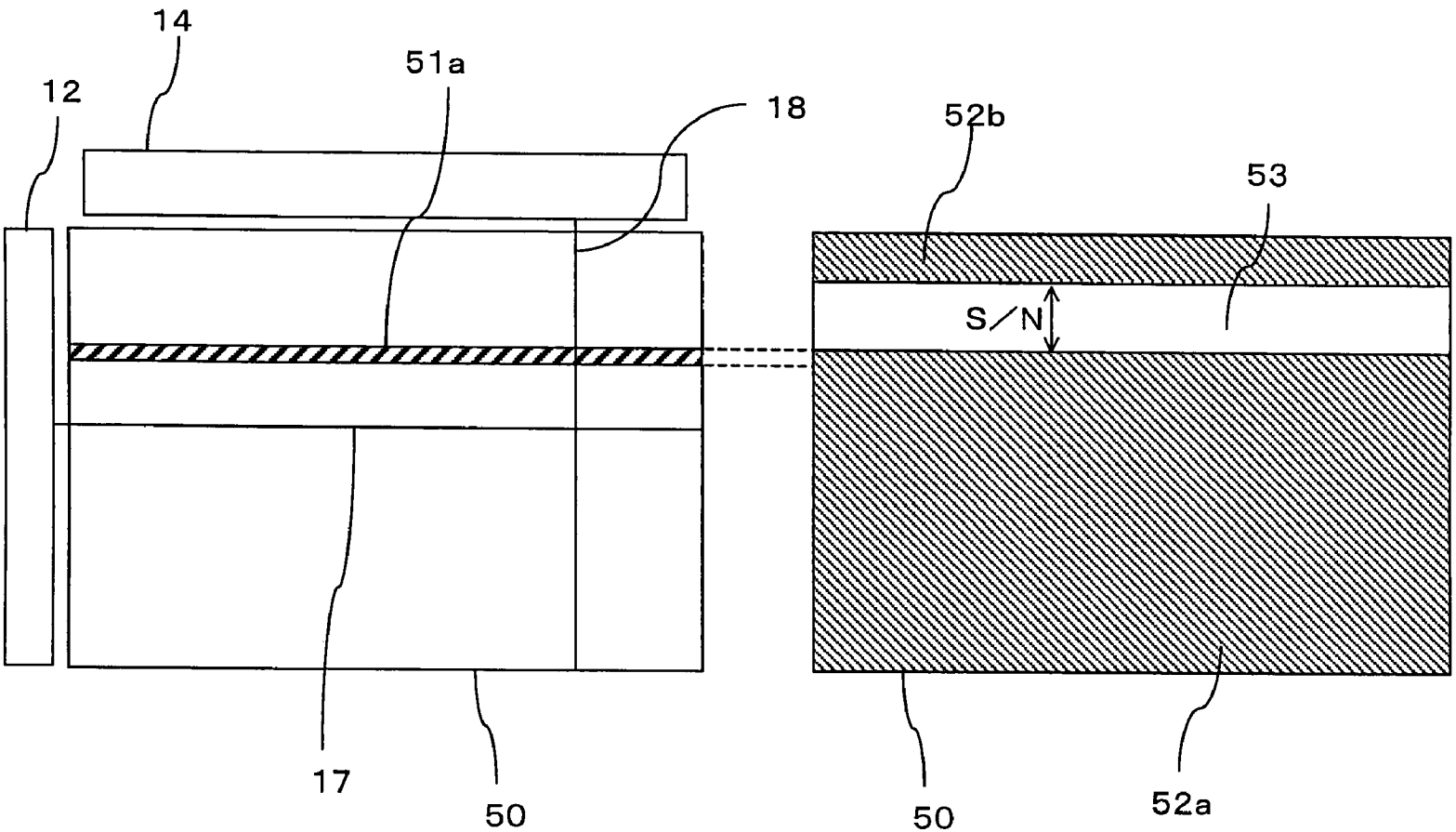
FIG. 13 are schematic diagrams of a display state of the display panel.
Figure 19:
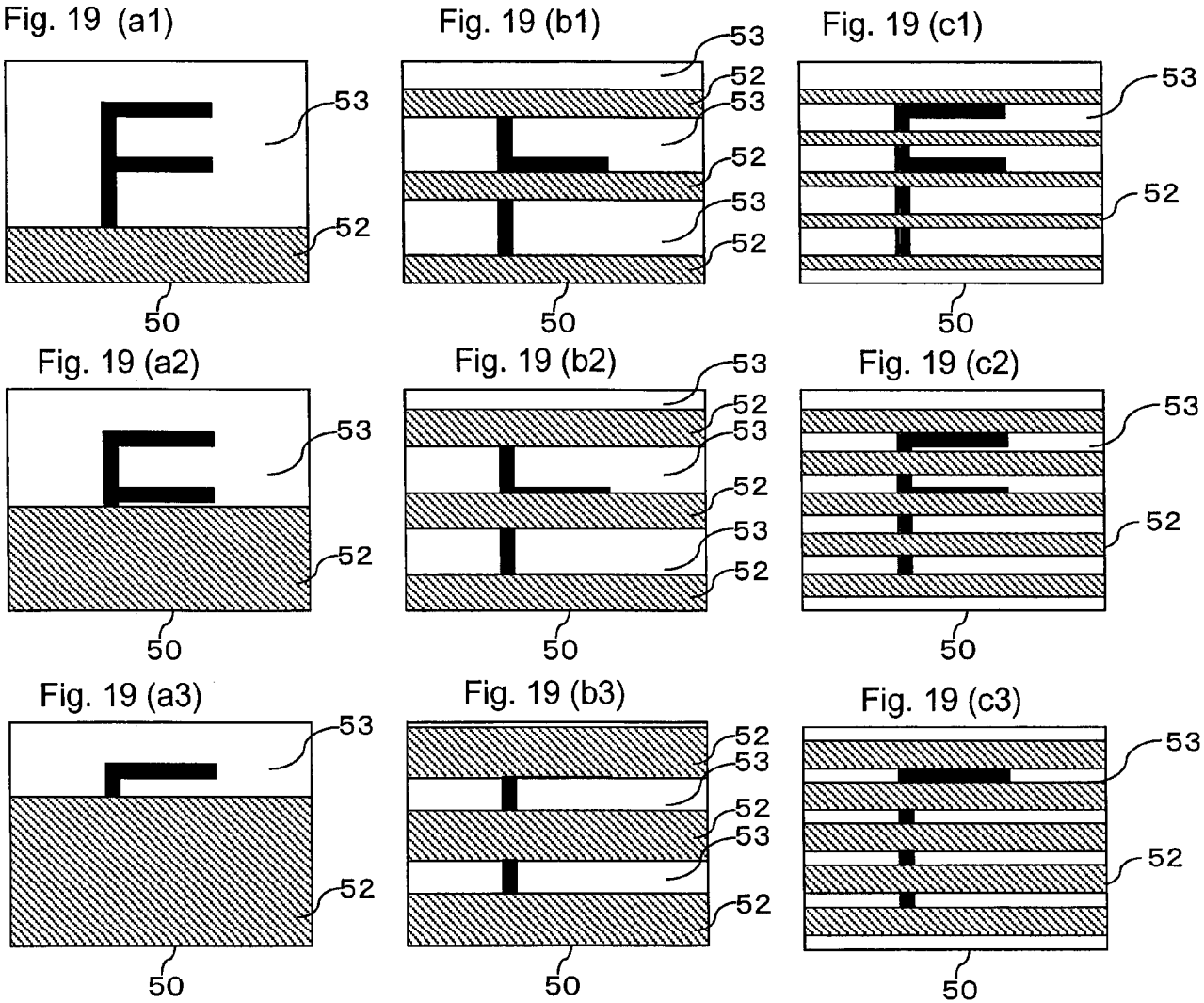
FIG. 19 are schematic diagrams of the display state of the display panel.
Figure 20:
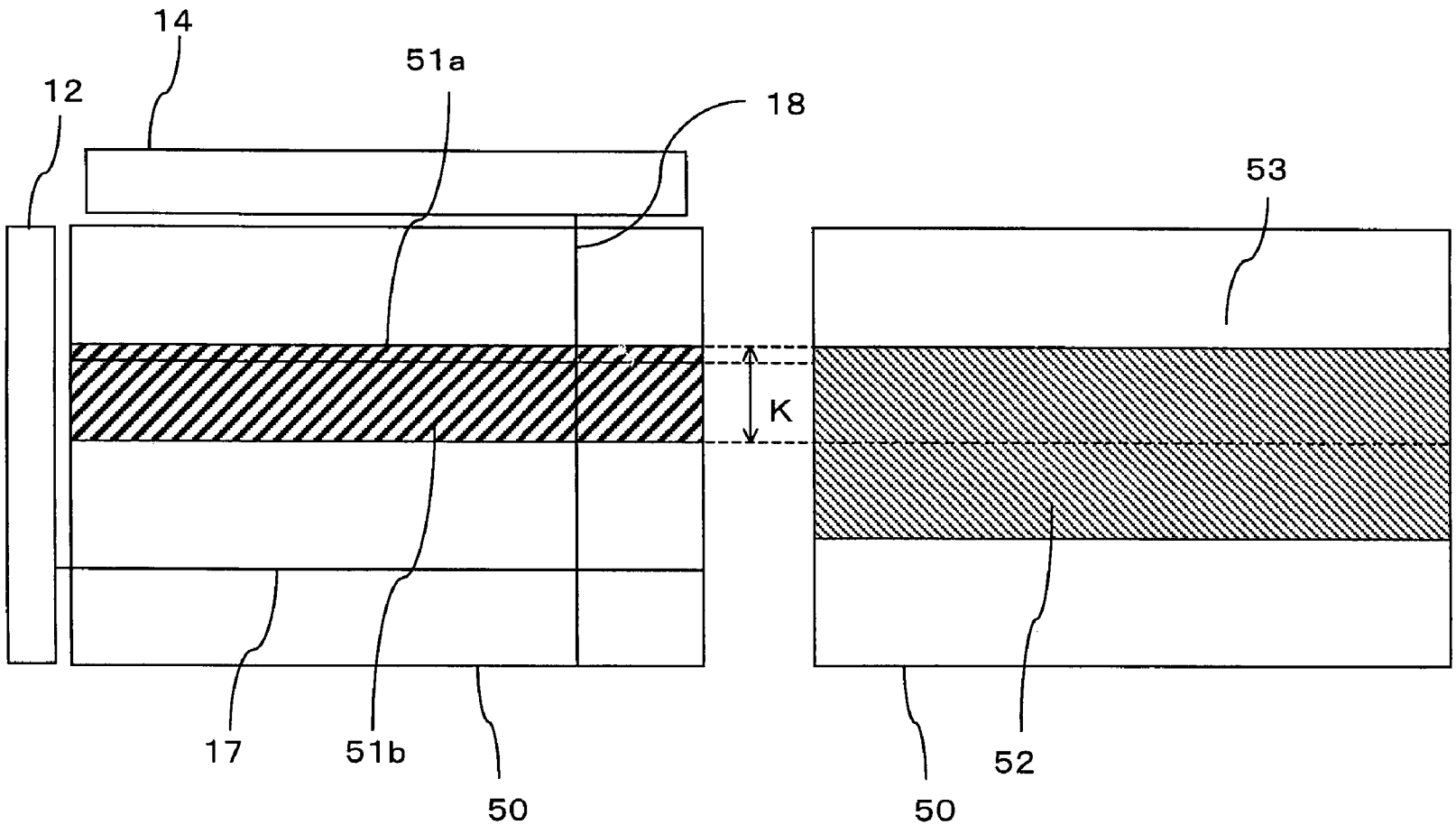
FIG. 20 are schematic diagrams of the display state of the display panel.
Figure 21:
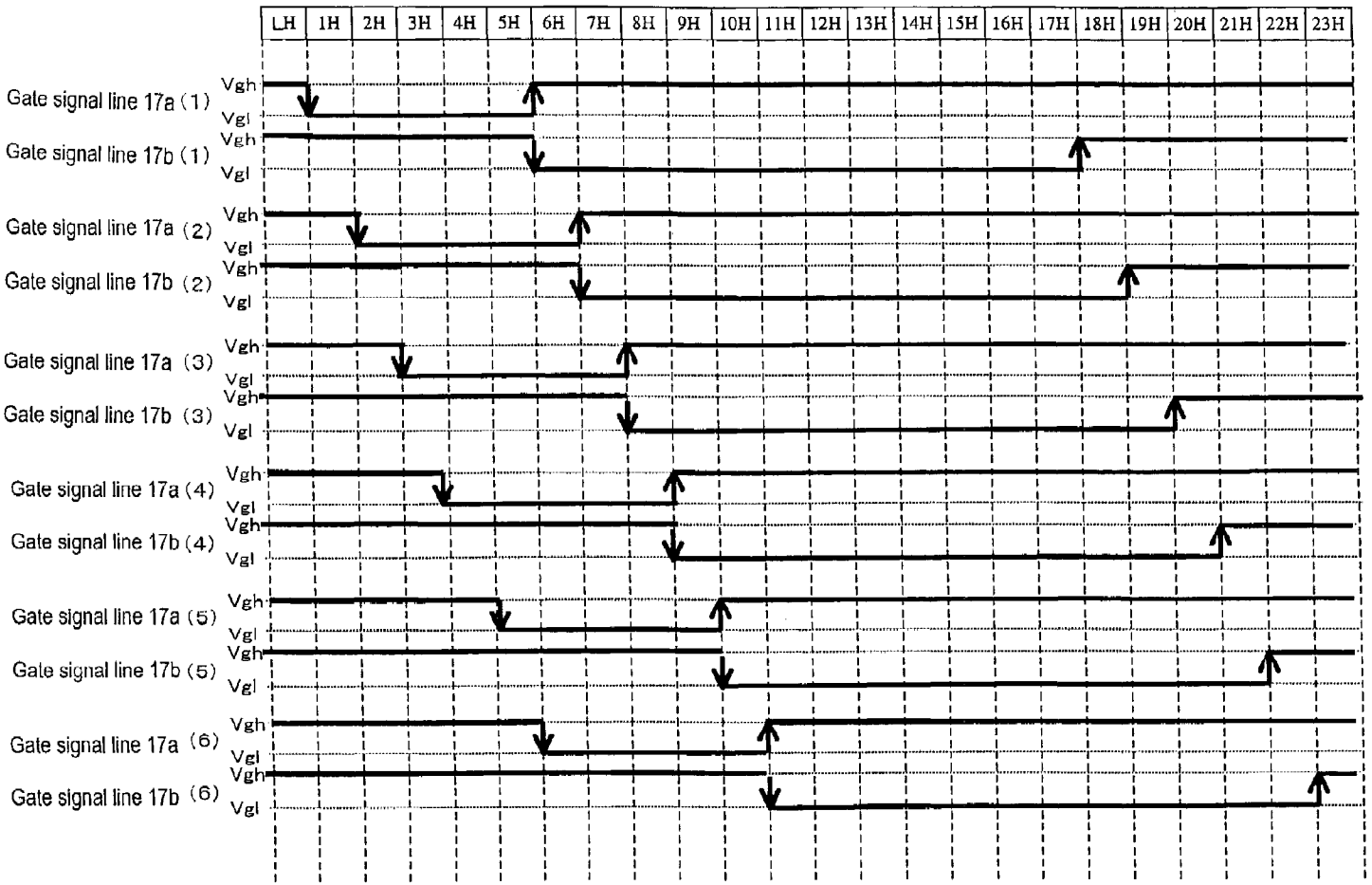
FIG. 21 is a diagram showing the drive waveform according to the present invention.
Figure 22:
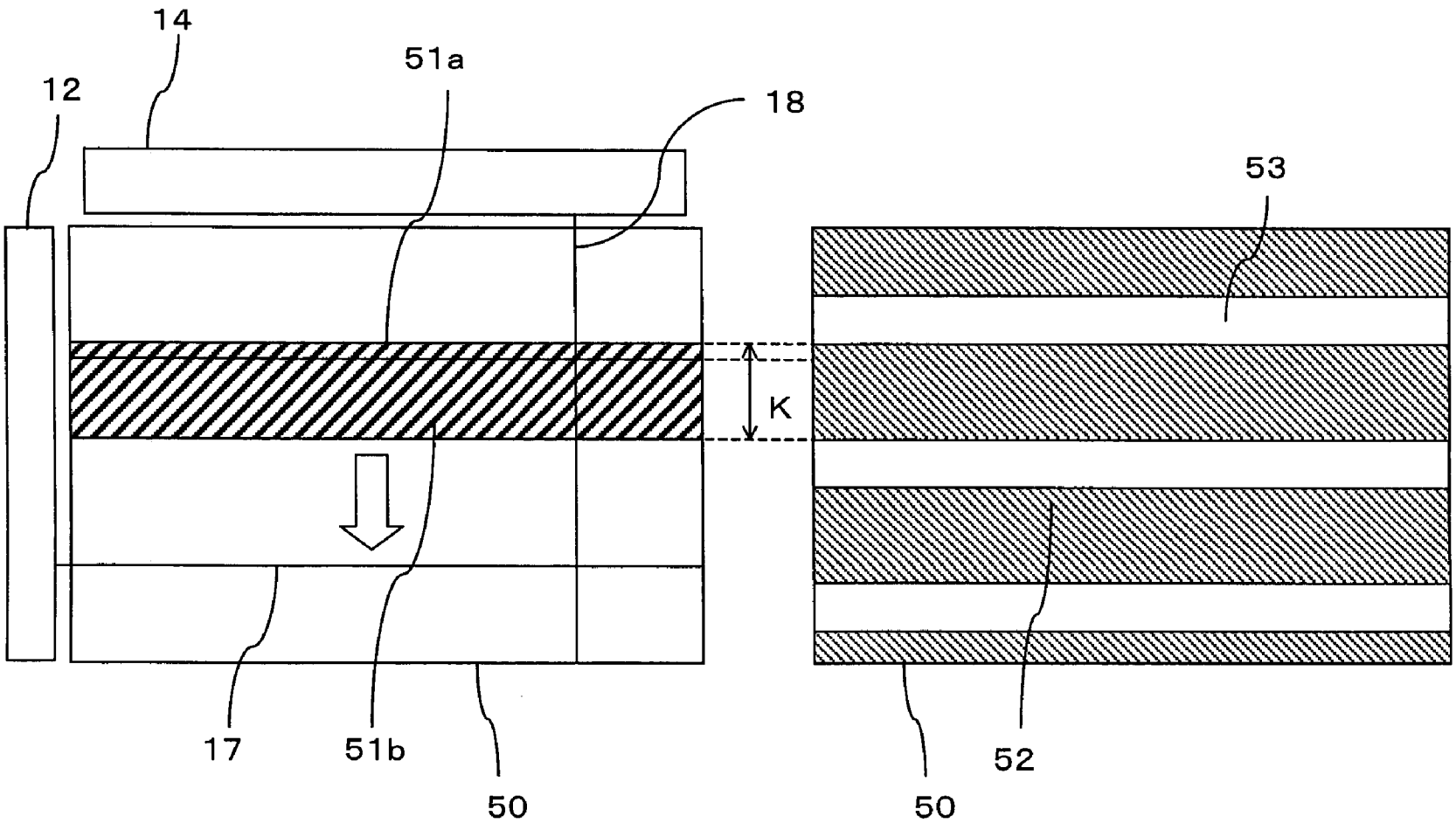
FIG. 22 are schematic diagrams of the display state of the display panel.
Figure 23:
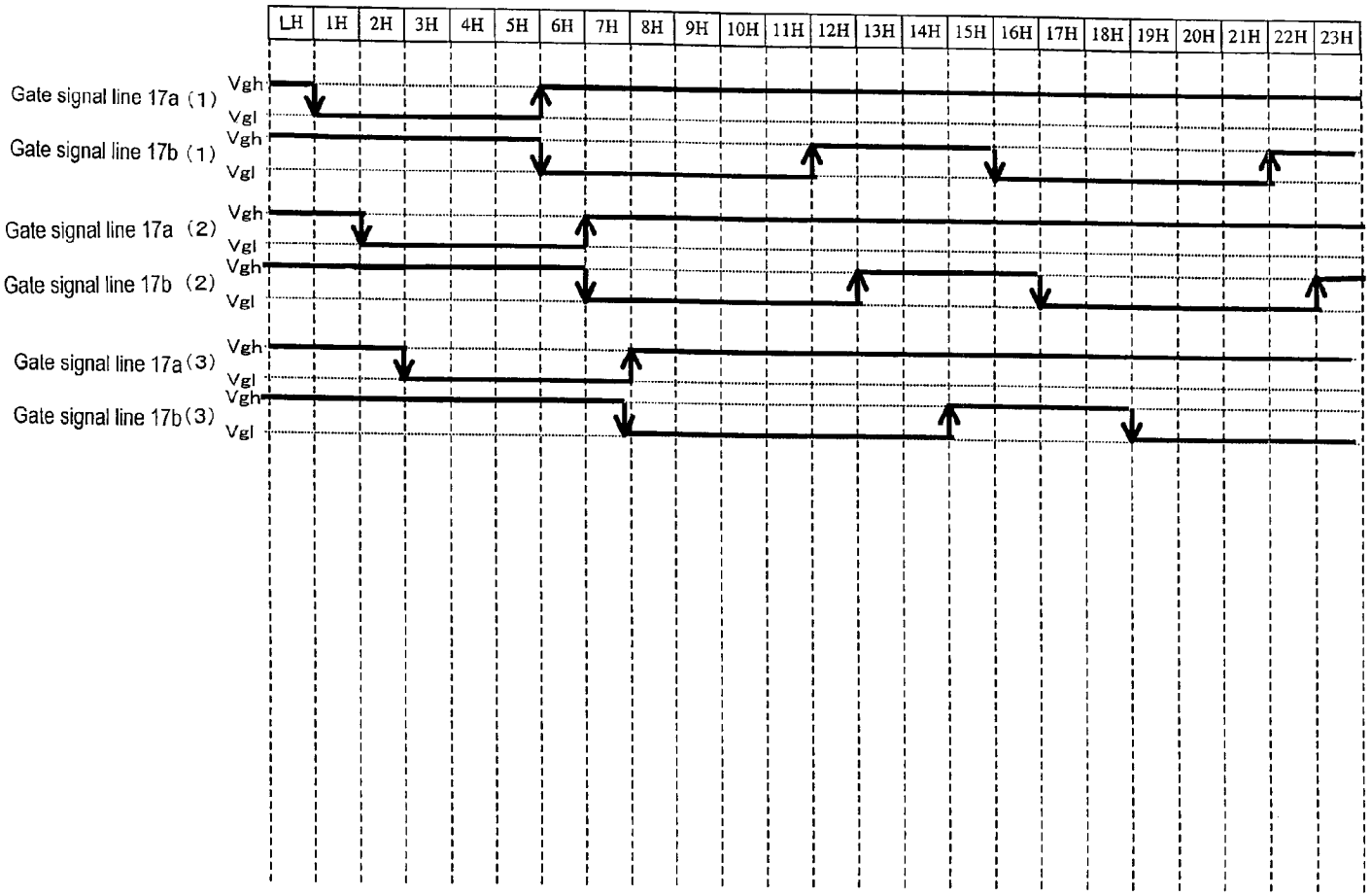
FIG. 23 is a diagram showing the drive waveform according to the present invention.

As shown in FIG. 19, the display mounted according to the present invention is capable of adjusting the brightness by the display area lit up in one inter-frame space. As shown in FIG. 13, if the number of horizontal scanning lines in an image display area is S and the display area lit up in one inter-frame space is N, the brightness of the display area is N/S. It is possible, as previously described, to easily implement adjustment of the brightness of the display area according to this method by controlling a shift register circuit 61 of the gate driver IC 12.

Figure 31:
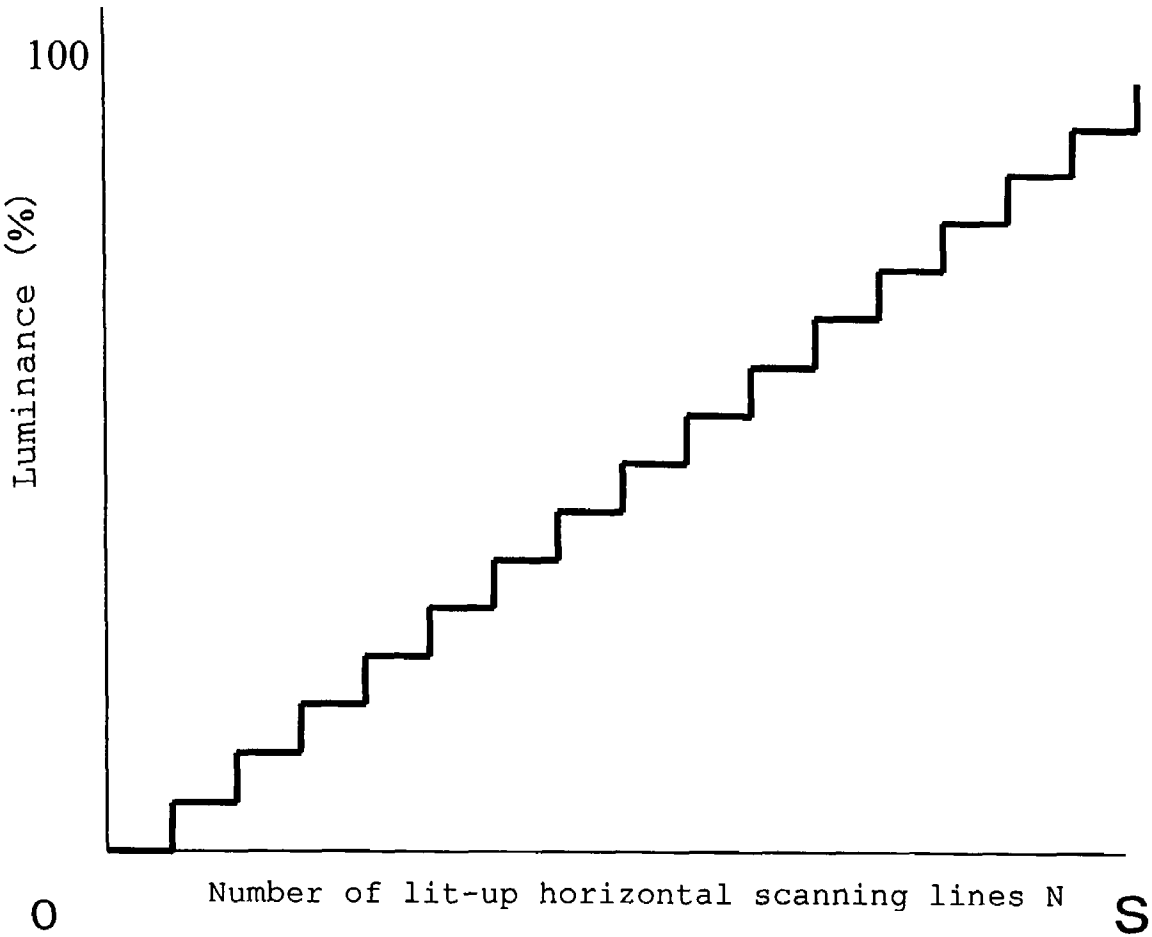
FIG. 31 is a diagram showing a relationship between a lighting rate and the brightness.

However, this method can only adjust the brightness of the display area in S stages. FIG. 31 shows the change in the brightness of the display area when changing N of the lit-up display area. As the brightness is adjusted by changing the number of lit-up horizontal scanning lines N, the change in the brightness becomes stepwise as shown in FIG. 31. There is no problem in the case where an adjusted width of the brightness is small. In the case where the adjusted width of the brightness is large, however, the change in the brightness becomes significant when changing N according to this adjustment method so that it becomes difficult to change the brightness smoothly.

Figure 28:
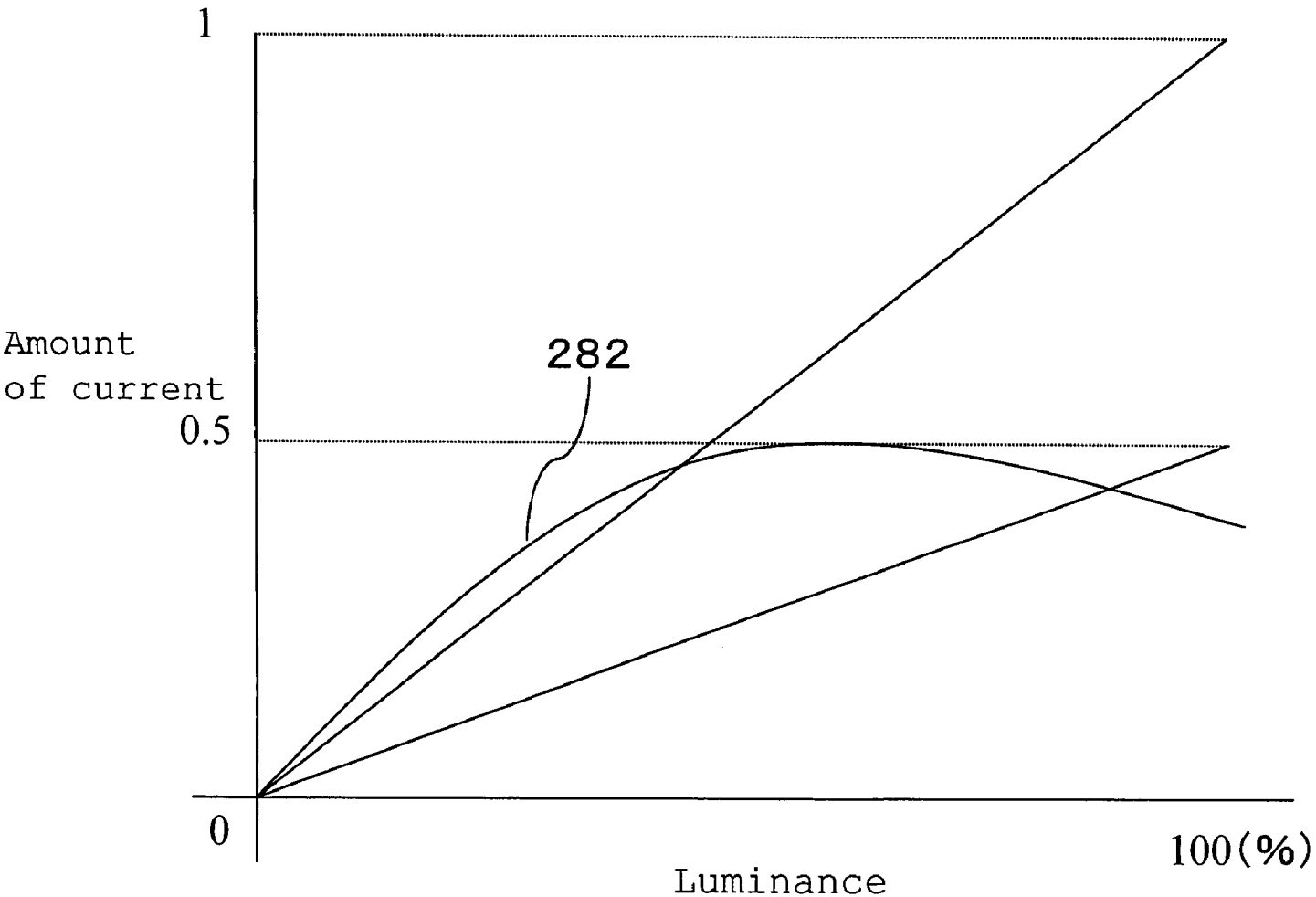
FIG. 28 is a diagram showing a relationship between a luminance and an amount of current of the display area when applying a lighting rate control drive.

Thus, two signal lines 62*a* and 62*b* are placed in the gate driver IC 12 as shown in FIG. 6. The two signal lines 62*a* and 62*b* are connected to gate control signal lines 64 and OR circuits 65 connected to the shift registers. The output of the OR circuits 65 is connected to output buffers 63, and is then outputted to the gate signal lines 17. As shown in FIG. 28, the gate signal lines 17 output LOW only when both the signal lines 62 and 64 are LOW, and output HI when one of them is HI.

Thus, it is possible to render the gate signal lines 17 as HI output and turn off the transistor 11*b* and 11*d* by rendering the signal lines 62 as HI output when the transistor 11*b* and 11*d* are in the on state (the gate signal lines 17 output LOW). The present invention is not limited to the combination of the signal lines and OR circuits. It changes the gate signal lines 17 by changing the signal lines 62, where it is also possible to use AND circuits, NAND circuits or NOR circuits instead of the OR circuits.

Figure 32:
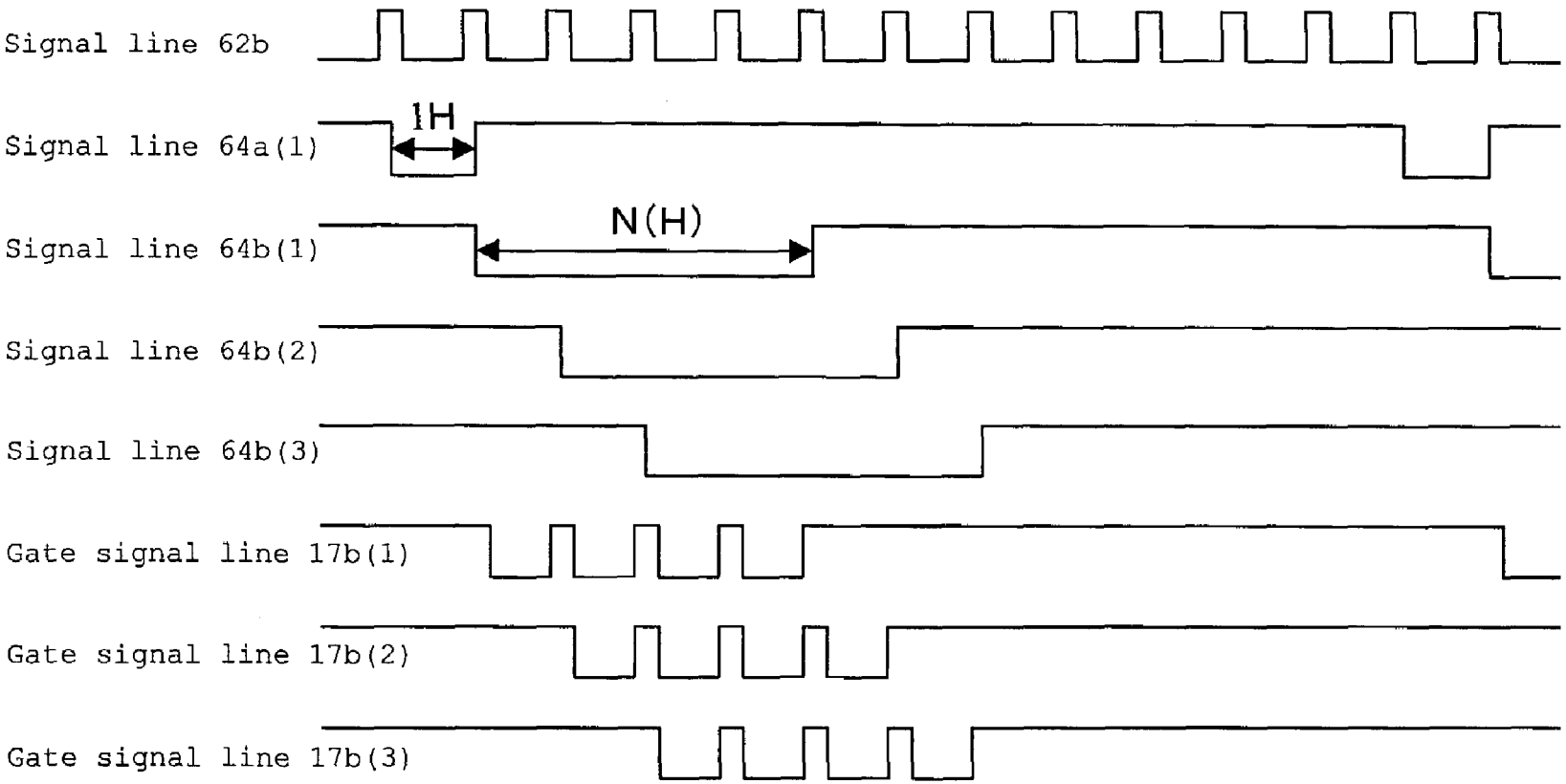
FIG. 32 is a diagram showing the drive waveform according to the present invention.
Figure 33:
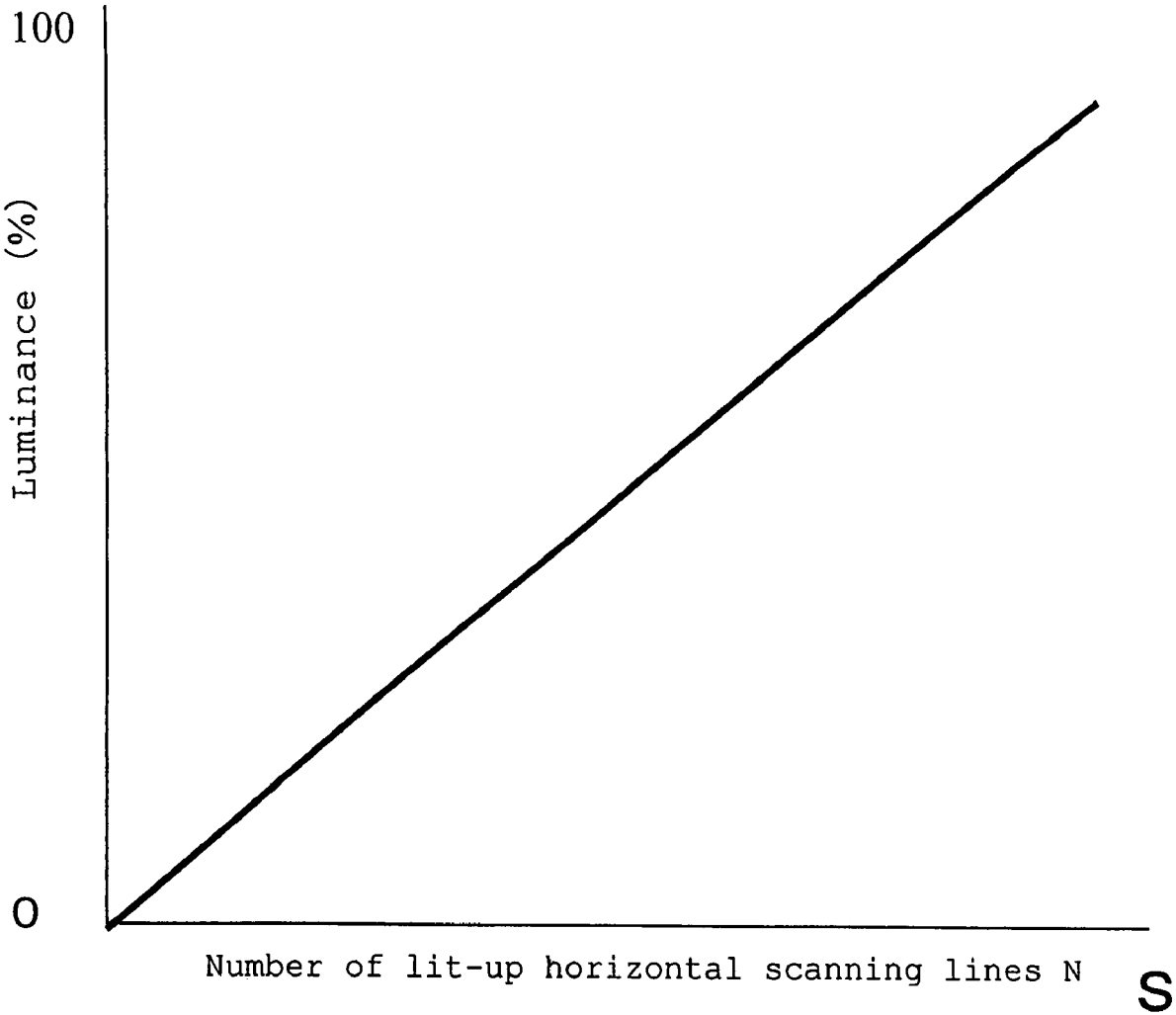
FIG. 33 is a diagram showing the relationship between the lighting rate and the brightness corrected according to the present invention.

As shown in FIG. 32, the light emission time of the EL element 15 is adjusted by adjusting an HI output period of the signal line 62*b*. If attention is directed toward one EL element 15, it is lit up in one inter-frame space for N horizontal scanning periods (H) when the number of lit-up scanning lines is N. In this case, if the HI output period of the signal line 62*b* in one horizontal period (1H) is M (μ), the lighting time of one inter-frame space decreases by M×N (μ). FIG. 33 shows the change in the brightness in this case. The luminance between N=N' and N=N'−1 ($1 \leqq N' \leqq S$) has its inclination represented by −M×N'. It is thereby possible to make a linear change of stepwise brightness in FIG. 31.

This drawing describes that the signal line 62*b* becomes HI output once per H. However, the present invention is not limited thereto. A processing method in which the signal line 62*b* becomes HI once in a few 1H periods is also thinkable, and there is no problem whichever location in 1H the period of the HI output may be placed. It is also possible to adjust the brightness among a few frames. For instance, if the signal line 62*b* is rendered as the HI output once in two frames, a period M of the HI output becomes ½ to the eye. However, there is a possibility of having unevenness of the brightness in the image display area if the signal line 62*b* is rendered as the HI output only in a specific display period when performing such a process.

Figure 35:
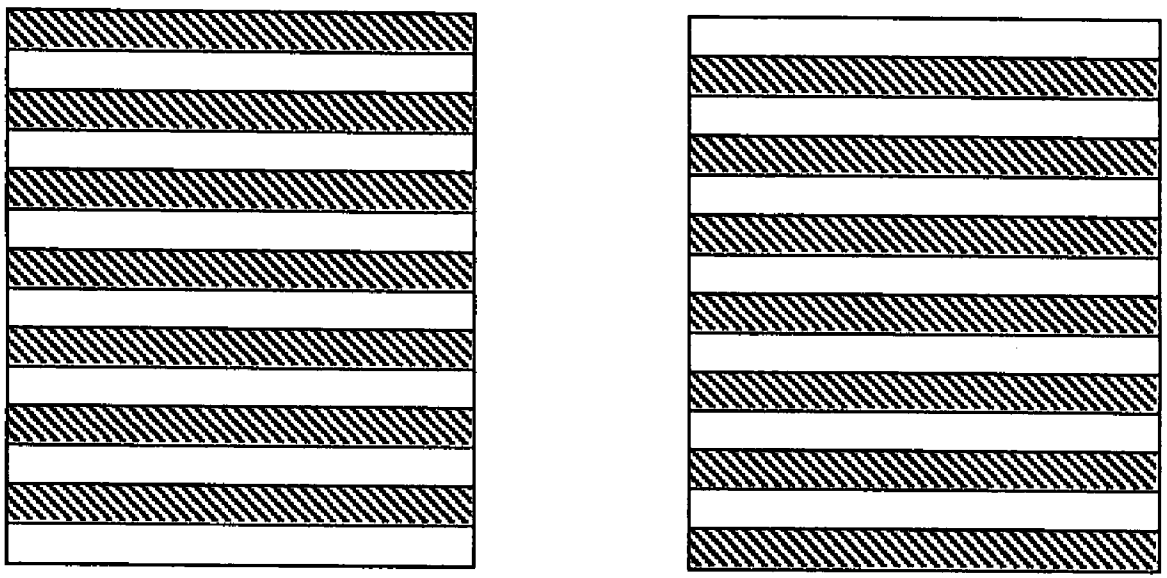
FIG. 35 are schematic diagrams of the display state according to the present invention.

In such a case, it is possible to eliminate the unevenness of the brightness by performing the process over a few frames. For instance, as shown in FIG. 35, there is a method of switching frame by frame between a display method 351*a* of rendering the signal line 62*b* as HI when odd lines are lit up and a display method 351*b* of rendering the signal line 62*b* as HI when even lines are lit up. This eliminates the unevenness of the brightness in the image display area to the eye. According to the present invention, the brightness is adjusted by operating the signal lines 62 only when N/S≦¼ in the case where there are S pieces of the horizontal scanning line of the display area and nine pieces thereof are inverted. First, a description will be given as to the merit of operating the signal lines 62 when N/S is ¼ or less.

As previously described, if the brightness is adjusted according to the change in the number of lit-up horizontal scanning lines N, the change in the brightness becomes stepwise. Therefore, the brightness significantly changes at a boundary on which N changes. Human eyesight does not easily notice the magnitude of the change in the case where the brightness of the display area is high, but easily notices it in the case where the brightness is low. Consequently, the present invention allows the amount of change in the brightness to be fine-tuned by adjusting the signal lines 62 in the case where the brightness of the display area is low.

Figure 9:
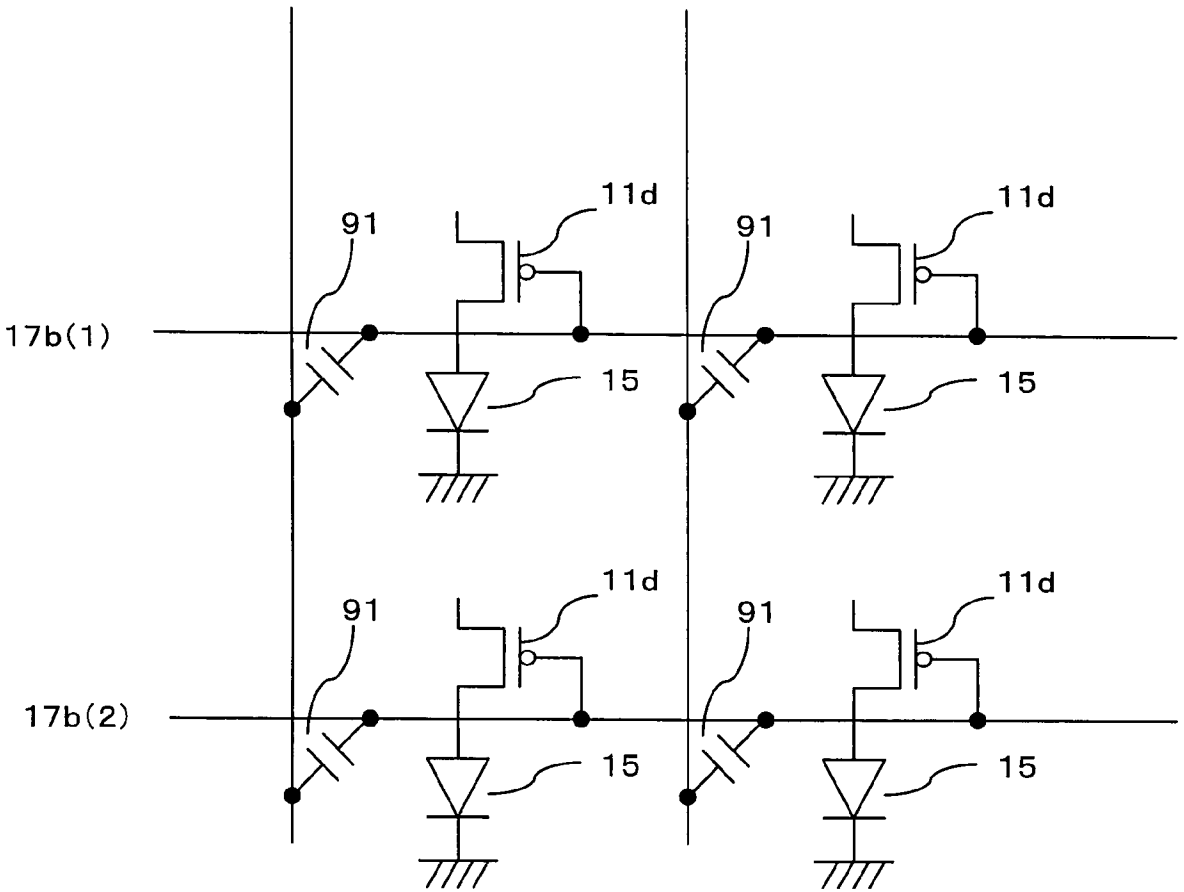
FIG. 9 is a diagram describing a stray capacitance between a source signal line and a gate signal line.
Figure 36:
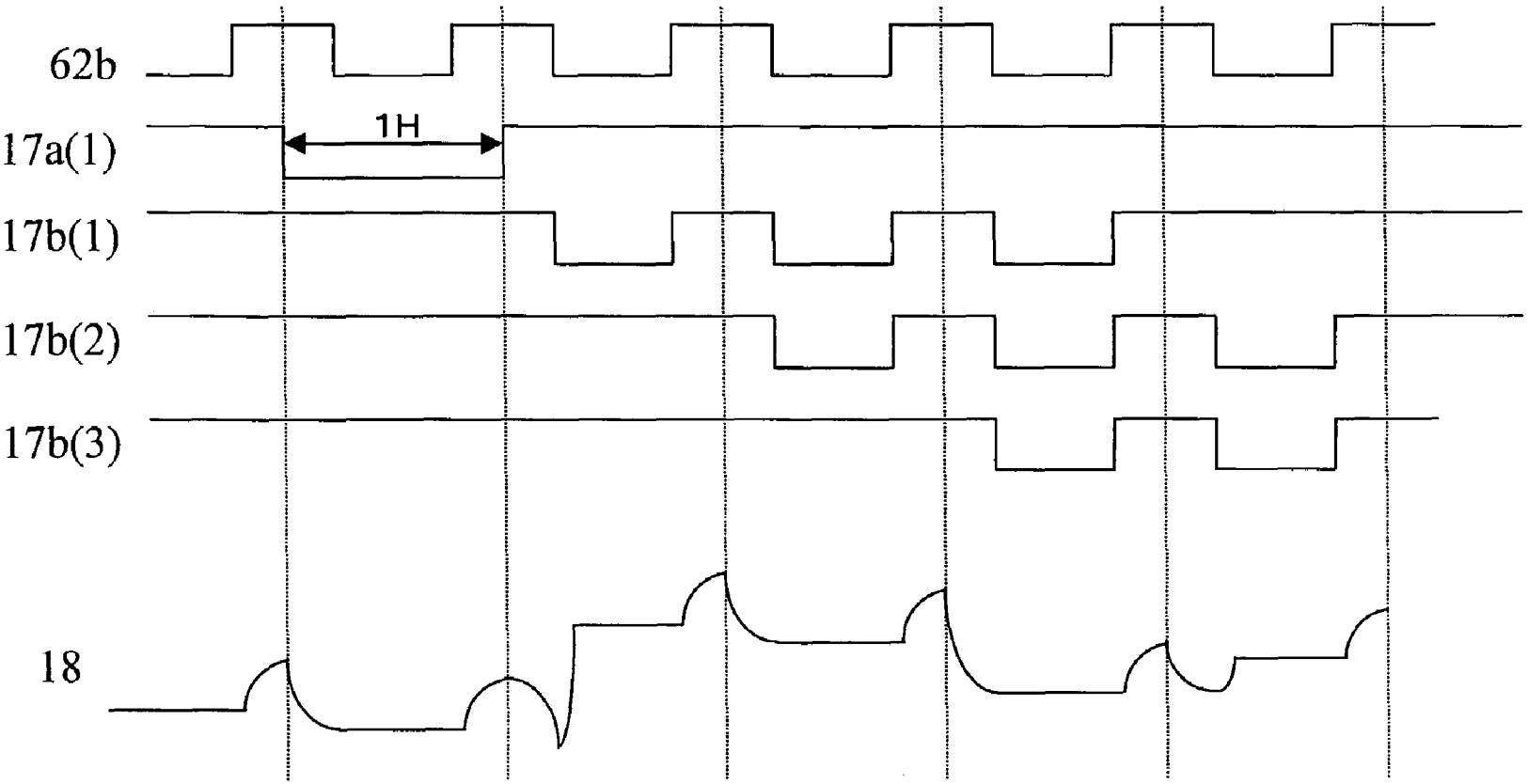
FIG. 36 is a diagram describing coupling with the source signal line.
Figure 37:
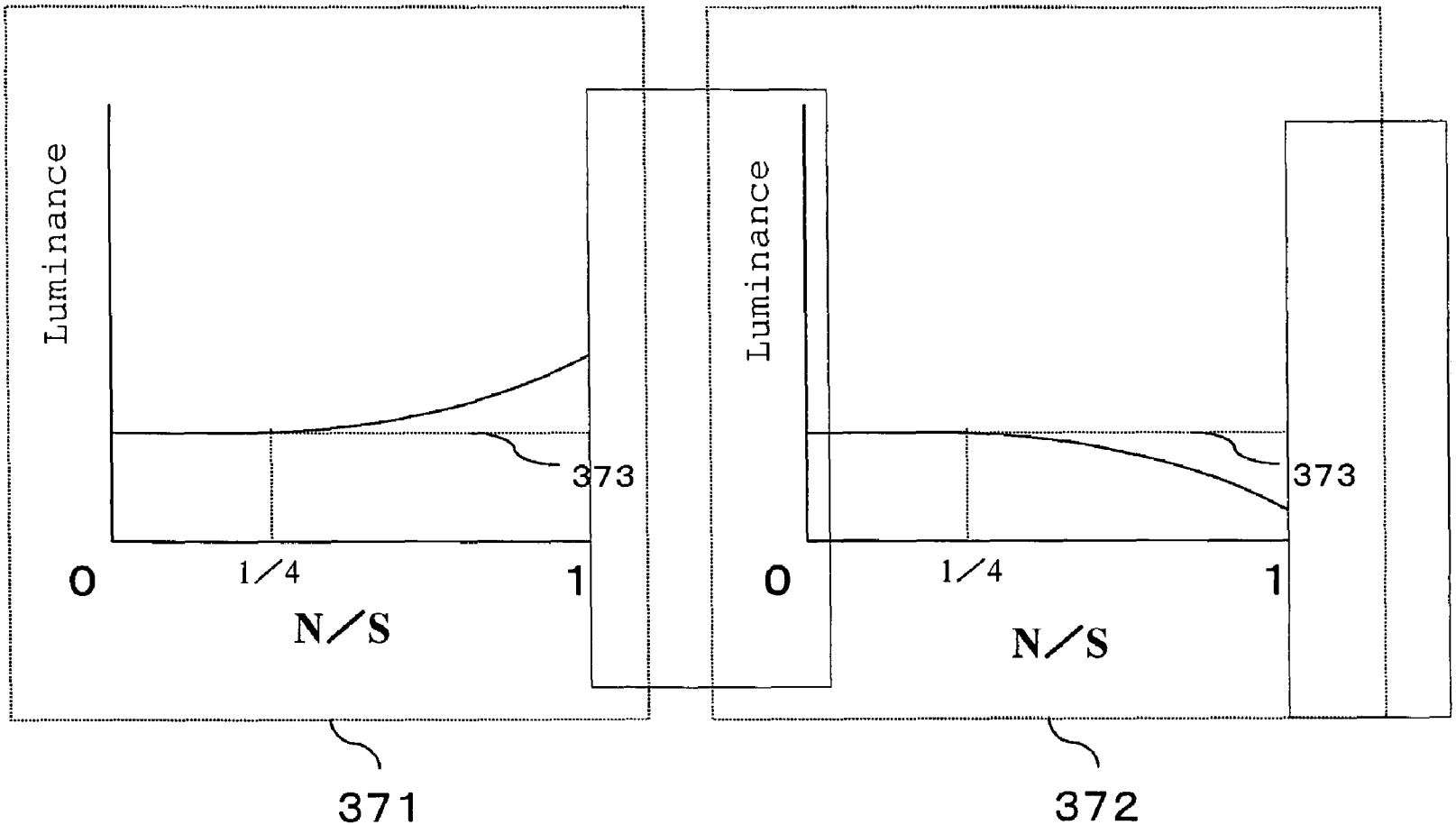
FIG. 37 are diagrams showing the relationship between the lighting rate and the coupling.

Next, a problem in the case where N/S is ¼ or more will be described. As shown in FIG. 9, a stray capacitance 91 exists between the source signal line 18 and the gate signal line 17*b*. If the signal line 62*b* is rendered as the HI output, N pieces of the gate signal lines 17*b* become the HI output all together. Therefore, the source signal line 18 changes due to coupling of the source signal line 18 and the gate signal lines 17*b* as shown in FIG. 36. It becomes impossible, due to this coupling, to write a correct voltage to the storage capacitance 19. In particular, as shown in FIG. 37, the change in a write voltage due to the coupling cannot be corrected in a low gradation portion of writing at low current. Therefore, in the case where the write voltage becomes high as indicated in 371, the low gradation portion becomes higher than a target brightness 373. And in the case where the write voltage becomes low as indicated in 372, the low gradation portion becomes lower than the target brightness 373.

As described above, N/S≦¼ is adequate as the period which has the merit of being able to fine-tune the change in the brightness and is not much influenced by the change in the write voltage due to the coupling.

Figure 60:
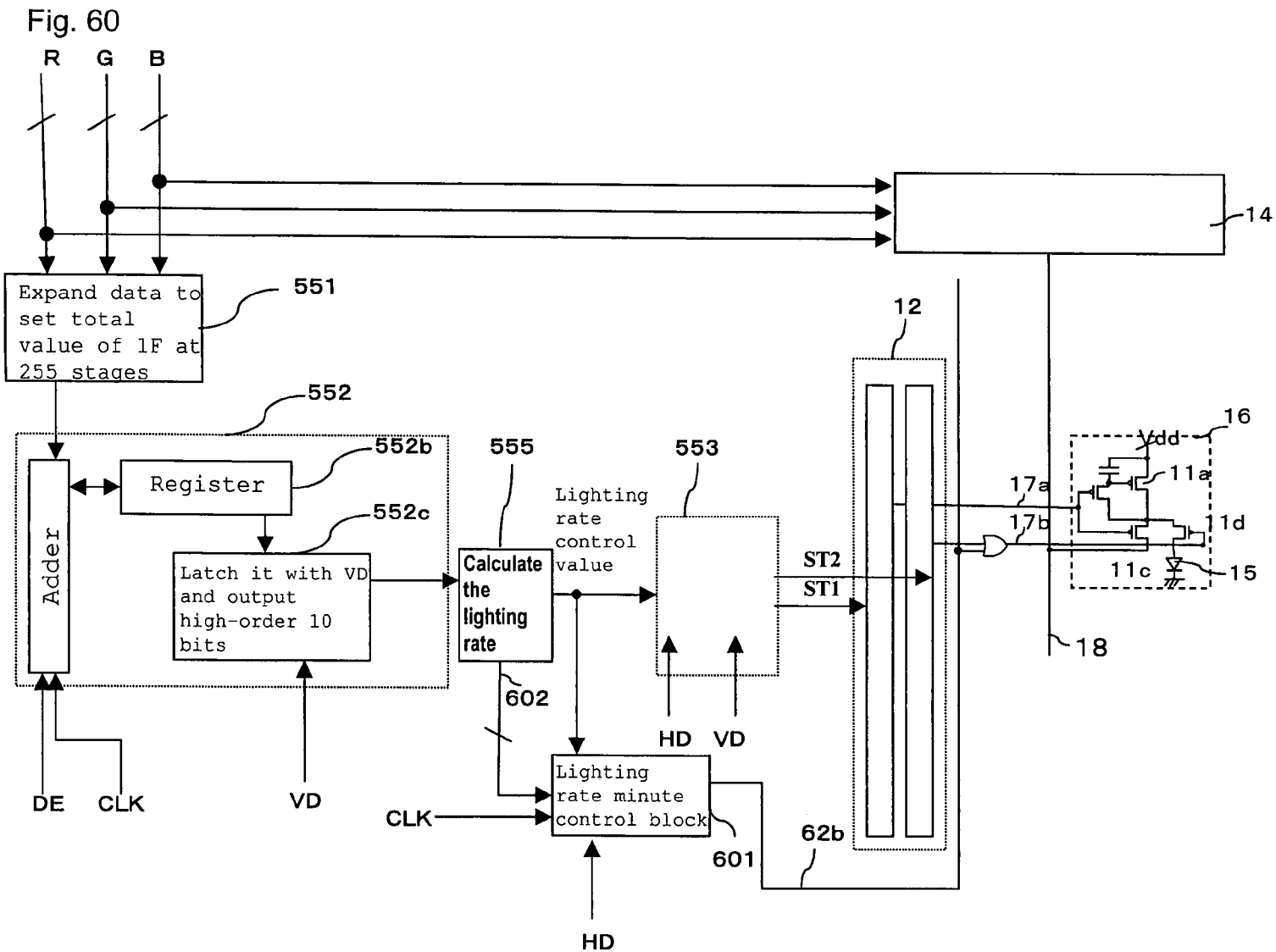
FIG. 60 is a circuit block diagram of a lighting rate minute control drive.

FIG. 60 shows the circuit configuration as to the driving method. The driving is performed in 601. As the driving method seeks a minuter lighting rate control value, 10-bit data is outputted from 552*c* so as to create the lighting rate control value 556. It is possible, if the lighting rate control value 556 is created from the 10-bit data, to create the data of 1024 steps, where control can be exerted four times as minutely as the case of creating the lighting rate control value 556 with 8 bits. However, the lighting rate can only be adjusted in the stage of the number of horizontal scanning lines S. Thus, if S is an 8-bit value, low-order 2 bits of generated 10-bit control data are used for fine-tuning of the lighting rate. It is also possible, in the case of performing the driving of FIG. 61 previously described, to use the data of n bits shifted to the LSB side on outputting for the fine-tuning of the lighting rate.

As this driving is performed in the period in which the lighting rate is N/S≦¼, the lighting rate control value 556 is inputted from 555 to 601. 601 performs the driving at the lighting rate of N/S≦¼. As previously indicated, the signal line 62*b* outputted from 601 has the logical operation performed with a signal line 64*b* outputted from the gate driver IC 12, and the output thereof is the gate signal line 17*b*. For this reason, it is possible to operate the transistors lid of all the pixels in an output status of the signal line 62*b*. In a section of N/S≦¼performing no driving, output is produced to the signal line 62*b* so as to reflect an output waveform of the signal line 64*b* on 17*b*.

In the case of N/S≦¼ 601 drives in synchronization with an HD. It does not necessarily synchronize only with the HD. It is also feasible to provide a dedicated signal of driving 601. 601 operates the signal line 62*b* so that the transistors lid are turned off for a specified period by an inputted fine-tuning signal 602 and a clock (CLK). As previously indicated, if the HI output period of the signal line 62*b* in one horizontal period (1H) is M(μ) in the status of lighting up N lines, the lighting time of one inter-frame space decreases by M×N(μ). For that reason, it is possible to calculate M by calculating the time of 1H and the data of 602 and manipulate reduction in the lighting time by the operation of the signal line 62*b* so as to change the lighting rate smoothly.

FIG. 60 is in the form of having 601 added to FIG. 55. As a matter of course, it is applicable to any of the circuit configurations described herein, such as FIGS. 58 and 61.

Figure 45:
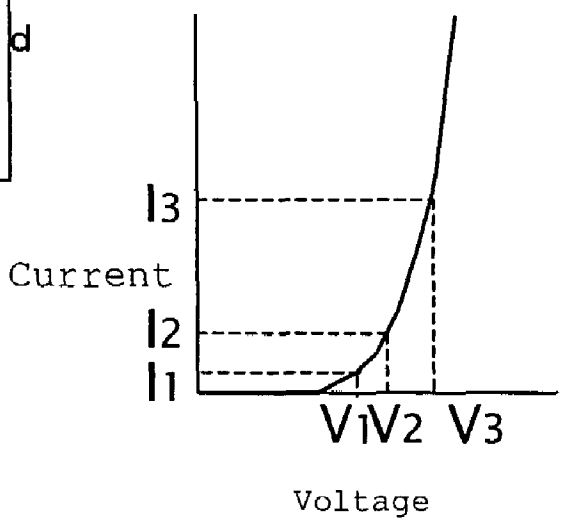
FIG. 45 is circuit block diagrams of the present invention.
Figure 45:
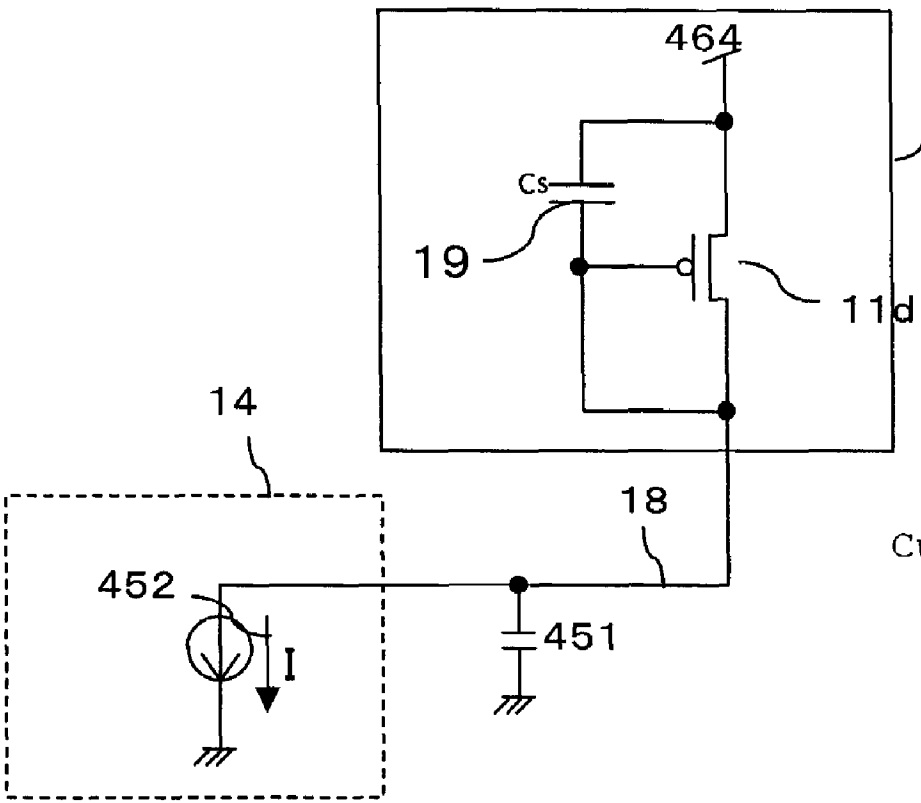
Figure 46:
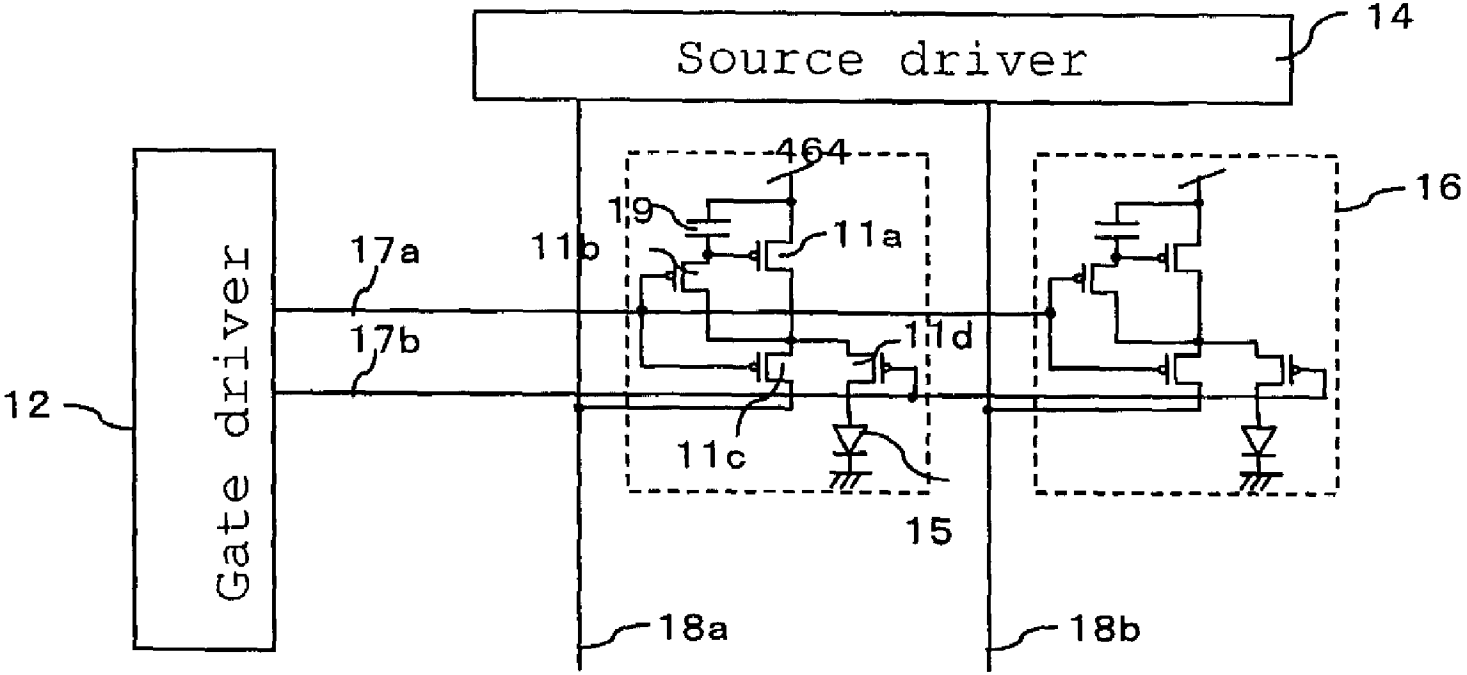
FIG. 46 is a circuit block diagram of the present invention.

Next, consideration is given to the case of writing a predetermined current value to a certain pixel from the source signal line on the active matrix type display apparatus having the pixel configuration shown in FIG. 46. FIG. 45(*a*) shows the circuit having the circuits related to the current path from an output stage of the source driver IC 14 to the pixels extracted.

A current I corresponding to the gradation passes as a drawn current in the form of a current source 452 from inside the source driver IC 14. This current is taken inside the pixel 16 through the source signal line 18. The current taken in passes through the driving transistor 11*a*. To be more specific, in a selected pixel 16, the current I passes through a source driver IC 36 via the driving transistor 11*a* and the source signal line 18 from an EL power wire 464.

If the video signal changes and the current value of the current source 452 changes, the current passing through the driving transistor 11*a* and the source signal line 18 also changes. In that case, the voltage of the source signal line changes according to current-voltage characteristics of the driving transistor 11*a*. In the case where the current-voltage characteristics of the driving transistor 11*a* are as in FIG. 45(*b*), the voltage of the source signal line changes from V2 to V1 when the current value passed by the current source 452 changes from I2 to I1 for instance. This change in the voltage is caused by the current of the current source 452.

The stray capacitance 451 exists on the source signal line 18. To change the source signal line voltage from V2 to V1, it is necessary to draw out the charge of the stray capacitance. The time ΔT required to draw it out is ΔQ (charge of the stray capacitance)=I (current passing through the source signal line)×ΔT=C (stray capacitance value)×ΔV. Here, ΔT=50 msec is required if ΔV (signal line amplitude from white display time to black display time) is 5 [V], C=10 pf and I=10 nA. This is longer than one horizontal scanning period (75 μsec) on driving QCIF+size (number of pixels 176×220) at a frame frequency of 60 Hz. Therefore, if the black display is attempted on the pixels under the white display pixels, the switching transistors 11*a* and 11*b* for writing the current to the pixels are closed while the source signal line current is changing. It means that the pixels shine at the luminance in the middle of white and black as a halftone is stored in the pixels.

The lower the gradation is, the smaller the value of I becomes so that it becomes increasingly difficult to draw out the charge of the stray capacitance 451. Therefore, as the gradation display becomes lower, there appears more conspicuously the problem that the signal before changing to the predetermined luminance is written inside the pixels. To put it extremely, the current of the current source 452 is 0 at the black display time, where it is impossible to draw out the charge of the stray capacitance 451 without passing the current.

Figure 47:
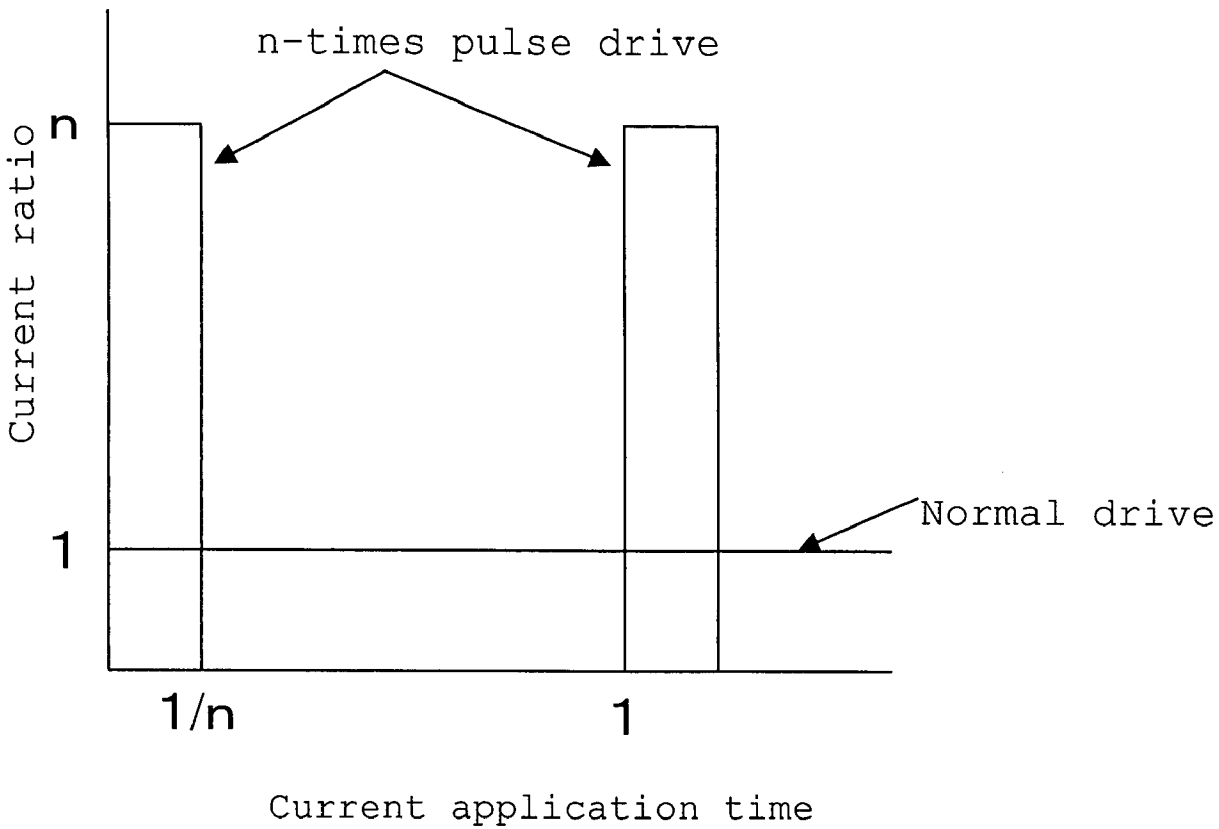
FIG. 47 is a drive waveform diagram of an N-times pulse drive.
Figure 48:
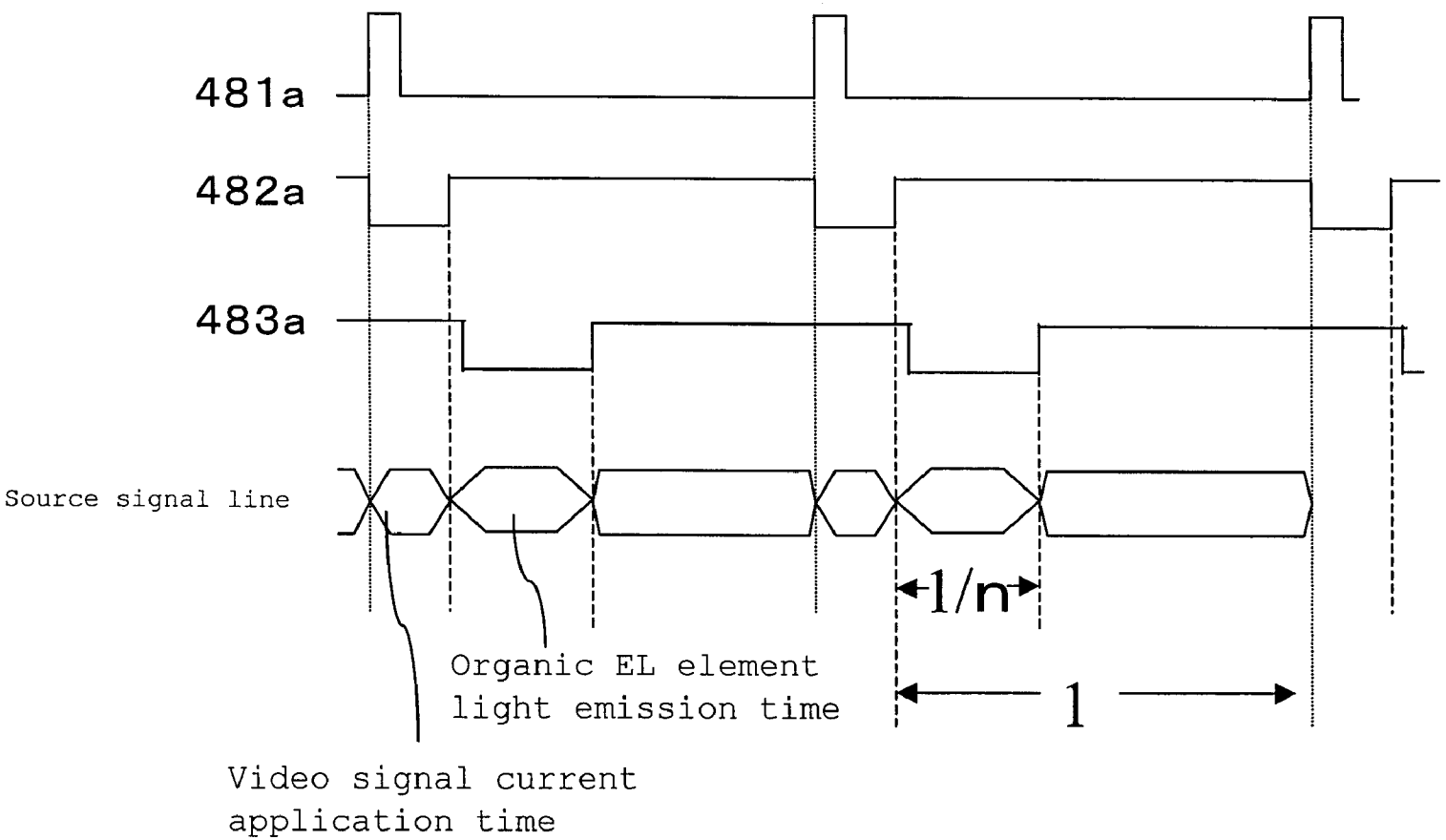
FIG. 48 is a drive waveform diagram of the N-times pulse drive.

To solve this problem, n-times pulse drive of applying a current which is n times a normal one to the source signal line 18 shown in FIG. 47 for 1/n of normal time is used. This driving method allows the current higher than normal to be written so as to reduce the time of writing to the capacitor. If then-times current is passed through the source signal line, the n-times current also passes through the organic EL element. Therefore, a gate control signal is outputted to be 483*a* and conduction time of the TFT 11*d* is set at 1/n so as to apply the current to the EL element 15 only for the period of 1/n without changing an average impressed current.

The time t required for the change in the current value of the source signal line 18 is t=C·V/I if the size of the stray capacitance 451 is C, the voltage of the source signal line 18 is V, and the current passing through the source signal line 18 is I. Therefore, being able to render the current value 10 times larger instrument that the time required for the change in the current value can be reduced to close to one tenth. It also indicates that, even if the stray capacitance 451 of the source line becomes 10 times larger, it can change to the predetermined current value. Therefore, it is effective to increase the current value in order to write the predetermined current value within a short horizontal scanning period.

If an input current is rendered 10 times larger, the output current also becomes 10 times larger so that the luminance of EL becomes 10 times larger to obtain a predetermined luminance. Therefore, the conduction time of the TFT 11*d* of FIG. 1 is set at one tenth of the conventional one and the lighting rate is also set at one tenth so as to display the predetermined luminance.

To be more specific, it is necessary to output a relatively large current from the source signal line 18 in order to sufficiently charge and discharge the stray capacitance (parasitic capacitance) 451 of the source signal line 18 and program the predetermined current value on the TFT 11*a* of the pixels. However, if such a large current is passed through the source signal line 18, this current value is programmed on the pixels so that the current larger than the predetermined current passes through the EL element 15. For instance, if programmed with a 10-times current, the 10-times current naturally passes through the EL element 15 which will then emit light at a 10-times luminance. To set it at a predetermined light emitting luminance, the time of passing through the EL element 15 should be rendered one tenth. It is possible, by thus driving it, to sufficiently charge and discharge the parasitic capacitance of the source signal line 18 and obtain the predetermined light emitting luminance.

The 10-times current value was written to the TFT 11*a* of the pixels (to be exact, terminal voltage of the capacitor 19 is set) and the on time of the EL element 15 was rendered one tenth. However, it is just an example. As the case maybe, it is also possible to write the 10-times current value to the TFT 11*a* of the pixels and render the on time of the EL element 15 one fifth. Inversely, it is also possible to write the 10-times current value to the TFT 11*a* of the pixels and render the on time of the EL element 15 twice.

As it is feasible, by using the N-times drive, to increase the amount of current passing through the source signal line, it is possible to solve the problem that the signal before changing to the predetermined luminance is written inside the pixels. For instance, it is possible, as for the gate signal line 17*b*, to change from a gradation 0 to gradation 1, which change takes the longest time, in 75 μsec or so if a source capacity is 20 pF or so in the case where a conventional conduction period is 1F (when current programming time is 0, normal programming time is 1H, and the number of pixel lines of the EL display apparatus is at least over 100 lines so that error is 1 percent or less even in the case of 1F) and it is N=10. This indicates that the EL display apparatus of 2 inches or so can be driven at the frame frequency of 60 Hz.

In the case where the stray capacitance (source capacitance) 451 is larger on a still larger display apparatus, the source current should be rendered larger by 10 times or more. In the case where a source current value is rendered N times larger, the conduction period of the gate signal line 17*b* (TFT 11*d*) should be 1F/N. It is thereby applicable to the display apparatuses for TV and a monitor. However, the N-times drive renders the current instantaneously passing through the pixels N times larger even if displayed at the same brightness so that a significant burden is placed on the organic EL element.

Figure 49:
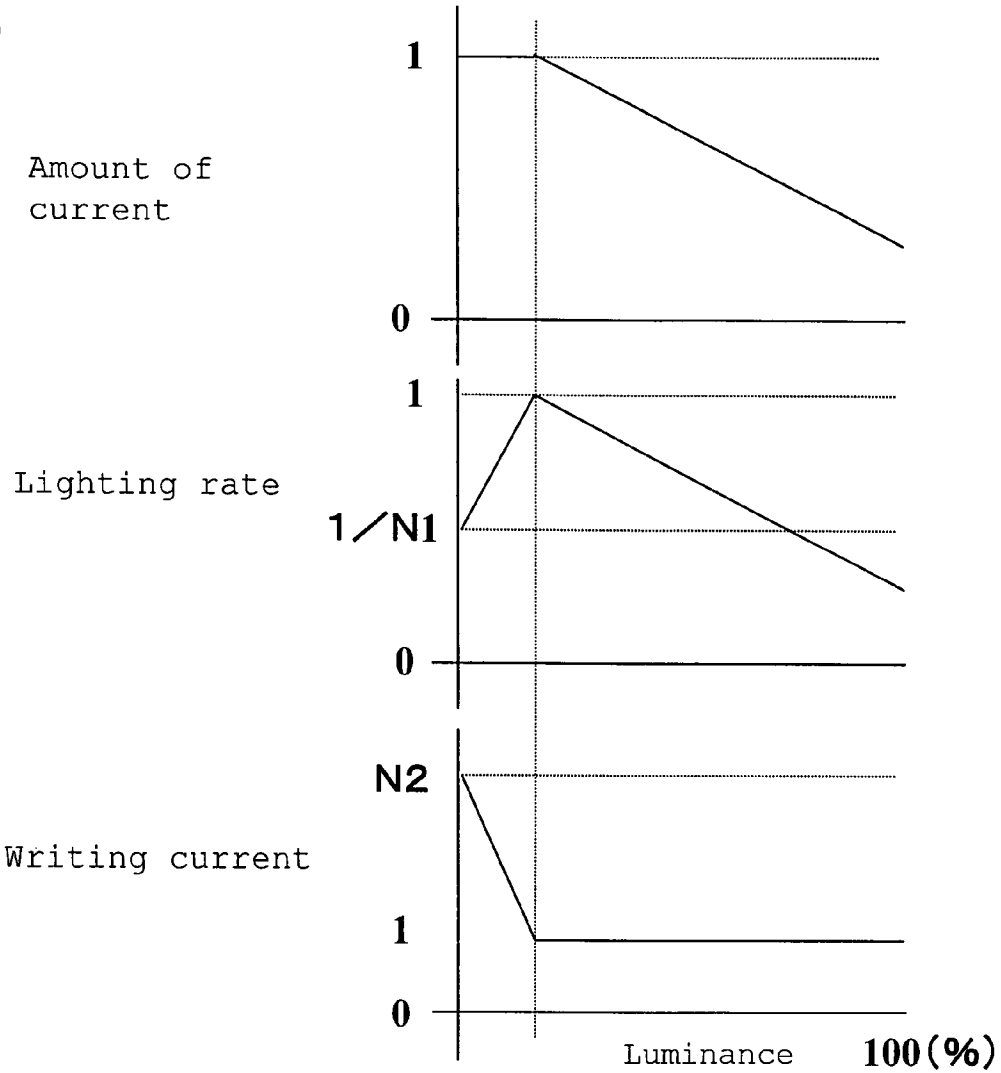
FIG. 49 is a schematic diagram of the N-times pulse drive in a low luminance portion.

Thus, it is proposed to use the driving method of controlling the lighting rate according to the input data of the present invention and thereby control the lighting rate and the amount of current passing through the source signal line 18 in the low luminance portion of a display image so as to perform the N-times pulse drive only in the low luminance portion as shown in FIG. 49. This driving method has a merit that, since the aforementioned problem of shortage of the amount of current hardly arises in a high luminance portion, the N-times pulse drive placing a burden on the EL element 15 is not performed in the high luminance portion but performed only in the low luminance portion having less current passing through the pixels on the whole, and hence it is thereby possible, while reducing the burden on the organic EL element, to solve the aforementioned problem that the signal before changing to the predetermined luminance is written inside the pixels for the stray capacitance 451 of the source signal line.

To be more precise, in the low luminance portion, the lighting rate is set at 1/N1 and the current passing through the source signal line is increased to 2 times N so that a total amount of current becomes a target value. In this case, it does not have to be N1=N2. There are also the cases of N1≦N2 and the cases of N1≧N2 as a matter of course. However, it is N2>1 since the object of this drive is to increase the amount of current passing through the source signal line 18. And the lighting rate does not always have to be decreased. There are also the cases where the lighting rate is not changed or the increase in the lighting rate is suppressed depending on the relation of the amount of current passing through the organic EL panel to the input data being sought.

Figure 50:
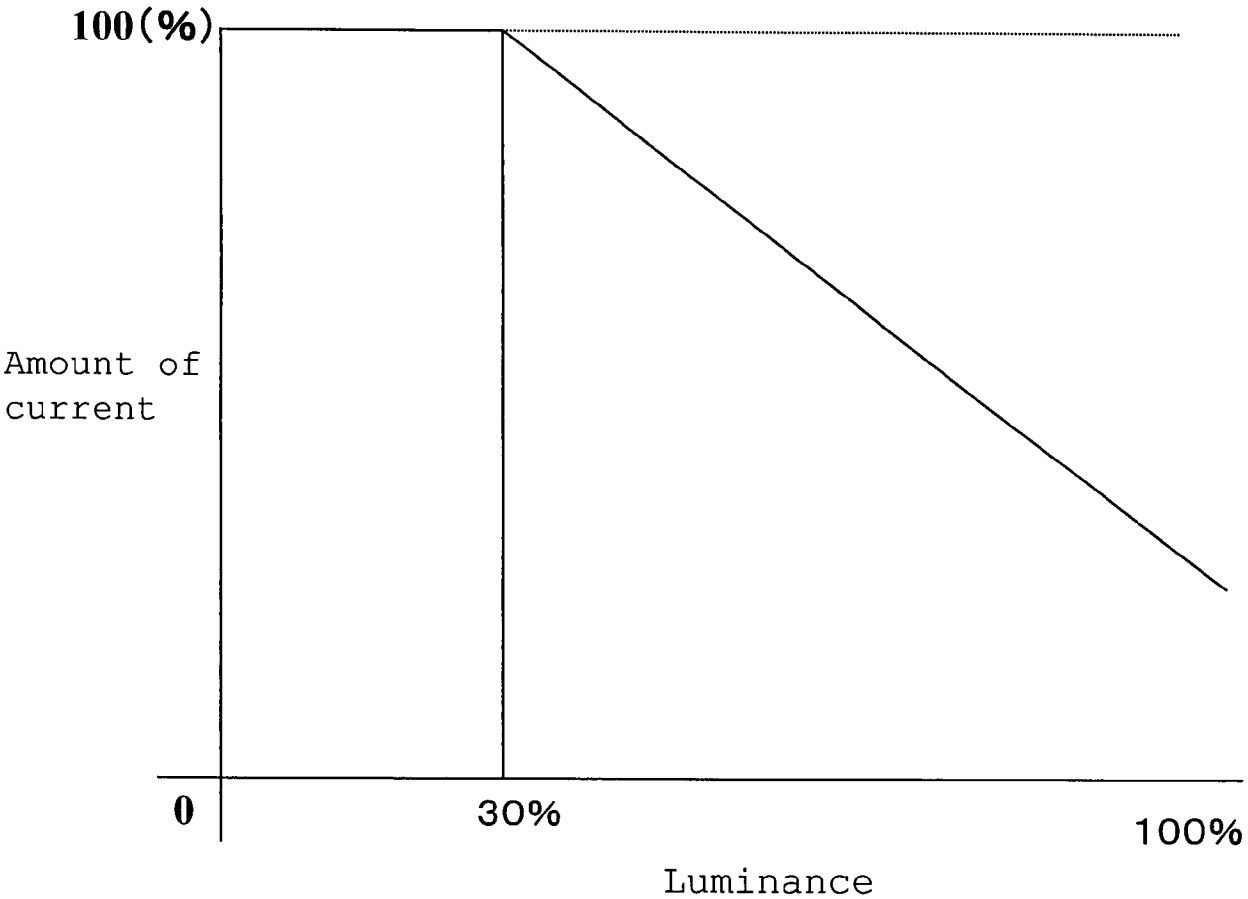
FIG. 50 is a schematic diagram of the drive of the present invention.
Figure 51:
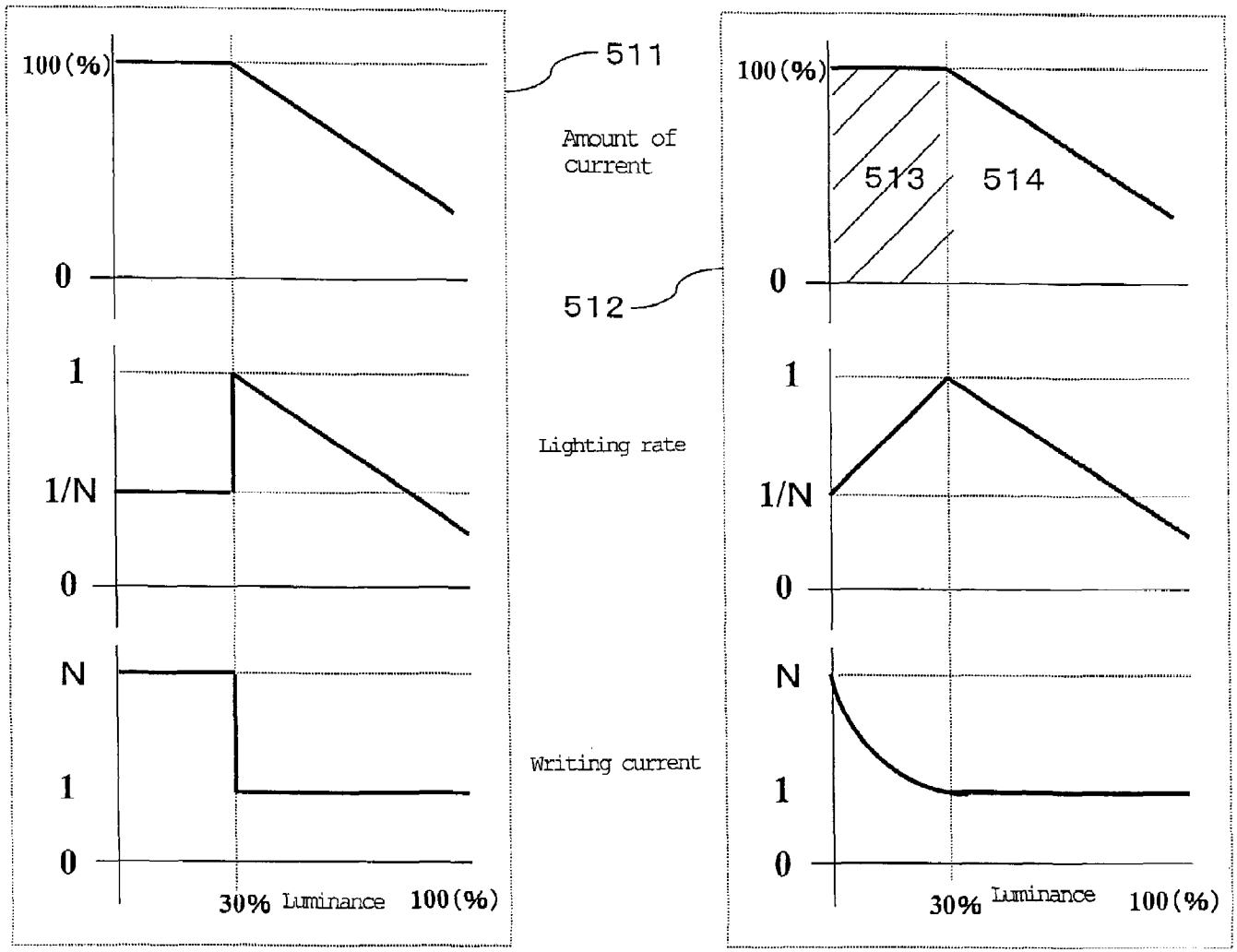
FIG. 51 are schematic diagrams of the N-times pulse drive in the low luminance portion.

Consideration is given to a drive wherein, as to the relation between the input data and the lighting rate by way of experiment, the lighting rate is maximized in the area of less than 30-percent input data while the lighting rate is reduced in the area of 30-percent or higher input data so as not to have the limit capacity of the battery 241 exceeded by the amount of current passing through the organic EL panel as in FIG. 50. And the N-times pulse drive is performed in the area of less than 30-percent input data on the aforementioned driving.

To be more specific, in the case where the amount of current eciuivalent to displaying white is represented as 100, and if a gradation of a low-current region having the predetermined amount of current represented as 30 or less is given a positive number which is N1>1, N2>0 and N1≦N2 as a coefficient, W as the predetermined amount of current, I org as a current value at the time, and T org as a light emitting period, the amount of current satisfying the current value of I org×N1 and the light emitting period of T org×1/N2 is applied instead of the predetermined amount of current. However, a switching point between the N-times pulse and a normal drive is not fixed at 30 percent. Considering duration of life, however, it is desirable to have the switching point with the N-times pulse in the area of 30-percent or less.

Here, two proposals are made as to the method of performing the N-times pulse drive. Firstly, there is a method of rendering the lighting rate 1/N in the area of less than 30-percent input data and rendering the amount of current passing through the source signal line N times larger as in 511. Secondly, there is a method of gradually reducing the lighting rate in the state of 30 percent to 0 percent of the input data and inversely, gradually increasing the amount of current passing through the source signal line as in 512. In both cases, the amount of current passing through the organic EL panel is in the relation shown in FIG. 50. As for the first method, both the lighting rate and current value may be fixed in the status of less than 30 percent of the input data, and so there is a merit that it is very easy to create the circuitry. However, the lighting rate and current value change significantly at a boundary of 30 percent of the input data, and so there is a problem that the flicker is seen at the moment of the change.

The second method has a demerit that it is complicated to create the circuitry because the lighting rate and current value must be simultaneously operated in the state of less than 30 percent of the input data. According to this method, however, it is possible to change the lighting rate and current value moderately so as to have no problem of the flicker. Furthermore, the smaller the amount of current passing through the source signal line is, the more conspicuous the problem that the signal before changing to the predetermined luminance is written inside the pixels becomes as previously indicated. Therefore, the method of increasing the amount of current passing through the source signal line as the input data decreases makes sense, and the burden on the organic EL element is also reduced. This method has implemented the driving method of reducing the burden on the organic EL element as much as possible and solving the problem that the signal before changing to the predetermined luminance is written inside the pixels.

Figure 64:
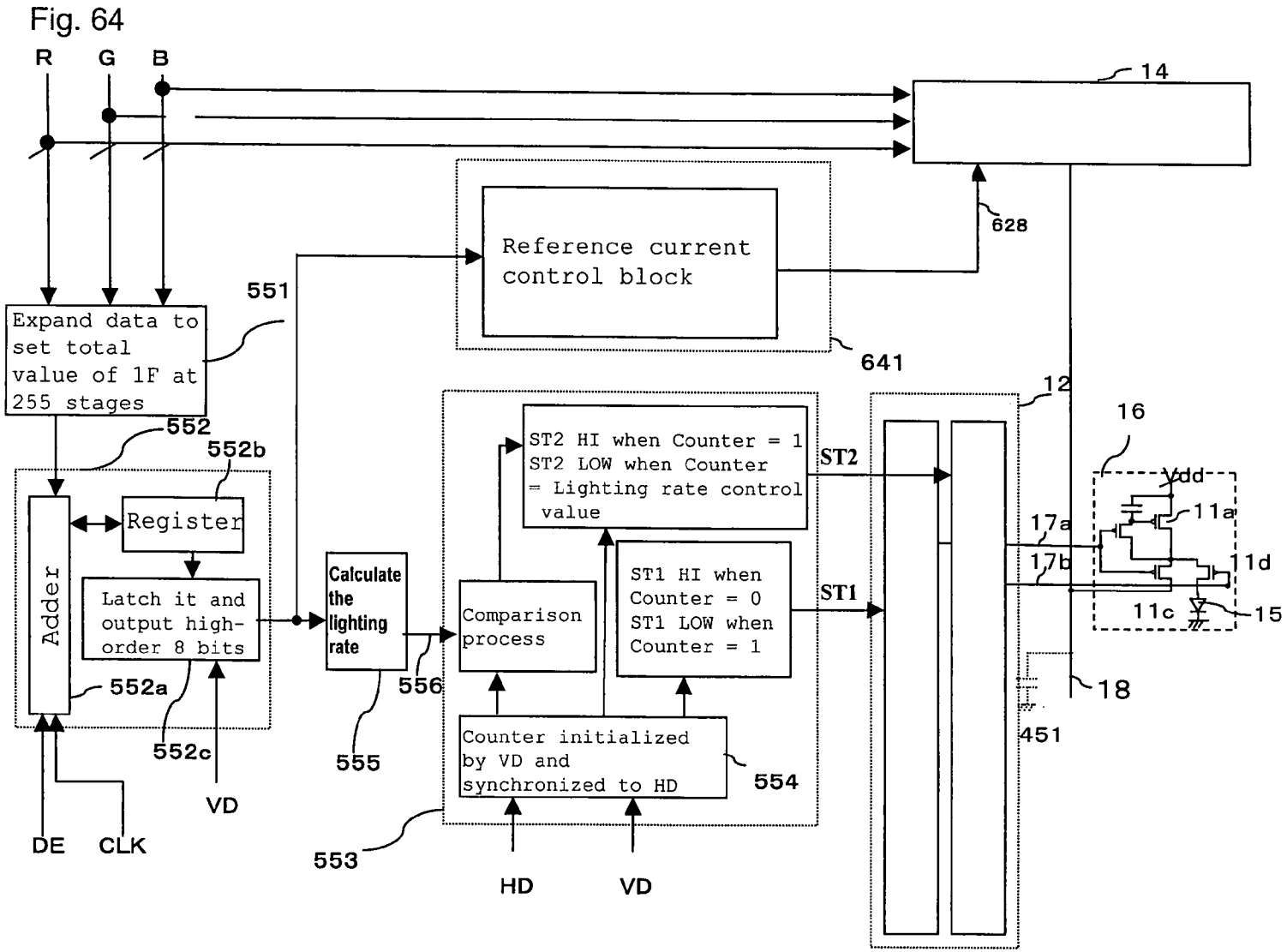
FIG. 64 is a circuit block diagram of a driving method of performing the N-times pulse drive in the low luminance portion.

The circuit configuration of this drive will be described by referring to FIG. 64. The video data added in 552 is inputted to a reference current control module 641. The reference current control module 641 controls the source driver 14 so as to increase or decrease the amount of current passing through the source signal line 18 according to the inputted data.

Figure 62:
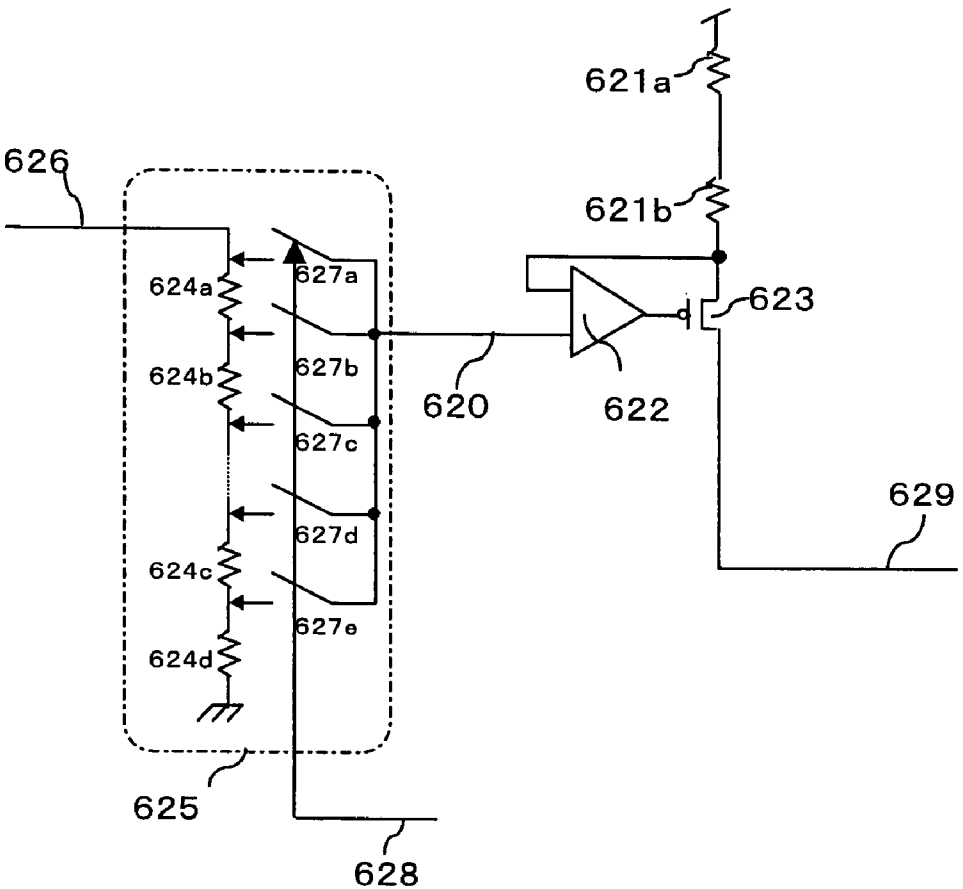
FIG. 62 is a block diagram of a source driver.
Figure 63:
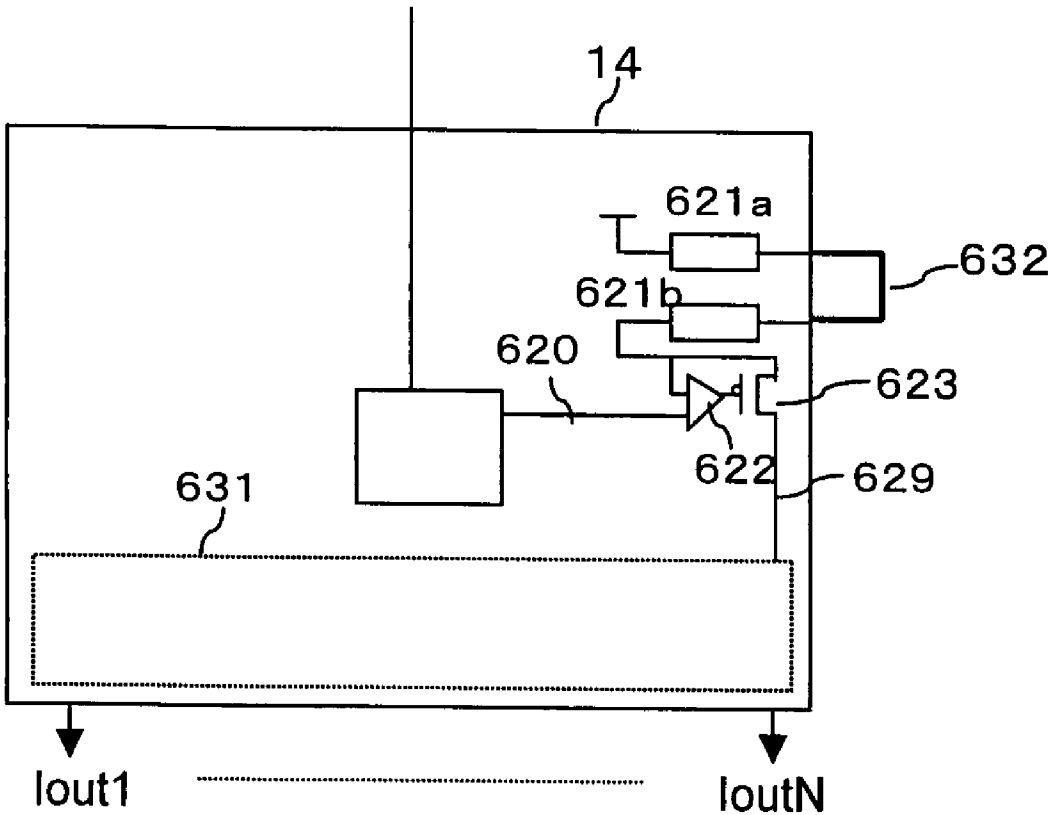
FIG. 63 is a block diagram of the source driver.

The source driver 14 will be described by referring to FIGS. 62 and 63. As shown in FIG. 63, the source driver 14 passes the current through the source signal line 18 according to a reference current 629. To further describe the reference current 629, the reference current 629 is determined by a potential of a nodal point 620 and a resistance value of a resistance element 621 in FIG. 62. Furthermore, the potential of the nodal point 620 can be changed by means of a control data signal line 628 by a voltage adjustment portion 625. To be more specific, it is possible, by controlling the control data signal line 628 with 641, to change it within the range determined by the resistance value of the resistance element 621.

Figure 65:
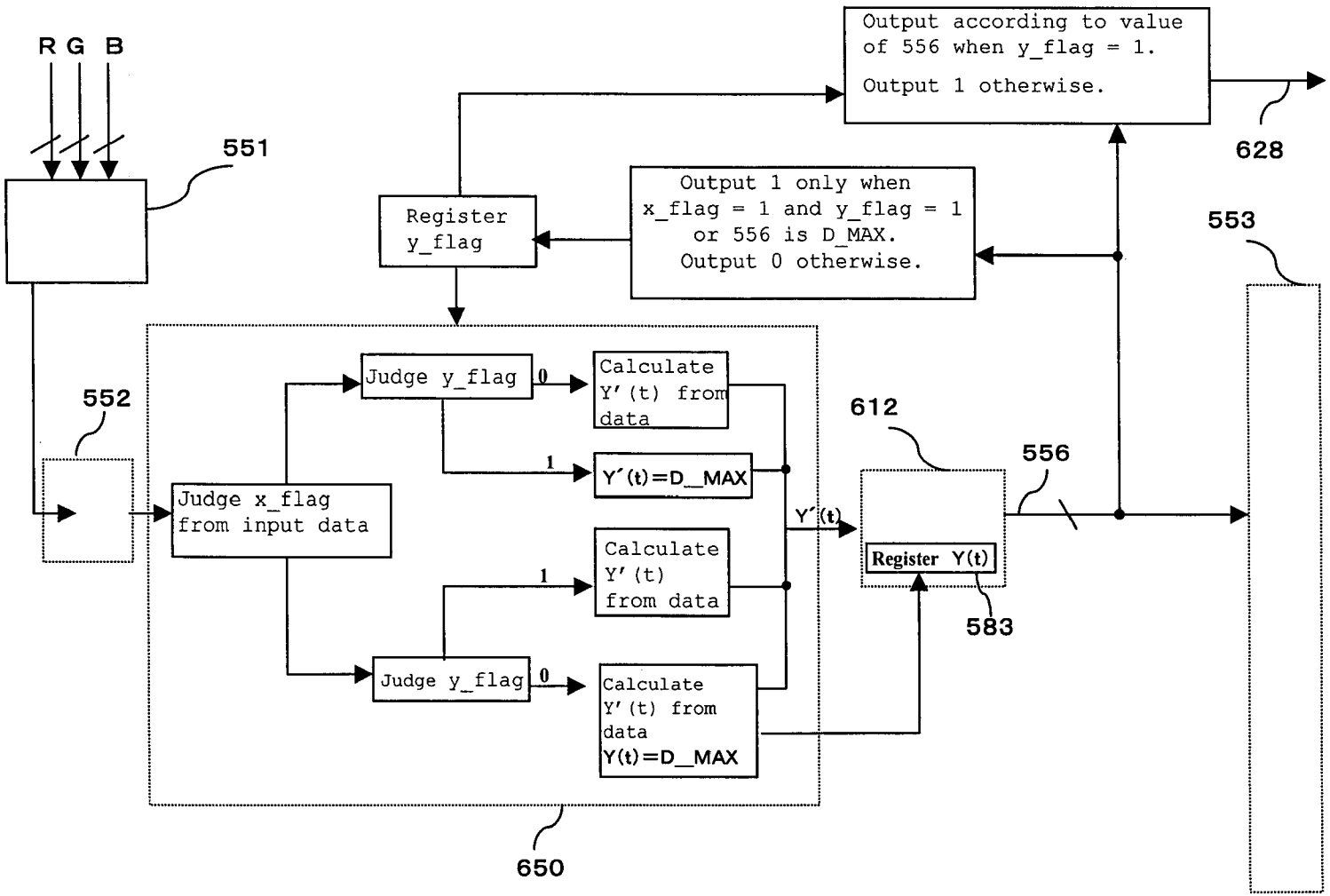
FIG. 65 is a circuit block diagram of the driving method of performing the N-times pulse drive in the low luminance portion.

FIG. 65 shows the circuit configuration having the driving method added to the circuit configuration of FIG. 61 as an example of application of the driving method. In the case where the relation among the input data, lighting rate and reference current value is as in 512, an area 513 of changing the reference current and an area 514 of not changing it are differentiated. It is configured so that x_flag of FIG. 65 becomes 1 in the case where the input data is in the area of 513, and becomes 0 in the case of the area of 514. Likewise, y_flag becomes 1 in the case where a lighting rate Y(t) of that frame is in 513, and becomes 0 in the case of 514. To be more specific, in the case where y_flag is 1, it becomes the area of changing the reference current, and changes the control data signal line 628 of the reference current according to the data of 556 when y_flag is 1 in 651. The inside of 650 is configured by combination of y_flag and x_flag. When both y_flag and x_flag are 0, both are in the area of 514, and so Y'(t) should be designed with the same sequence as 555. Likewise, when both y_flag and x_flag are 1, they move in the area of 513 and so the reference current changes. As for calculation of the lighting rate, however, the same sequence as 555 may be used. When y_flag and x_flag are (0, 1) or (1, 0), it is a status of moving from the area of 513 to the area of 514 (or vice versa). In the area of 513, both the lighting rate and reference current value change while moving to be always constant if multiplied. To be more specific, the lighting rate in 514 is the same as a maximum status (defined as D_MAX). Thus, Y'(t) is D_MAX in the status in which y_flag is 0 and x_flag is 1, that is, when moving from the area of 514 to the area of 513. Inversely, it moves from D_MAX to Y'(t) led by 555 in the status in which y_flag is 1 and x_flag is 0, that is, when moving from the area of 513 to the area of 514. It is possible, by considering as above, to input D_MAX to the register 583 holding Y(t) and design Y'(t) with the same sequence as 555 so as to implement the change in the lighting rate with no uncomfortable feeling.

A description will be given as to a circuit configuration to be used in combination with the method of drawing a curve of the lighting rate as in FIG. 30. This driving method allows the circuit scale to be reduced by using it in combination with the method of drawing a curve of the lighting rate as in FIG. 30.

Figure 130:
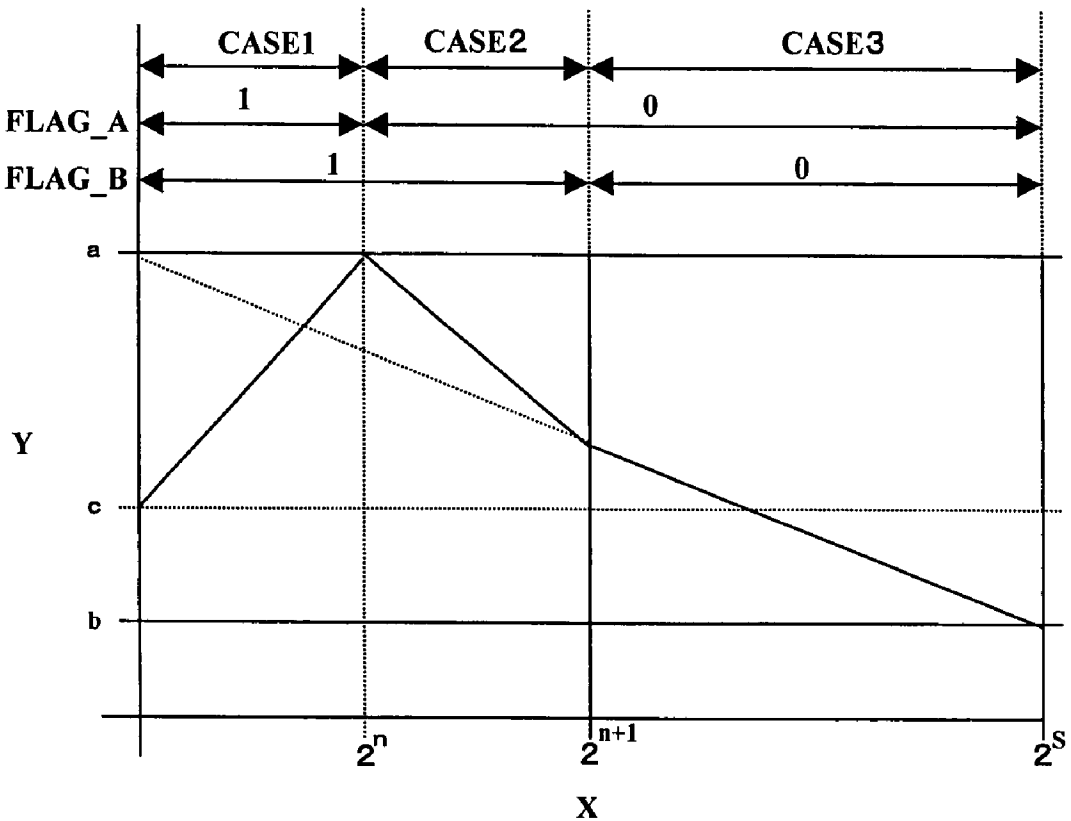
Figure 131:
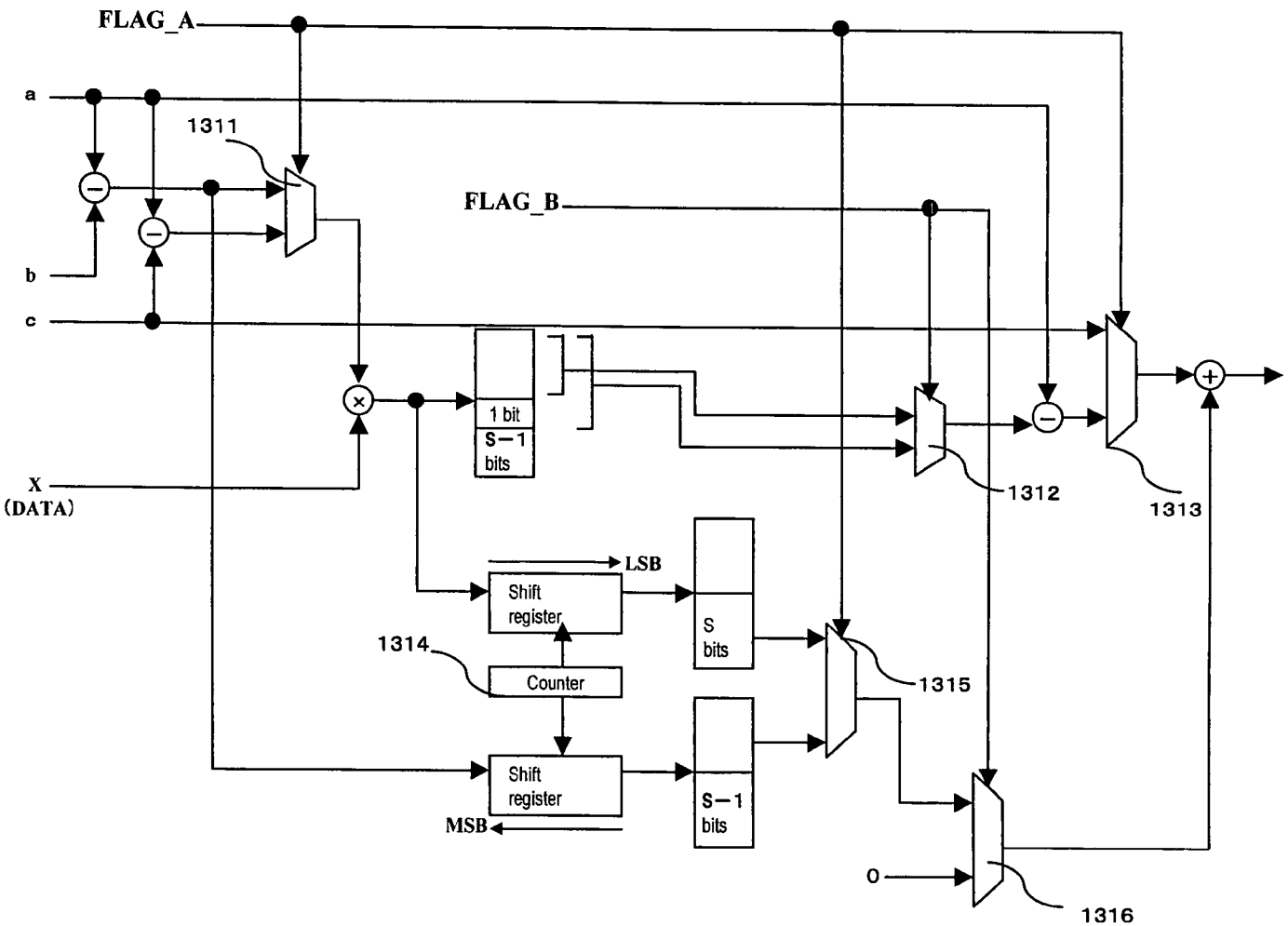

As shown in FIG. 130, the input data is divided by 2 raised to S-th power, and the N-times current value and 1/N lighting rate driving is performed up to the input data of 2 raised to n-th power. A maximum lighting rate value is a, a minimum lighting rate value of normal lighting rate suppression driving is b, and a minimum lighting rate value of the N-times current value and 1/N lighting rate driving is c. And the input data is 0, that is, the minimum value to 2 raised to n-th power is CASE 1, 2 raised to n-th power to 2 raised to (n+1)-th power is CASE 2, and 2 raised to (n+1) -th power to 2 raised to S-th power, that is, the maximum value is CASE 3. FLAG_A of becoming 1 only in CASE 1 and FLAG_B of becoming 0 only in CASE 3 are prepared. It is thereby possible to represent CASE 1 as (FLAG_A, FLAG_B)=(1, 1), CASE 2 as (FLAG_A, FLAG_B)=(0, 1) and CASE 3 as (FLAG_A, FLAG_B)=(0, 0). Subsequently, FIG. 131 shows the circuit configuration of implementing this driving. The values of FLAG_A and FLAG_B can be determined by shifting the input data with the shift register and inputting it to a comparator. If the data shifted by n bits is 0, FLAG_A is 1 and anything else is 0. If the data further shifted by 1 bit (n+1 bits in total) is 0, FLAG_B is 1 and anything else is 0. 0 and 1 of FLAG_A and FLAG_B may be reversed. These two flags are used to create a circuit meeting CASES 1 to 3.

Three formulas are represented as follows if the lighting rate is Y and the data is X (2 raised to S-th power at the maximum).

$$Y=((a-c)/2^n)\cdot X+c \qquad \text{CASE 1}$$

$$Y=a-2\cdot((a-b)/2^s)\cdot X+2^n\cdot((a-b)/2^{(s-1)}) \qquad \text{CASE 2}$$

$$Y=a-((a-b)/2^s)\cdot X \qquad \text{CASE 3}$$

To implement the three, the calculation should be performed in each case. It is desirable, however, to reduce the number of times of performing the calculation because arithmetic processing in the circuit configuration extends the circuit scale. In particular, multiplication processing places a great burden on the circuit scale. For that reason, the circuit configuration with a little load is implemented by using a lot of selector circuits and shift registers.

First, a−b and a−c are performed respectively. The values are processed by a selector 1311. As a−c is performed only in CASE 1 from the above formulas, a−c is outputted when FLAG_A is 1, and a−b is outputted when it is 0. The output value of the selector 1311 and input data X are calculated. Thus, the value of (a−b)·X and the value of (a−c)·X are completed. As the inclination is twice larger in CASE 2 and CASE 3, the as-is output value of the selector 1311 and a doubled value thereof are selected by a selector 13212 according to the value of FLAG_B. As for the method of doubling in this case, the output value of the selector 1311 should be shifted to the MSB side by 1 bit. As both are divided by $2^S$, it is also possible, without using the shift register, to have the output value of the selector 1311 of which low-order S bits are cut and that of which low-order S−1 bits are cut processed by a selector 1312. A subtraction result of a and the output of the selector 1312 matches with the value of Y of CASE 3. CASE 2 is this calculation result having $2^n\cdot((a-b)/2^{(S-1)})$ added thereto. And CASE 1 may be considered as $((a-c)/2^n)\cdot X$ added to c. Therefore, this output value and the value of c are processed by a selector 1313 selected by FLAG_A, and it is thereby possible to acquire the lighting rate by selecting the value to be added to the selector 1313. $2^n\cdot((a-b)/2^{(S-1)})$ is $((a-b)/2^{(S-1)})$ shifted to the MSB side by n bits. $((a-c)/2^n)\cdot X$ is (a−c)·X, that is, a calculation value of the output of the selector 1311 and the input data X shifted to the LSB side by n bits. As both are shifted by n bits, the shift can be completed just by one counter 1314. $2^n\cdot((a-b)/2^{(S-1)})$ is outputted by cutting low-order S−1 bits after shifting the value of a−b to the MSB side by n bits. The two outputs are processed by a selector 1315. As this selector is the selector of CASE 1 and CASE 2, FLAG_A is used. As for CASE 3, it is not necessary to add this output, and so it is processed by a selector 1316 with FLAG_B and 0 is outputted in the case of CASE 3. Thus, it is possible to calculate the lighting rates of all the CASES by means of minimum calculation and selectors. This method requires a half or smaller circuit scale compared to the case of separately calculating CASES 1 to 3 so that it is very effective in implementing this mechanism.

In general, a gamma curve is used for the images. The gamma curve is image processing in which the low gradation portions are suppressed and a feeling of contrast is thereby given as a whole. If the low gradation portions are suppressed by the gamma curve, however, the image having a lot of low gradation portions is blacked out and becomes an image providing no depth feel. Nevertheless, the image having a lot of high gradation portions will become an image having no feeling of contrast unless the gamma curve is used.

In the case where the display area has a lot of low gradation display on performing the lighting rate control drive of the present invention, the lighting rate is increased to render the entire area brighter. In this case, if the low gradation portions are blacked out by the gamma curve, the difference in the brightness between the displayed pixels and the pixels not displayed becomes significant so that there is a possibility of becoming the image with less depth. In the case where the display area has a lot of high gradation display, the lighting rate is decreased so that the difference in the brightness between the display pixels and nondisplay pixels becomes smaller. For that reason, it will be the image having no feeling of contrast unless blacked out by the gamma curve.

Thus, a proposal is made as to a driving method of controlling the gamma curve by changing the display area in conjunction with a current amount control drive of the present invention.

Figure 67:
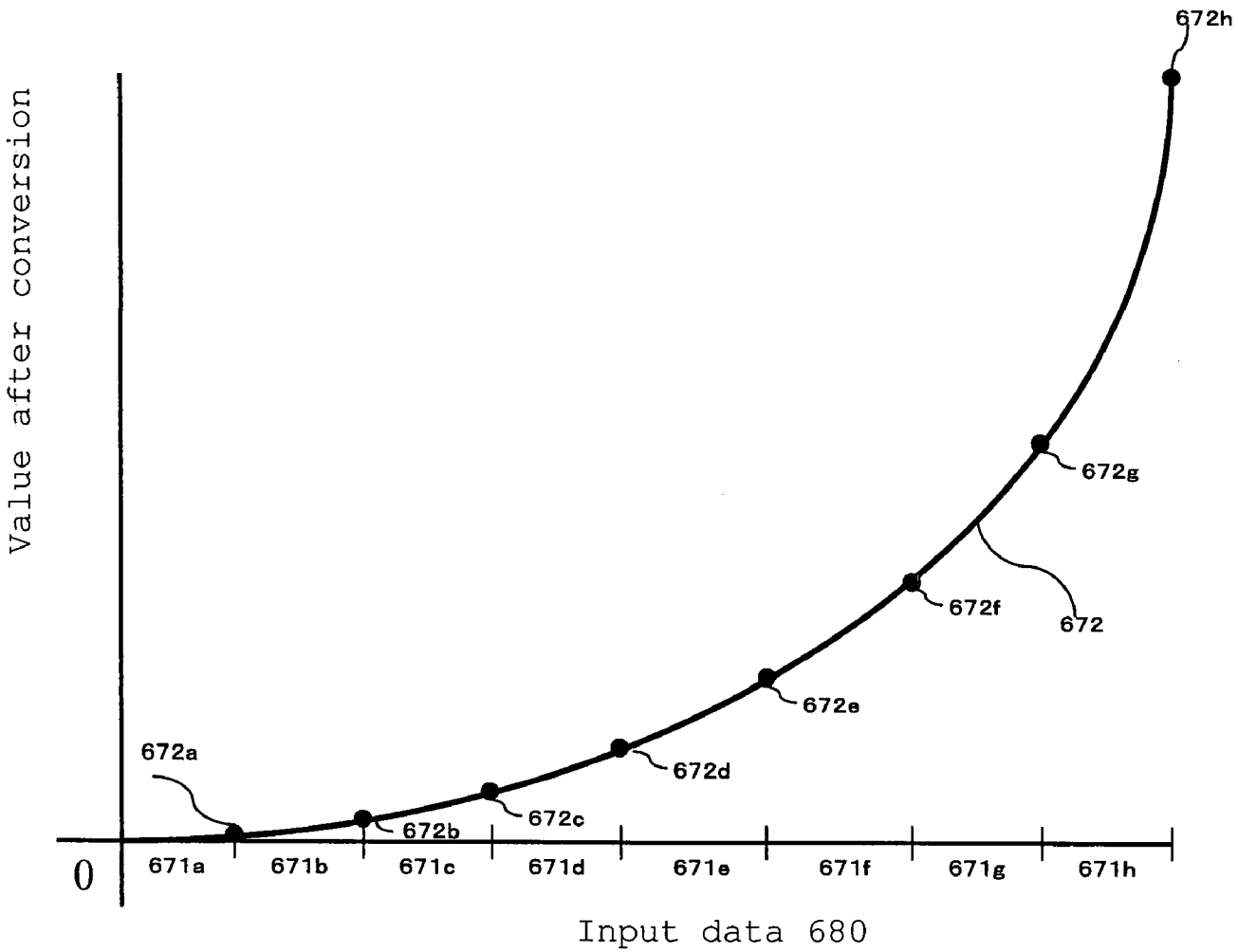
FIG. 67 is a schematic diagram of the gamma curve.
Figure 68:
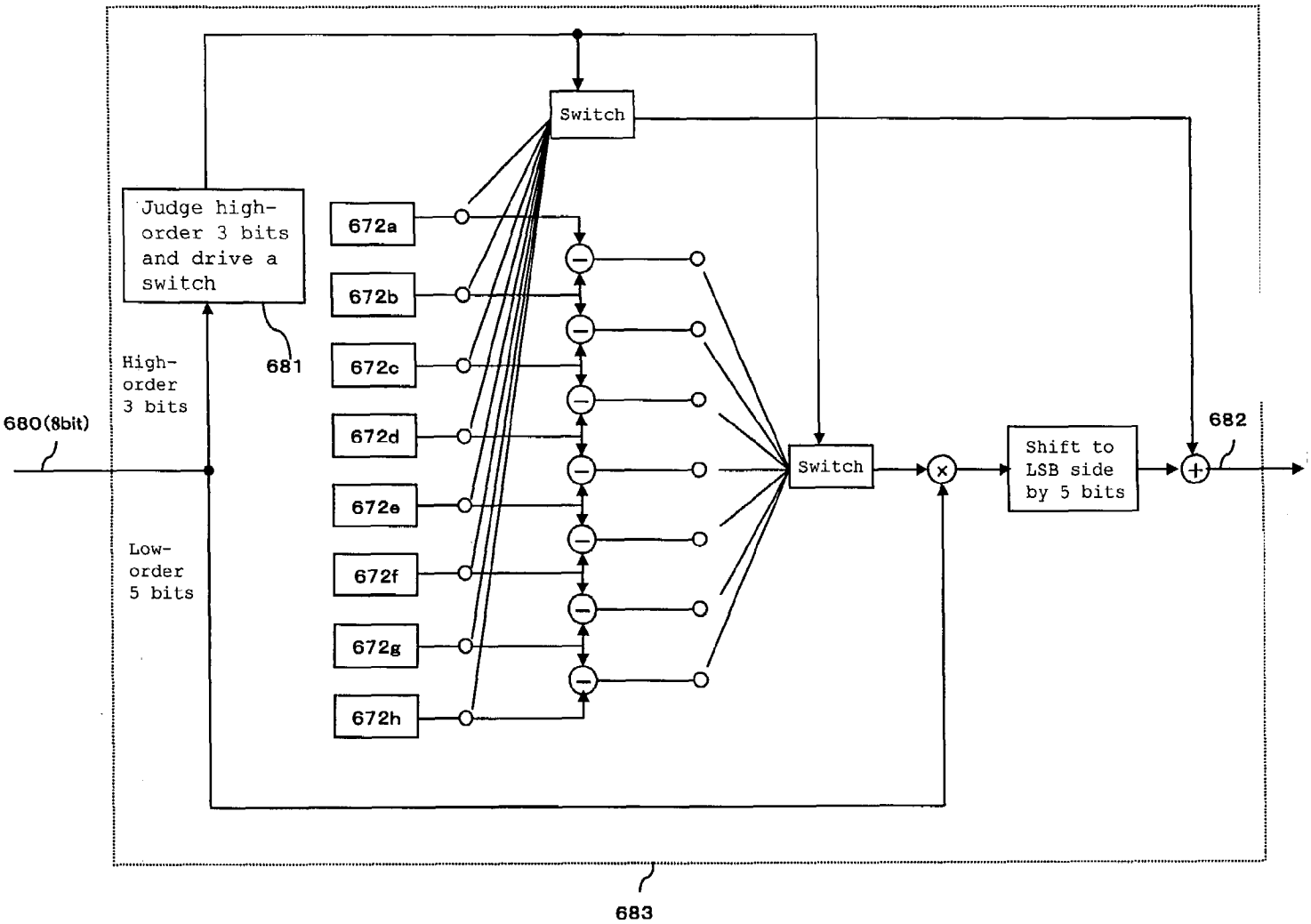
FIG. 68 is a circuit block diagram of the gamma curve.

A circuit configuration of implementing a γ curve will be described by referring to FIGS. 67 and 68. Inputted color data is taken as a horizontal axis of a graph and is divided by 2 raised to n-th power. FIG. 67 has it divided into eight, where they are 671*a*, 671*b* . . . 671*f* respectively. And the values 672*a* to f of the γ curves corresponding to the boundaries of 671*a* to f are inputted. In FIG. 68, the inputted color data is processed on the assumption that it is 8 bits. First, high-order 3 bits of input data 680 are determined in 681. As the gamma curve is divided into eight (divided into the cube of 2), it is possible, with the values of the high-order 3 bits of 680, to determine which area of 671*a* to f the input data 680 is located in. It is assumed that 680 is in the area of 671*c*. In the area of 671*c*, the value of the gamma curve is 672*b* at the minimum and 672*c* at the maximum, where one section is divided into 32 stages since the input data of 256 stages is divided into eight. Therefore, inclination of the graph at 671*c* is (672*b*−672*c*)/32. It is equal to the value of low-order 5 bits of 680 as to where in the area of 671*c* the input data exists. Therefore, an increase in 671*c* is the value of (low-order 5 bits of 680)×(672*b*−672*c*) shifted to the LSB side by 5 bits (divided by 32). To be more specific, if the value of 672*b* is added to the above, it becomes an output value 682 which is the input data 680 converted by the gamma curve.

Figure 66:
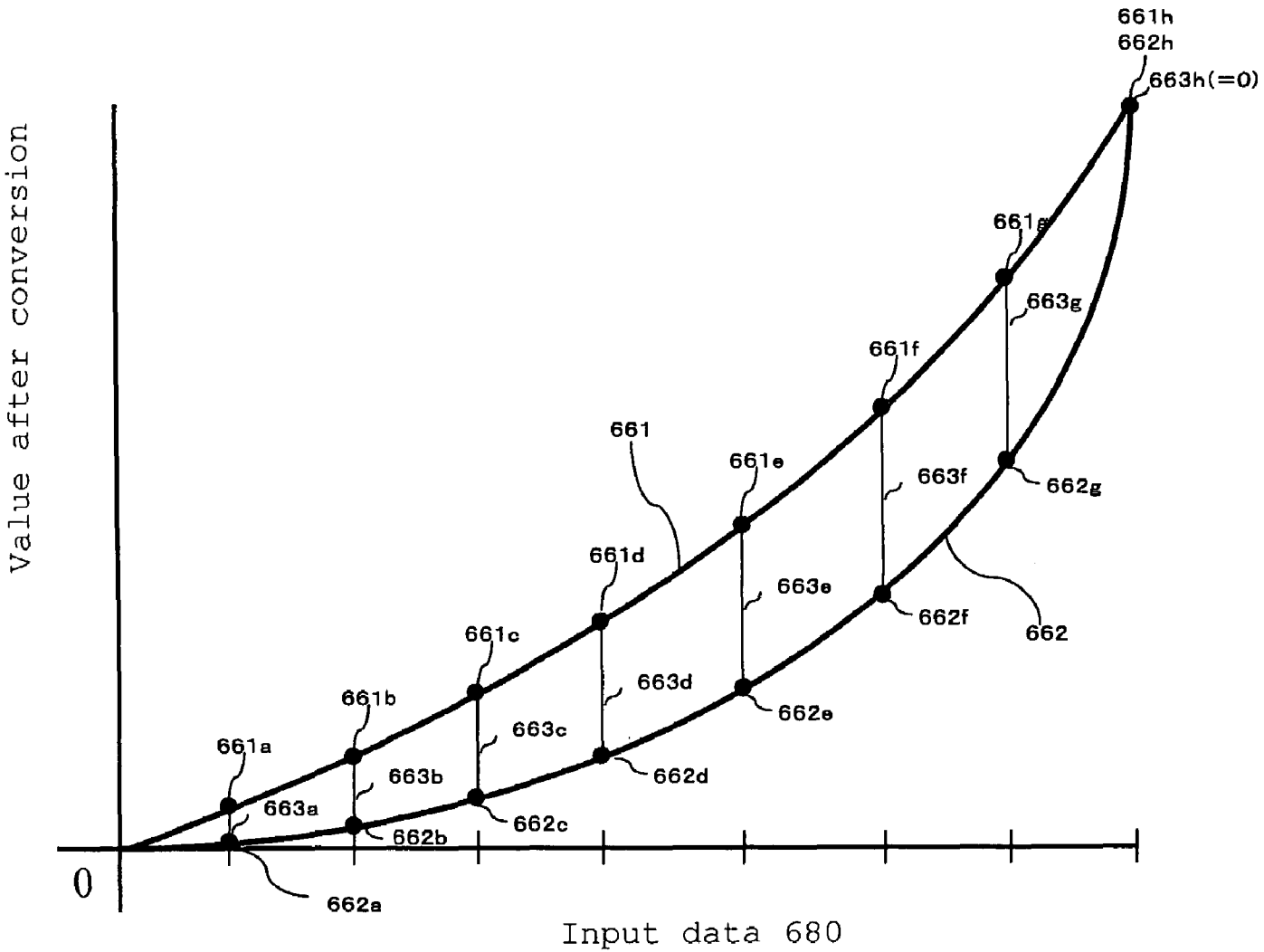
FIG. 66 is a schematic diagram of a gamma curve.
Figure 69:
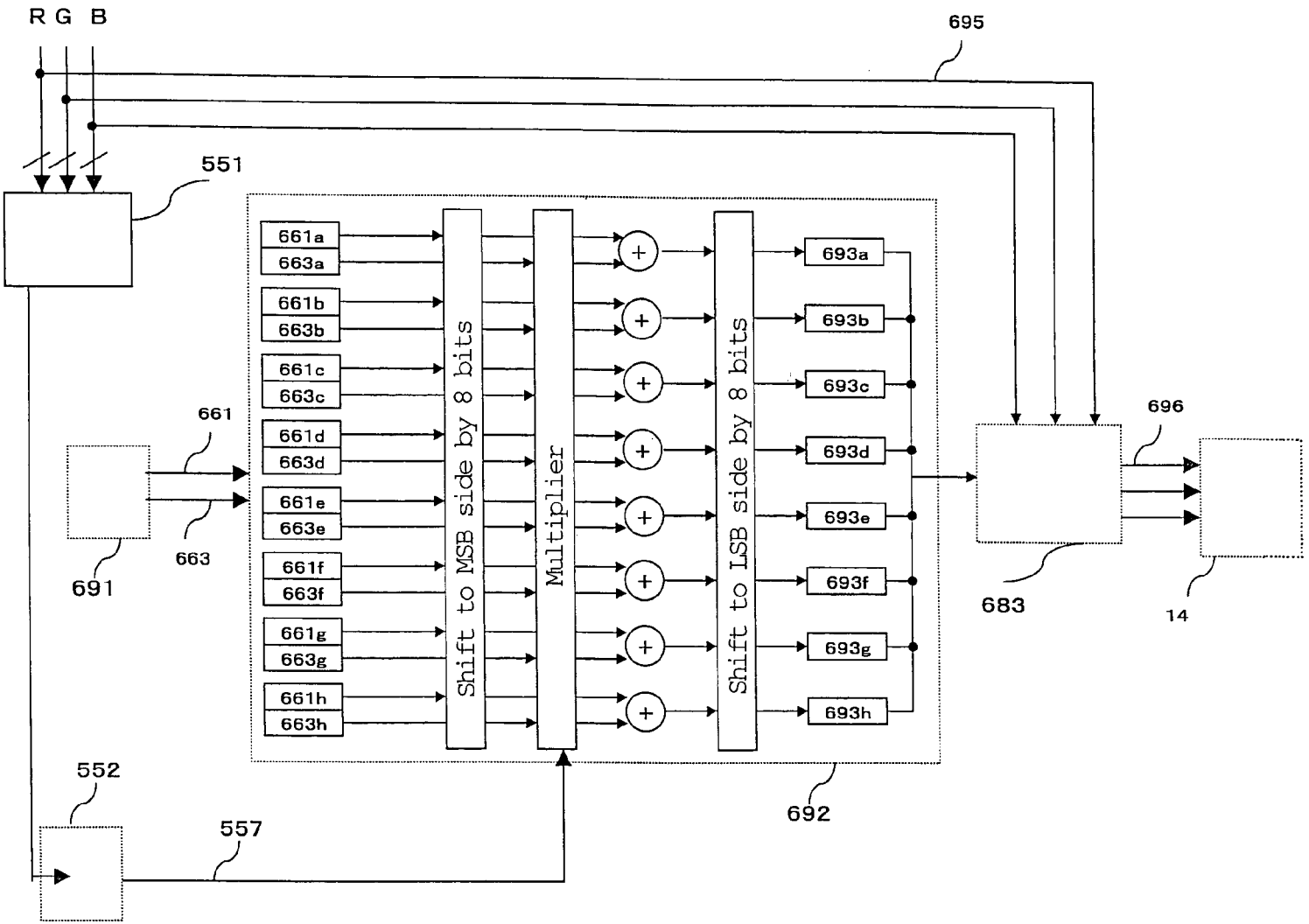
FIG. 69 is a circuit block diagram of the present invention.

Subsequently, a description will be given by referring to FIGS. 66 and 69 as to a circuit configuration of adjusting the γ curves according to the display state by using data 557 indicating the display state of the organic EL panel created in 552. First, in 691, the values of 661*a* to 661*h* and 662*a* to 662*h* are determined in order to create two kinds of γ curves. Here, 661≧662 holds. As the γ curves are different depending on the device to be used, these values should be settable from outside. And 663*a* to f as differences between 661*a* to f and 662*a* to f are taken. Thereafter, 661*a* to f and 663*a* to f are outputted from 691 to 692. 557 which is the data on the display state outputted from 552 is also inputted to 692. In 692, the value of the gamma curve is determined according to 557. The larger 557 is, the more high gradation portions the image has, and so it is necessary to sharpen the gamma curve so as to render the image lively. And the smaller 557 is, the more low gradation portions the image has, and so it is necessary to render the gamma curve gentler so as to give the image a depth feel. As 557 is the data of 0 to 255, gamma data 693*a* to f corresponding to 557 is created by calculation of (data on 661*a* to f)−{(data on 663*a* to f)×(data of 557/255)}. The gamma data 693*a* to f is inputted to 683. As described in FIG. 68, 683 is a module to which the data converted by the gamma curve created from the inputted color data 680 based on the data on 672*a* to f is outputted. The data 693*a* to f is inputted to 672*a* to f, and inputted data 695 on RGB is converted by the gamma curve created by 693*a* to f so as to be inputted as an output 696 to the source driver 14.

The above description takes the method of subtracting the data corresponding to 557 from a gentle gamma curve 661. As a matter of course, it is also possible to adopt the method of adding the data corresponding to 557 from a sharp gamma curve 662.

The gamma curves are not limited to those created from two kinds. It is also possible to use a structure of creating the gamma curve suited to the displayed video from multiple gamma curves.

As with the change in the lighting rate, the change in the gamma curve also has the problem that the flicker is seen if frequently changed. Thus, just as the change in the lighting rate is delayed by 612, it is very effective to have the speed of change of 557 slowed down by 612.

While RGB is processed like wise by 694 in the drawings, it is also possible to process RGB separately so as to create individual gamma curves of RGB.

According to the above driving, it is possible to perform the driving of providing the depth feel by slackening the gamma curve in the case where the display area has a lot of low gradation portions and providing the feeling of contrast by sharpening the gamma curves in the case where it has a lot of high gradation portions.

Figure 129:
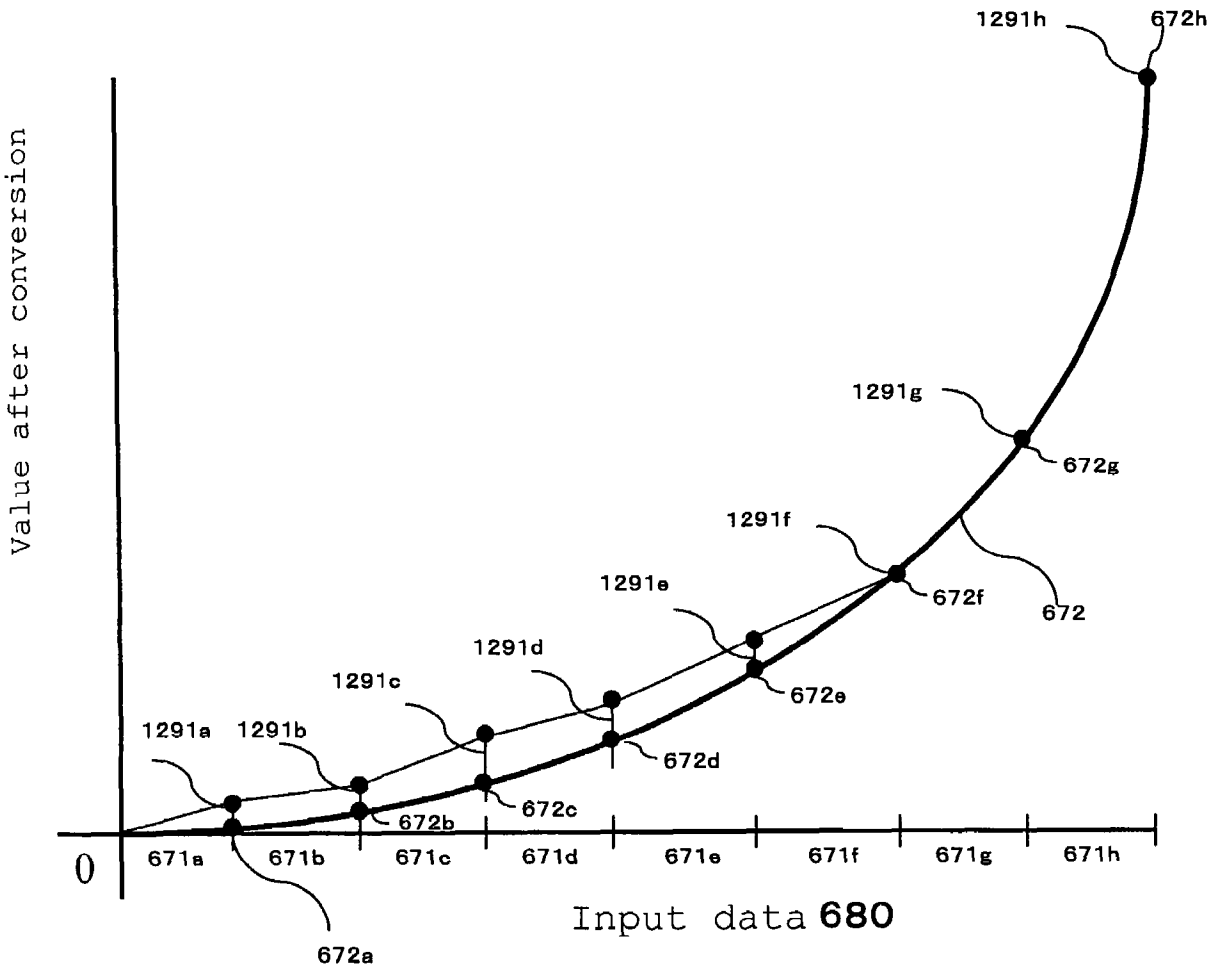

It is also possible to create the gamma curves separately for RGB by adding correction values 1291*a* to 1291*f* for each of RGB to the gamma curve 672 created as shown in FIG. 129 as instrument which creates the gamma curves separately for RGB. This method requires only one kind of complicated gamma curve calculation, which can be implemented without extending the circuit scale.

As the organic EL element 15 deteriorates, there are the cases where, if a fixed pattern is continuously displayed, only the organic EL elements 15 of certain pixels deteriorate and the displayed pattern burns. To prevent burn-in, it is necessary to determine whether or not the displayed video is a still image.

As for the methods of determining the still image, there is a method of having the frame memory built in and storing all the data of 1F period in the frame memory so as to judge whether or not the video data is correct with the next frame and judge whether or not it is the still image. This method has an advantage of securely recognizing differences in the video data. However, the circuit scale becomes very large because the frame memory must be built in.

Figure 71:
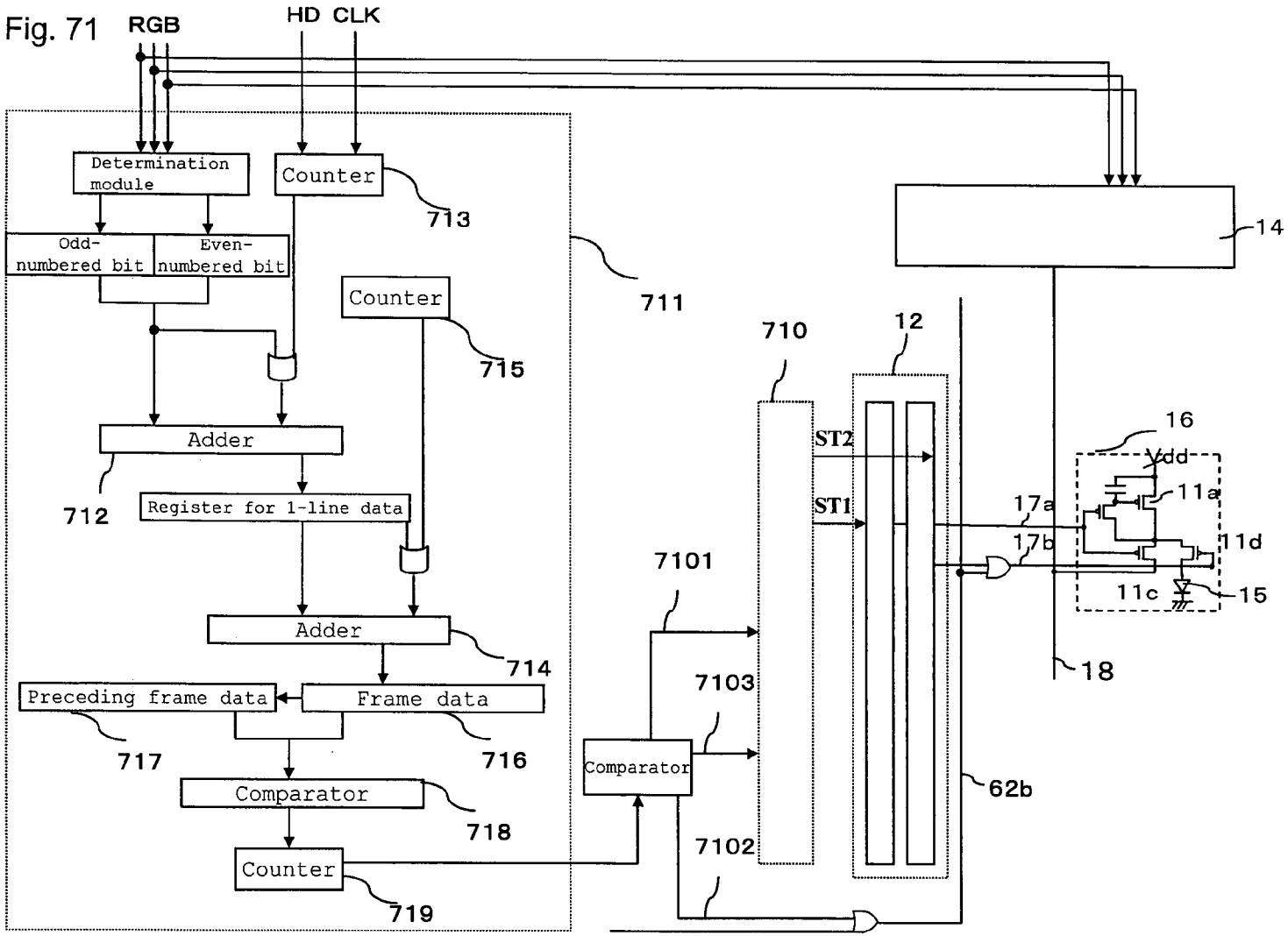
FIG. 71 is a circuit block diagram of the present invention.

Thus, a proposal is made as to a method of judging whether or not it is the still image without using the frame memory as shown in FIG. 71. As the method of judgment, there is a method of judging it with a total value having added the data on all the pixels in the 1F period. In the case where the video remains unchanged, the video data also remains unchanged so that a total amount of the data remains unchanged. For that reason, it is possible to detect whether or not it is the still image by adding and comparing all the data in 1F. This method can be implemented with the circuit scale much less than that of storing all the video data as-is. However, there are the cases where the method of taking the total amount of data is not effective in a specific pattern. For instance, in the case of the image in which a white block bounces around in a black screen, it is misrecognized as the still image because the total amount of data is the same even if the location of the white block is different. Therefore, the present invention proposes a method whereby the data is created by combining a few pixels so as to provide a correlation with the data on other pixels.

First, 711 is operated by a data enable (DE) and a clock (CLK). This is intended to make a determination only with necessary data without constantly having the data.

Figure 70:
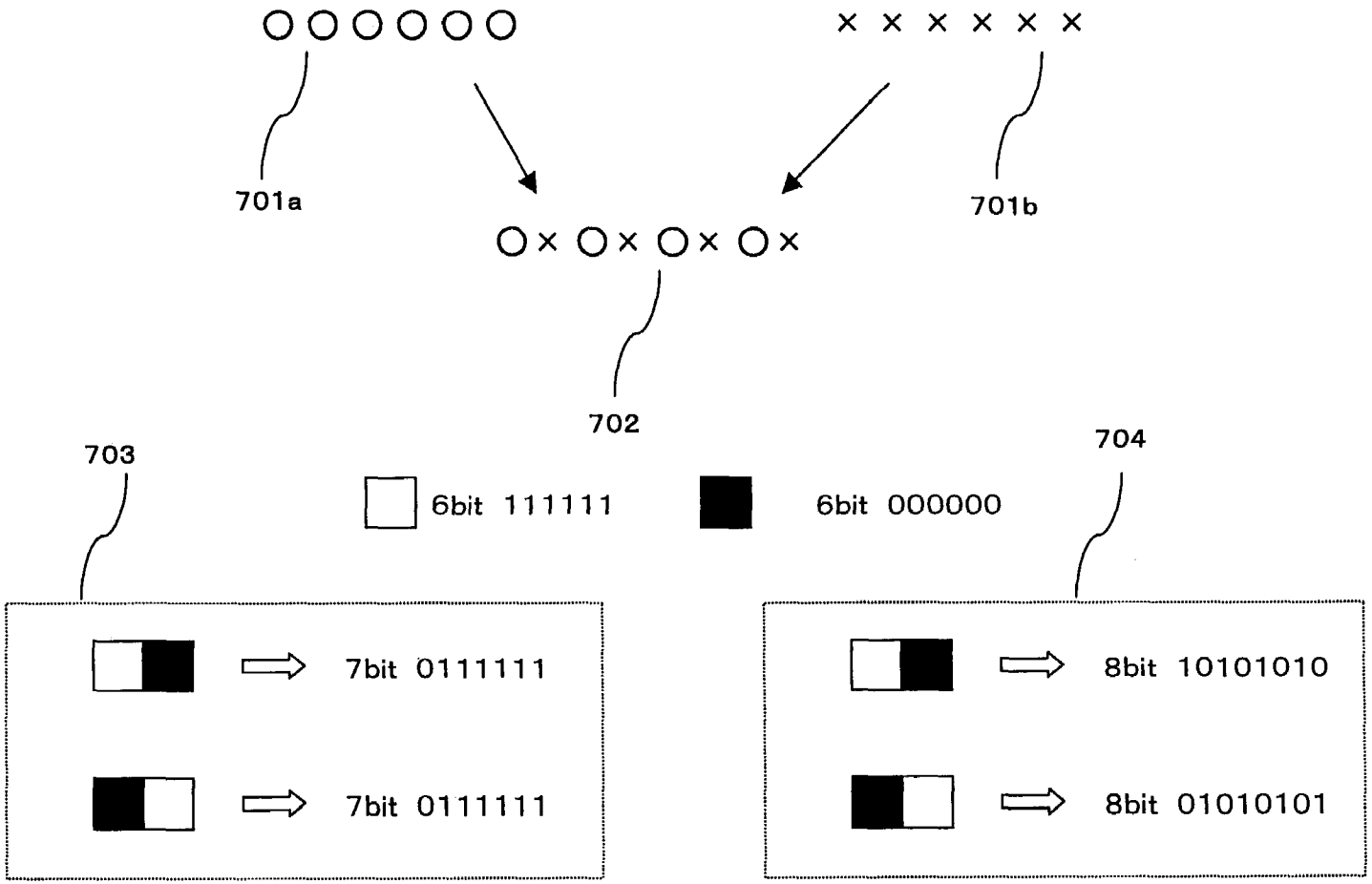
FIG. 70 are block diagrams of a register used for the present invention.
Figure 74:
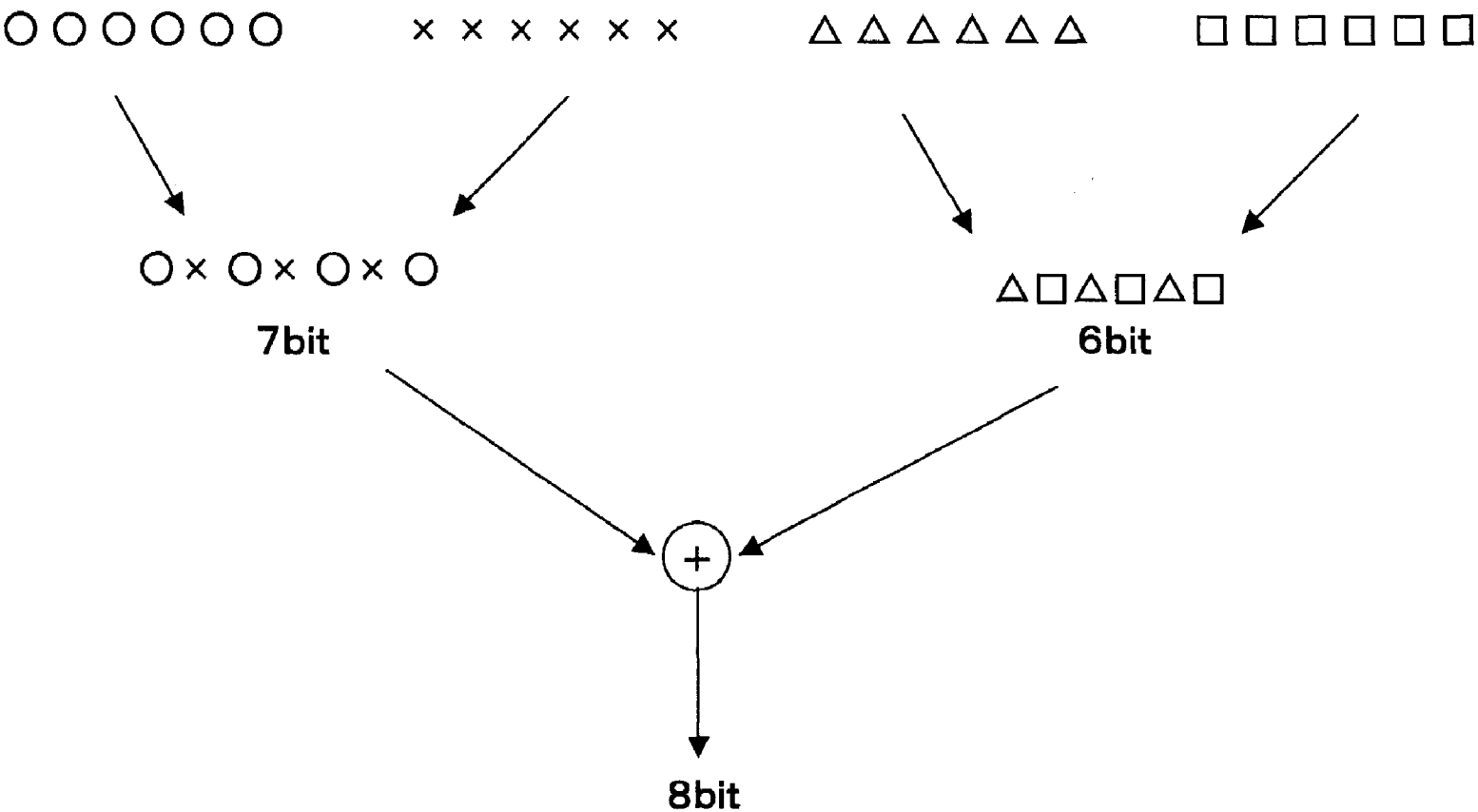
FIG. 74 is a block diagram of the register used for the present invention.

As shown in FIG. 70, in the case of inputting 6-bit video data 701*a* and 701*b*, an 8-bit register 702 is prepared, where one register is configured by inputting high-order 4 bits of each of the video data to odd-numbered bits and even-numbered bits. In this case, the register 702 does not need to be 8-bit. It may be a 12-bit register although the circuit scale becomes larger, or may be a register configuration of less than 8 bits if reduction in accuracy is acceptable. It is also possible to change the ratio of the two pieces of video data. In the case of inputting the data to the 8-bit register, it is also possible to do so at the ratio of 5 bits from 701*a* and 3 bits from 701*b*. Furthermore, it is not always necessary to take the data to be inputted to the register from high order. It is also possible to select and input the low-order 4 bits, and it is effective means to change the place of taking the data according to the value of a counter 713. In the case of two pixels as shown in FIG. 70, the data is the same in either pattern in the case of 703. However, the data becomes different in the case of 704 and so it will not be misrecognized as the still image. In FIGS. 70 and 71, a correlation is provided between the two pixels in order to simplify the driving method for description. However, there may be three or more pixels. If the method of FIG. 70 is performed with a lot of pixels, there is a merit of improving accuracy of still image detection. However, there is a demerit of extending the circuit scale because the number of bits of the register 702 becomes larger. For that reason, there is also a method of preparing a few kinds of registers of different numbers of bits so as to provide correlations among multiple pixels as shown in FIG. 74.

712 adds the values of the logical operation performed with the data of the register and the values of the counter 713. The counter 713 is a module which is reset by the horizontal synchronizing signal (HD) and counts up with the clock. For that reason, it is the same as indicating coordinates in the horizontal direction of the display area. It is possible, by performing the logical operation of the counter and data, to assign weight of the coordinates in the horizontal direction to the data.

714 adds the values of the logical operation performed with the data of one horizontal period and the values of the counter 715. The counter 715 is a module which is reset by the vertical synchronizing signal (VD) and counts up with the HD. For that reason, it is the same as indicating coordinates in the vertical direction of the display area. It is possible, by performing the logical operation of the counter and data, to assign weight of the coordinates in the vertical direction to the data.

It is possible to improve the accuracy of still image detection by using the above methods. However, it is not always necessary to use all the above methods. The above methods are techniques of improving the accuracy, and it does not mean that the still images cannot be detected without using all the above methods.

Frame data 716 is made in the form of combining the above methods. The frame data is compared with data 717 of a preceding frame by 718. As for the method of comparison performed by 718, the two pieces of data do not always have to be the same. The video data has noise in no small part. For that reason, the two pieces of data will not be the same except in the case of completely noiseless data. 718 should decide an error range of the two pieces of data according to required accuracy. As for the methods of comparison, there is a method of performing subtraction with the two pieces of data and judging whether or not it is the still image from the calculation result. There is also a method of inverting the data 717 of the preceding frame at the beginning of the frame and having it inputted to the frame data (register) 716 so as to judge the still image by how close to 0 the frame data 716 added between 1F gets. While 712 and 714 are using the adders, there is also a method of judging whether or not it is the still image by how close to 0 it gets from the data 717 of the preceding frame by using a subtracter.

In FIG. 71, it is judged whether or not it is the still image by adding the data on all the display areas. Depending on the display image, however, there may be the cases where 50 percent is the still image and remaining 50 percent is a moving image. For that reason, there is also an effective method of dividing the screen into a plurality and judging which range of the screen is the still image with the counters 713 and 715 so as to perform various processes.

In the case where the comparator 718 judges that it is the still image, a counter 719 is counted up. Inversely, in the case where the comparator 718 judges that it is the moving image, the counter 719 is reset. To be more specific, the value of the counter 719 is duration of the still image.

First, a proposal is made as to a method of using the counter 719 and thereby decreasing the lighting rate for the sake of slowing down deterioration speed of the EL element 15.

A signal line 7101 is operated when the counter 719 reaches a certain value. The signal line 7101 is the signal line of forcibly controlling the lighting rate when it is HI. A module of connecting the lighting rate control value 556 with the signal line 7101 is prepared inside 710, and the circuit configuration is performed to forcibly decrease the lighting rate to ½ of a current lighting rate when the signal line 7101 is HI. In this case, it is not necessary to fix the value to which the lighting rate is forcibly decreased at ½. The lighting rate should be decreased as required. As the lighting rate is decreased, the organic EL element 15 decreases the amount of light emission so as to slow down the speed of deterioration due to life. As a matter of course, it is also possible to exert control to decrease the lighting rate when 7101 is LOW.

Even though the speed of deterioration is slowed down by the above method, however, the burn-in occurs if the current is passed for a long time. For that reason, it is necessary to completely stop the current passed through the organic EL element 15 in the case where the still image status lasts for a long time. For that purpose, a signal line 7102 is used to forcibly operate the signal line 62*b* and turn off a switching element forcibly controlling the period of passing the current through the organic EL element so as to prevent the current from passing through the organic EL element. As previously indicated, the signal line 62*b* is the signal line which can forcibly fix the gate signal line 17*b* of operating a switching element 11*d* either at HI or LOW. It is possible to control the signal line 62*b* with the signal line 7102 and thereby stop the light emission of the organic EL element in the case where the still image lasts for a long time so as to prevent the burn-in of the organic EL element.

The display apparatus using the organic EL element further has a merit of being able to detect the still image. As indicated below, the organic EL element can perform intermittent driving, and the present invention also controls the lighting rate by controlling the lighting rate control value. As previously indicated, it is possible to clarify contours of the video by collectively inserting black on the intermittent driving so as to put the image in a very good status. However, there is also a demerit of collectively inserting black. There is a problem that, as the black area to be inserted becomes larger, human eyes become more capable of catching up with black insertion so that the black insertion can appear as the flicker. This is the problem mainly seen in the still image. In the case of the moving image, the flicker of black insertion is not seen due to variation of the video. This phenomenon is improved by dividedly inserting black. At the same time, the effect of clearly displaying the contours by means of collective black insertion cannot be used.

Figure 72:
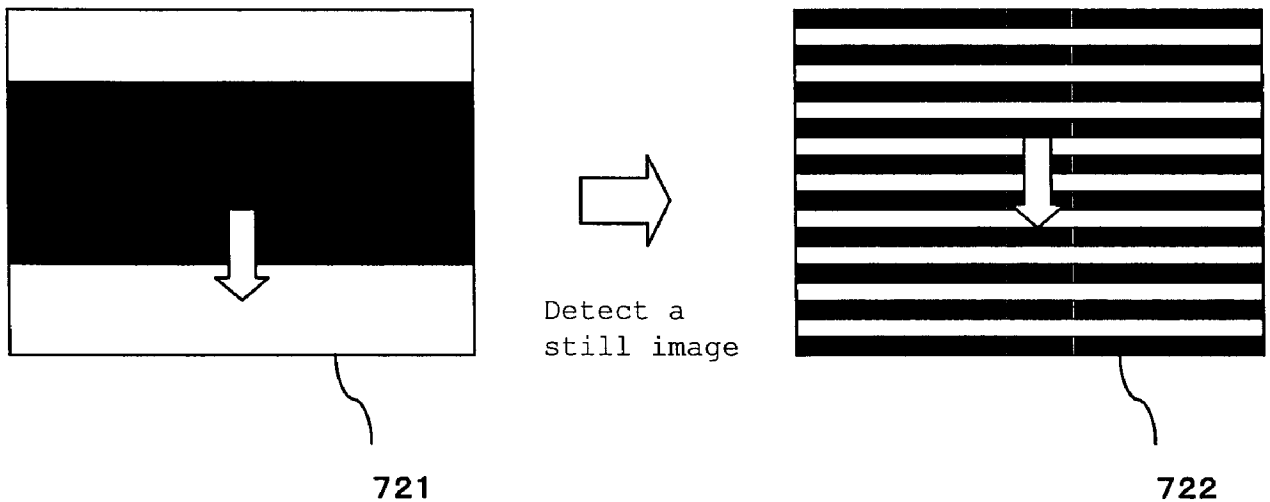
FIG. 72 are diagrams showing the display state.

Thus, a proposal is made as to a driving method of, in the case of moving image display, performing the driving method of collectively inserting black, and dividedly inserting black on detection of the still image so as to prevent the flicker on the still image as shown in FIG. 72.

Figure 75:
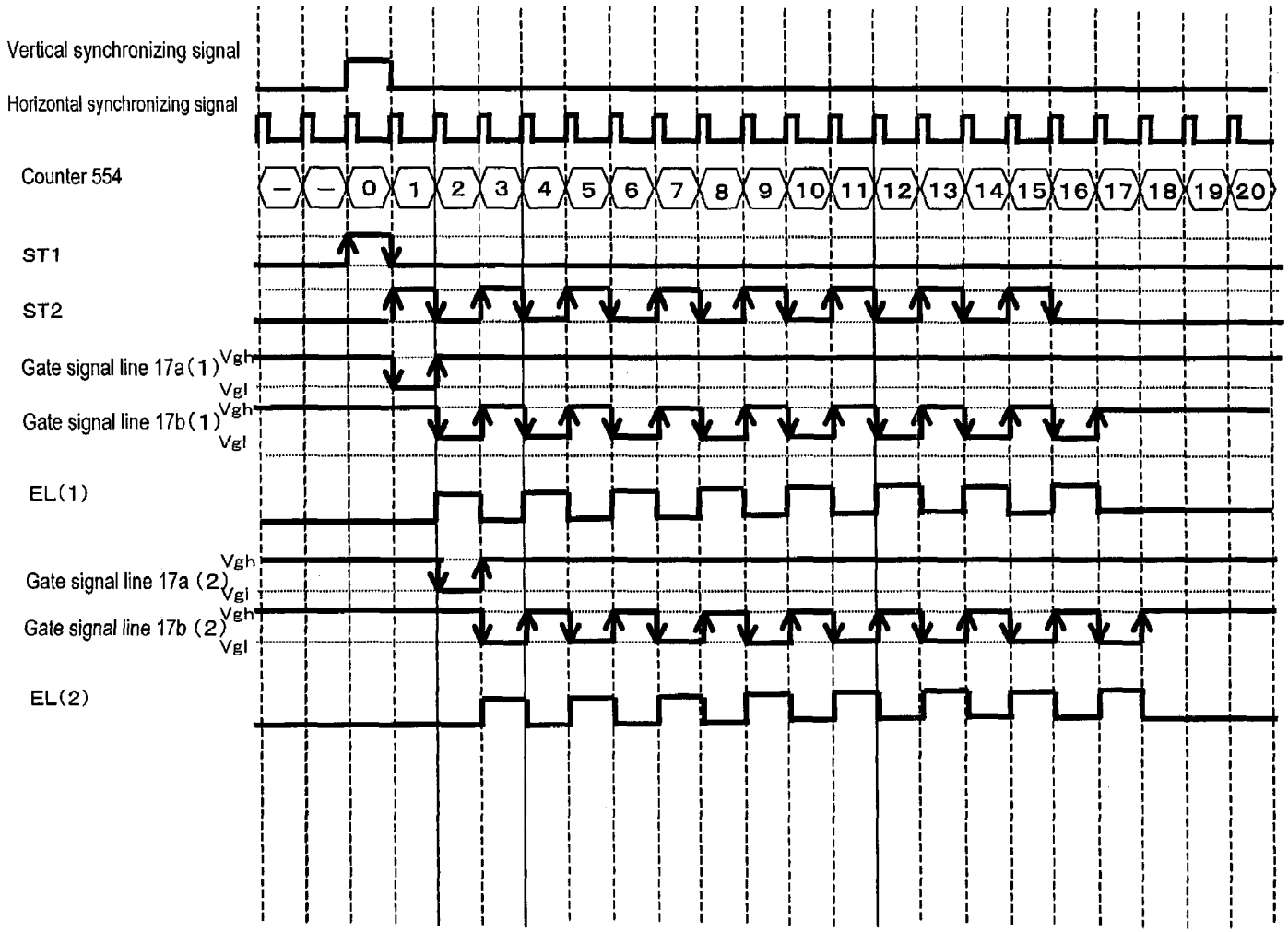
FIG. 75 is a timing chart of the present invention.

A description will be given by using FIG. 73 as to the circuit configuration of using the counter 554 and lighting rate control value to dividedly insert black. As previously indicated, the switching transistor 11*d* is controlled by the gate signal line 17*b*, and the gate signal line 17*b* is decided by ST2 inputted to the gate driver 12. As shown in FIG. 75, if ST2 repeats on and off by 1H, the switching transistor 11*d* repeats on and off by 1H so that it becomes the image such as 722 in which black is dividedly inserted. Thus, a large number of selectors such as 731 are used to implement divided insertion of black.

As for the circuit configuration of 710, the LSB of the counter 554 is noted first. The selector 731 outputs the value of B when an input value S is 1, and outputs the value of A when it is 0. To be more specific, considering 731*a*, it outputs the value of the MSB of the lighting rate control value when the value of the LSB of the counter 554 is 1. When the LSB of the counter 554 is 0, the output value of 731*b* is reflected. As for 731*b*, a 7th-bit value is outputted in the case where the value of the lighting rate control value is 8 bits when a 2nd bit from the low order of the counter 554 is 1. It is the circuit configuration of repeating this as to a 3rd bit, 4th bit and so on. The LSB of the counter 554 repeats HI and LOW in each 1H. In the case where the lighting rate control value is 8 bits, it is 128 or more when an 8th bit is 1 so that it becomes HI once in 2H without fail. To be more specific, if the value of the MSB of the lighting rate control value is outputted when the LSB is 1 with the LSB of the counter 554 as the switch of the selector, ST2 becomes HI once in 2H. In the case where the LSB is 0, the value of the signal outputted from a first selector to the left is outputted to ST2. And the 7th bit of the lighting rate control value is outputted when the LSB of the counter 554 is 0 and the 2nd bit from the low order of the counter 554 is 1. To be more specific, the 7th bit of the lighting rate control value is outputted once in 4H. To continue it likewise, the 6th bit of the lighting rate control value is outputted once in 8H and so on. It becomes possible, by combining these, to convert it from collective black insertion to divided black insertion.

It is possible, by combining circuit methods of detecting the still image including the circuit configuration of the divided black insertion and the method of using the frame memory previously indicated, to perform the driving method of collectively inserting black to clarify the contours in the case of the moving image and implement the driving of dividedly inserting black to prevent the flicker due to the collective insertion in the case of the still image.

As the means of drawing out the stray capacitance 451 of the source signal line 18 previously indicated, there is a method of preparing a voltage source 773 of low impedance and applying voltage to the source signal line 18. The technique is called precharge driving.

Figure 77:
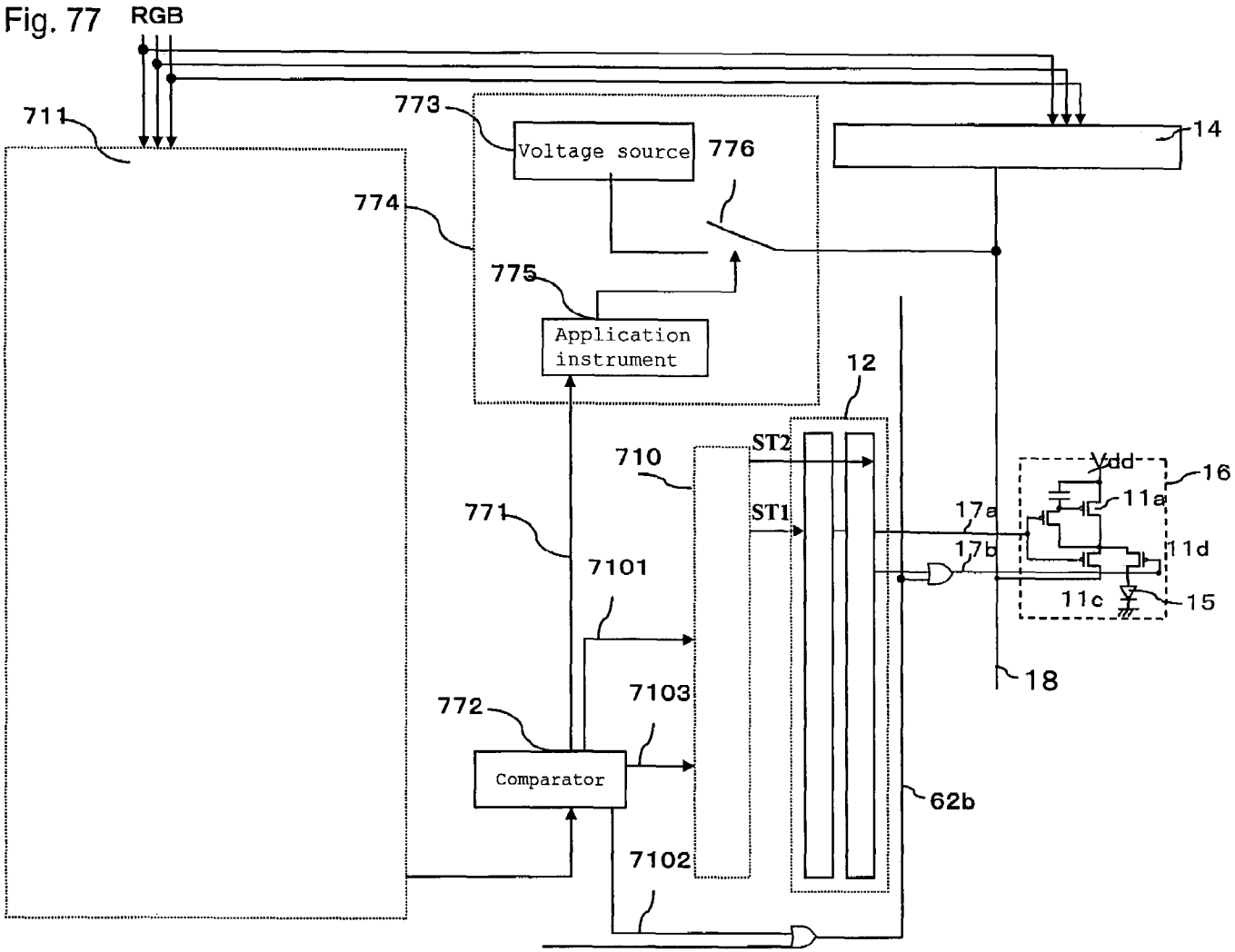
FIG. 77 is a circuit block diagram of the present invention.
Figure 78:
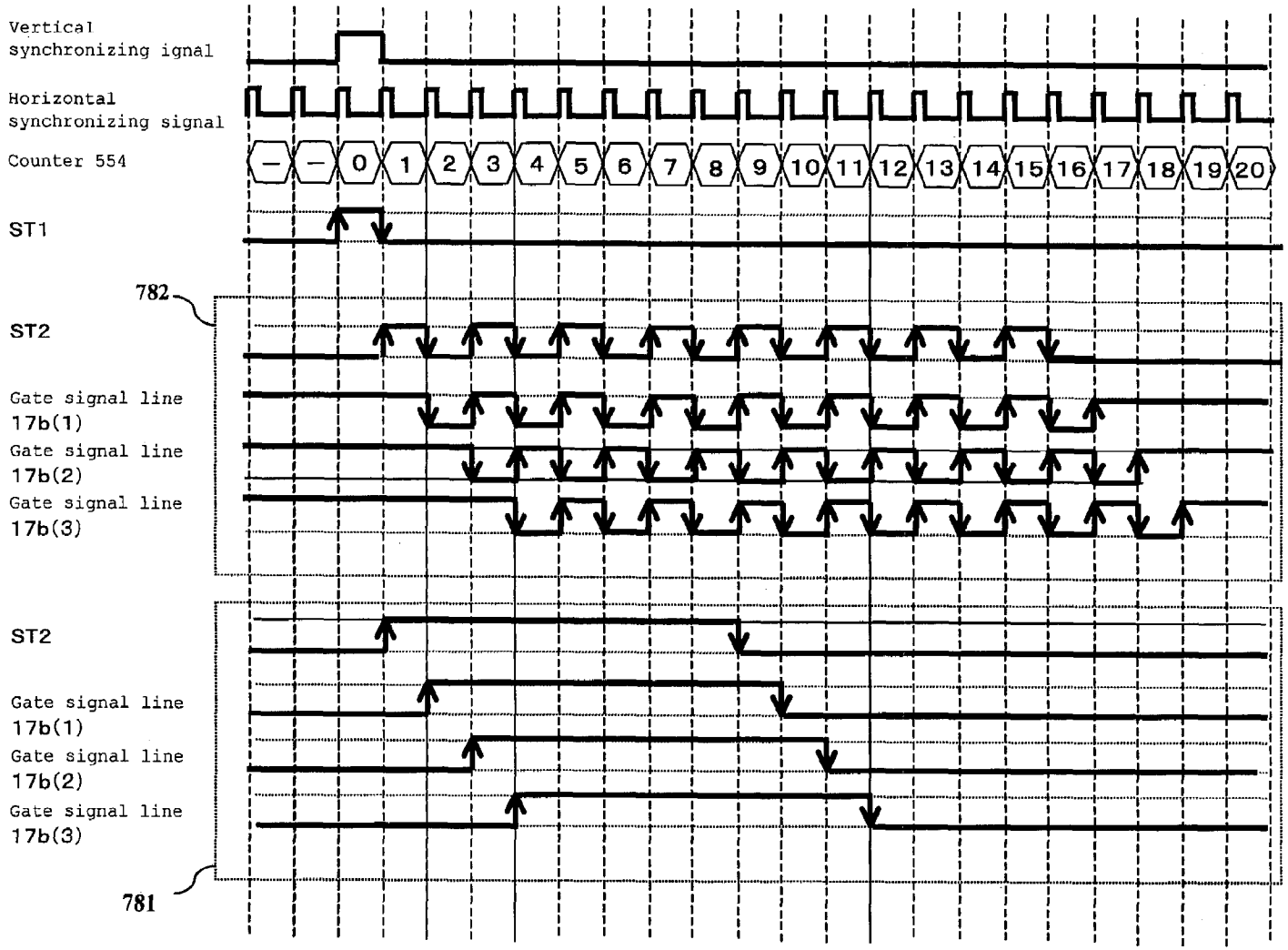
FIG. 78 is a time chart of the present invention.

FIG. 77 shows the circuit configuration of the precharge driving. The voltage source 773 and voltage application instrument 775 are provided in the circuit. If the voltage application instrument 775 turns on a switch 776, the voltage source 773 charges and discharges the stray capacitance 451 of the source signal line 18. For convenience of the drawings, 774 is separately described from the source driver 14. However, 774 may also be built into the source driver 14. If the circuit configuration allows the source signal line 18 of performing the precharge to be selected by the voltage application instrument 775, it is possible to adjust on and off of the precharge for each pixel so as to enable detailed settings.

The present invention uses still image detection instrument 711 for the above circuit configuration. In this case, the frame memory and so on may be used instead of 711. Image deterioration due to the stray capacitance 451 previously indicated is more noticeable in the still image than in the moving image. Therefore, it is possible to prevent the image deterioration on the still image by detecting the still image with 711 and operating the voltage application instrument 775 with a comparator 772 to perform the precharge.

In the case of displaying the moving image as previously described, it is desirable to collectively insert black to clarify the contours, and besides, it is also desirable to collectively insert black in view of the power for the gate driver circuit of driving the organic EL display apparatus.

The gate driver IC 12 of driving the EL display panel operates each gate signal line 17*b* by means of a shift register 61*b* of operating the start pulse ST2 on a clock CLK2. In the case of collectively inserting black for use shown in 781, each gate signal line 17 has only to be turned on and off once in one inter-frame space. In the case of dividedly inserting black as shown in 782, the gate signal lines 17 are repeatedly turned on and off. For this reason, multiple signal lines are simultaneously turned on and off, and so there is a problem that power consumption of the gate driver IC 12 is increased.

From the above viewpoints, it is preferable that the organic EL display apparatus collectively insert black under ordinary circumstances. In the case of collectively inserting black, however, the flicker due to collectively inserting black on the still image is visible. The still image or the video with little movement is displayed for that reason. Figures are schematic diagrams of the display state of the mounted panel according to the present invention. Figures are schematic diagrams of the display state of the mounted panel according to the present invention. In this case, it requires a mechanism of changing the collective insertion of black to the divided insertion of black. However, if switched from the collective insertion of black to the divided insertion of black, the flicker is seen at the moment of switching. There are two thinkable reasons for this.

The first thinkable reason is temporary deterioration of luminance on switching to the divided insertion.

Figure 79:
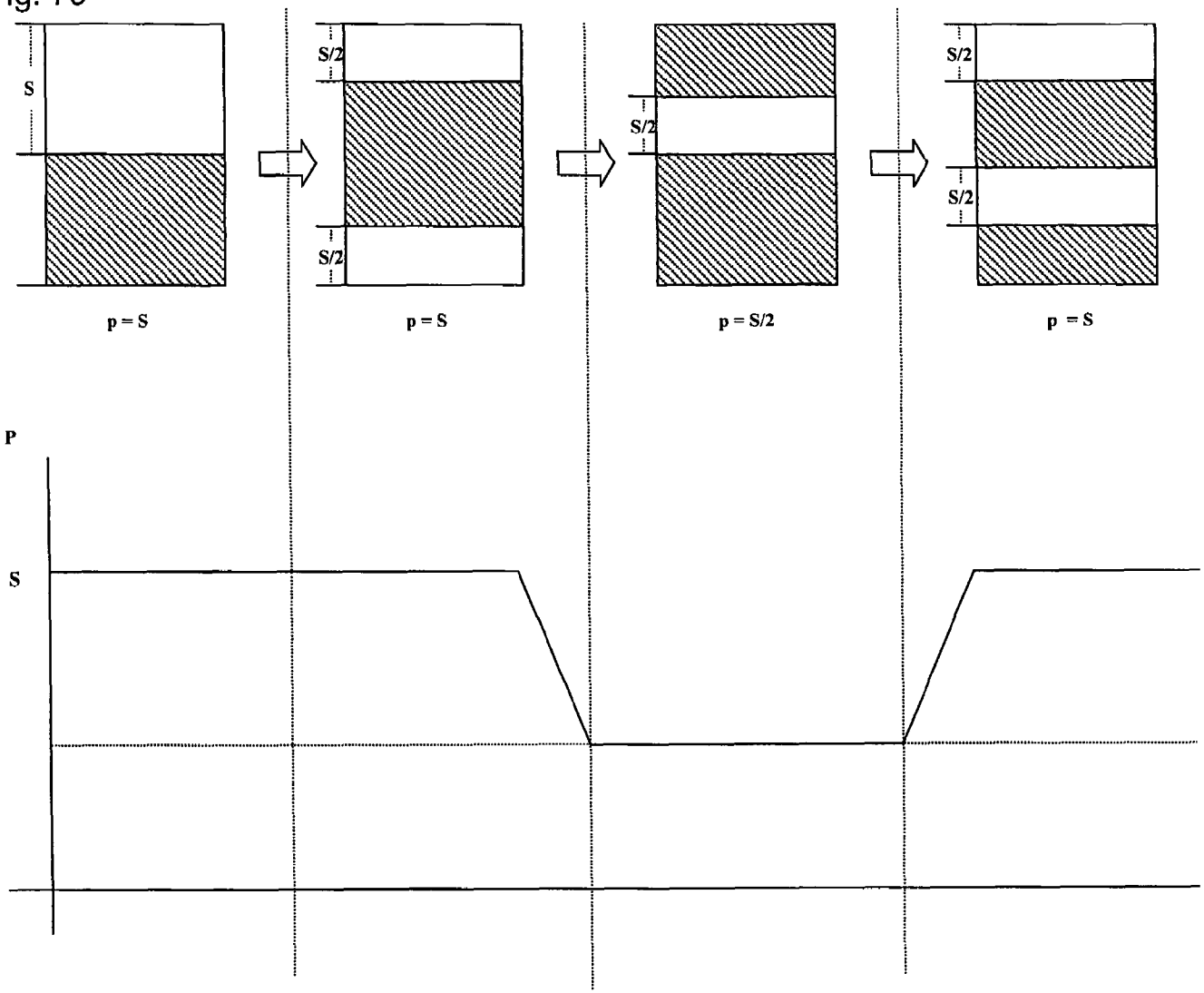
FIG. 79 are schematic diagrams of the display state of a mounted panel according to the present invention.

As shown in FIG. 79, consideration is given to a status in which S pieces of horizontal scanning lines are lit up out of P pieces of the horizontal scanning lines. The number of scanning lines which are unlit, that is, black in this case is P−S (pieces). In the case of dividing them into two, the number of scanning lines which are unlit is (P−S)/2 (pieces) respectively. While S pieces of horizontal scanning lines are always lit up before switching, S/2 pieces thereof are lit up only at the moment of switching and then the number of scanning lines lit up becomes S/2 during (P−S)/2 (pieces). During this time, the luminance of the display areas becomes S/2, and so reduction in luminance occurs only in one frame, which is supposedly causing the image deterioration.

The second thinkable reason is a drastic change in interval of black.

It is thinkable, as one of the causes of the image deterioration on the collectively insertion of black, that the human eyes are unconsciously chasing the inserted black. Therefore, it is thinkable that, as black is dividedly inserted switching from the state of collectively inserting black, intervals are felt as if suddenly changing the image, leading to a feeling of the image deterioration.

Figure 80:
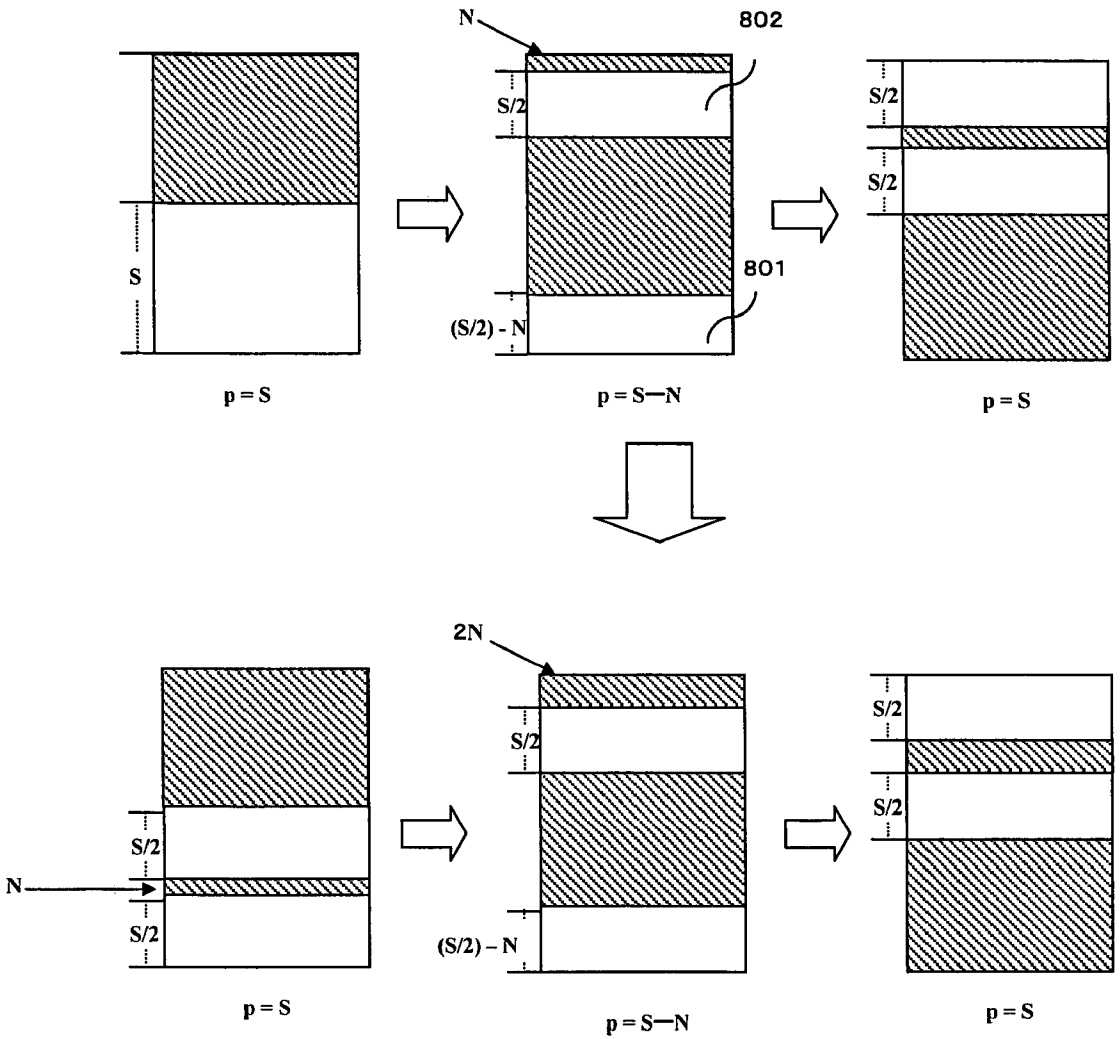
FIG. 80 are schematic diagrams of the display state of the mounted panel according to the present invention.
Figure 89:
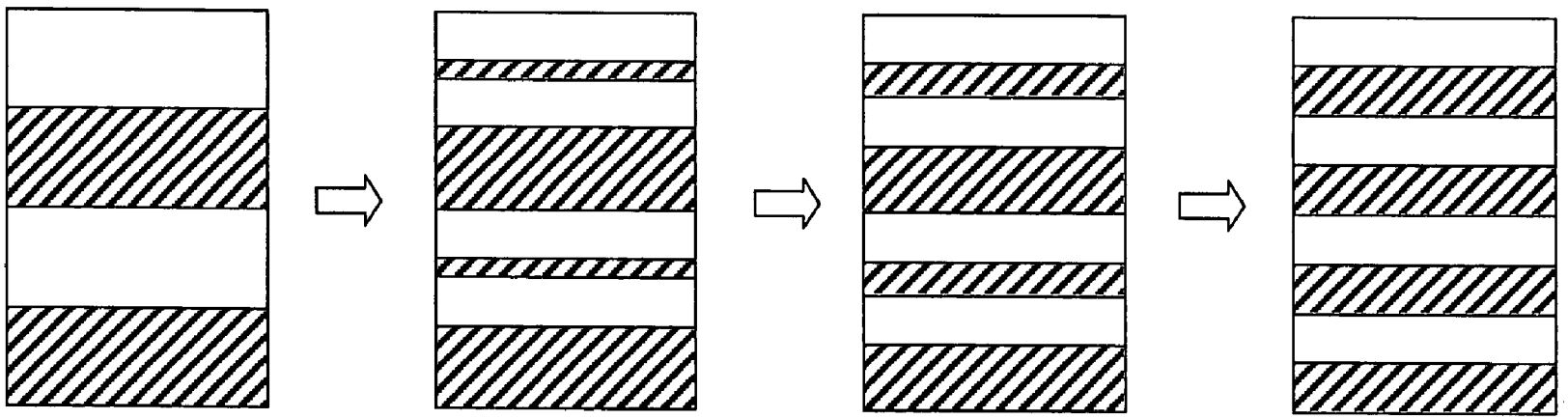
FIG. 89 are schematic diagrams of the display state of the mounted panel according to the present invention.

The present invention proposes a method of solving the two problems and changing the method of inserting black from the collective insertion to the divided insertion without deterioration of the image. The deterioration of the image on switching is caused by rapid change in the luminance and feeling of black as previously described. Therefore, according to the present invention, the deterioration of the image on switching is prevented by the method of gradually dividing the interval of black over multiple frames as shown in FIGS. 89. FIGS. 80 show the change in the luminance in the case of making the intervals of N horizontal scanning periods (hereafter, the horizontal scanning period is described as H) and dividing the number of lit-up horizontal scanning lines into two. In a status of having S pieces of the horizontal scanning lines lit up, a preceding stage of the start pulse divided in two is 801 and a subsequent stage thereof is 802. Then, the number of lit-up horizontal scanning lines of 801 and 802 is S/2 (S=2·4·6 . . . ·)j. For this reason, after the start pulse 801 of the preceding stage is outputted to the gate signal line, the number p of horizontal scanning lines having the EL display panel lit up during S/2 (H) is (S/2)−N pieces. The luminance of the display panel during that time is as follows against that before switching.

$$\{(p/S\}\times 100(\%) \tag{6}$$

Figure 81:
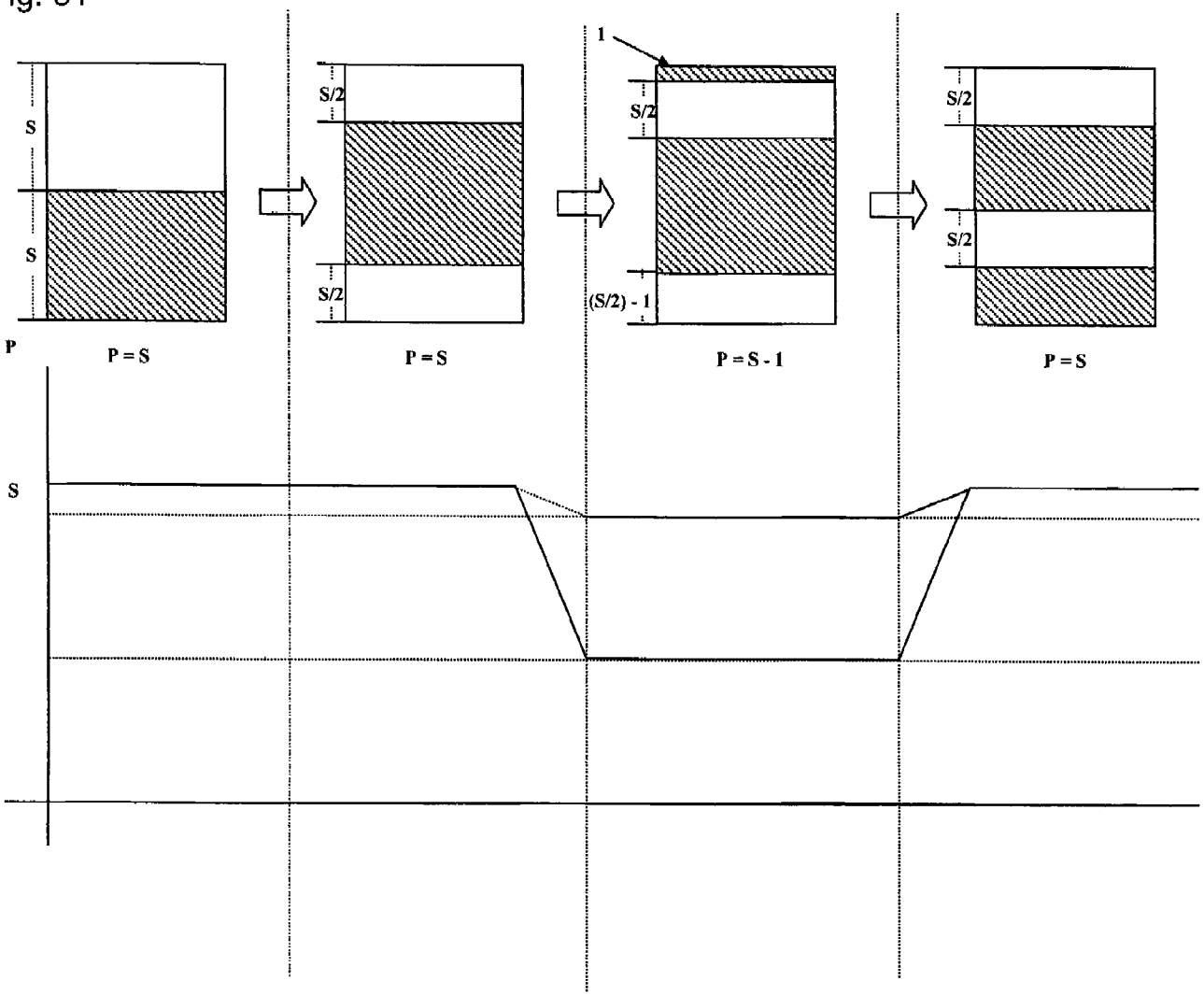
FIG. 81 are schematic diagrams of the display state of the mounted panel according to the present invention.

The graphs shown in FIG. 81 represent differences in the luminance in the case of dividing it by N=1 in FIGS. 79 and 80 at a time. It is thinkable that the luminance at the time of this division is significantly involved in the image deterioration.

Figure 100:
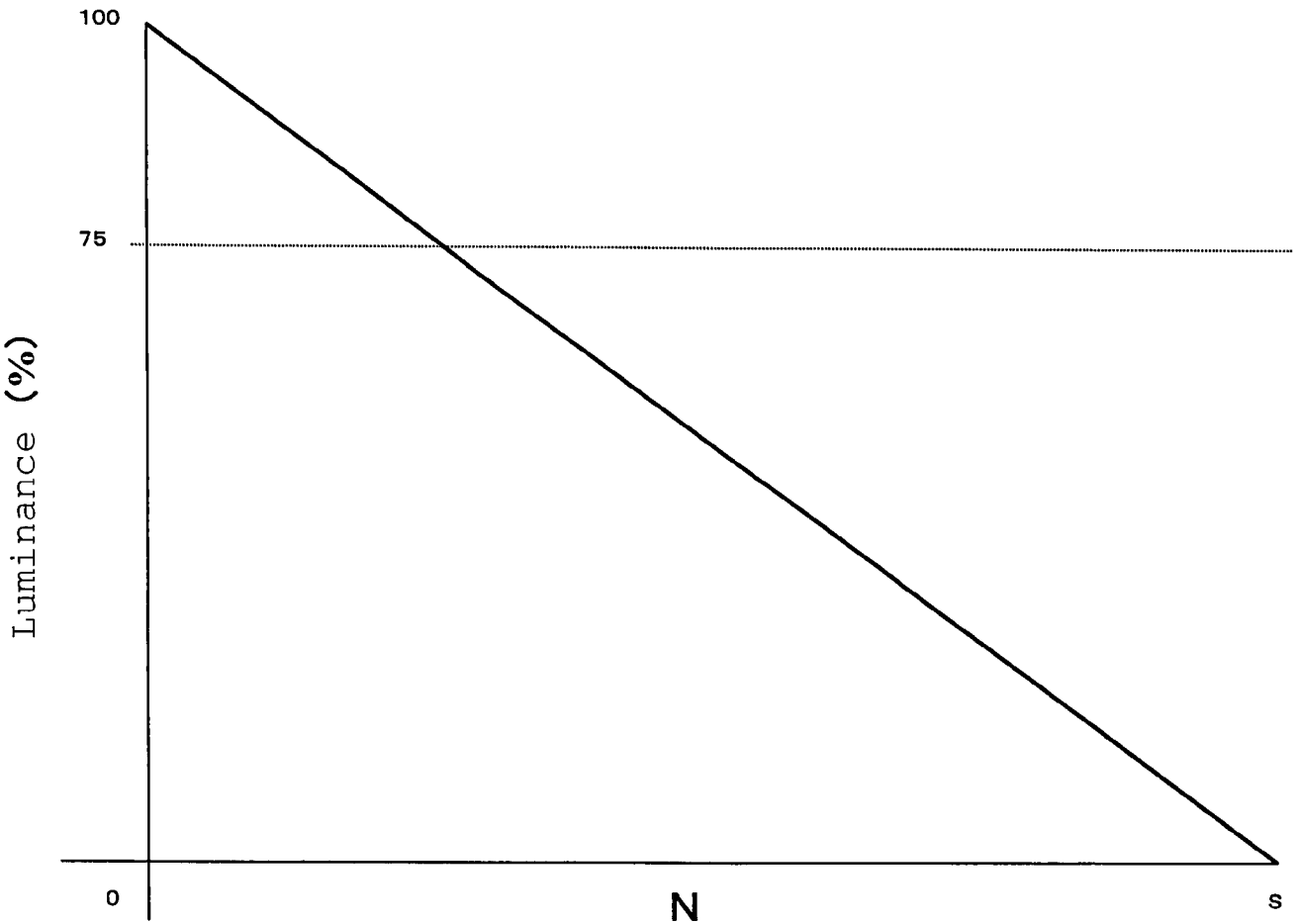
FIG. 100 is a schematic diagram of the display state of the mounted panel according to the present invention.
Figure 101:
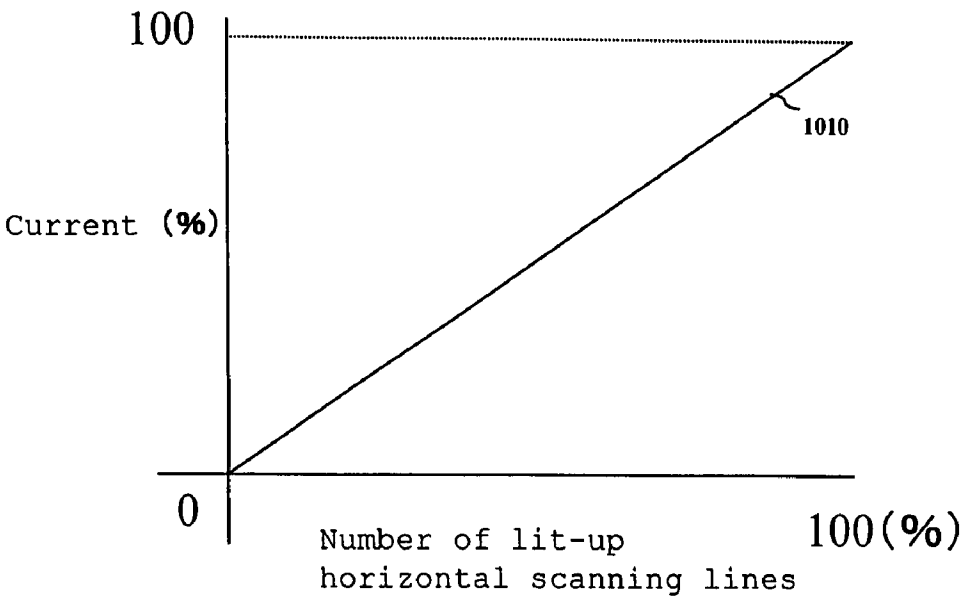
FIG. 101 is a schematic diagram of the display state of the mounted panel according to the present invention.

As the value of formula (6) is p=S−N, it changes according to S and N as shown in FIG. 100. It could be analyzed from actual measurement values that the image deterioration occurs when the value of formula (6) becomes less than 75 percent. For that reason, the present invention proposes a method of extending the insertion interval of black by the value of N of making the value of formula (6) 75 percent or more, that is, N≦S/4 (provided that it is N≧1) from formula (6). While no image deterioration occurs if the value of formula (6) is 75 percent or more, a further effect can be expected if it is 80 percent or more. Most desirably, it should be 90 percent or more (N≦S/10).

Figure 82:
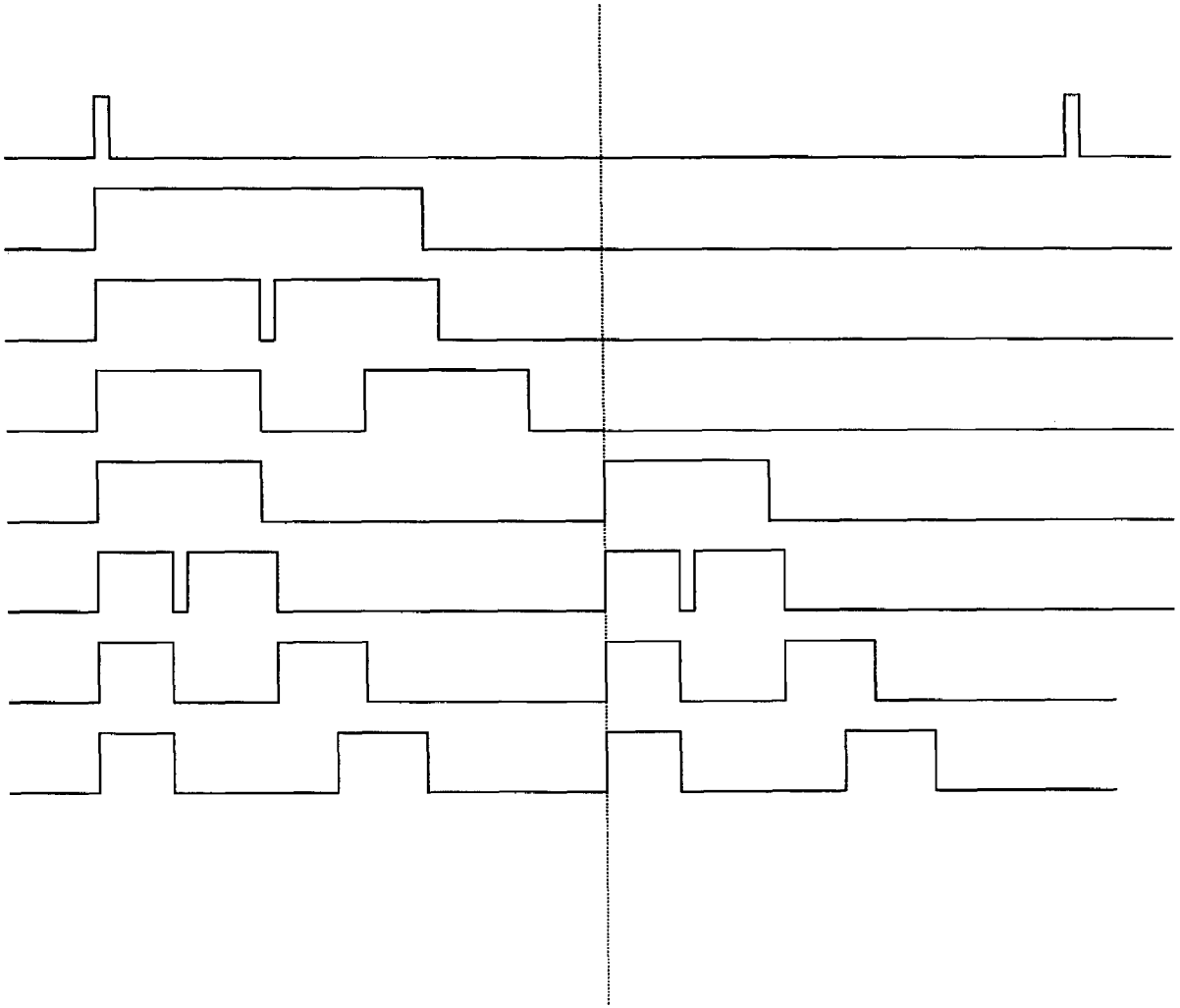
FIG. 82 is a time chart of the present invention.
Figure 83:
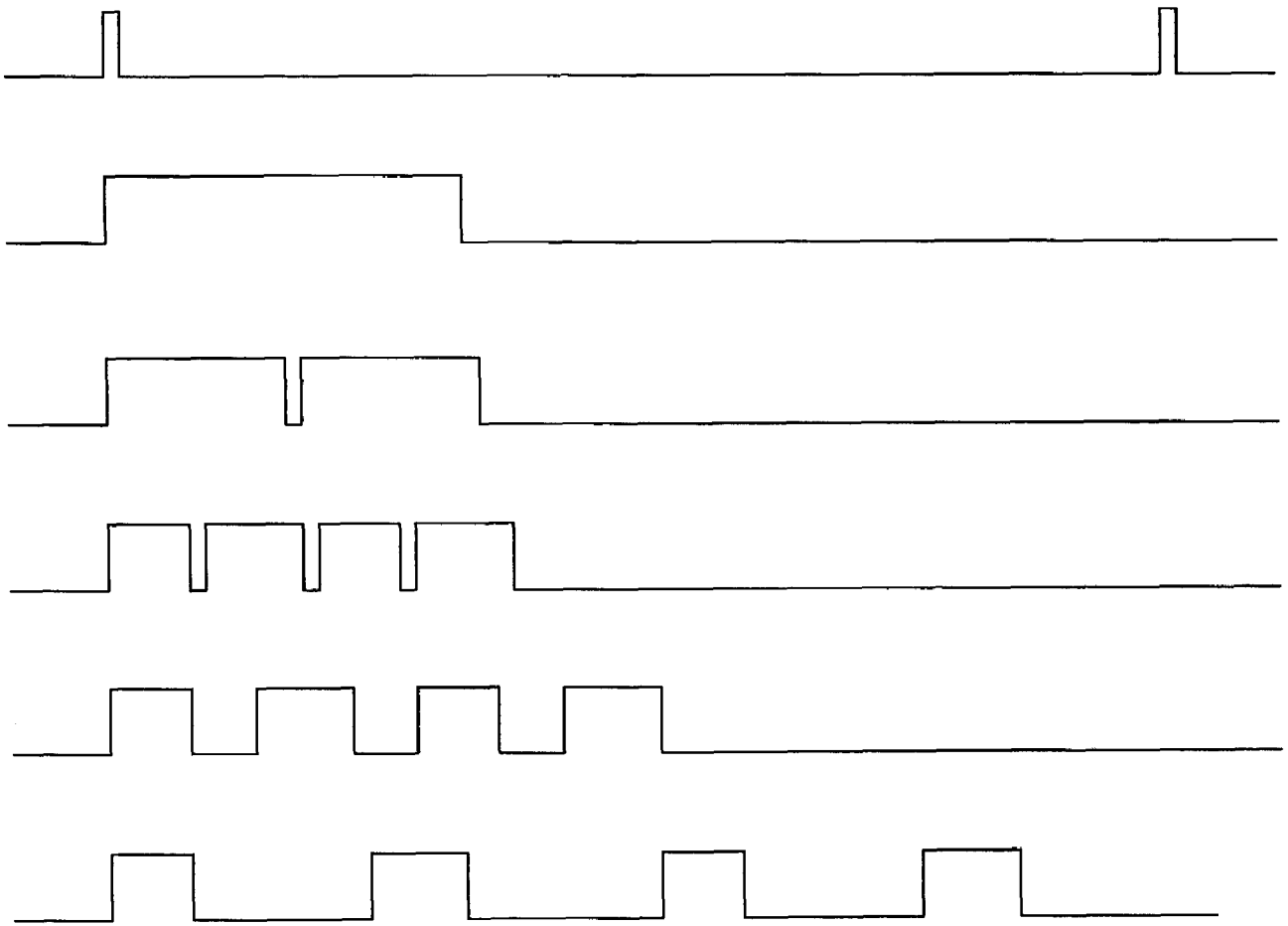
FIG. 83 is a time chart of the present invention.

According to the present invention, however, it can make any change as long as the luminance does not become less than 75 percent. In FIG. 79, it is S/2 in the case of dividing the number of lit-up horizontal scanning lines into two in the status of having S pieces of the horizontal scanning lines lit up. However, it may be divided into S' pieces and S−S' pieces (S'<S). The amount to be divided at a time is not limited to division into two. If N=3, it is possible, by providing intervals by one horizontal scanning period, to keep the luminance of 90 percent or more even when divided into four at a time so that the process is not influenced. In FIG. 82, lighting intervals are controlled up to the location at which the insertion interval of black becomes the same and then it moves on to the next division in order to render the insertion interval of black constant. As shown in FIG. 83, however, it is also feasible to divide it first and then adjust the insertion interval of black. The effect of improving the image deterioration becomes higher by uniformizing the lighting intervals. However, it is not always necessary to uniformize the lighting intervals.

Figure 84:
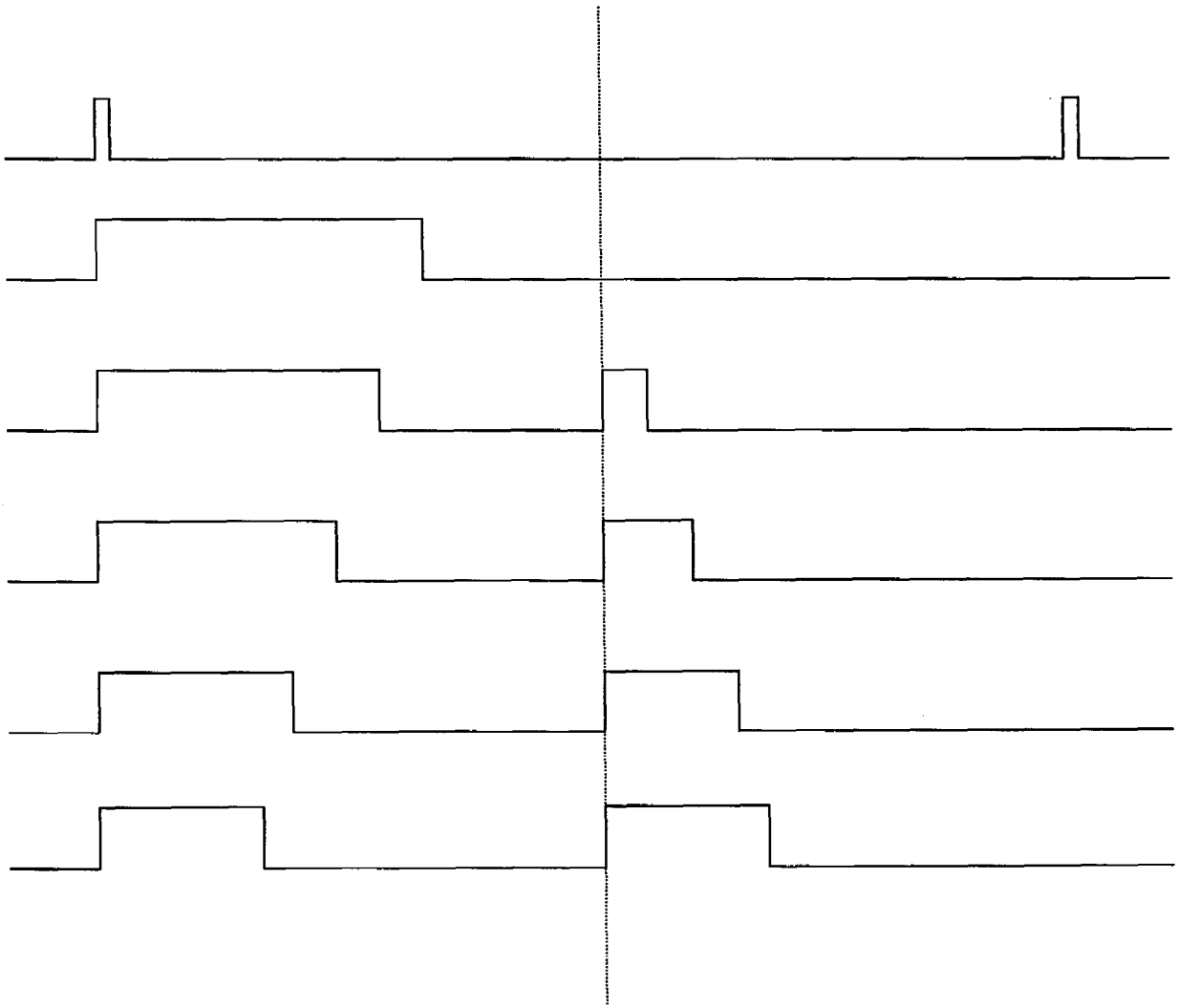
FIG. 84 is a time chart of the present invention.

The method described above was the method of gradually extending the insertion interval of black. As shown in FIG. 84, however, it may inversely be the method of gradually decreasing the number of lit-up horizontal scanning lines. If lit up by the method of dividing them into S−N pieces and N pieces and then into S−2N pieces and 2N pieces from the status of having S pieces lit up, the luminance does not become less than 90 percent so that no image deterioration due to the change in the luminance occurs. It is thinkable that this method cause the rapid change in the insertion interval of black which is a second reason for the image deterioration and thereby causes the image deterioration. As previously described, however, it is effective since the image deterioration due to the change in the luminance can be solved.

Figure 85:
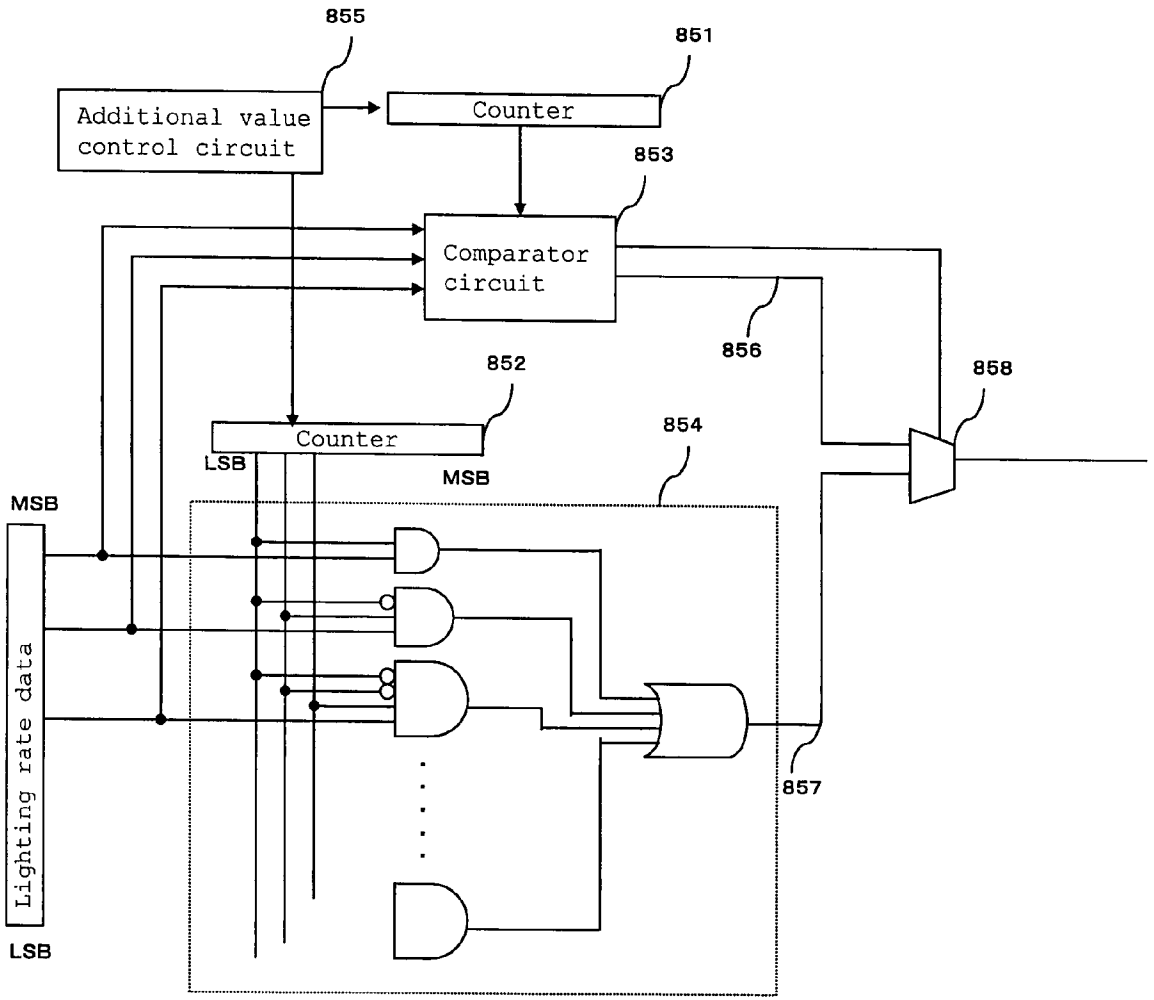
FIG. 85 is a circuit block diagram of the present invention.

FIG. 85 shows a circuit block diagram of implementing the driving method of the present invention. The circuit configuration of the present invention is comprised of two counter circuits 851, 852, circuits 853, 854 of generating signals from the two counters, an additional value control circuit 855 of controlling the additional values of the two counters, and a selector 858 of outputting one of an output 856 outputted from 853 and an output 857 outputted from 854.

Figure 73:
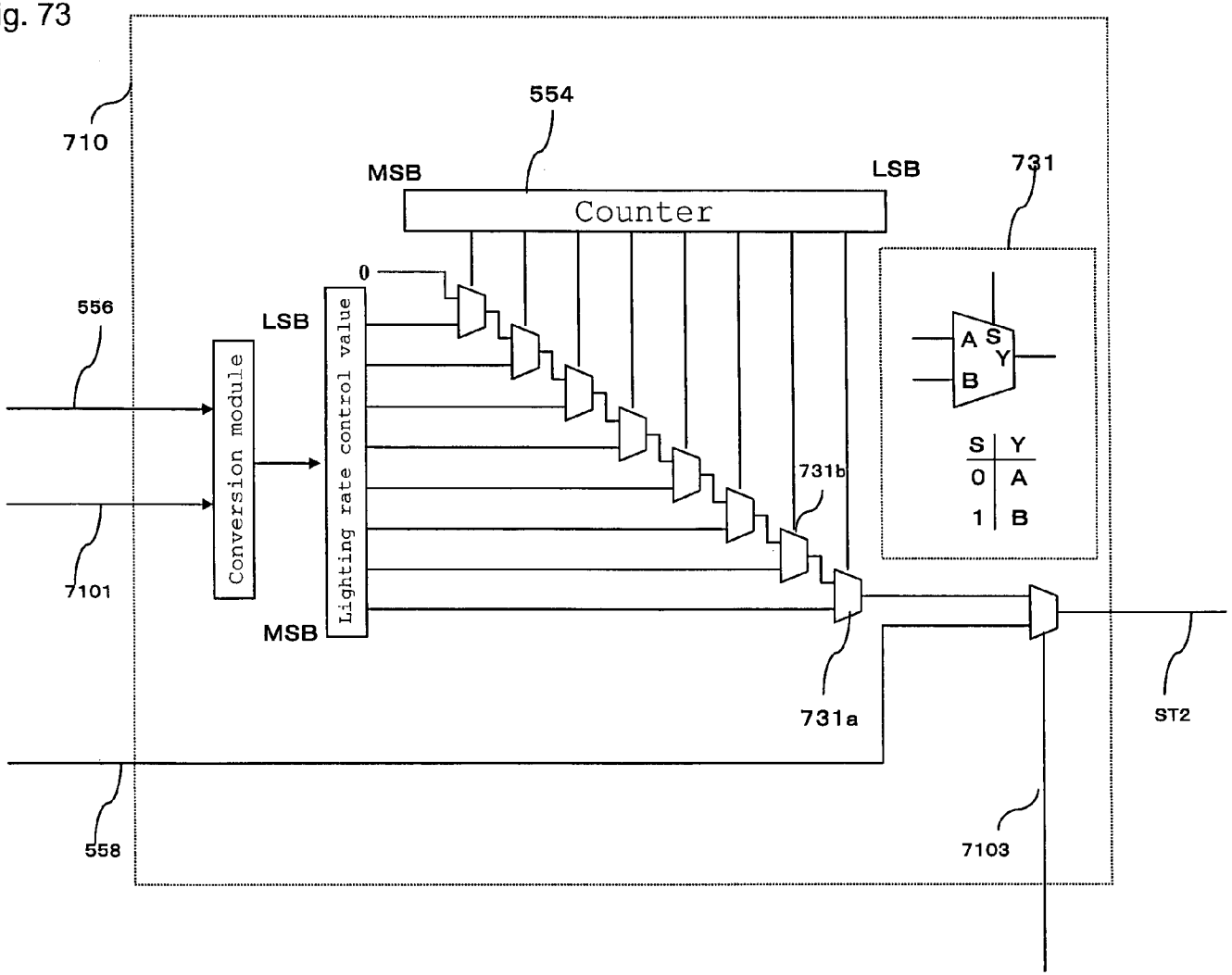
FIG. 73 is a circuit block diagram of the present invention.

The circuit 854 is the circuit of dividing and outputting the waveform from the lighting rate control value and the value of the counter 554 shown in FIG. 73, which is reconfigured as the circuit having less delay. The circuit of FIG. 73 is the same as 854, and either one may be used. The circuit 853 renders the output 856 HI when the counter 851 is 0. It also generates a counter value of rendering the output 856 LOW from the lighting rate control value in the additional value control circuit 855. In the case where the lighting rate control value is N bits and the start pulse ST2 to be inputted to the gate driver circuit IC 12 is divided into 2 raised to t-th power, the output 856 is rendered LOW when it becomes the value of a high-order (N−t) bits of the lighting rate control value. The counter 851 is set to be initialized to 0 by the value at which all (N−t) bits become 1. When initializing the counter 851, the selector 858 is controlled to select the output 857 from the circuit 854.

The above settings are performed in order to facilitate the circuit configuration.

The lighting rate control value is not always a divisible value. In the case where the lighting rate control value is not divisible when dividing the start pulse into 2 raised to t-th power, lengths of the divided start pulses become different. A new circuit configuration is required to control the start pulses of different lengths so that the circuit configuration becomes complicated.

Thus, there arises an advantage of using the above circuit configuration. In the case of dividing the start pulse into 2 raised to t-th power, the value from the low order of the lighting rate control value to t bits is a remainder of dividing the lighting rate control value into 2 raised to t-th power. It becomes possible to divide the circuit by complementing the remainder portion. It is outputted according to the data from the low order of the lighting rate control value tot bits when high-order t bits of the counter 852 change in the circuit equivalent to 854 shown in FIG. 73. The time when the high-order t bits of the counter 852 change is in synchronization with the time of initialization of the counter 851. Therefore, it is possible, at the time of initialization of the counter 851, to select the output 857 of the circuit 854 with the selector 858 and thereby complement the remainder portion so as to allow the division of the start pulse. It is possible to reduce the circuit scale by using this circuit configuration.

Figure 86:
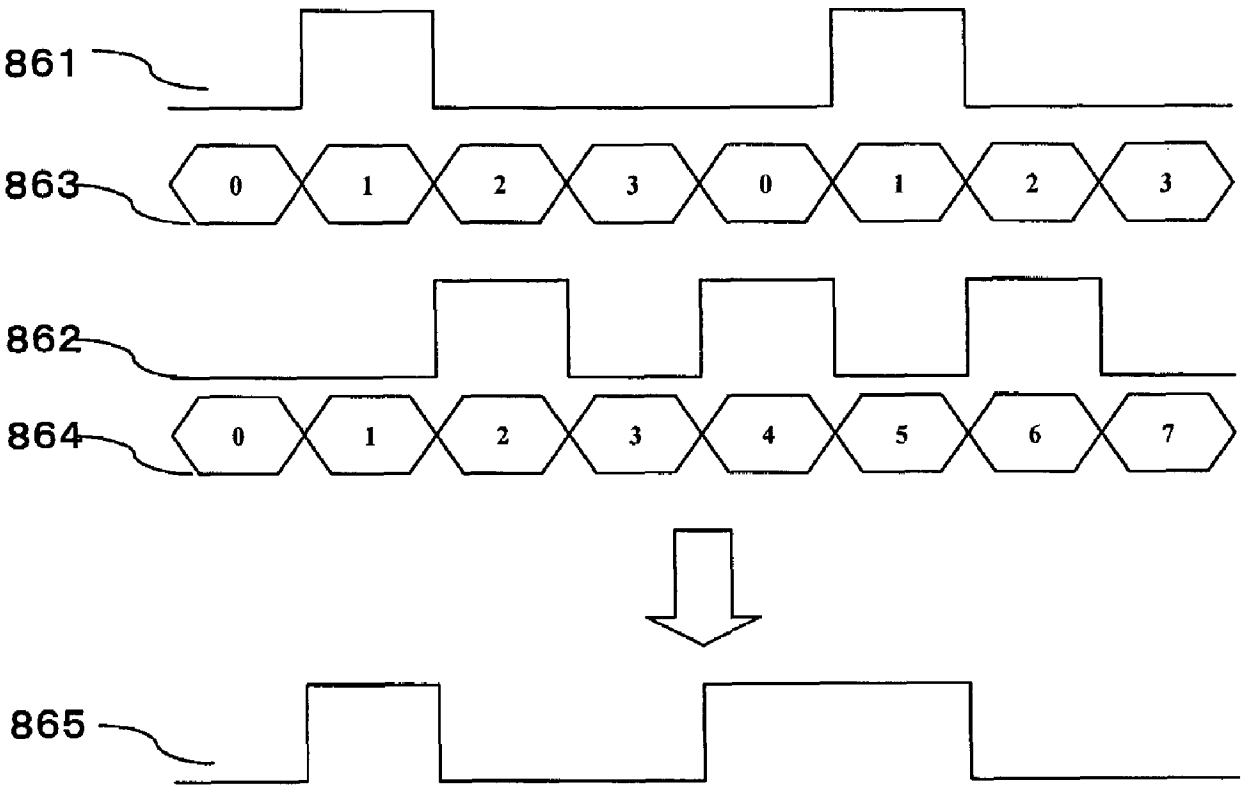
FIG. 86 is a time chart of the present invention.

A description will be given by using actual values and referring to FIG. 86 as to a processing flow of the circuit. Reference numeral 861 denotes the output 856 of the circuit 853, and 864 denotes the output 857 of the circuit 854. Reference numeral 863 denotes a value of the counter 851, and 864 denotes a value of the counter 852. The lighting rate control value has a capacity of 3 bits, and its value is 3. It is 011 if described as a binary number. If it is divided into two, it becomes t=1. Therefore, the value of initializing the counter 851 is 11 as a binary number, that is, 3 as a decimal number. And the value of reducing the output to LOW in the circuit 853 is 01, that is, 1 as a decimal number. In the circuit 853, the output becomes HI when the counter 851 is 0, and becomes LOW when it is 1. In the circuit 854, the output becomes HI when the counter 852 is 2, 4 or 6. The period of selecting the output 857 of the circuit 854 is the time of initialization of the counter 851, that is, when the counter 852 is 4. Therefore, the two outputs are synthesized by the above circuit configuration to be as indicated by 865 so as to confirm that the start pulse can be divided into two.

Figure 87:
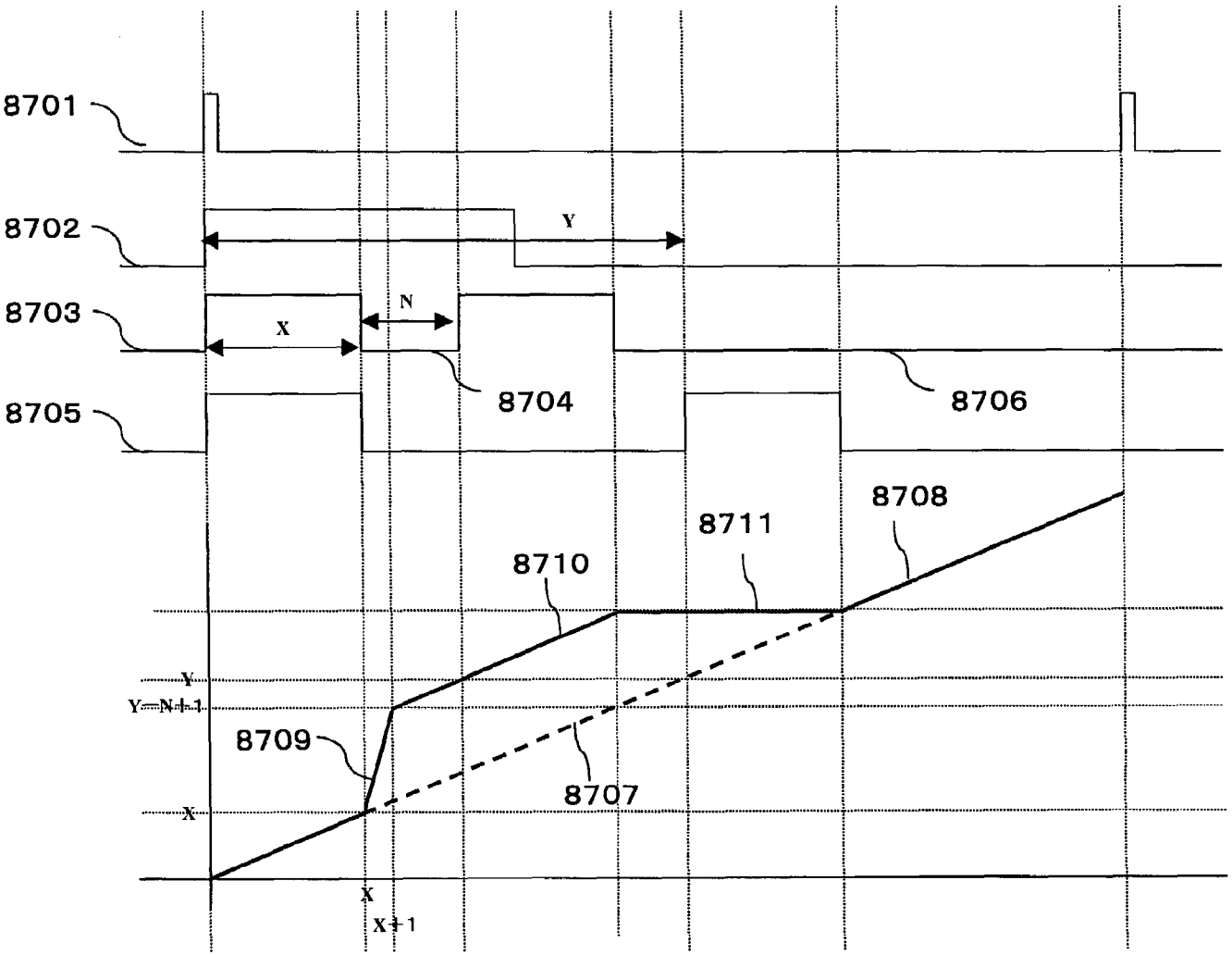
FIG. 87 is a time chart of the present invention.
Figure 88:
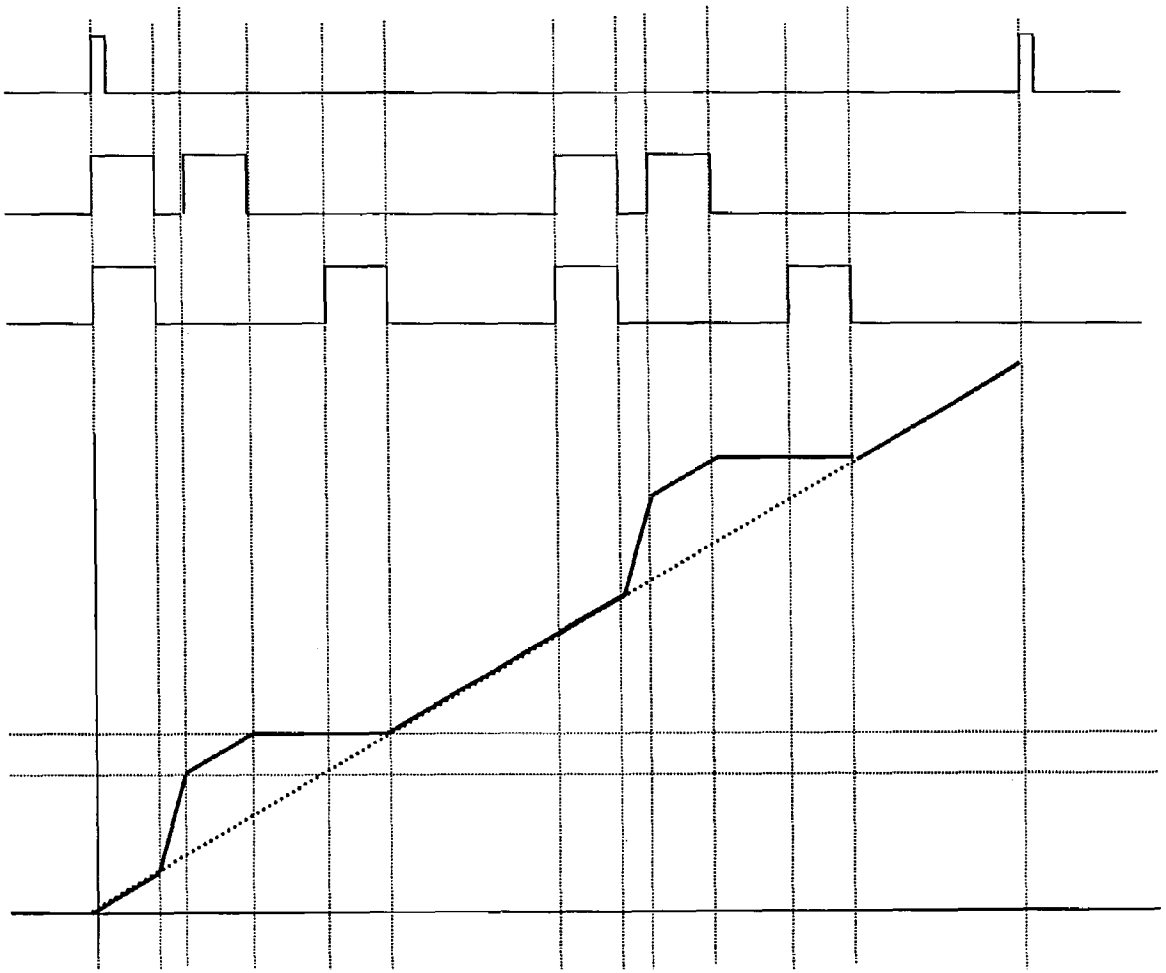
FIG. 88 is a time chart of the present invention.

Subsequently, a description will be given as to a circuit configuration of gradually changing the insertion interval of black, which uses an additional value control apparatus. The additional value control apparatus 855 is used to simultaneously control the two counters 851 and 852. The additional value control apparatus 855 uses a state of adding one by one, a state of adding the lighting rate control value and a division number of the waveform or the value derived from the insertion interval of black, and a state of adding nothing according to the circumstances so as to control the insertion interval of black. Changes in the state of the additional value control apparatus will be described by referring to FIG. 87. Reference character Y denotes a value of initializing the counter 851, and X denotes a value of rendering the output 856 LOW. Reference numeral 8701 denotes a vertical synchronizing signal, 8702 denotes a start pulse in a collective black insertion state, 8703 denotes a state in which insertion interval of black 8704 in the preceding stage is N (H), 8705 denotes a state in which the insertion interval of black 8704 in the preceding stage and insertion interval of black 8706 in the subsequent stage are almost the same intervals. As the aforementioned image deterioration occurs if it is changed from the state of 8703 to the state of 8705, the aforementioned insertion interval of black 8704 is gradually extended such as N, 2N, 3N and so on, and are eventually put in the state of 8705 so as to prevent the image deterioration. A description will be given by using the graph of FIG. 87 as to operation of the additional value control circuit 855 in the state of 8703. The broken line indicated by 8707 is the graph of the values of the counter in the case where the counters 851 and 852 rise one by one. In comparison, a graph 8708 indicated in full line is the graph of the values of the counter, where increased values of the counters 851 and 852 are controlled by the additional value control circuit 855. The additional value control circuit 855 controls the counters 851 and 852 to increase one by one until the value of the counter 851 becomes X. And the start pulse becomes LOW when the value of the counter 851 becomes X. Originally, the start pulse becomes HI next at the time of Y when the counter 851 is initialized, and there should be a Y−X (H) period in between. Here, the additional value control apparatus 855 exerts control so that the counters 851 and 852 become the value of Y−N by adding a value as indicated by 8709. Thus, the period until the start pulse becomes HI next is reduced to N (H). Here, the additional value control apparatus 855 returns the value to be added to the counters 851 and 852 to 1 as indicated by 8710. The counters 851 and 852 have their values reach Y after N−1 (H). The period until reaching the value of Y changes depending on how the value of 8709 is added. In the case where the value of 8709 is asynchronously added to the counter 851, there is a possibility that the period until reaching the value of Y may become N (H). The present invention may use either way of addition. And then, the counter 851 is initialized and the output 857 is selected, and the start pulse becomes HI again thereafter. Thus, the insertion interval of black 8704 in the preceding stage becomes N (H). The start pulse becomes LOW again X (H) after it became HI. Here, as indicated by 8711, the additional value control apparatus 855 exerts control to put the counters 851 and 852 in no addition state in order to render the values of the counters 851 and 852 equal to the value of 8707. The values of the counters 851 and 852 become equal to the value of 8707 by continuing the no addition state for the same period as the value added to the period of 8709. If the values of the counters 851 and 852 become equal to the value of 8707, the additional value control apparatus 855 returns the increased values of the counters 851 and 852 to 1. FIG. 88 shows a variation diagram of the counters 851 and 852 when changing from the division into two to division into four, and FIGS. 89 show the change in the insertion interval of black in that case. From FIGS. 89, it is understandable that it is a feasible, by using the above driving method, to implement the driving method of gradually adjusting the insertion interval of black, which has solved the problems of the image deterioration due to the rapid change in the luminance and the image deterioration due to the rapid change in the insertion interval of black.

Figure 90:
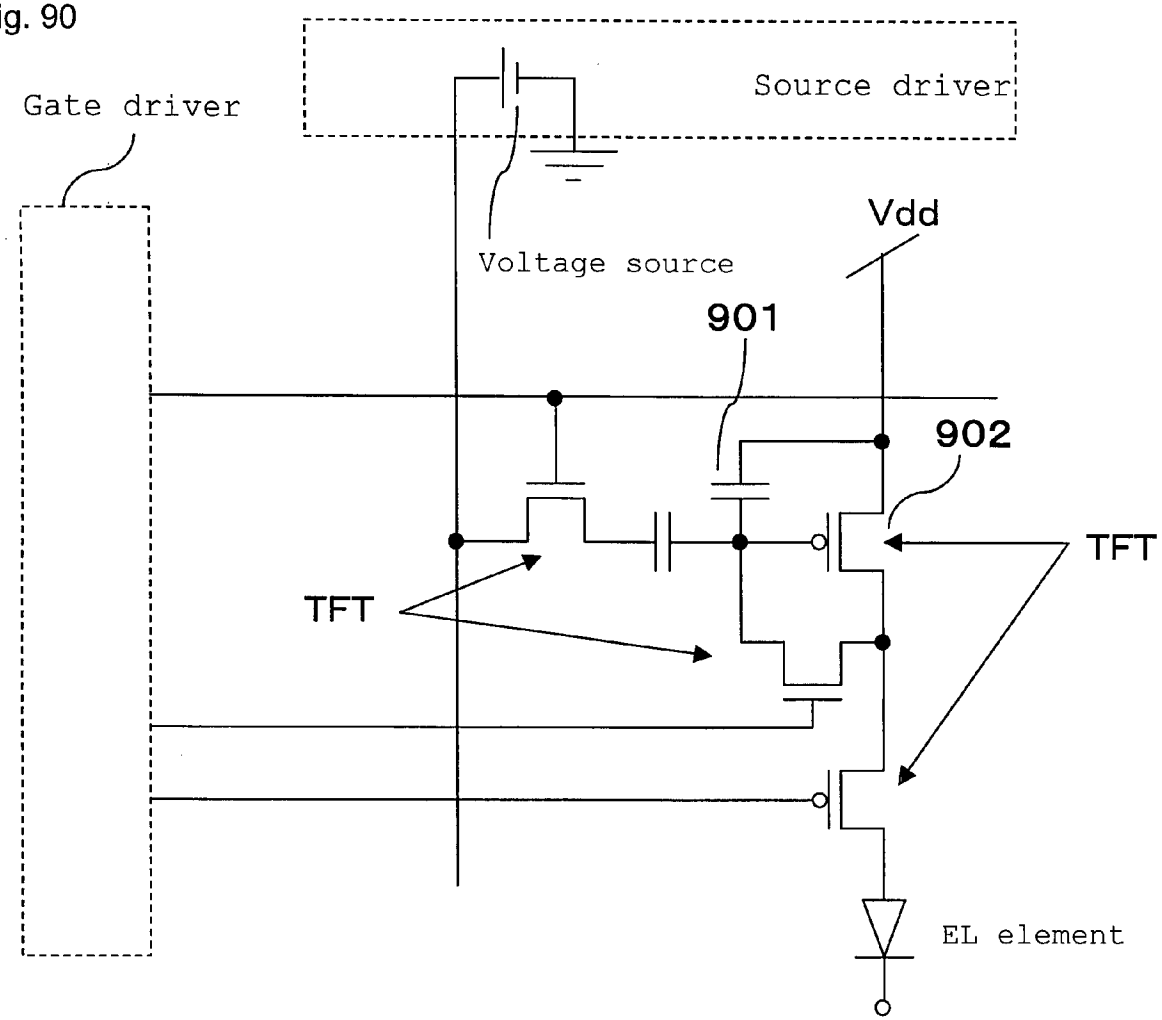
FIG. 90 is a schematic diagram of the pixel configuration.

The present invention is usable in the circuit configuration of not only FIG. 1 but of FIG. 27, if it is the circuit configuration which controls the period of applying the current to the organic EL element 15 by causing the switching transistor lid to turn on and off the current passed by the driving transistor 11*a* or 271*b* by means of the charge programmed in the storage capacitance 19. And whether the TFT used for the circuit configuration is the P channel or N-channel, it does not influence the driving method of the present invention. It is also applicable to the circuit configuration shown in FIG. 133, which is comprised of the N-channel. And it is not influenced by the configuration of the source driver 14. The driving method of the present invention is also usable for the circuit of a voltage driving method of charging a storage capacitor 901 in FIG. 90 with direct voltage to drive a driving transistor 902. It is also usable for the display of deciding the amount of current by using a mirror ratio of the TFT generally called a current mirror as in FIG. 76.

Figure 96:
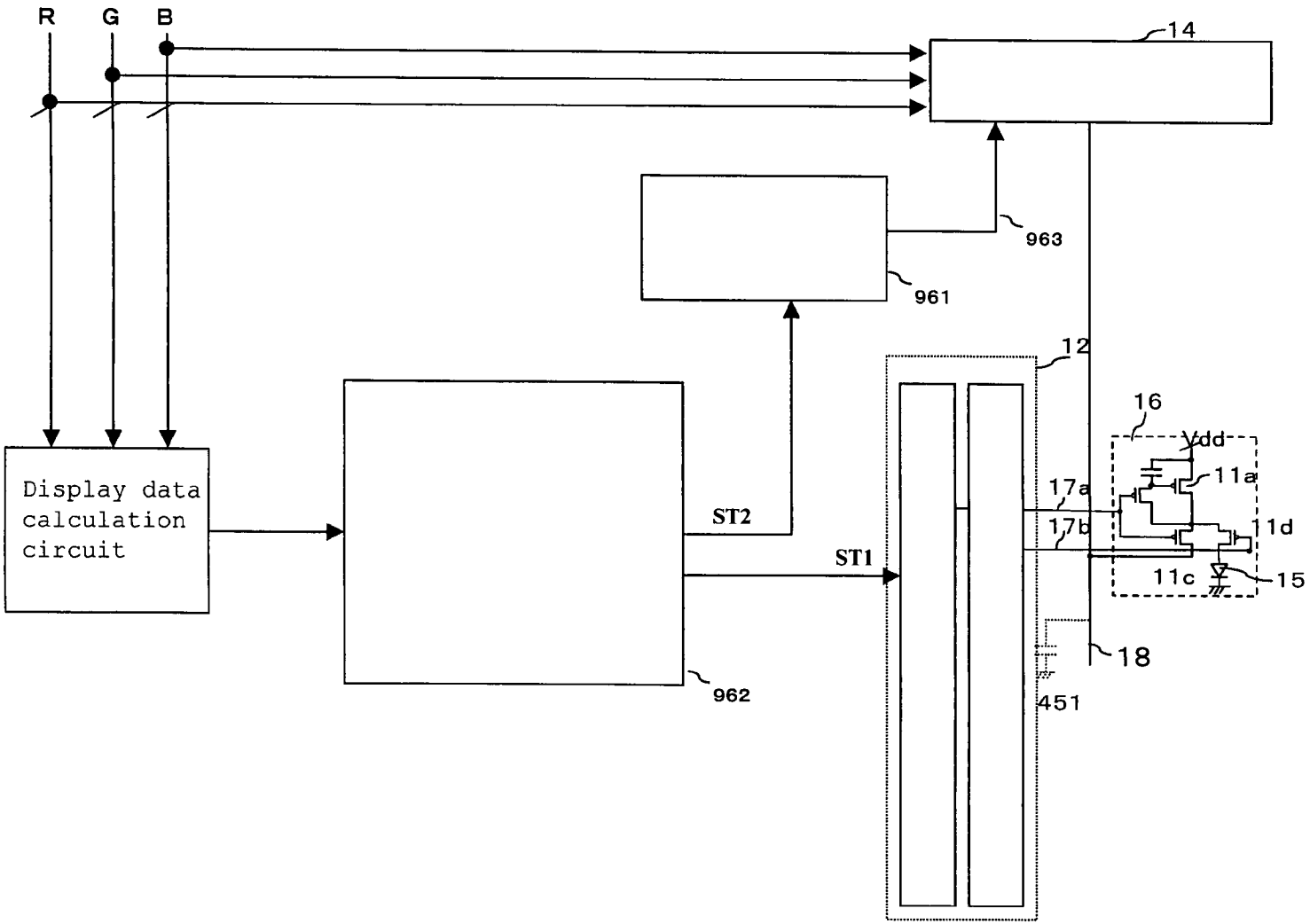
FIG. 96 is a circuit block diagram of the present invention.
Figure 97:
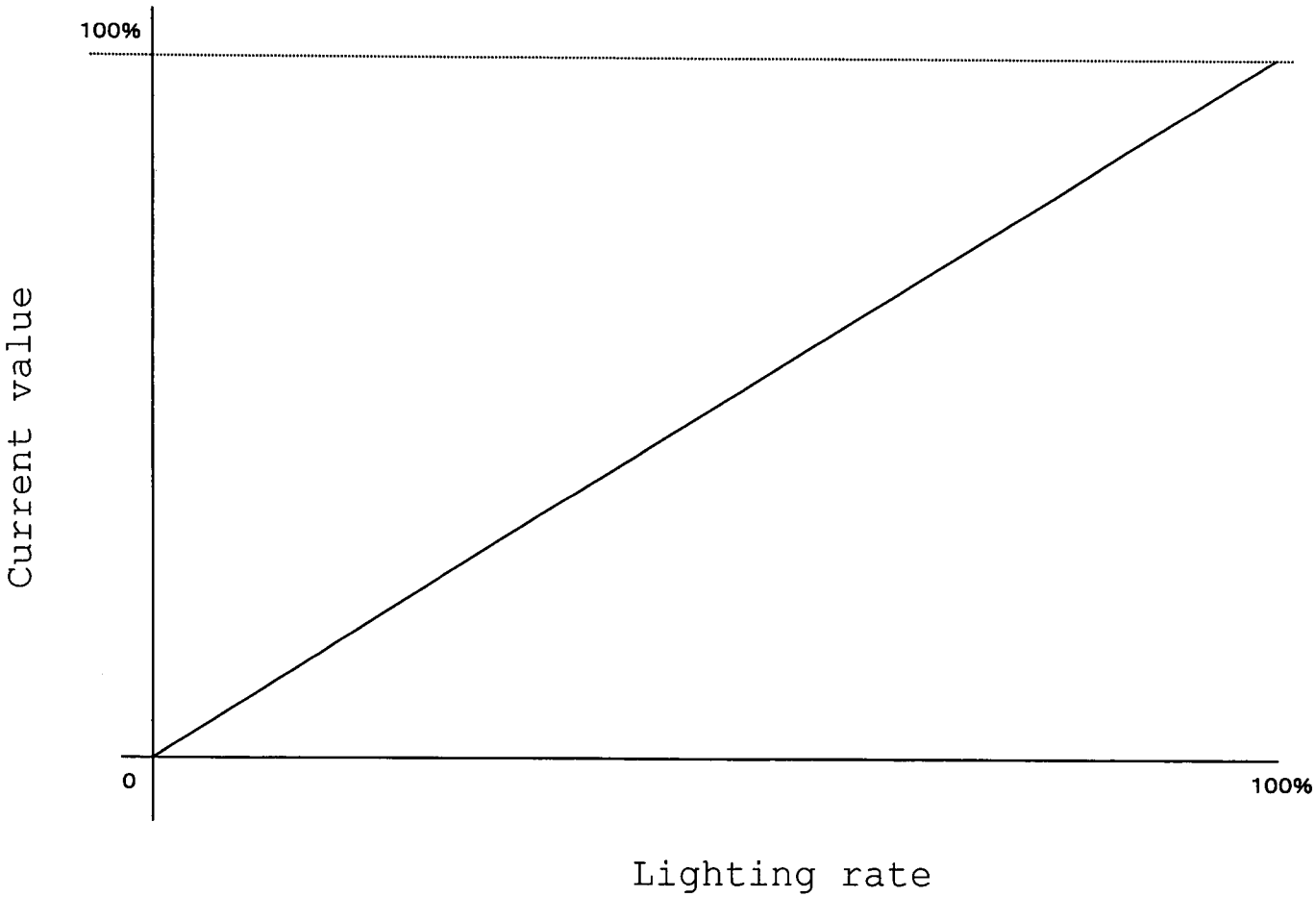
FIG. 97 is a diagram showing the relationship between the lighting rate and a current value.

This driving method is a driving method of controlling the current value of the panel by means of control of the lighting rate. However, there is also a feasible method of controlling the amount of current of the panel, wherein a signal line ST2 inputted to the gate driver IC 12 is inputted to a module of 961 for the sake of controlling the lighting rate as shown in FIG. 96, and electronic volume of the source driver 14 is controlled to have the current value according to the lighting rate as in FIG. 97 so as to adjust the current of the source signal line 18. 962 has any driving method of controlling the amount of current described in the present invention applied thereto.

Figure 91:
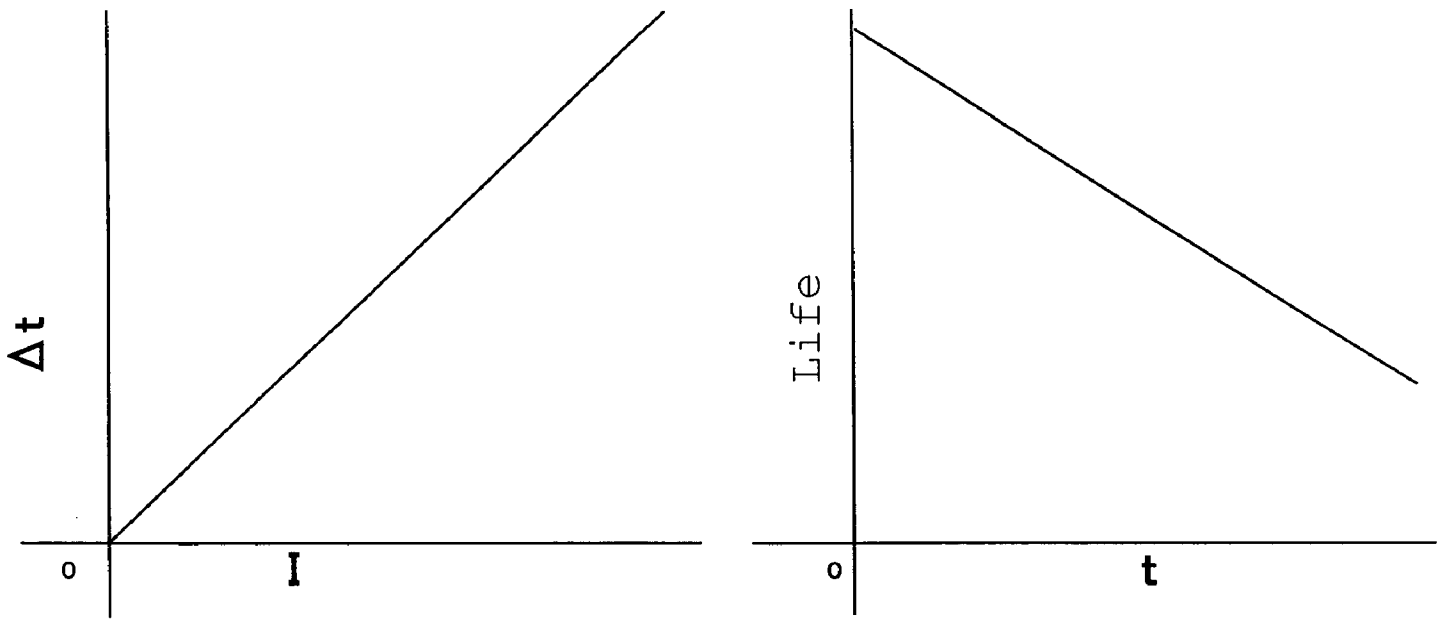
FIG. 91 are diagrams showing the relationship between temperature and life of an organic EL element.
Figure 98:
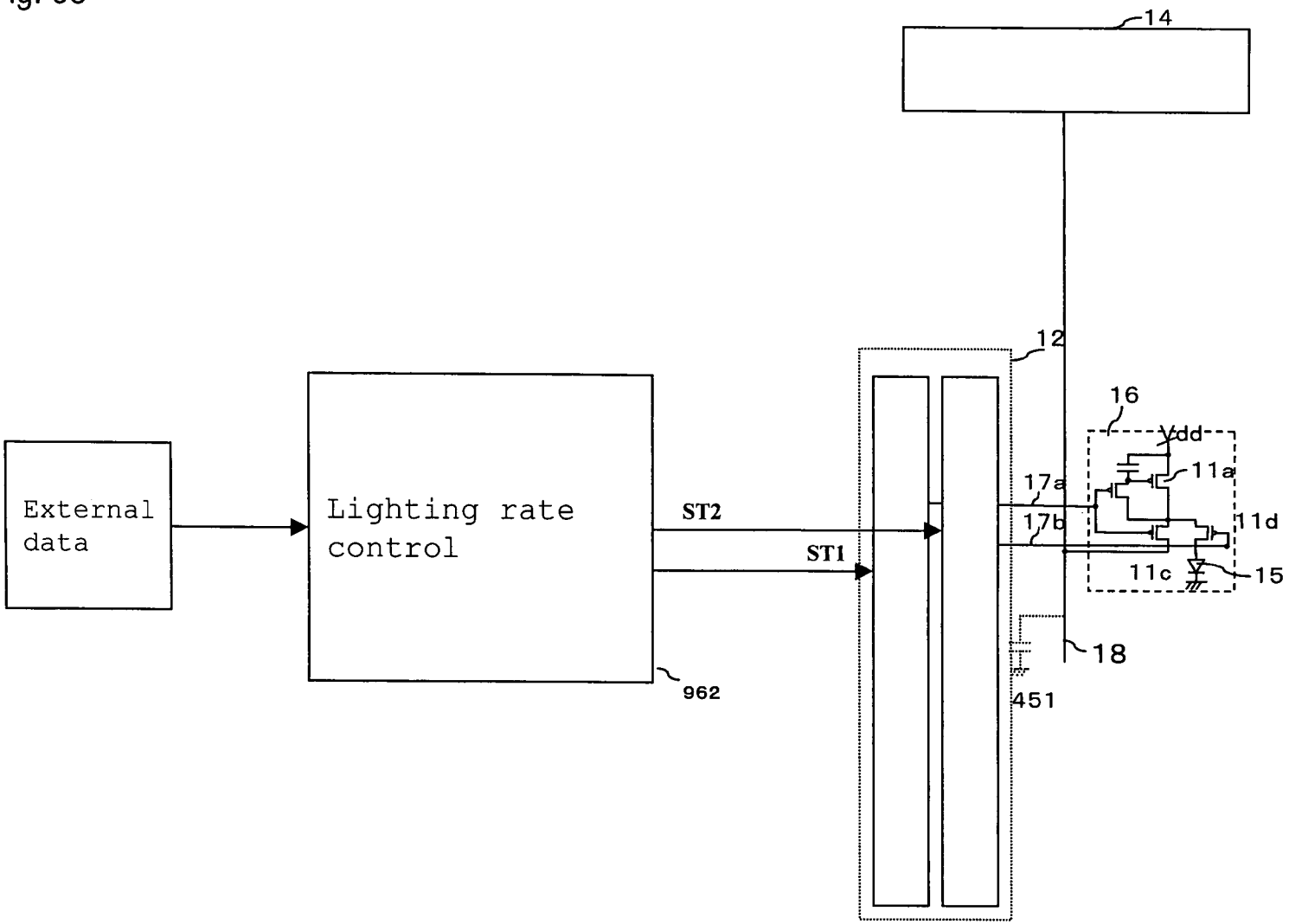
FIG. 98 is a circuit block diagram of the present invention.

The aforementioned driving method of controlling the lighting rate based on the data sent from outside as shown in FIG. 98 is effective in improving life of the organic EL element. The organic EL element has its life deteriorated if temperature t of the device increases as shown in FIG. 91. The device using the organic EL element has a temperature rise value $\Delta t$ increased in proportion to an amount of current I passing through the device. For that reason, the aforementioned driving method of controlling the lighting rate can suppress the amount of current passing through the device. Therefore, it can prevent a temperature rise of the device and improve the life of the organic EL element.

As shown in FIG. 12, the organic EL element 15 has its amount of light emission increased in proportion to the amount of current passing through it. For that reason, the display using the organic EL element can extend a range of representation of the video by controlling the current passing through the organic EL element. As previously described, however, the device using the organic EL element has its temperature increased in proportion to the amount of current passing through the device so that deterioration of the organic EL element may be caused. For that reason, the present invention proposed the driving of extending the range of representation of the video by controlling the lighting rate from the display data and thereby suppressing the amount of current passing through the device. However, this driving method is also limited as to the control over the lighting rate and so it cannot extend the range of representation of the video further than magnification of the lighting rate.

Figure 92:
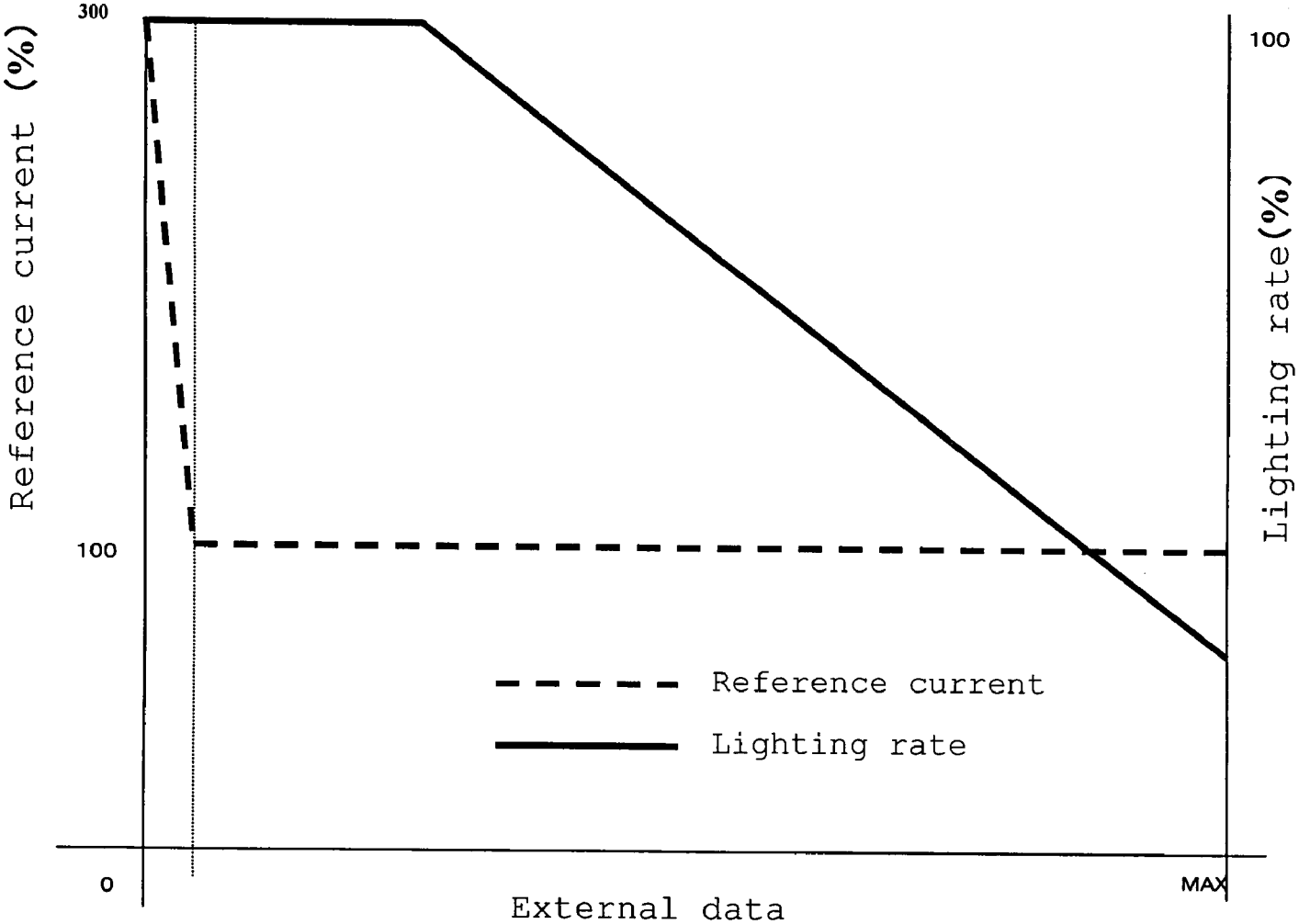
FIG. 92 is a diagram showing the relationship among data of determining a device status, a lighting rate of a device and a reference current value of a current passing through a signal line on using the present invention.
Figure 93:
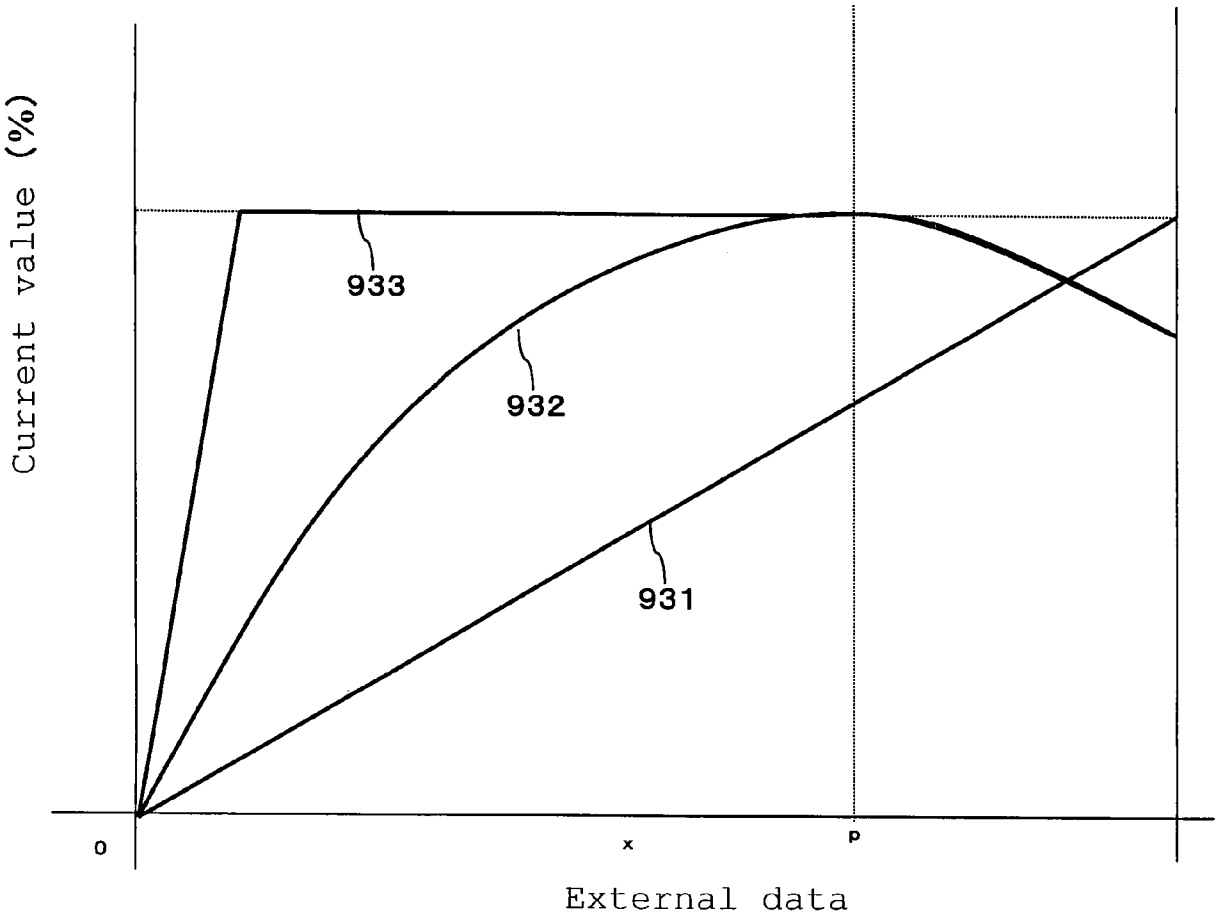
FIG. 93 is a diagram showing the relationship between the data of determining the device status and the amount of current passing through the device on using the present invention.
Figure 94:
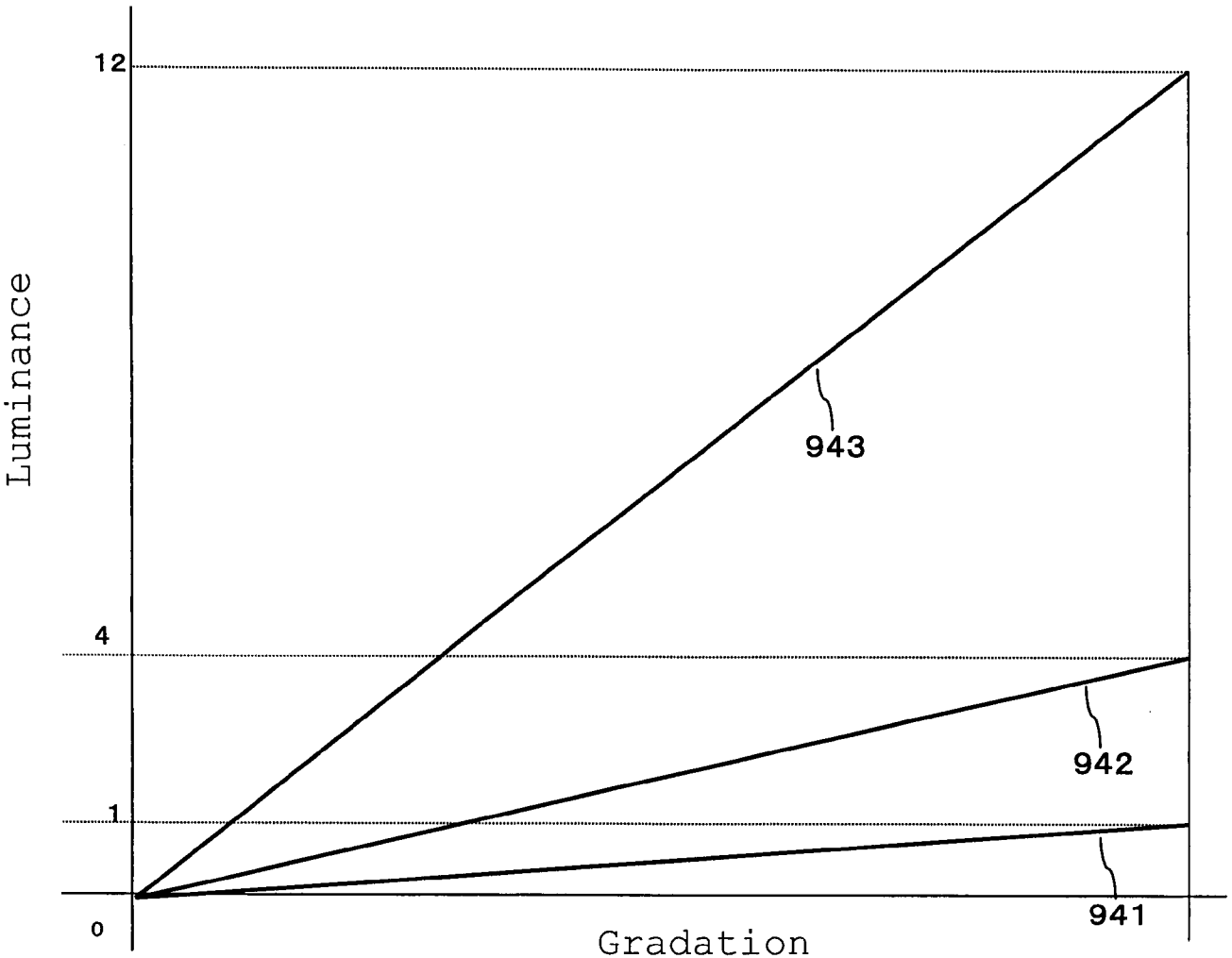
FIG. 94 is a diagram showing the relationship of an amount of light emission of the pixels on using the present invention.

Thus, the present invention proposes a driving method whereby, in the case where inputted external data is small as shown in FIG. 92, not only the lighting rate is increased but the electronic volume of the source driver 14 is controlled to control the reference current value of the current to be passed through the source signal line so as to increase the amount of current passing through the pixels and extend the range of representation of the video of the display using the organic EL element. FIG. 93 shows a diagram of the external data and the amount of current of the entire device when using this driving. Reference numeral 931 denotes a current value when not using this driving, and 932 denotes a current value when using a lighting rate suppression drive of the present invention. Furthermore, reference numeral 933 denotes a current value obtainable when controlling the electronic volume, where external data x is $0 \leqq x \leqq p$ if the value of the external data as a maximum current value in the lighting rate control drive is p as in this drawing, which is the range of changing the electronic volume. FIG. 94 shows a relationship diagram between the gradation and the luminance per pixel. Reference numeral 941 denotes a relationship diagram in the case of performing no lighting rate control drive. 942 denotes a relationship diagram at the maximum lighting rate in the case of performing the lighting rate. 943 denotes a relationship diagram in the case of performing reference current control drive in addition to the lighting rate control drive. In the case of a configuration in which the current can be passed only in relation to 941 due to the life and battery, 942 can be lit up to be four times brighter than 941 by performing the lighting rate control drive at the ratio of 3:1 between the maximum and the minimum of the lighting rate. Furthermore, in the case of further rendering the reference current value variable up to three times with the electronic volume of the source driver 14, it is possible to emit light from 943 to be further three times brighter than that from 942 and twelve times brighter than that from 941 so that the representation range per pixel becomes twelve times larger. This allows great diversity of image representation.

To increase the amount of current passing through the organic EL element 15, the electronic volume of the source driver 14 should be controlled as previously described. The method of controlling it is not limited to the electronic volume, but it is also possible to change the voltage by using a D/A converter. Even in the case of the configuration of directly charging the storage capacitance 19 with voltage, the present invention is applicable if it has a structure capable of controlling the voltage to be charged by means of digital data.

Figure 95:
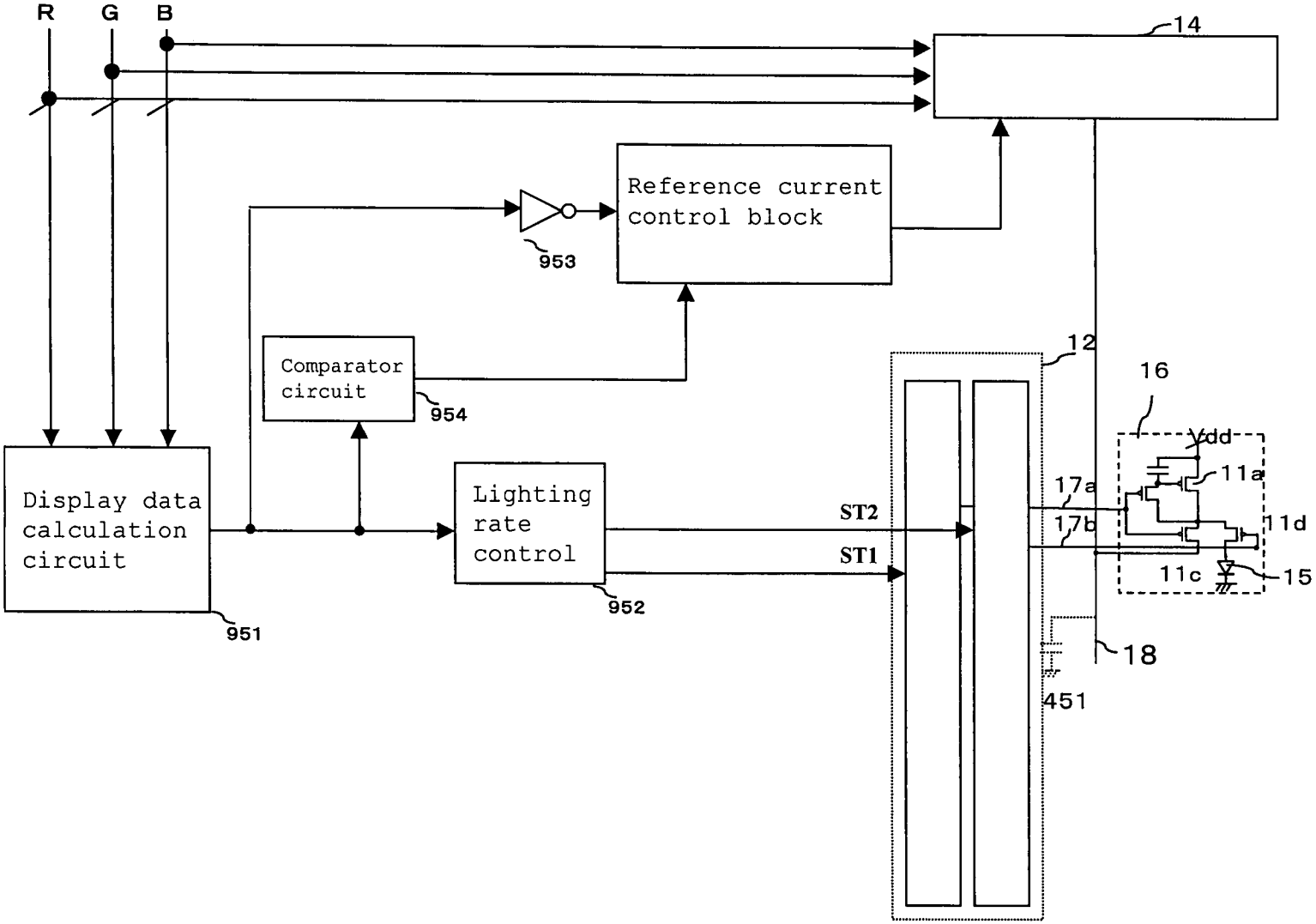
FIG. 95 is a circuit block diagram of the present invention.

As for setting of the electronic volume, the output of a display data calculation circuit 951 should be used. In FIG. 95, the display data has RGB which is the video data therein. However, any data capable of checking a device status such as temperature data using the thermistor may be used. As for the structure, 951 has the same structure as 552. A difference from 552 is that 951 outputs the bits up to a few bits further below the number of bits necessary to control the lighting rate. In the case where the number of bits necessary for 952 to control the lighting rate is 8 bits, if it is designed to output high-order 10 bits of the total value of the video data, the high-order 8 bits of the 10 bits are used to control the lighting rate. In that case, the remaining low-order 2 bits can be considered as a decimal portion of the high-order 8 bits. In the case of controlling the electronic volume in an area in which the electronic volume of the source driver 14 is 6 bits and the lighting rate is less than 1 as a decimal number, 951 further adds 6 bits of controlling the electronic volume in the decimal portion to the 8 bits necessary to control the lighting rate so as to output 14 bits in total. This is just an example, and it is also possible to output 15 bits or more of the output of 951 and use the high-order 8 bits thereof for the lighting rate control and the low-order 6 bits for the electronic volume control. It is also possible to have the bits used for the light ingrate control and the bits used for the electronic volume control overlapping. For instance, in the case where 951 outputs 10 bits and uses the high-order 8 bits for the lighting rate control and the low-order 6 bits for the electronic volume control, the same bits are used for the low-order 4 bits for the data on the lighting rate control and the high-order 4 bits for the electronic volume control. While both the lighting rate control and electronic volume control are to control the amount of light emission of the device, there is no problem video-wise since they have the same direction of controlling the brightness (whether to brighten or darken it). To put it all together, when 951 outputs X bits in the state of requiring a bits for the lighting rate control and b bits for the electronic volume control, high-order a bits of the output of 951 should be used for the lighting rate control and the low-order b bits should be used for the electronic volume control. The output data of 951 is inverted by a NOT circuit 953, because the change in the electronic volume and the display data are in a relation of inversion in which the value of the electronic volume increases if the display data decreases. In the case of performing a drive as in FIG. 92 in which the smaller the display data is, the higher the lighting rate becomes, it becomes a structure in which the smaller the display data is, the larger the value of the electronic volume becomes. For that reason, the structure in which the electronic volume becomes larger if the data is smaller is implemented with one NOT circuit by inverting the data with the NOT circuit. Thus, it can be implemented without extending the circuit scale.

A comparator 954 outputs an enable signal to a block of controlling the electronic volume. The comparator 954 outputs the enable signal on judging whether or not the high-order (N−n) bit is 0 when the data outputted from 951 is N bits and the electronic volume is controlled with low-order n bits. It is there by possible to implement the circuit configuration of controlling the electronic volume with specific display data or less without extending the circuit scale.

Figure 99:
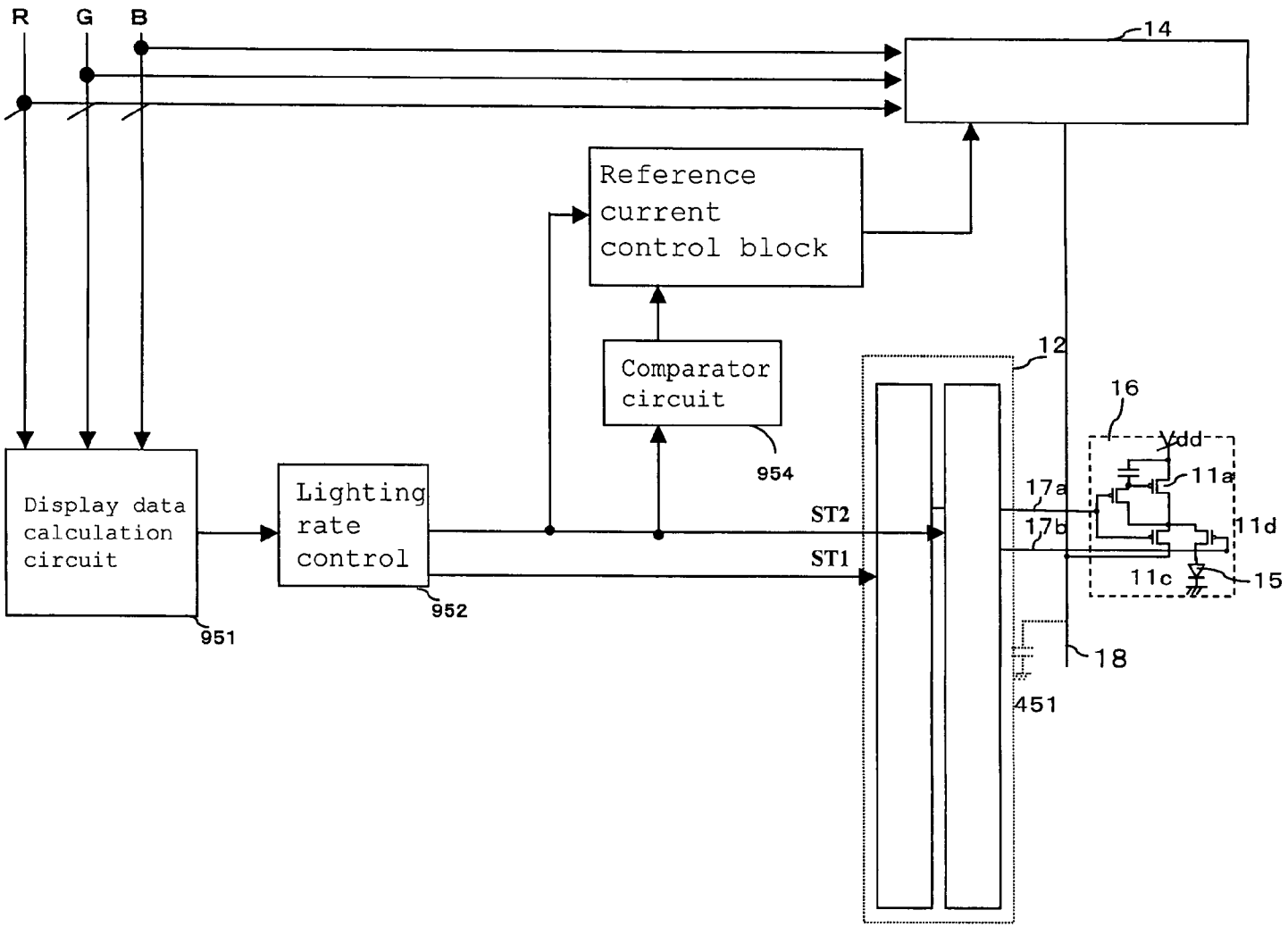
FIG. 99 is a circuit block diagram of the present invention.

It is also possible, as shown in FIG. 99, to use a few low-order bits of the values of controlling the lighting rate. The principle of operation is the same as the previous description. However, it is not necessary to have the NOT circuit because the higher the lighting rate is, the larger the value of the electronic volume should become in the case of exerting control with the values of controlling the lighting rate. This method is effective since it can be used simultaneously with a delay process in the case of using a module of performing the delay process of preventing the flicker when creating the data controlling the lighting rate from the display data as in FIG. 61.

As for whether or not the NOT circuit is necessary, it also changes depending on the configuration of the electronic volume of the source driver 14. The NOT circuit becomes necessary or unnecessary depending on whether the switch of the electronic volume operates at HI or at LOW.

This method controls the electronic volume by using the signal line used to control the lighting rate so as to control the electronic volume with almost no extension of the circuit scale. It is also possible to extend the representation range per pixel by means of this process and thereby allow great diversity of image display.

Figure 111:
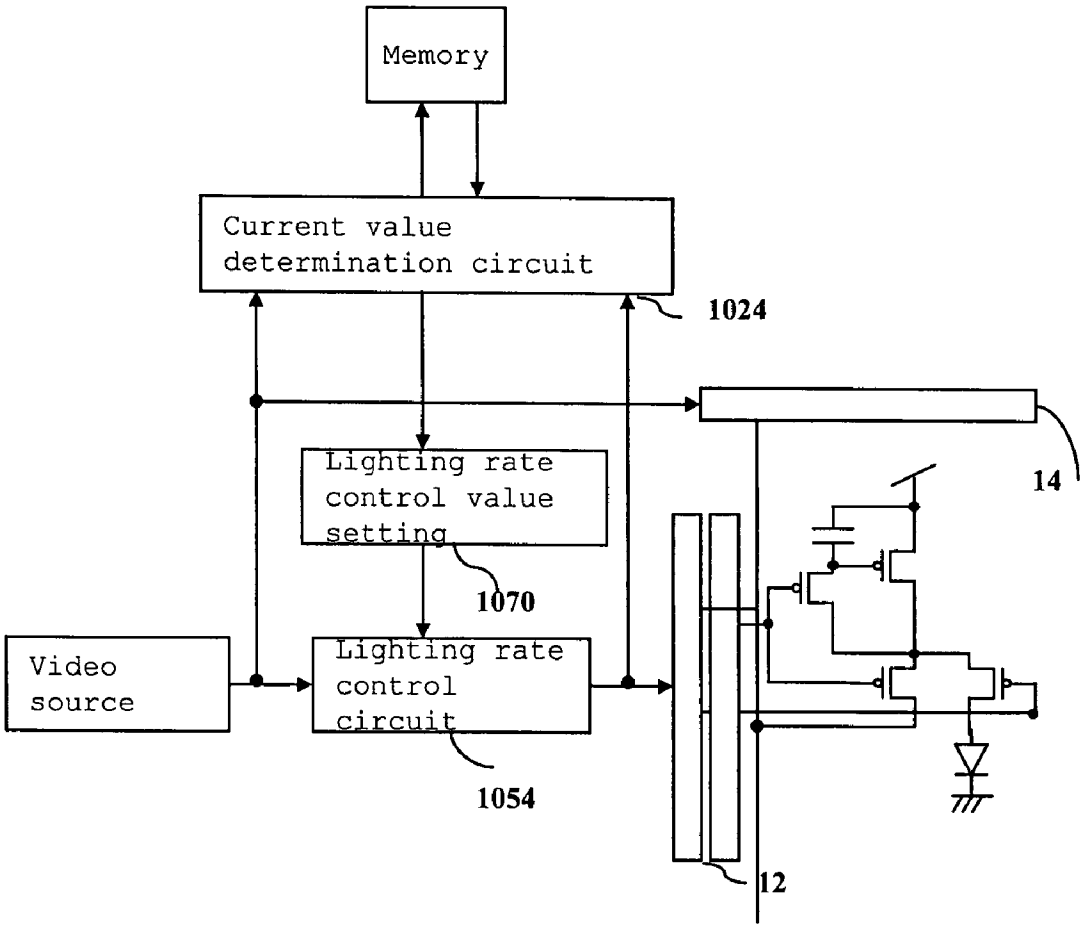
FIG. 111 is a circuit block diagram of the present invention.

The deterioration of the organic EL element depends on the temperature of the device. And the temperature rise of the device mainly depends on the total amount of current passing through the device and the amount of current passing through the element. For that reason, a mechanism of manipulating the amount of current according to the temperature of the device is necessary in order to prevent the deterioration of the organic EL element. There is a method, as one of the methods of sensing the temperature of the device, of placing the thermistor in the device and converting it to the digital data with the thermistor and A/D converter to sense it. However, this method requires placement of the thermistor inside the device or inside the pixel, and further requires the A/D converter to sense it as the digital data. Therefore, this method has a problem that it extends the circuit scale. For that reason, the present invention proposes a driving method of controlling the temperature by using a mechanism of controlling the number of lit-up scanning lines from the video data indicated earlier as shown in FIG. 111.

Figure 102:
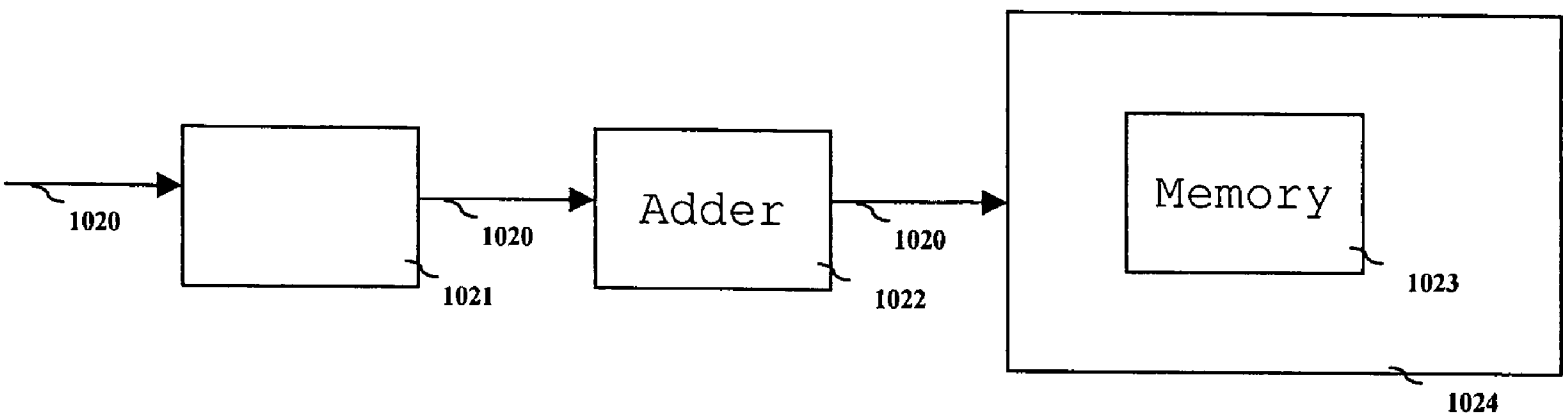
FIG. 102 is a circuit block diagram of the present invention.

FIG. 29 show the relation between the video data and the number of lit-up horizontal scanning lines in the case of performing the driving method of controlling the number of lit-up scanning lines from the video data indicated earlier. The relation between the number of lit-up scanning lines and the current passing through the device is as indicated by 1010. Thus, it is possible to grasp the amount of current passing through the device by performing the arithmetic processing from the number of lit-up horizontal scanning lines and the video data. The circuit configuration as in FIG. 102 is used for that purpose. Reference numeral 1020 denotes the video data to be displayed on the device. Reference numeral 1021 denotes a circuit of processing inputted video data. In the case where the three colors of RGB are inputted and there are differences in the amount of current passing through the device among R, G and B, it is possible to calculate more accurate current values by assigning weights to the data in 1021. In the case where the data does not have to be highly accurate, it is possible, although the data becomes less accurate, to reduce the circuit scale by cutting a few low-order bits in 1021 and thereby reducing the amount of data itself. Reference numeral 1022 denotes a circuit of adding the data outputted from 1021. Ordinary video data is displayed at between 50 Hz and 60 Hz, and so the video data changes at the same speed. As previously described, however, the number of lit-up scanning lines is gradually changed over a few frames in order to prevent the deterioration such as the flicker of the image, and the video seldom has the images continuously changed a lot by one frame. For that reason, the data of a few frames is added by ( ) and is divided by the number of added frames so as to acquire an average current value of a few frames. In this case, the number of added frames should desirably be 2 raised to n-th power. In the case where the number of added frames is not 2 raised to n-th power, it is necessary to use a divider in order to take an accurate average so that the circuit scale becomes larger. In the case where the number of added frames is 2 raised to n-th power, the same effect as performing the division is obtained by shifting the additional value to the LSB side by n bits so as to allow reduction in the circuit scale. As previously described, the number of lit-up horizontal scanning lines changes over 10 to 200 frames. Thus, it is desirable that the average data of 16 to 256 frames be acquired as to the output of 1022. In the case of the video data of 60 Hz, it takes 60 frames per second. Therefore, on seeking the average of 64 frames in particular, the output data of 1022 can be regarded as an average amount of current per second so that it is easy to grasp the amount of current.

The output of 1022 is inputted to a circuit 1024 of grasping the current value of a certain period including an FIFO memory 1023. The FIFO memory 1023 is a memory having a counter of controlling a writing address and a reading address built therein, and is capable of simultaneously viewing the latest data and the oldest data inside the memory. Therefore, it is possible, by using the FIFO memory, to constantly grasp current data of a certain period. In this case, the memory does not always have to be FIFO. If the counter of reading and writing addresses is prepared and controlled so as to control new data and old data, it is equal to using FIFO.

Figure 103:
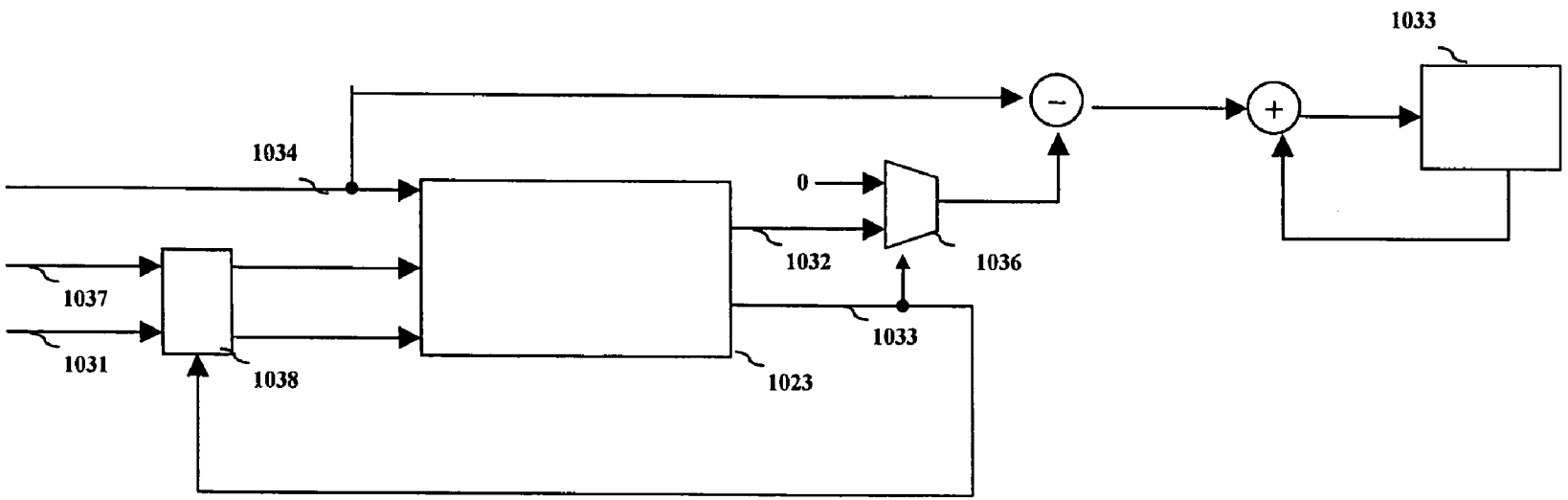
FIG. 103 is a circuit block diagram of the present invention.

A description will be given by using FIG. 103 as to the mechanism of the circuit 1024 of grasping the current value of a certain period, which uses the FIFO memory. As previously indicated, the FIFO memory is a memory having the counter of controlling the writing address and reading address built therein. If the writing address comes immediately before the reading address, the FIFO memory outputs a FULL signal 1030. This indicates that the writing address has come immediately before the reading address. In other words, it indicates that output data 1032 from FIFO in the state of having the FULL signal 1030 outputted is the oldest data in the FIFO memory. Reference numeral 1033 denotes a register of storing a total additional value of the data inside FIFO. As FIFO has a structure of replacing the data, a difference between output-side data 1032 and input-side data 1034 is taken and is added in 1035. Reference numeral 1036 denotes a selector of selecting the output data 1032 from FIFO or 0 by means of the FULL signal. It selects the output from FIFO when the FULL signal is outputted and selects 0 when not outputted so that the difference between the latest data and the oldest data in the FIFO memory is inputted to 1033. It is also possible, by taking this method, to guarantee the period from the start until the FIFO memory is filled so as to improve the accuracy of the circuit. A write enable signal 1031 and a read enable signal 1037 exist in the FIFO memory. When the enable signal is inputted, the input data is written to the writing address and the output data 1033 is read by the clock to which the FIFO memory is inputted. The write enable signal and read enable signal are controlled by the FULL signal by means of a circuit of 1038. The read enable signal is inputted to FIFO only when the FULL signal is outputted, and the write enable signal is not inputted to FIFO when the FULL signal is outputted. It is possible, by using such a circuit configuration, to improve the accuracy of internal data of the FIFO memory.

Figure 104:
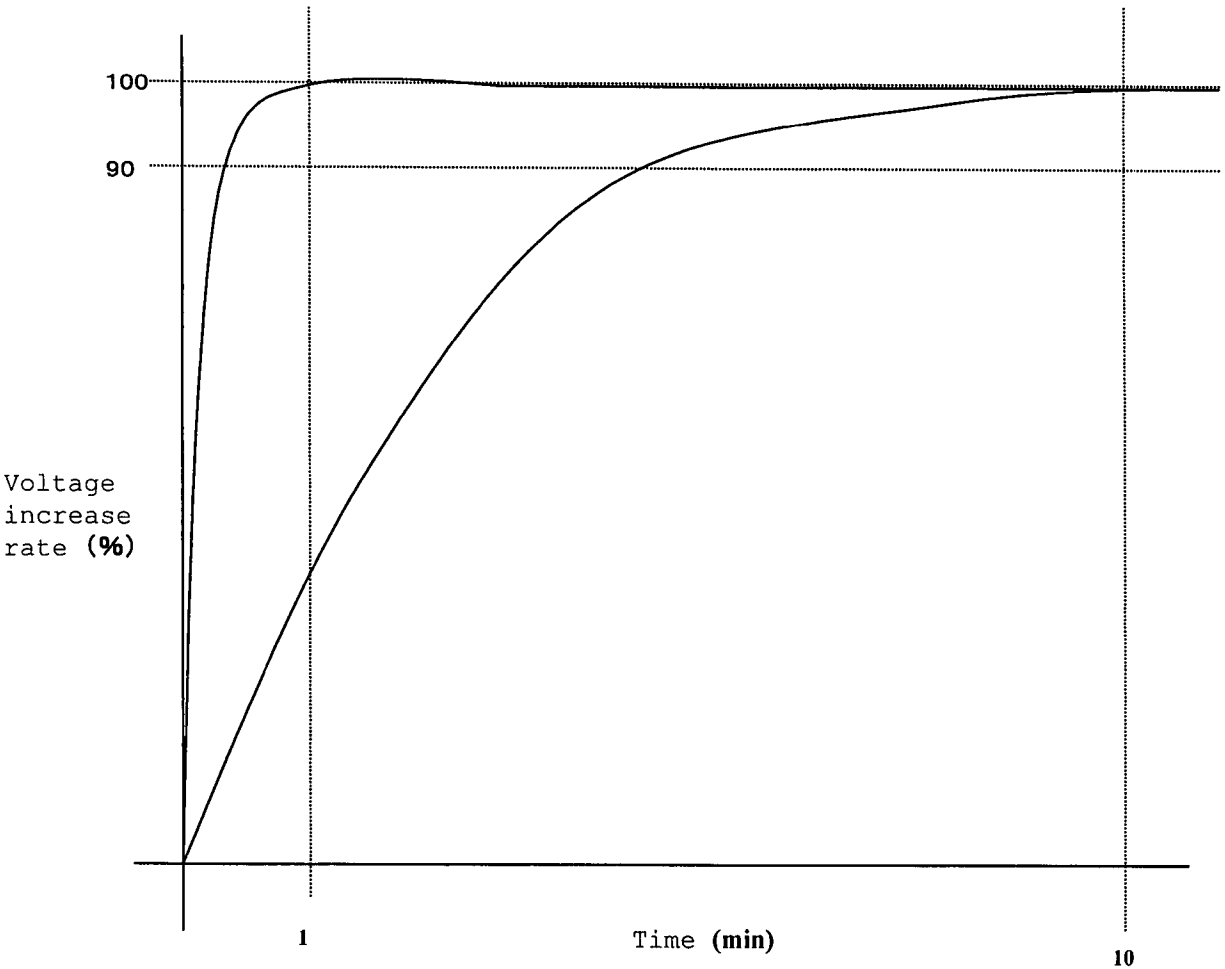
FIG. 104 is a diagram showing the relationship of a temperature rise rate of the device.

A measurement period of accumulable data, that is, the amount of current changes according to the capacity of the FIFO memory. As shown in FIG. 104, a time until saturation of the temperature rise of the device changes according to light emission area. It takes one minute in the case where the light emission area is small, and it takes ten minutes in the case where the light emission area is large. For that reason, it is necessary to prepare a memory capable of grasping the current values between the present and 1 to 10 minutes in the past. The time until saturation of the current also changes according to the size of the device, radiation conditions and materials of the organic EL element, and so it may be necessary to grasp the current values for a longer time depending on the conditions.

Figure 105:
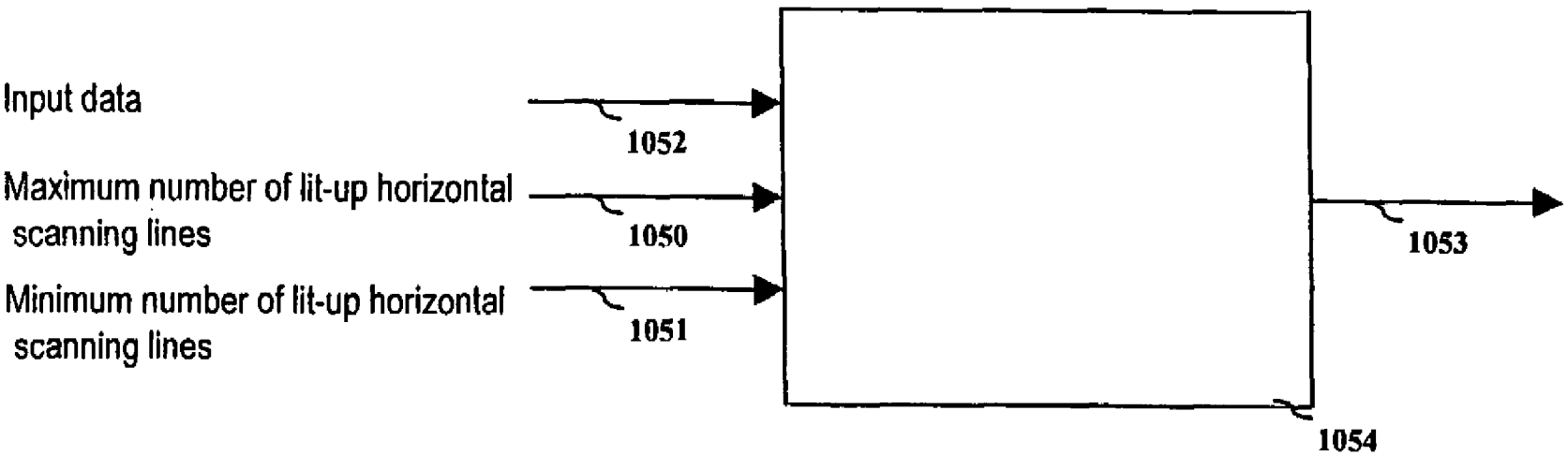
FIG. 105 is a circuit block diagram of the present invention.
Figure 106:
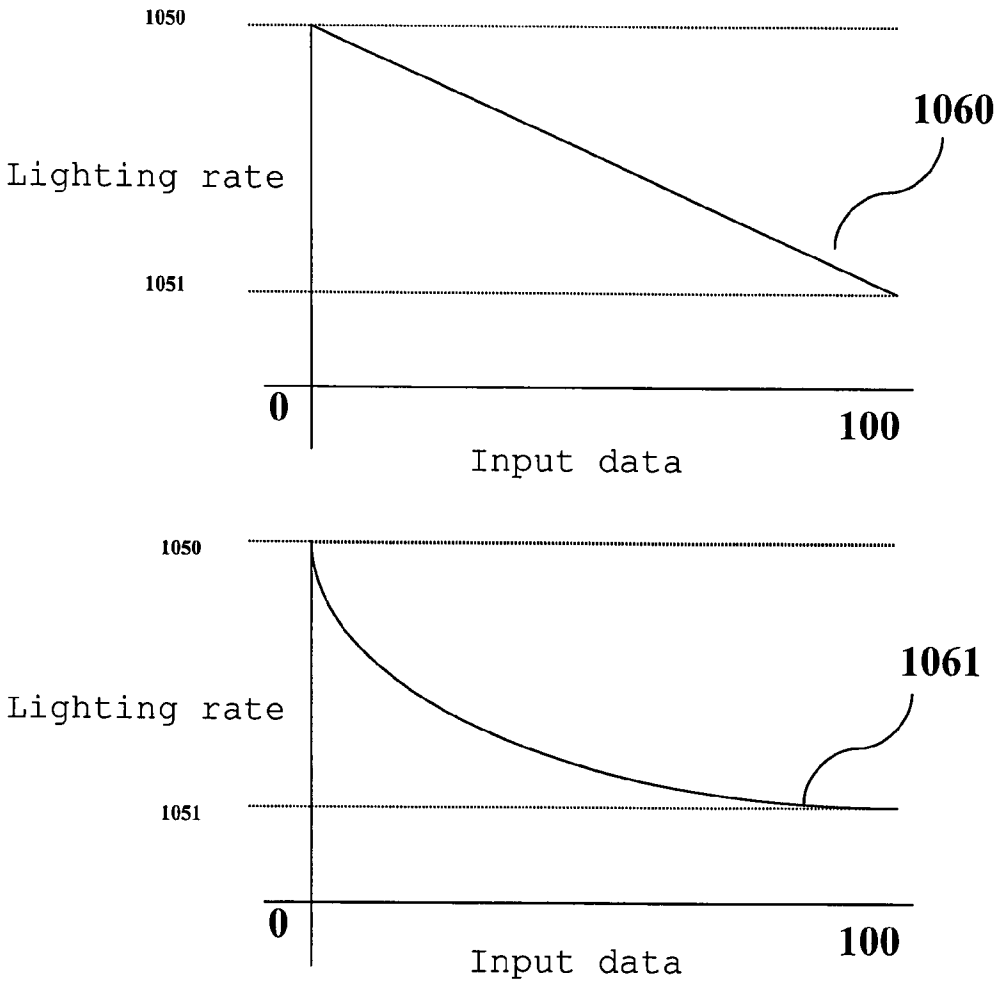
FIG. 106 is a diagram showing a relationship between the input data and the number of lighting horizontal scanning lines.
Figure 107:
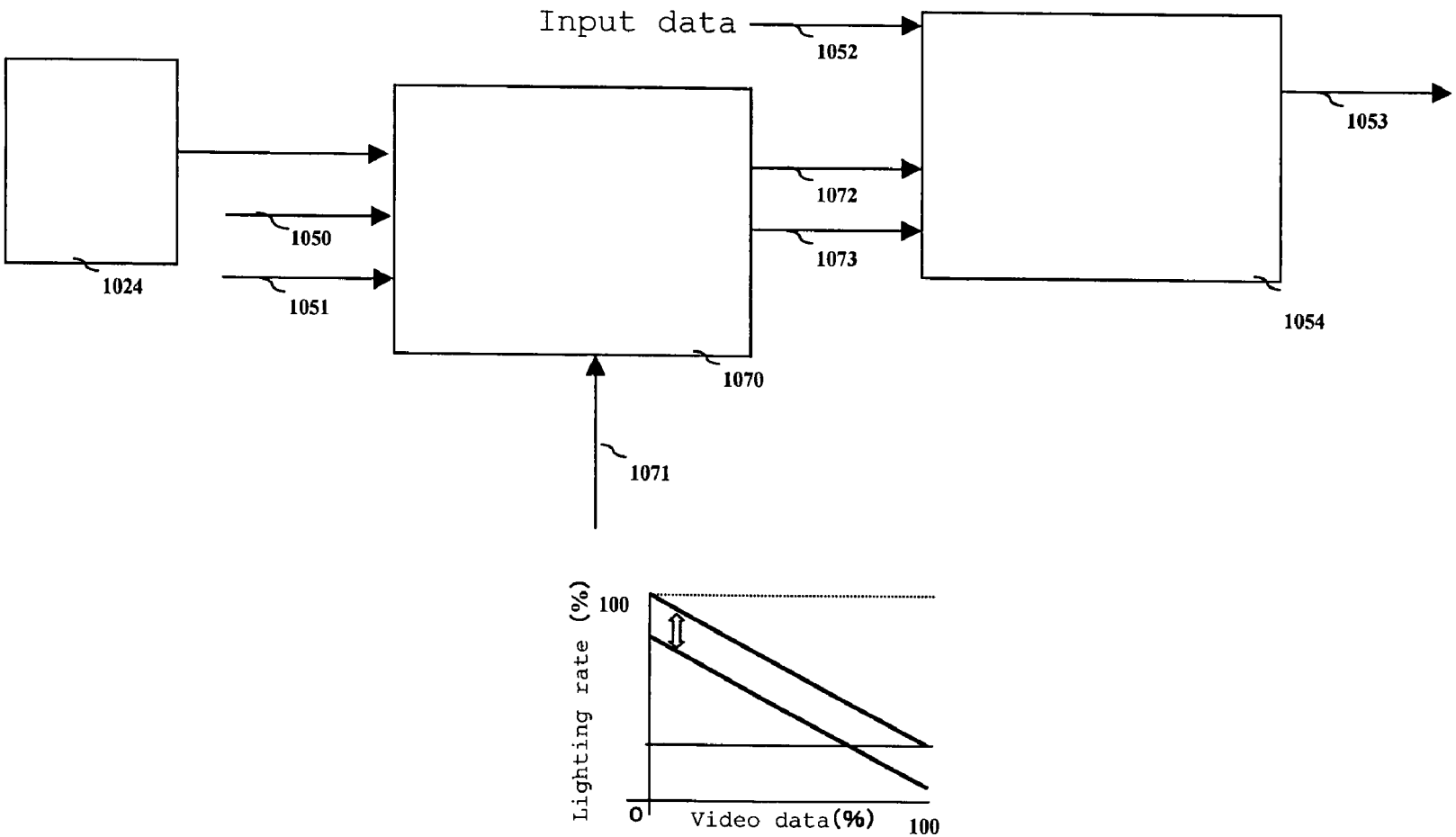
FIG. 107 is a circuit block diagram of the present invention.
Figure 108:
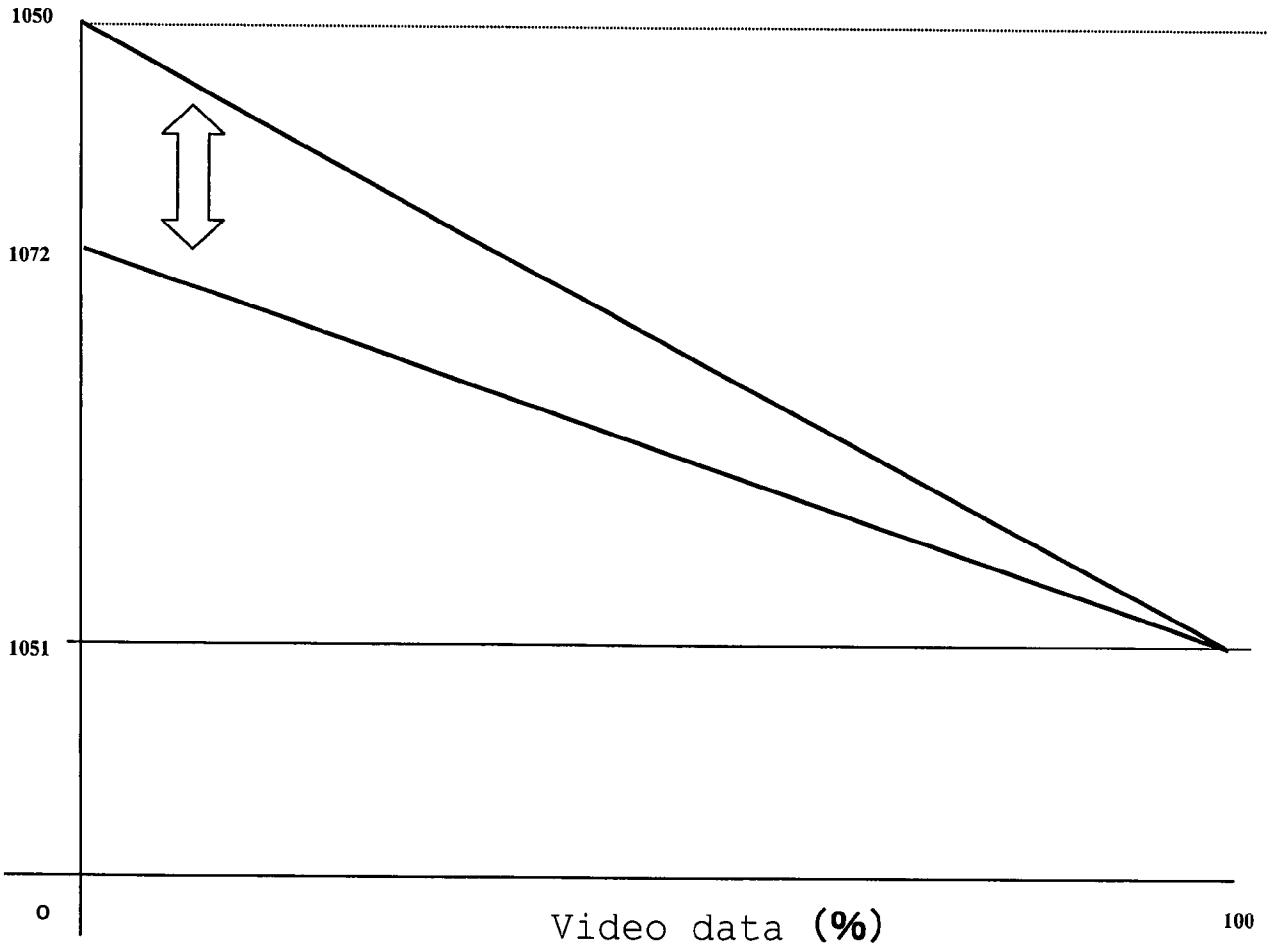
FIG. 108 is a diagram showing a relationship between the input data and the number of lighting horizontal scanning lines.

Next, a method of controlling the amount of current will be described by referring to FIG. 105. As previously described, the present invention manipulates the number of lit-up horizontal scanning lines from the video data and thereby controls the lighting time so as to suppress the amount of current. As a method of controlling the number of lit-up horizontal scanning lines from the video data, a maximum number of lit-up horizontal scanning lines 1050 and a minimum number of lit-up horizontal scanning lines 1051 are inputted to a lighting rate control circuit 1054. Calculation is performed from these two points to derive the relation between the video data and the number of lit-up horizontal scanning lines, and output data 1053 is outputted according to input data 1052. As for the method of calculation, the difference between 1050 and 1051 should be taken and divided by the division number according to the video data so as to acquire the inclination. In this case, the relation becomes proportional if the difference between 1051 and 1050 is equally divided as in 1060, and it is also possible to draw a curve by weighting and dividing it as in 1061. As shown in FIG. 107, the present invention suppresses the current by using a circuit 1070 of controlling 1050 and 1051 with an output value of 1024. 1071 inputted to 1070 is intended to input a boundary value of whether or not to suppress the current. In the case where the output from 1024 is larger than 1071, the current is suppressed. In the case where the output from 1024 is smaller than 1071, the current is not suppressed. Suppression of the current is performed by manipulating the maximum number of lit-up horizontal epe*ating scanning lines 1050 and the minimum number of lit-up horizontal scanning lines 1051 previously described. In the case where the output from 1024 is larger than 1071, the current is suppressed by outputting 1072 and 1073 to which the values have been reduced from the inputted maximum number of lit-up horizontal scanning lines 1050 and minimum number of lit-up horizontal scanning lines 1051. As for the method of reduction, there is a method of reducing them by a fixed amount in the case of exceeding 1071 or a method of calculating the difference between the output of 1024 and 1071 and reducing them by that value. The latter can minutely control a suppression amount of current so as to improve the accuracy of the suppression amount. In the case of controlling 1051 and 1050, it is not necessary to reduce them by the same value. A method of reducing only 1050 is also thinkable as in FIG. 108.

Figure 109:
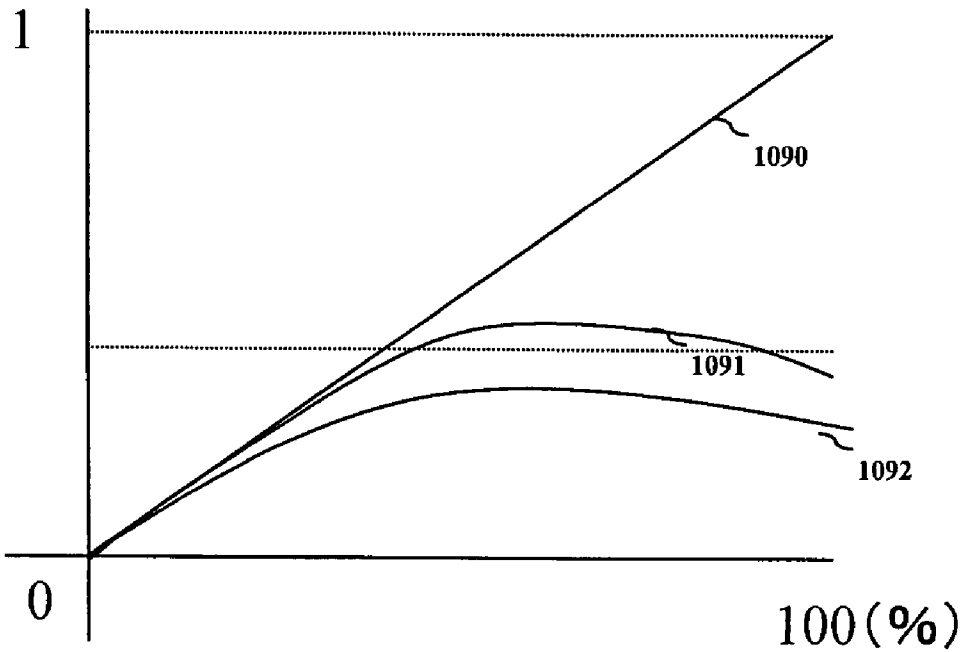
FIG. 109 is a diagram showing the relationship between the input data and the temperature rise.

FIG. 109 shows the relation between the number of lit-up horizontal scanning lines and the video data in the case of controlling the maximum number of lit-up horizontal scanning lines 1050 and the minimum number of lit-up horizontal scanning lines 1051, and the relation of the amount of current passing through the device against the video data in the case of controlling them.

1093 is the case of not controlling the number of lit-up horizontal scanning lines at all. 1094 is the case of controlling the number of lit-up horizontal scanning lines. 1095 is the case of controlling 1051 and 1050. If the amount of current is suppressed for a fixed period of time, the data inputted to 1033 during that time becomes smaller. Consequently, the value outputted from 1024 becomes smaller and a suppression value of the current becomes smaller, so that the status such as 1090 again returns. It is thereby possible to perform the driving of suppressing the temperature rise only with the video data without measuring the temperature by using the external circuit such as the thermistor.

Figure 110:
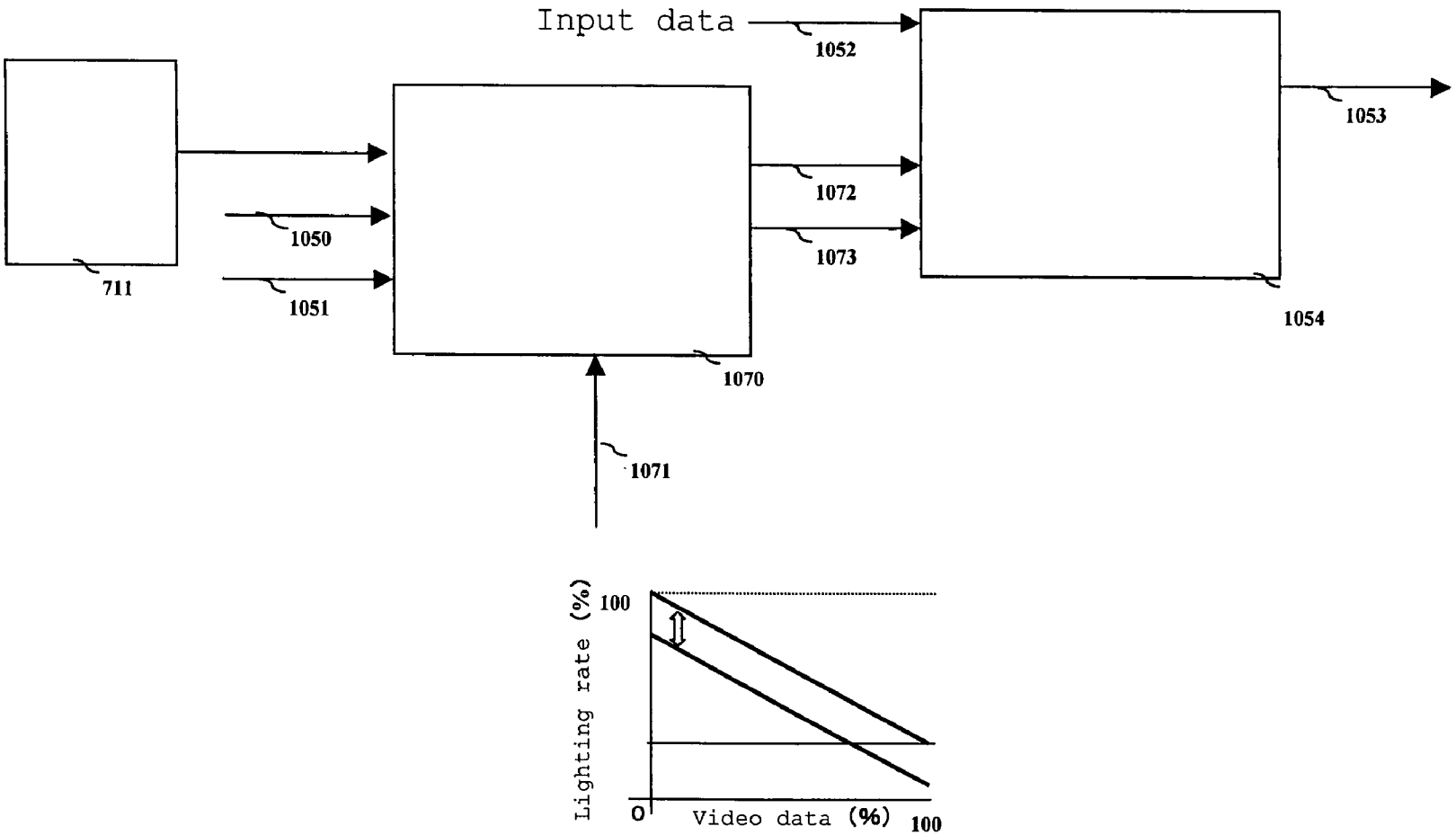
FIG. 110 is a circuit block diagram of the present invention.

The temperature is also apt to rise when one location is intensively lit up. For that reason, it is also very effective means to use the circuit of detecting the still image such as FIG. 71 and thereby utilize a still image period as a control value of 1051 and 1050. A circuit configuration diagram in that case is as shown in FIG. 110.

Figure 112:
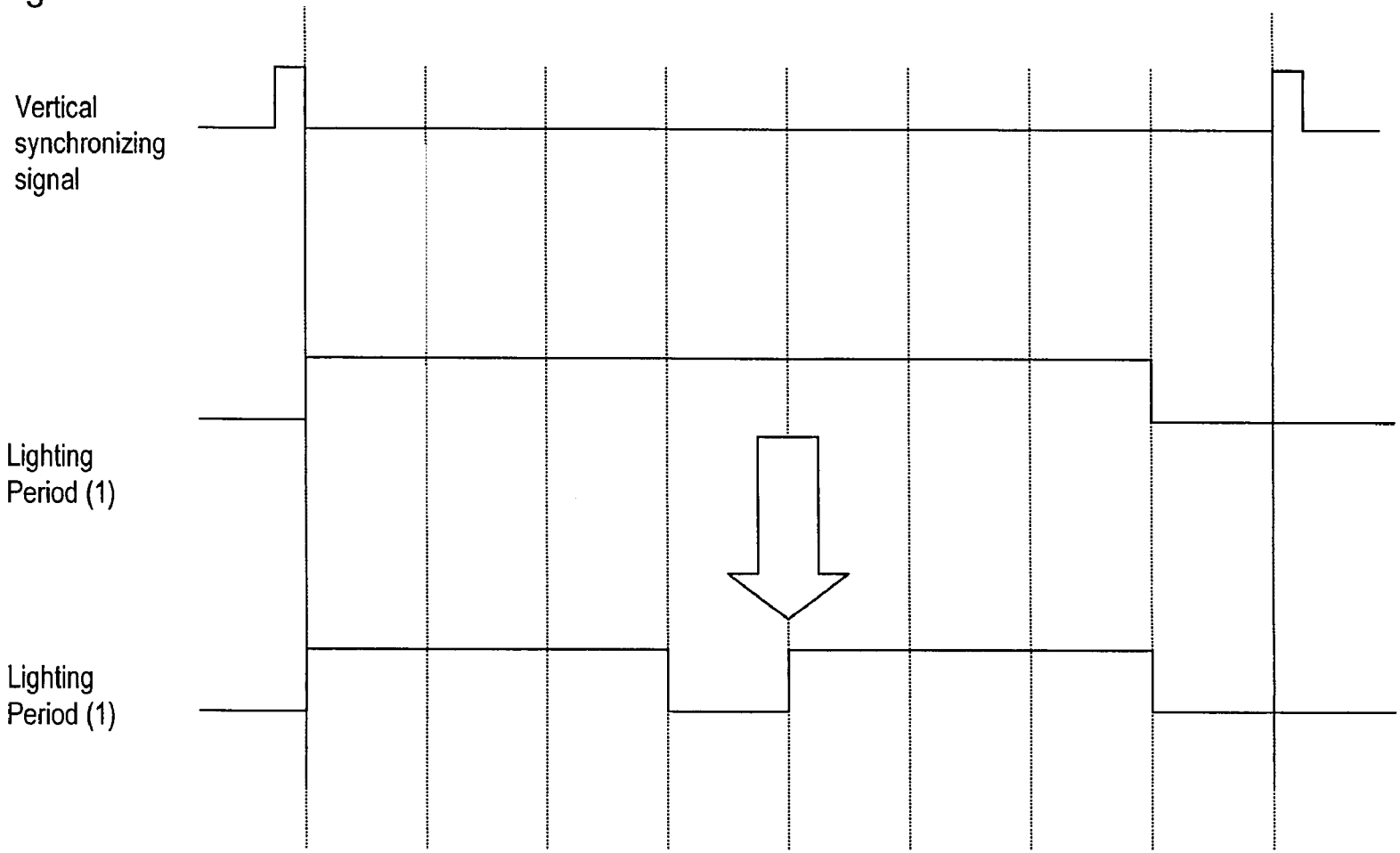
FIG. 112 is a time chart of the present invention.

If the intermittent driving is performed and black is collectively inserted as previously described, it is thereby possible to create a sharp image of which contours are clear when displaying the moving image. However, there is a problem that the screen flickers if a black insertion rate in the intermittent driving becomes high. In the case of the display using the organic EL element in particular, the speed of changing from white to black (or vice versa) is fast unlike a liquid crystal display, and so the flicker is seen more conspicuously. There is a method, as the driving method of suppressing the flicker, of using the circuit configuration as shown in FIG. 85, where the circuit configuration of dividing the black insertion is used in the still image period in which the flicker is apt to be seen and under the circumstances of a very high black insertion rate so as to suppress the flicker. As regards this driving method, however, the flicker occurs in the case of the moving image having only a part of the screen moving because black is not dividedly inserted in that case. As it is very difficult to judge the display state of the screen accurately, it is impossible to solve this problem by this driving method. For that reason, there is a proposed driving method whereby, if the black insertion rate enters the area causing the flicker as shown in FIG. 112, a location for black insertion is newly created to suppress the flicker and fixed intervals of black insertion are maintained so as to improve moving image performance.

In the case of performing the intermittent driving on the organic EL display as previously described, it is performed by controlling the transistors 11*d*. The transistors 11*d* are controlled by 17*b* outputted from the gate driver IC 12, and so 17*b* should be controlled in order to control the black insertion rate.

According to the present invention, one frame is divided into eight so as to control the black insertion by block. As one frame is divided into eight, one thereof is 12.5 percent of one frame. The reason for making it 12.5 percent is that, as it turned out, the flicker starts to be seen at the black insertion rate of 15 to 25 percent and is conspicuously seen between 25 and 50 percent as a condition of the flicker due to the black insertion. To avoid reaching and exceeding the black insertion rate at which the flicker is seen, the blocks are set at 12.5 percent so that one mass of black will not exceed 12.5 percent. However, the range in which the flicker is seen varies according to the size of the display, light emitting luminance and video frequency. Therefore, one frame may be divided into sixteen (6.75 percent) in the case where the black insertion rate at which the flicker is seen is low, or inversely, one frame may be divided into four (25 percent) in the case where it is high.

Figure 113:
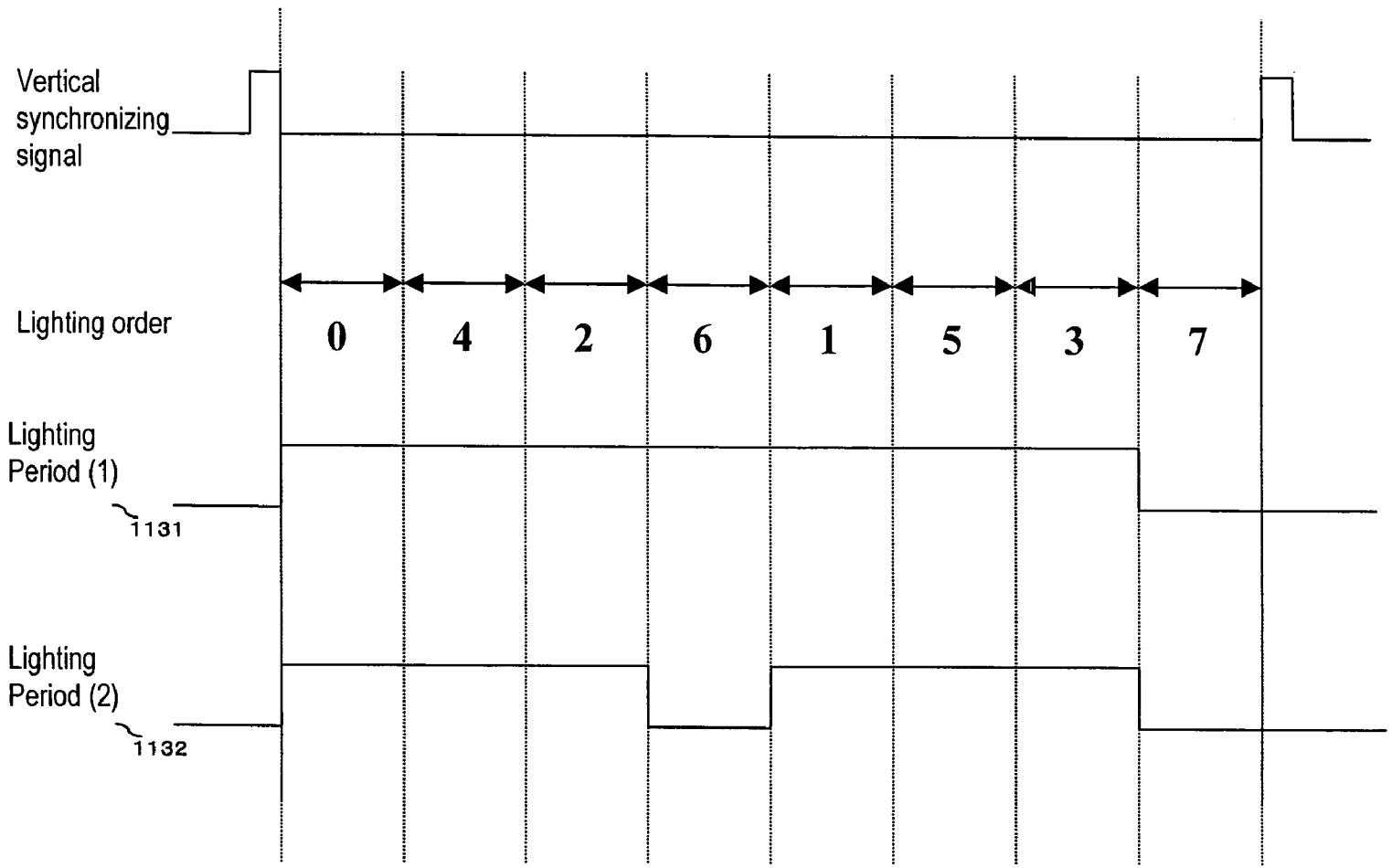
FIG. 113 is a time chart of the present invention.
Figure 114:
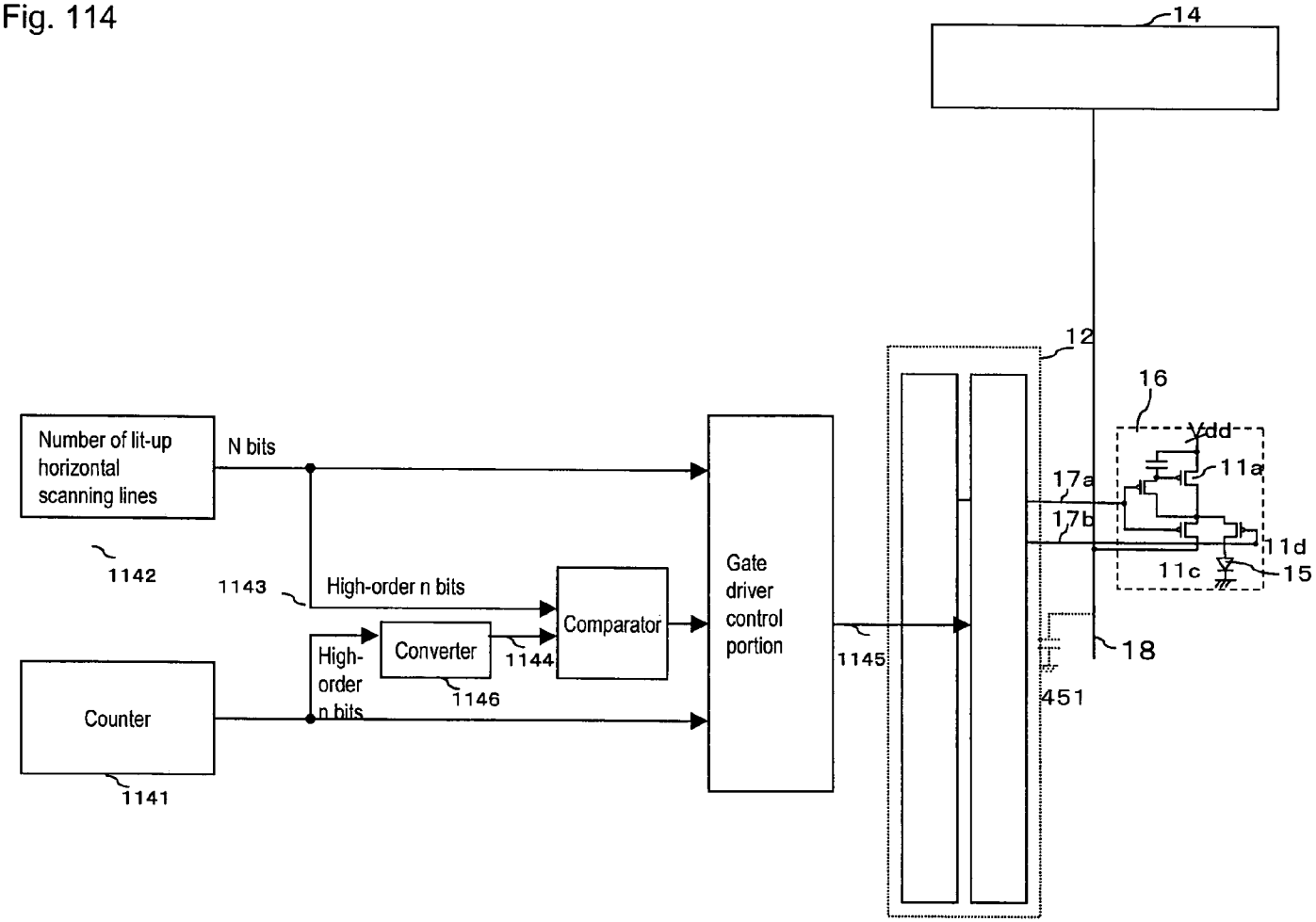
FIG. 114 is a circuit block diagram of the present invention.
Figure 115:
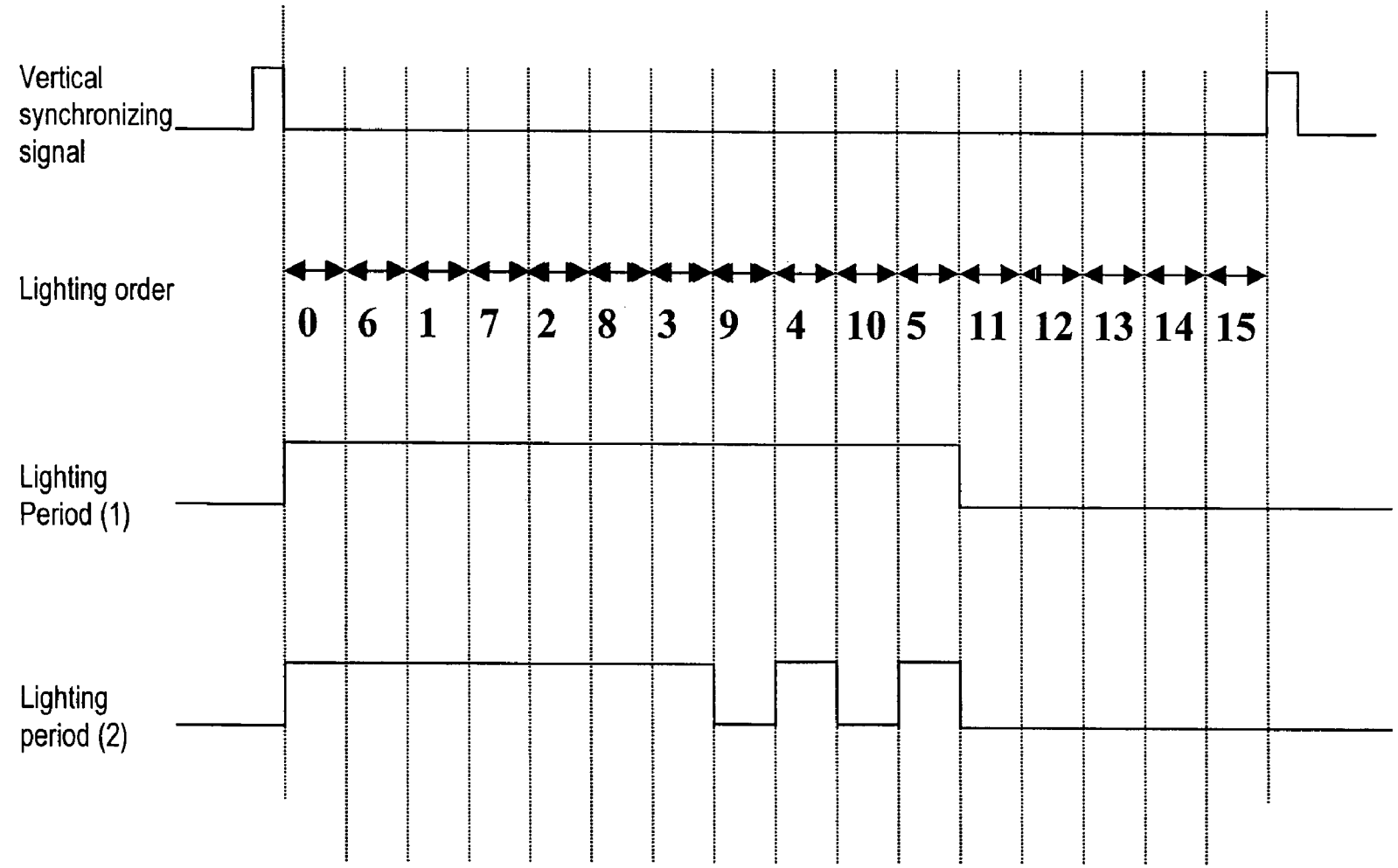
FIG. 115 is a time chart of the present invention.
Figure 116:
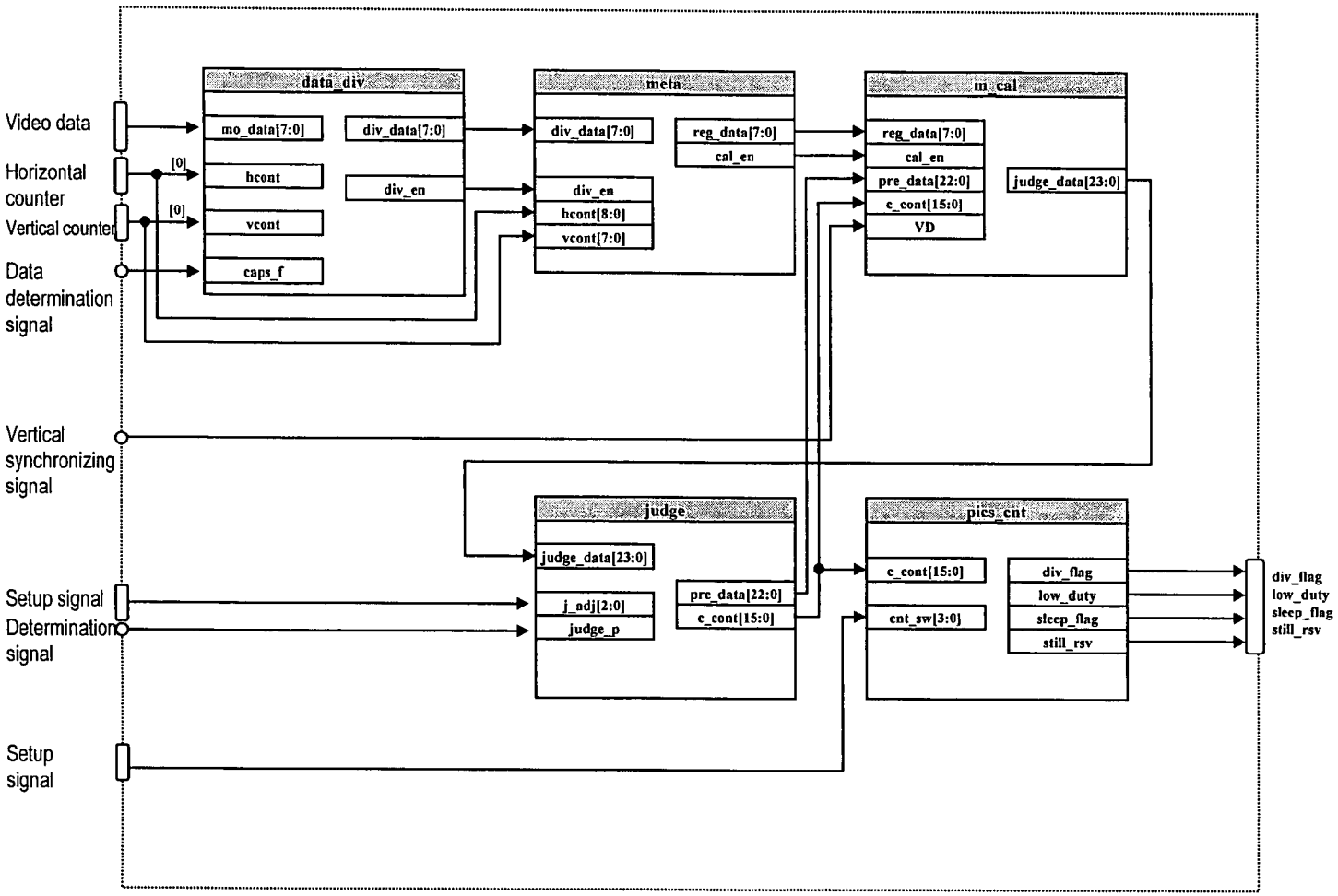
FIG. 116 is a circuit block diagram of the present invention.
Figure 117:
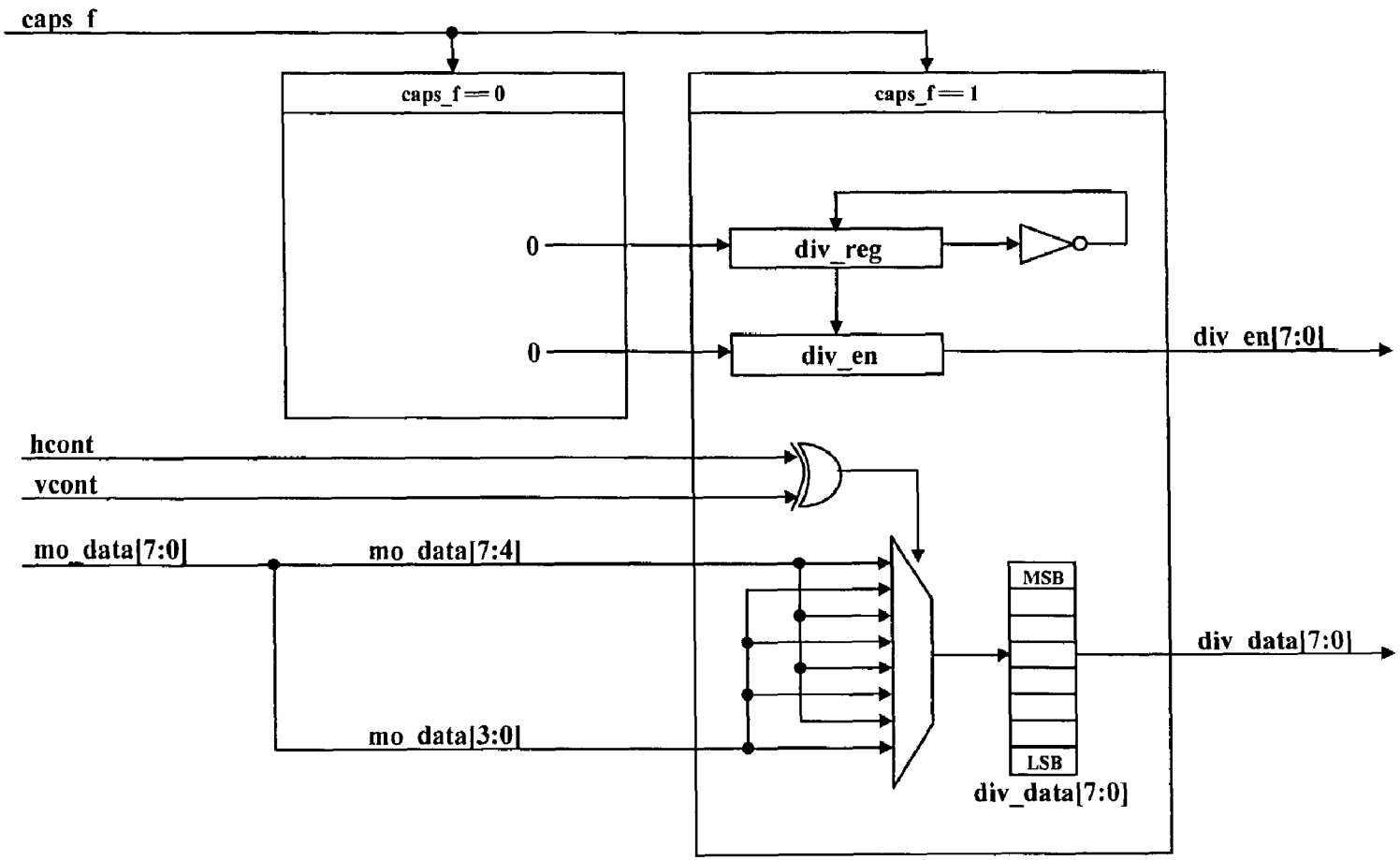
FIG. 117 is a circuit block diagram of the present invention.
Figure 118:
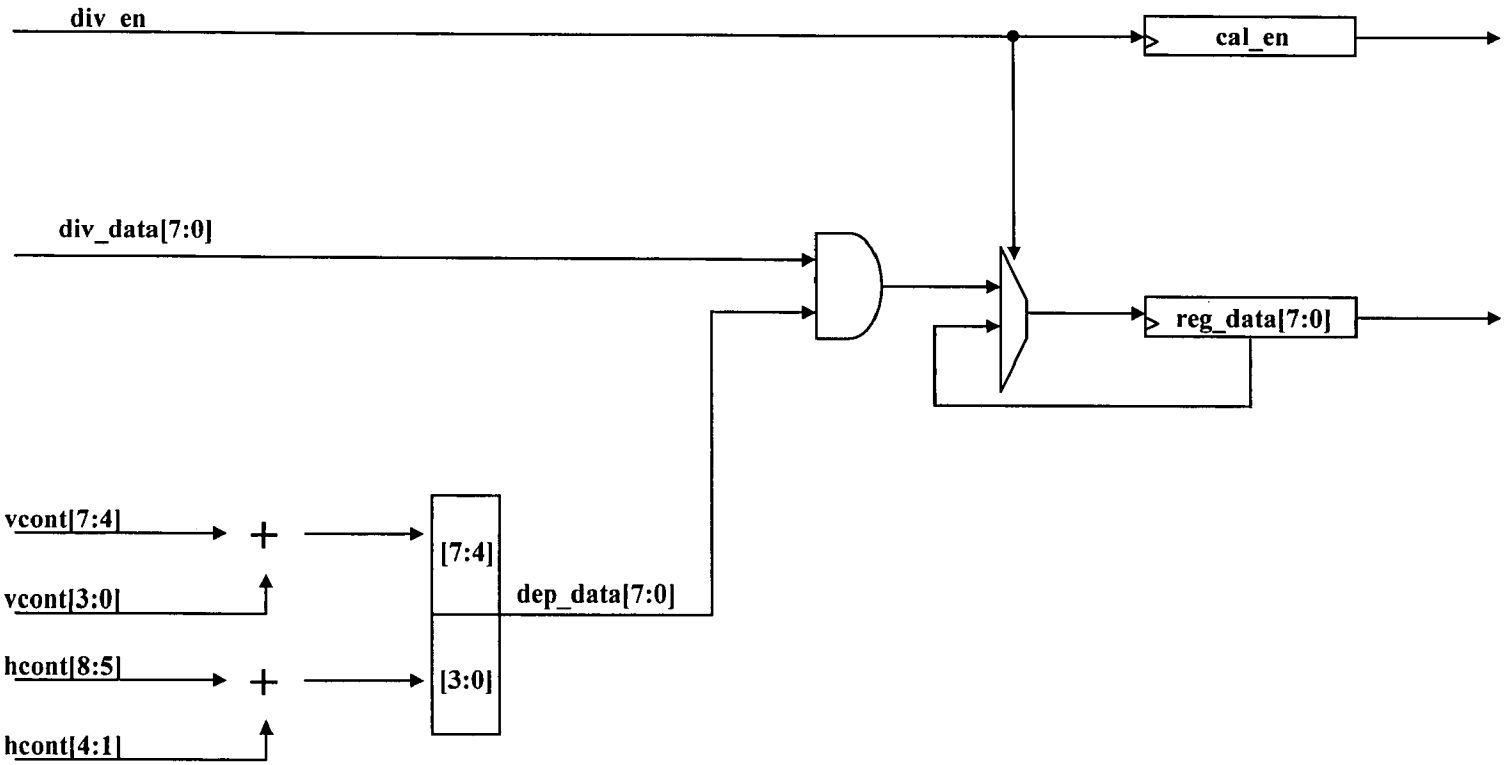
FIG. 118 is a circuit block diagram of the present invention.
Figure 119:
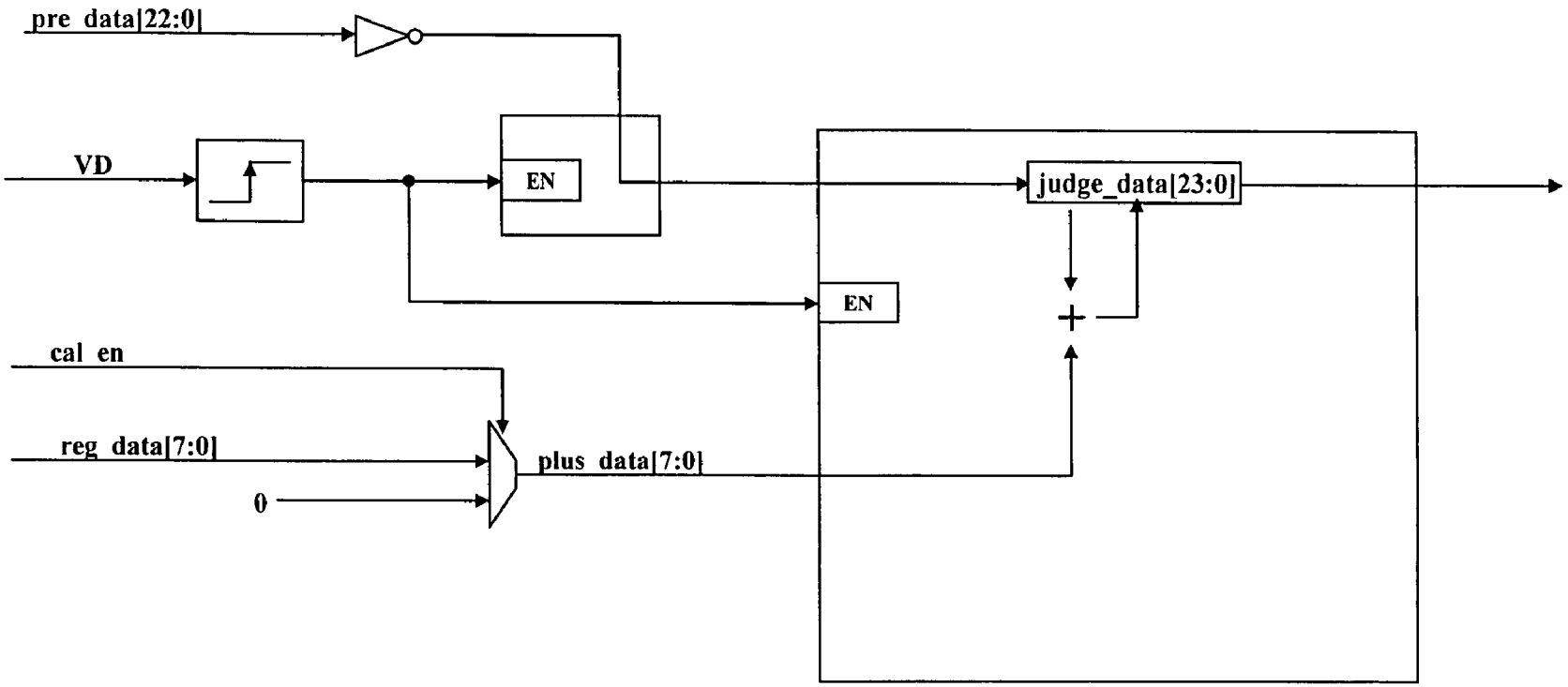
FIG. 119 is a circuit block diagram of the present invention.
Figure 120:
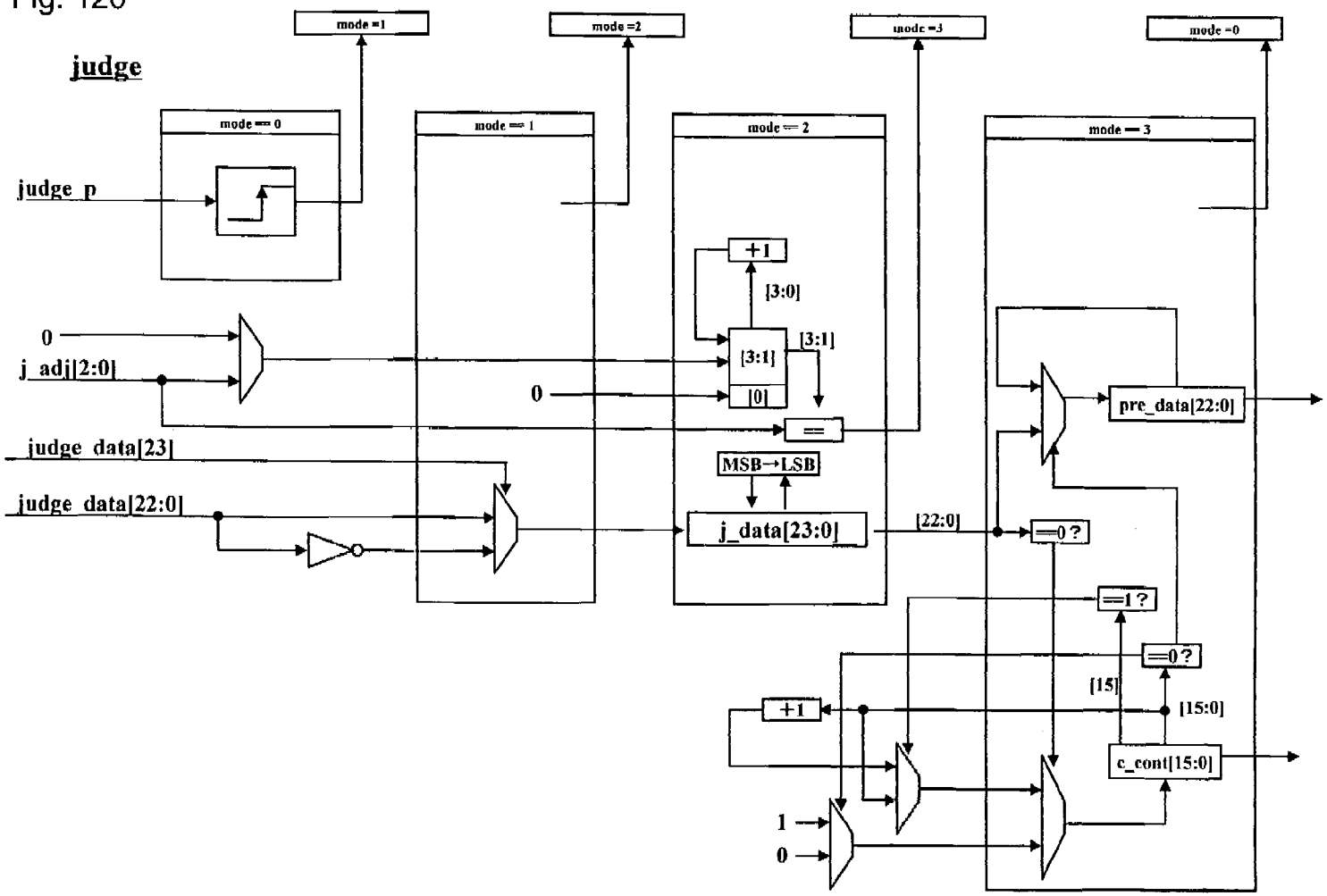
Figure 121:
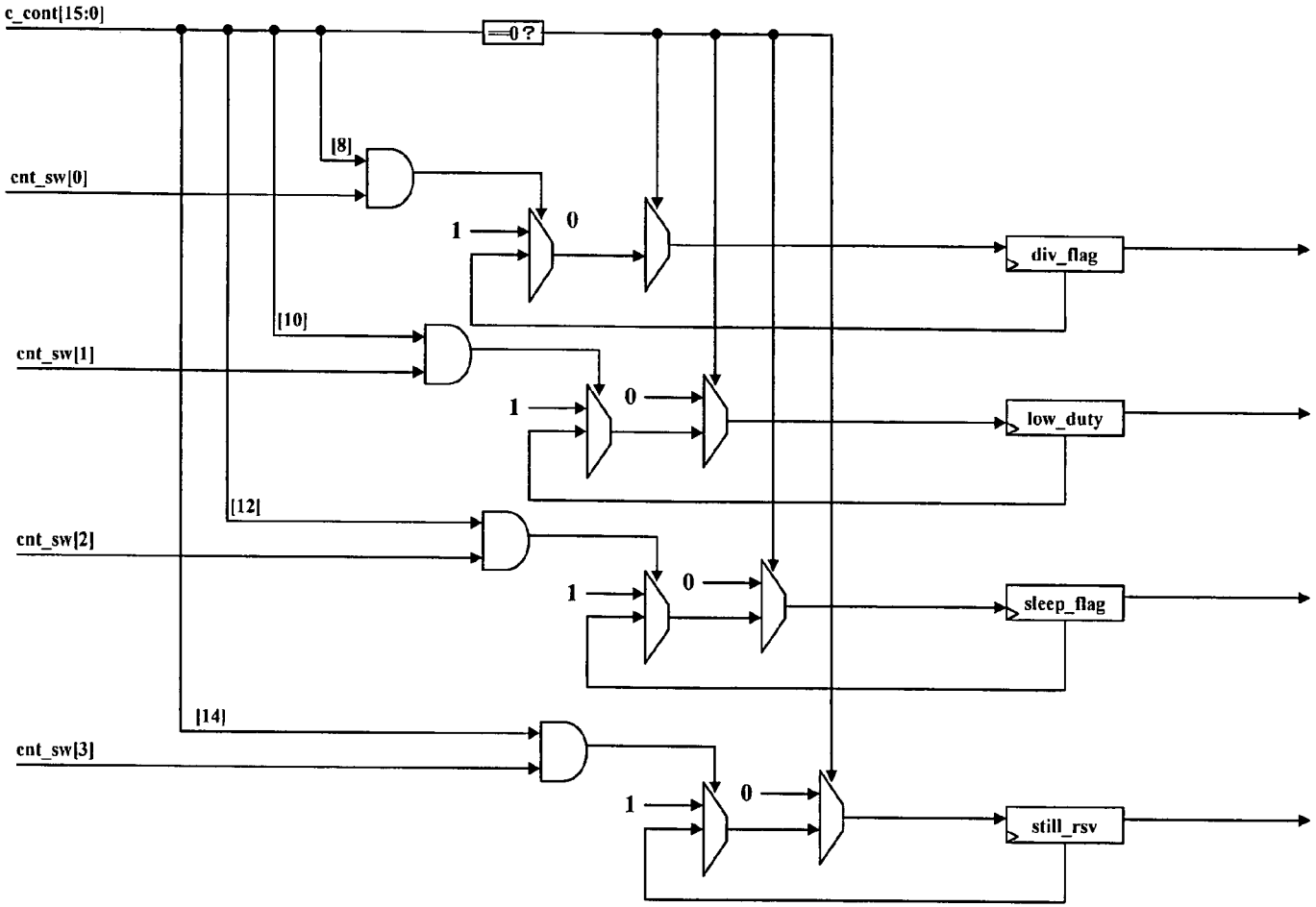

As shown in FIG. 113, the divided locations are numbered. The numbers indicate the order of lighting according to the number of lit-up horizontal scanning lines. If one inter-frame space is divided into eight as previously described, they are numbered in order of 0, 4, 2, 6, 1, 5, 3 and 7 as shown in FIG. 113. 17*b* is controlled so as to light up in order from number 0. To put it the other way around, the non-lit-up status, that is, the black insertion is performed in order from number 7. The blocks of number 7 are put in the non-lit-up status between 0 to 12.5 percent of the black insertion as indicated by 1131. The period of number 6 is put in the non-lit-up status while keeping all the blocks of number 7 in the non-lit-up status between 12.5 to 25 percent as indicated by 1132. It is possible, by this method, to perform the black insertion at another location while keeping the mass of black at a fixed amount so as to suppress the flicker while keeping the moving image performance improved. FIG. 114 shows the circuit configuration of implementing this driving. An example of dividing one inter-frame space into 2 raised to n-th power will be described. In the case where the number of lit-up horizontal scanning lines 1142 is comprised of N bits, a comparison is made between high-order n bits 1143 of the number of lit-up horizontal scanning lines 1142 and lighting order 1144. The lighting order 1144 is the output value wherein the high-order n bits of a counter value 1141 counting up with the horizontal synchronizing signal is processed by a converter 1146. In the case where 1143 is smaller than the lighting order 1144, a signal 1145 of controlling the output from the gate signal line 17*b* outputs LOW. In this case, 11*d* is put in the off state if 1145 is LOW. In the case where the lighting order 1144 and 1143 are the same, HI output equivalent to the value of the low-order (N−n) bits of 1142 is performed. In the case where 1143 is larger than 1144, 1145 performs the HI output. If this is performed, it will be as shown in FIG. 113. Therefore, it is possible, if there is the black insertion rate of 12.5 percent or more, to secure the black insertion of at least 12.5 percent in one section and thereby prevent the flicker while implementing the moving image performance improved by performing the fixed amount of the black insertion. In this case, performing the numbering as in FIG. 113 is most instrumental in preventing the flicker. However, the present invention is not limited to this order. The present invention consistently selects the locations of the black insertion by numbering divided periods and comparing the size of the numbers to control lines of the number of lit-up horizontal scanning lines. As shown in FIG. 115, there is also an effective method of minutely inserting black after securing the amount of black insertion capable of improving the moving image performance. It is generally said that the black insertion of 25 percent or more is necessary to improve the moving image performance. If the black insertion is performed in an area of over 50 percent, the flicker is apt to occur. For that reason, the driving should be performed by collectively performing the black insertion from 0 to 50 percent and dividedly performing the black insertion from 50 percent onward so as not to cause the flicker.

Figure 122:
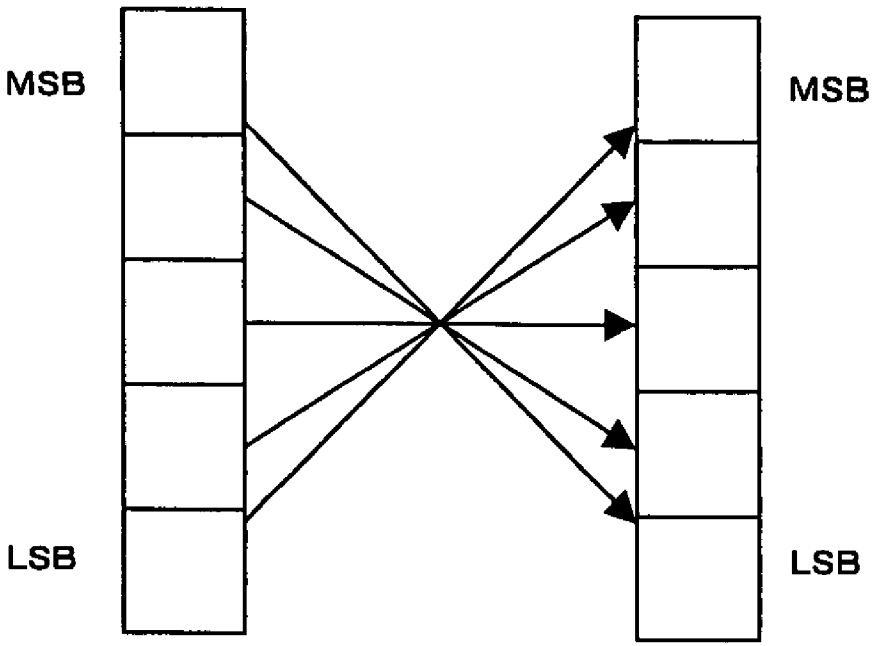

The converter 1146 has a method of creating a table of selecting the output value against the input value and a method of using a conversion circuit of interchanging the high order and low order in turn as shown in FIG. 122. The latter method has a merit of reducing the circuit scale.

FIGS. 116, 117, 118, 119, 120 and 121 have implemented the circuit configuration of detecting the still image without using the frame memory as shown in FIG. 71. It is possible, by using this circuit configuration, to detect the still image without rendering the circuit scale very large. It is possible to prevent the burn-in of the organic EL by using this circuit.

The organic EL has life due to the deterioration of the element as previously described. As for the causes of the deterioration of the element, the temperature around the element and the amount of current passing through the element itself can be named. The organic EL element increases its temperature in proportion to the amount of current as previously described. The display using the organic EL element is configured by placing the organic EL element in each pixel. Therefore, as the amount of current passing through the organic EL element placed in each pixel increases, each EL element emits light so that the temperature of the entire display rises and leads to the deterioration of the element. For that reason, as for the display using the organic EL element, it is necessary to suppress the current passing through the organic EL element in the case of an image which increases a heating value of the entire display.

Figure 123:
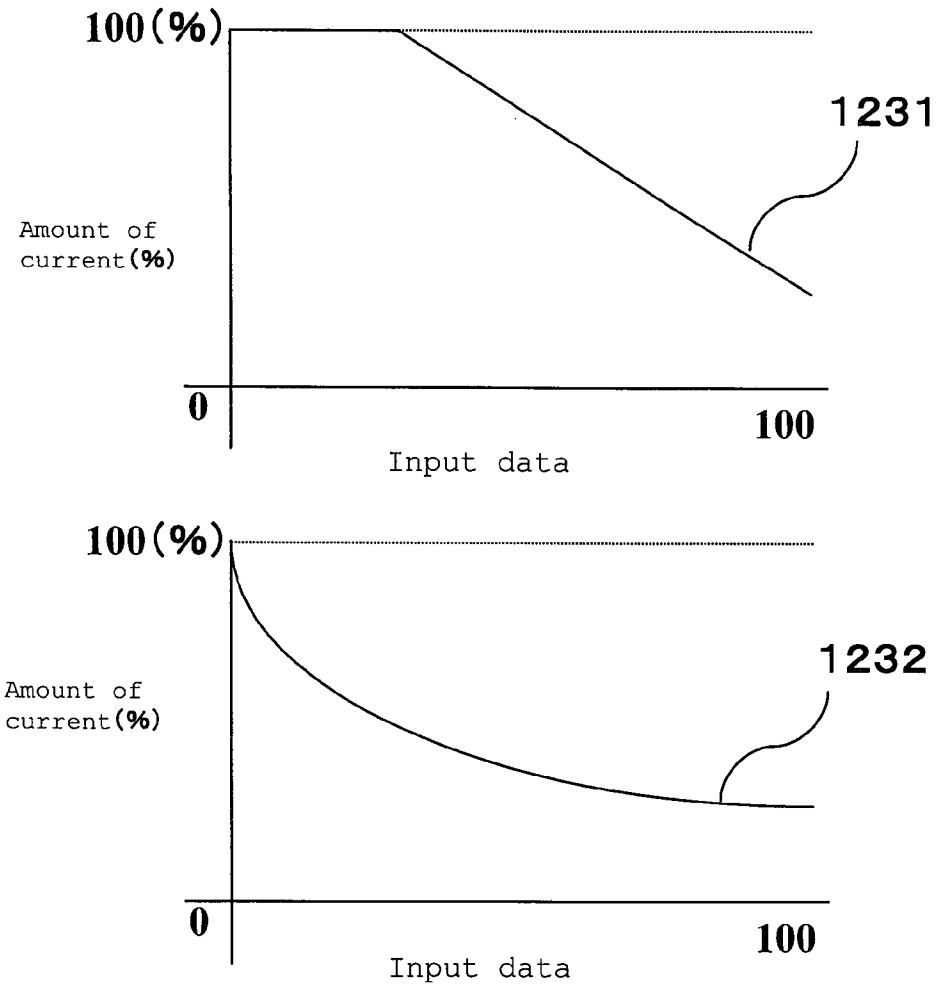

As previously described, as for the method of suppressing the amount of current of the organic EL element, there is a method of controlling the light emission time of the organic EL element against the input data as shown in FIG. 29. The light emission time of the organic EL is controlled so that there are the effects of suppressing the amount of current, decreasing the heating value and improving its life. However, the amount of current passing through the organic EL element is also one of the causes of the deterioration of the element. Therefore, it is possible to suppress the amount of current passing through the organic EL element itself as in FIG. 123 and thereby perform the driving of reducing the amount of current of the entire display so as to further prevent the deterioration of the element.

Figure 124:
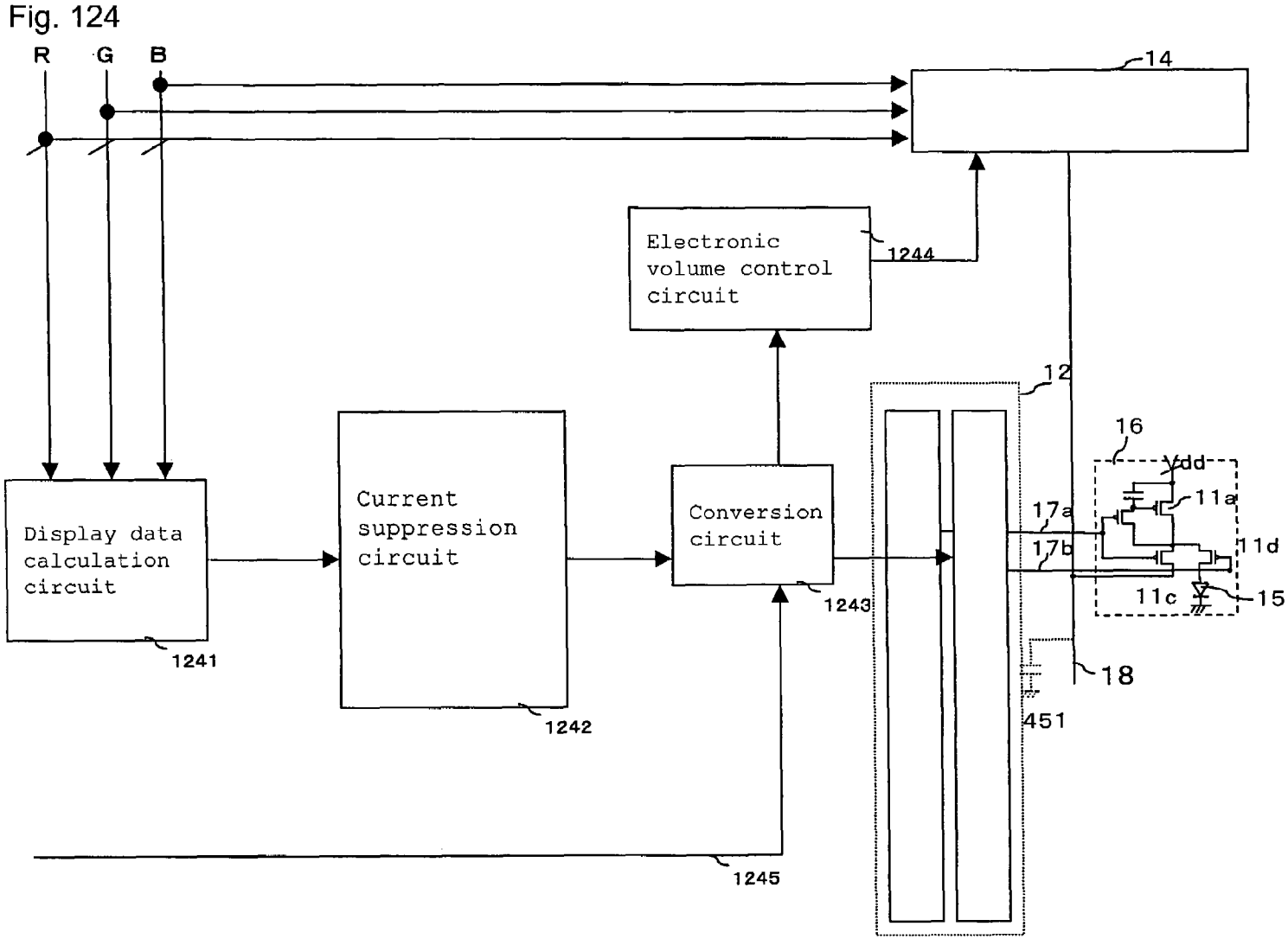

As for the method of suppressing the amount of current passing through the element itself, it should suppress the amount of current of the reference current line 629 intended for the source driver 14 to pass the current to the driving transistor 11*a*. As for the means of suppressing the amount of current of the reference current line 629, there is a method of rendering a resistance of creating the voltage of a reference supply line 636 as a variable resistance and manipulating the value of resistance itself. There is also a method, as shown in FIG. 62, of creating an electronic volume 625 of manipulating the reference current in the source driver itself and manipulating the electronic volume 625. FIG. 124 shows the circuit configuration of using the electronic volume to control the amount of current. The video data is determined by a circuit 1241 of counting the display data and is inputted to a current suppression circuit 1242. The current suppression circuit is a circuit having a circuit of calculating the lighting rate such as 55.5 or a delay circuit such as 612, which is a circuit of calculating the number of lit-up horizontal scanning lines of suppressing the current from the input data. In the case of controlling the amount of current by the electronic volume rather than by controlling the lit-up horizontal scanning lines, it is possible to convert the signal line of controlling the number of lit-up horizontal scanning lines with a conversion circuit 1243 and input it to an electronic volume control circuit 1244 so as to control it. In this case, it is also possible to prepare a signal line 1245 of selecting a current suppression method inside the electronic volume control circuit (conversion circuit) 1244 so as to generate the circuit configuration of controlling the amount of current either by the number of lit-up horizontal scanning lines or by the electronic volume.

However, there is a drawback to the method of suppressing the amount of current by suppressing the reference current with the electronic volume. As previously described, the stray capacitance 451 exists on the source signal line 18. To change the source signal line voltage, it is necessary to draw out the charge of the stray capacitance. The time $\Delta T$ required to draw it out is $\Delta Q$ (charge of the stray capacitance)=I (current passing through the source signal line)$\times\Delta T$=C (stray capacitance value)$\times\Delta V$. The lower the gradation is, the smaller the value of I becomes so that it becomes increasingly difficult to draw out the charge of the stray capacitance 451. Therefore, as the gradation display becomes lower, there appears more conspicuously the problem that the signal before changing to the predetermined luminance is written inside the pixels. For that reason, the problem appears even more conspicuously on low gradation display if the amount of reference current is suppressed by using the electronic volume. Thus, it becomes difficult to keep gradation properties in the low gradation portion.

Figure 125:
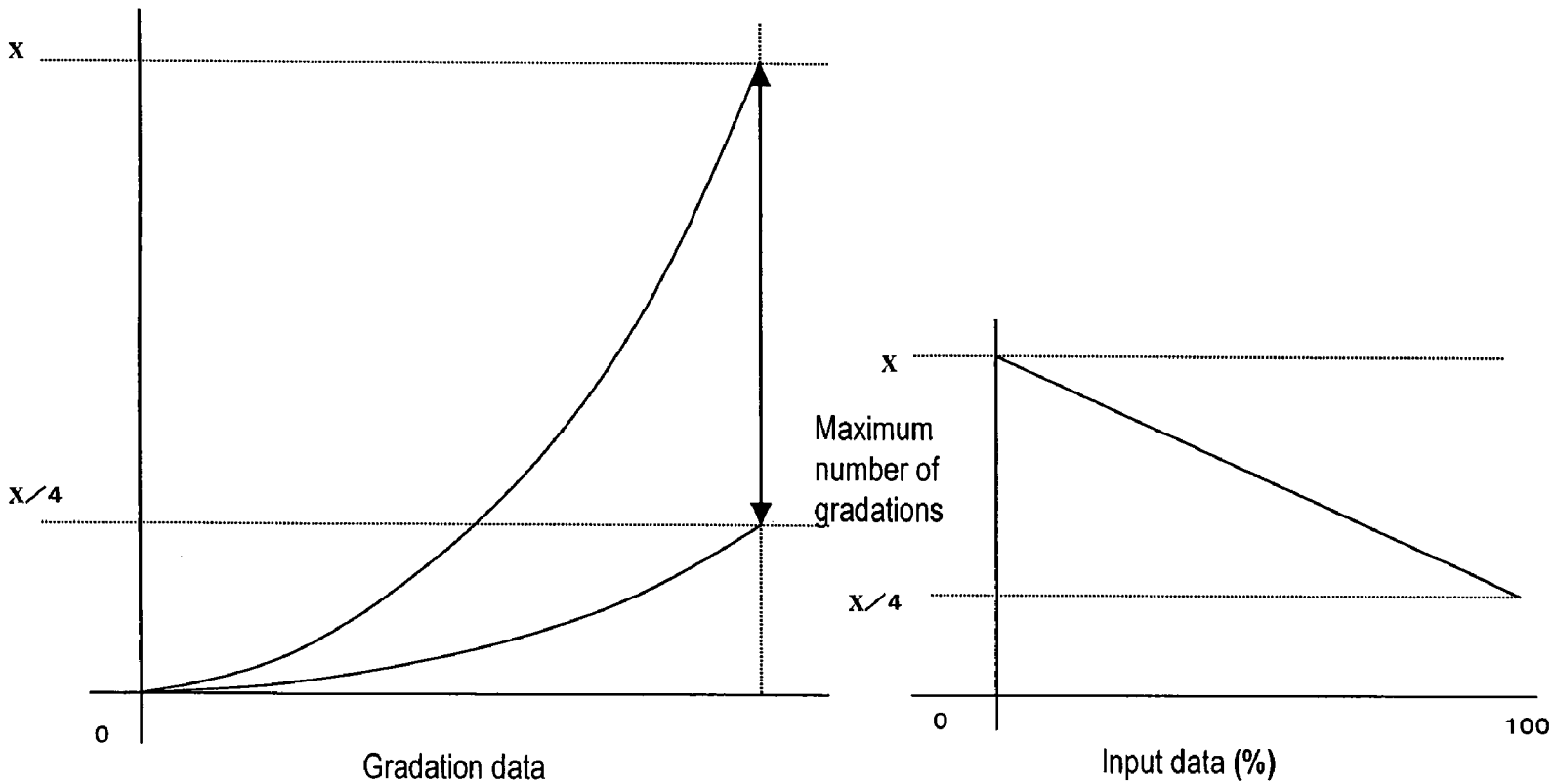

For that reason, as shown in FIG. 125, the present invention proposes a method of converting the inputted data itself and uniformly reducing the data to reduce the amount of current. As the amount of data itself is reduced, representable gradations are reduced. However, there will no longer be the problem of insufficient writing due to the stray capacitance as described above because the output of the source driver 14 itself is not reduced even in the low gradation portion. Reducing the amount of data means reducing the amount of current itself passing through the organic EL element, which can prevent the deterioration of the element. To be more specific, reducing the data means decreasing the maximum number of representable gradations. As shown in FIG. 125, it is possible to suppress the amount of current up to ¼ at the maximum by decreasing the maximum number of gradations from x to x/4 against the total amount of input data. Reference numeral 1251 denotes a diagram showing other gradations in the case of reducing the maximum number of gradations. As the maximum number of gradations is reduced to ¼, intermediate gradations so far decrease likewise. There is an advantage to this driving. Normally, decreasing the number of gradations results in a larger difference in the amount of current per gradation. For that reason, there arises a problem that, if the image is displayed, the difference in brightness is visible and pseudo contours are seen. In this driving, however, the maximum number of gradations is reduced while the amount of current per gradation remains unchanged. For that reason, the pseudo contours are not generated even if the number of gradations is reduced.

Figure 126:
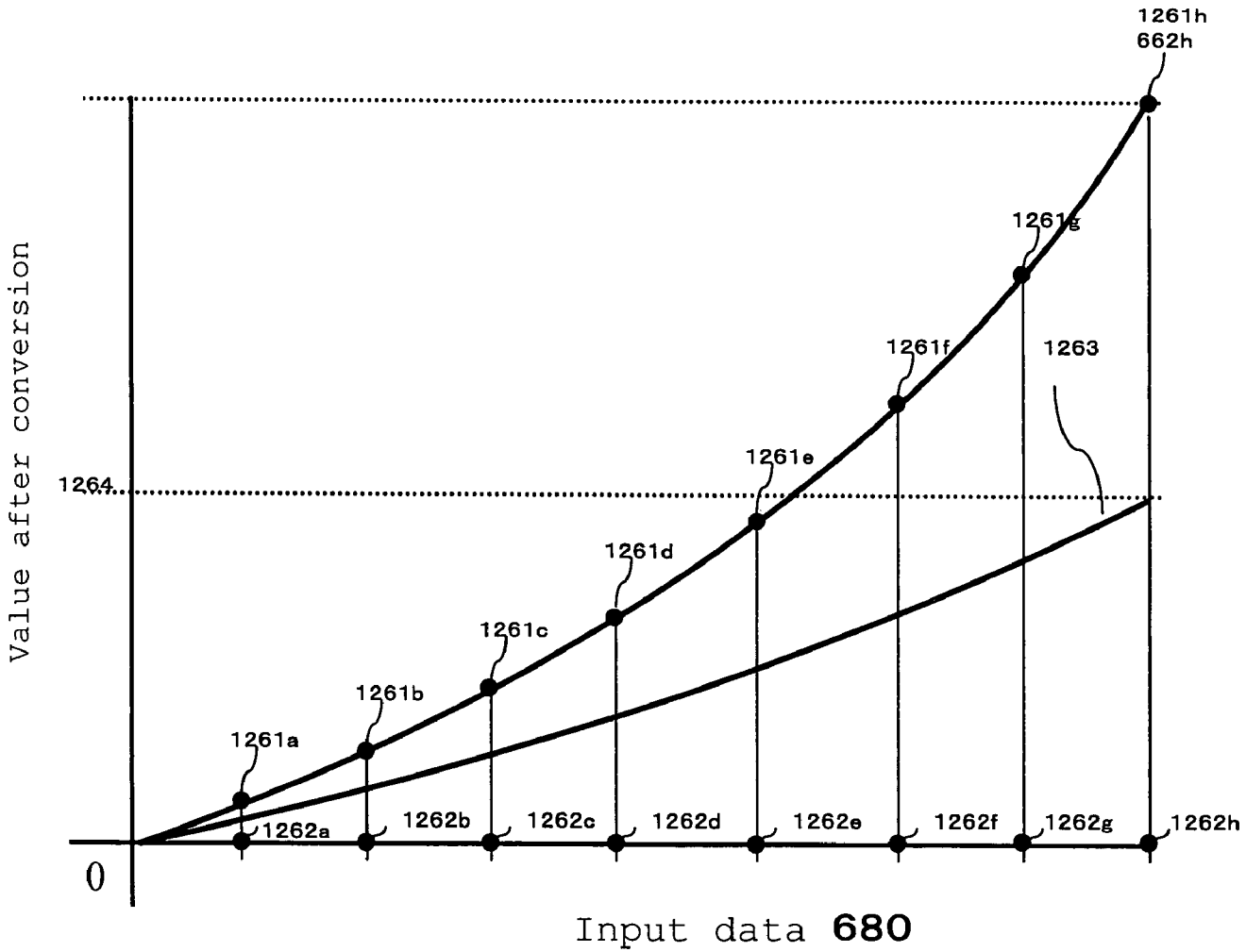

As for the method of reducing the amount of data, there is a method of reducing the amount of data by converting the gamma curve of expanding the input data as shown in FIG. 126. The gamma curve conversion is conducted by using a gamma curve conversion circuit having a few break points. As shown in FIG. 126, the break points when suppressing no amount of current are denoted by reference characters 1261*a*, 1261*b*, . . . 1261*h*. As opposed to them, points for reducing the data are provided, such as 1262*a*, 1262*b*, . . . 1262*h*. A line connecting the respective break points is decomposed by a current suppression value 1264 and reconnected to allow the gamma curve such as 1263 to be generated. And it is thereby possible to uniformly reduce the entire data without collapsing the ratio of the output data to the input data. The values of 1262*a*, 1262*b*, . . . 1262*h* should preferably be 0. It is because, in the case where 1262*a*, 1262*b*, . . . 1262*h* are 0, it is only necessary to divide the values of 1261*a*, 1261*b*, . . . 1261*h* by a control value. However, the present invention does not limit the values of 1262*a*, 1262*b*, . . . 1262*h* to 0. If the values of 1262*a*, 1262*b*, . . . 1262*h* are set at ½ of the values of 1261*a*, 1261*b*, . . . 1261*h*, it becomes possible to place a limit so that the current value can only be reduced to ½ whatever control is exerted.

As previously described, the current suppression method of reducing the data itself is more effective in preventing the deterioration of the element than the suppression method of controlling the lighting rate. However, it has a disadvantage that the range of representable gradations is reduced as the data itself is reduced. As previously described, the suppression method of controlling the lighting rate has the advantage of improving the moving image performance by becoming the intermittent driving, and is also capable of maintaining the gradation properties. Therefore, the suppression method of controlling the lighting rate is superior in terms of display video.

Figure 127:
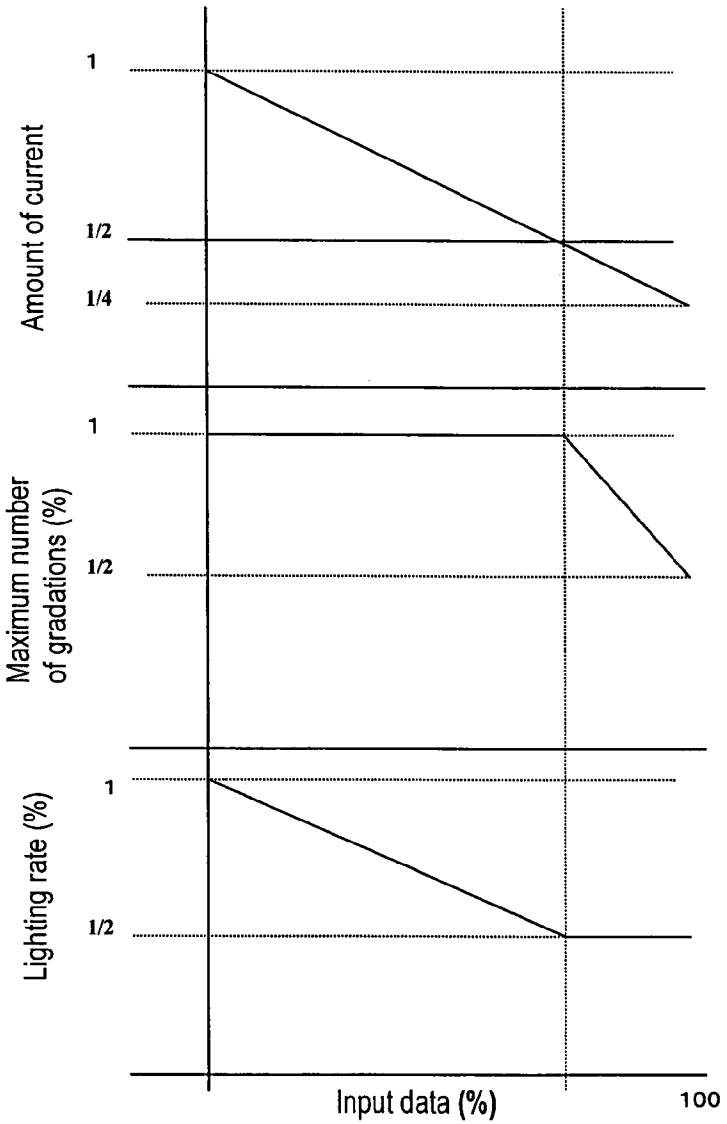

Thus, as shown in FIG. 127, the present invention proposes a method of suppressing the amount of current by controlling the lighting rate up to a fixed suppression amount and suppressing the amount of current thereafter by reducing the data itself. The waveform in FIG. 127 is an example of the suppression method. In FIG. 127, control is exerted by suppressing the lighting rate up to ½ of a current suppression amount. As for the suppression of the remaining ½ to ¼, the amount of current is suppressed to ¼by suppressing the data itself. As the data is reduced to ½, only the gradation representation of 7 bits is possible in the case where the data is represented by 8 bits. However, a high lighting area is an area in which there is a large amount of data per pixel and the gradation properties are difficult to judge. Therefore, there are few demerits of reduction in the gradations. In the case of performing this driving, even though the amount of current is the same as the case of exerting control only on the light emission period when displaying a white raster of the lighting rate of 100 percent, the amount of current instantaneously passing through the pixels is ½. Therefore, it is twice or more capable of preventing the deterioration of the element.

Figure 128:
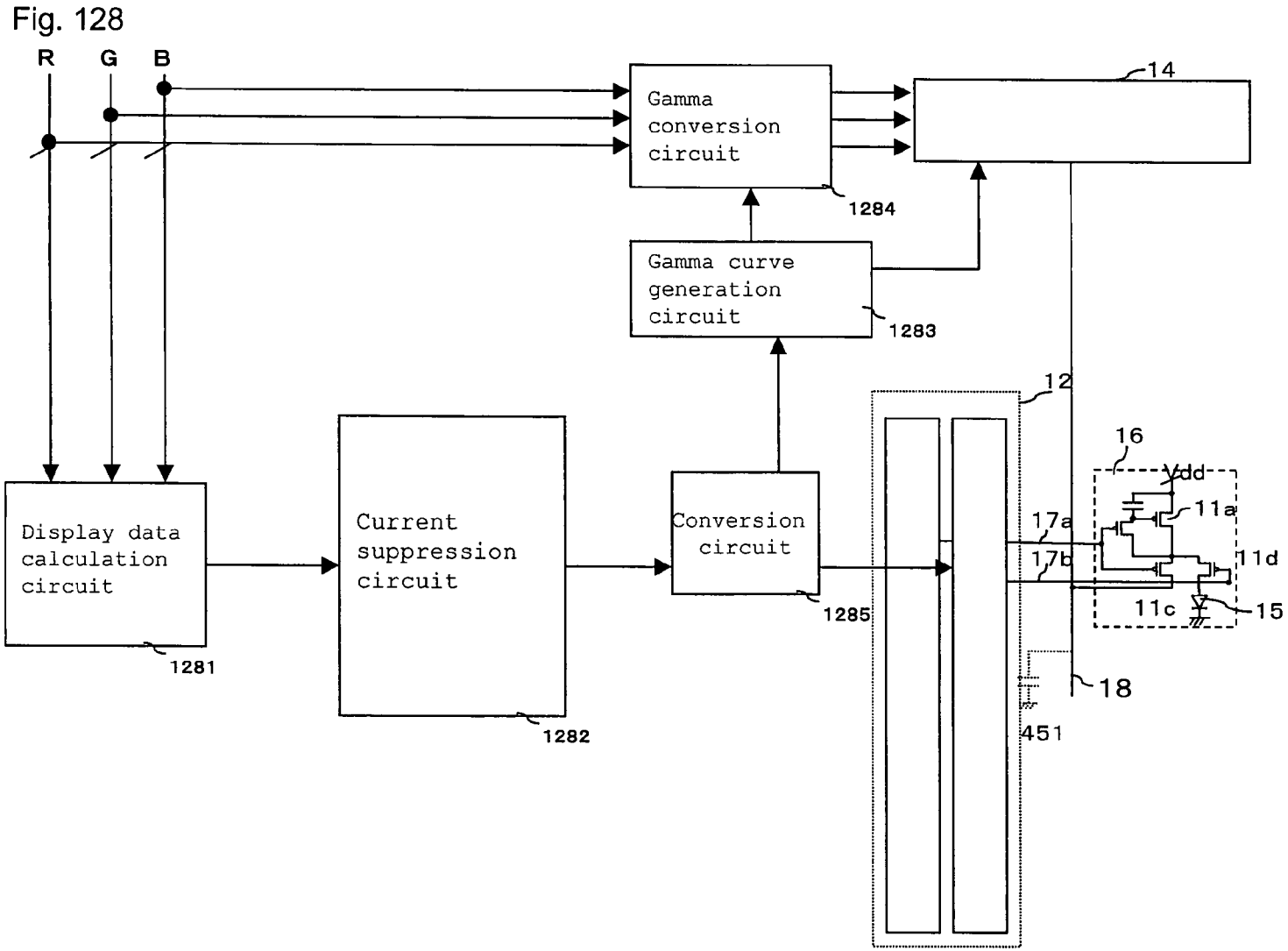

FIG. 128 shows the circuit configuration of implementing the present invention. 1281 has a mechanism of calculating the data inputted from outside and judging a video status. 1282 has a mechanism of controlling the amount of current by means of the data outputted from 1281. 1283 has a mechanism of generating the gamma curve. The gamma curve generated by 1283 is inputted to a gamma conversion circuit 1284. Input data RGB is converted by the gamma conversion circuit 1284 and is inputted to the source driver 14. 1285 has a mechanism of allocating the output of 1282 to the control of the number of lit-up horizontal scanning lines and the control of the gamma curve. The control value of the number of lit-up horizontal scanning lines is inputted to the gate driver circuit IC 12, and the control value of the gamma curve is inputted to 1283. In the case where the output of 1282 is to control the entire amount of current to ¼, 1285 then converts to control the number of lit-up horizontal scanning lines to ½ and also converts to control the gamma curve to ½. Thus, the entire amount of current becomes ¼. It is possible to implement various current suppression methods by changing in 1285 the ratio of allocation to the control of the number of lit-up horizontal scanning lines and the control of the gamma curve.

There is also a method of reducing the amount of reference current instead of the method of reducing the data itself. In the case of using this method, there is the problem of insufficient writing due to the stray capacitance as previously described. However, it is technically possible. It is also possible to use it in combination with the method of reducing the data itself and the method of controlling the number of lit-up horizontal scanning lines although the circuit configuration becomes complicated.

The contents of the present invention are adaptable to controller ICs of driving the display apparatus. The controller ICs may include a DSP having an advanced calculation function and may also include an FPGA.

Figure 34:
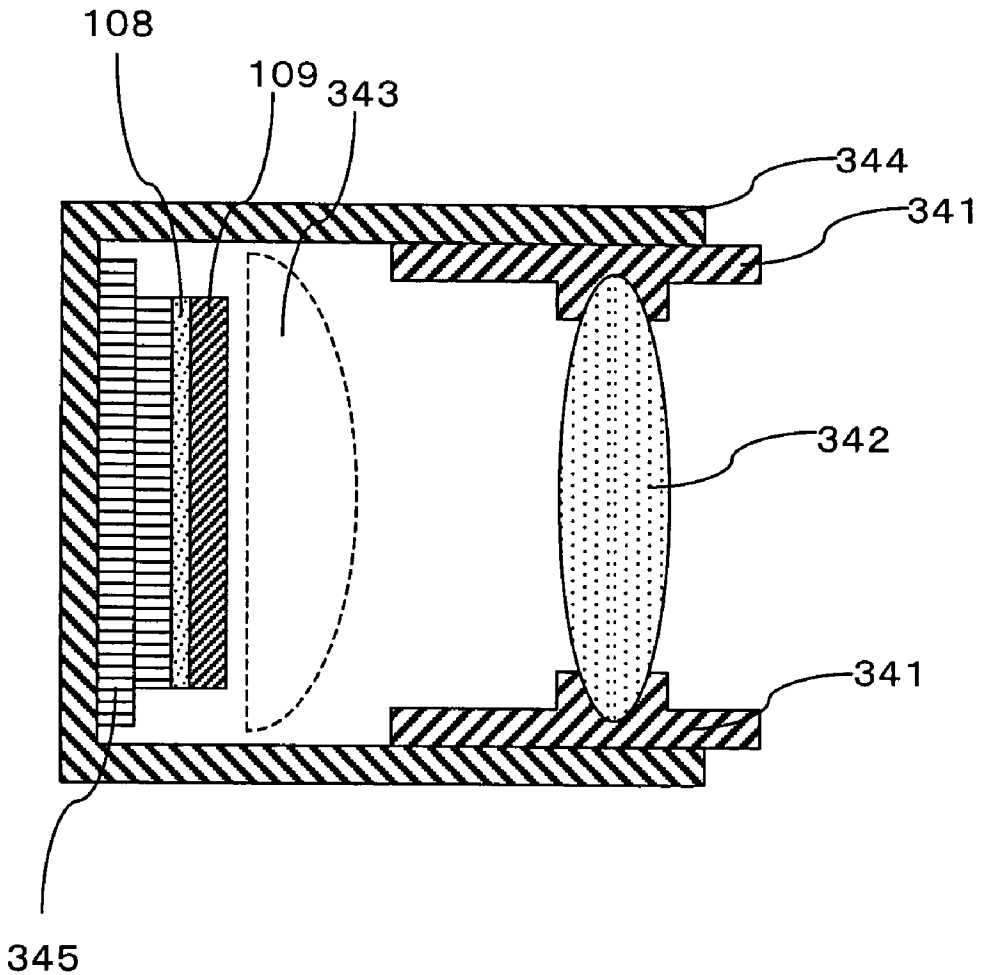
FIG. 34 is a schematic diagram of a viewfinder according to the present invention.

FIG. 34 is a sectional view of a view finder according to an embodiment of the present invention. It is illustrated schematically for ease of explanation. Besides, some parts are enlarged, reduced, or omitted. For example, an eyepiece cover is omitted in FIG. 34. The above items also apply to other drawings.

Inner surfaces of a body 344 are dark-or black-colored. This is to prevent stray light emitted from an EL display panel (EL display apparatus) from being reflected diffusely inside the body 344 and lowering display contrast. A phase plate (80 /4) 108, polarizing plate 109, and the like are placed on an exit side of the display panel.

An eye ring 341 is fitted with a magnifying lens 342. The observer focuses on a display image 50 on the display panel 345 by adjusting the position of the eye ring 341 in the body 344.

If a convex lens 343 is placed on the exit side of the display panel 345 as required, principal rays entering the magnifying lens 342 can be made to converge. This makes it possible to reduce the diameter of the magnifying lens 342, and thus reduce the size of the viewfinder.

Figure 52:
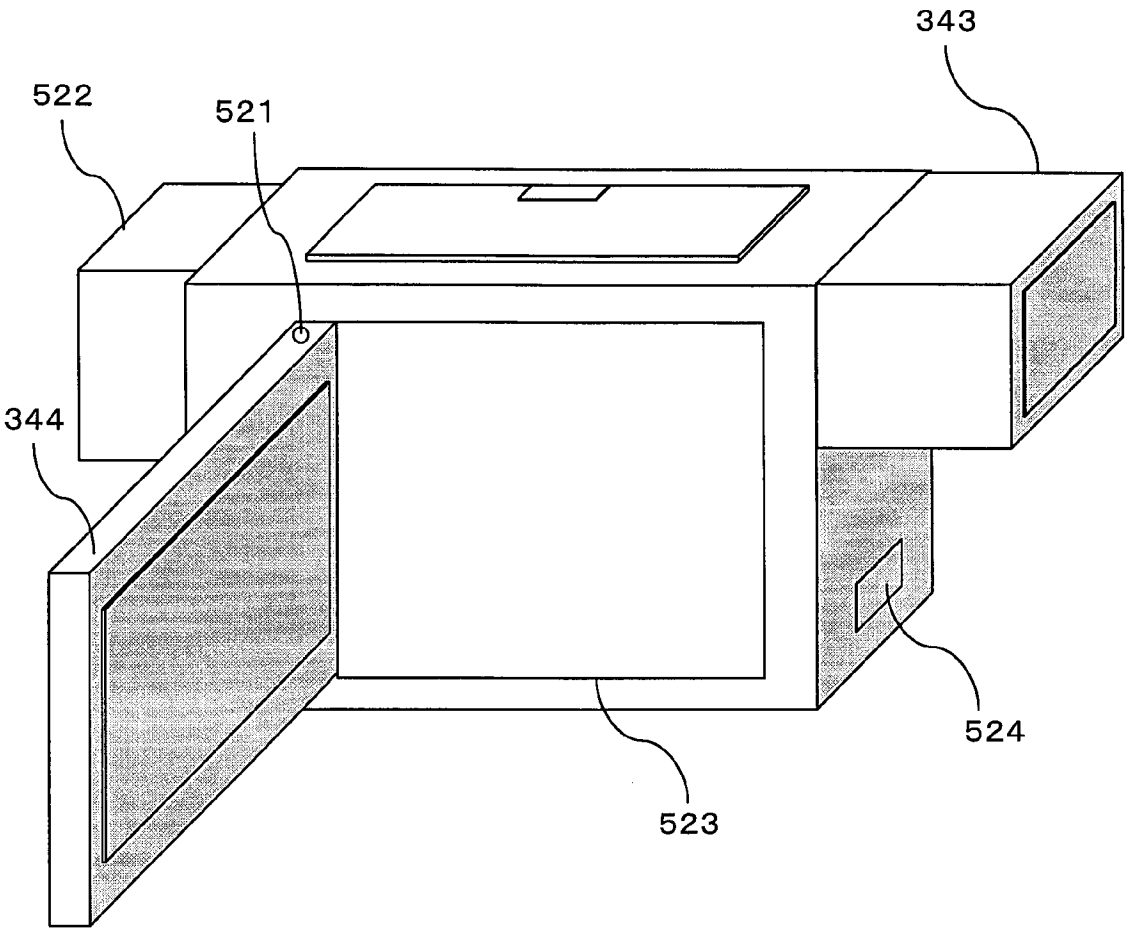
FIG. 52 is a schematic diagram of a video camera of the present invention.

FIG. 52 is a perspective view of a video camera. A video camera has a taking (imaging) lens 522 and a video camera body 344. The taking lens 522 and viewfinder 344 are mounted back to back with each other. The viewfinder 344 (see also FIG. 34) is equipped with an eyepiece cover. The observer views the image 50 on the display panel 345 through the eyepiece cover.

The EL display panel according to the present invention is also used as a display monitor. The display compartment 50 can pivot freely on a point of support 521. The display compartment 50 is stored in a storage compartment 523 when not in use.

A switch 524 is a changeover switch or control switch and performs the following functions. The switch 524 is a display mode changeover switch. The switch 524 is also suitable for cell phones and the like. Now the display mode changeover switch 524 will be described.

The switching operation described above is used for cell phones, monitors, etc. which display the display screen 50 very brightly at power-on and reduce display brightness after a certain period to save power. It can also be used to allow the user to set a desired brightness. For example, the brightness of the screen is increased greatly outdoors. This is because the screen cannot be seen at all outdoors due to bright surroundings. However, the EL elements 15 deteriorate quickly under conditions of continuous display at high brightness. Thus, the screen 50 is designed to return to normal brightness in a short period of time if it is displayed very brightly. A button which can be pressed to increase display brightness should be provided, in case the user wants to display the screen 50 at high brightness again.

Thus, it is preferable that the user can change display brightness with the switch (button) 524, that the display brightness can be changed automatically according to mode settings, or that the display brightness can be changed automatically by detecting the brightness of extraneous light. Preferably, display brightness settings such as 50%, 60%, 80%, etc. are available to the user.

Preferably, the display screen 50 employs Gaussian display. That is, the center of the display screen 50 is bright and the perimeter is relatively dark. Visually, if the center is bright, the display screen 50 seems to be bright even if the perimeter is dark. According to subjective evaluation, as long as the perimeter is at least 70% as bright as the center, there is not much difference. Even if the brightness of the perimeter is reduced to 50%, there is almost no problem.

Preferably a changeover switch is provided to enable and disable the Gaussian display. This is because the perimeter of the screen cannot be seen at all outdoors if the Gaussian display is used. Thus, it is preferable that the user can change display brightness with the button switch, that the display brightness can be changed automatically according to mode settings, or that the display brightness can be changed automatically by detecting the brightness of extraneous light. Preferably, display brightness settings such as 50%, 60%, 80%, etc. are available to the user.

Liquid crystal display panels generate a fixed Gaussian distribution using a backlight. Thus, they cannot enable and disable the Gaussian distribution. The capability to enable and disable Gaussian distribution is peculiar to self-luminous display devices.

A fixed frame rate may cause interference with illumination of an indoor fluorescent lamp or the like, resulting in flickering. Specifically, if the EL elements 15 operate on 60-Hz alternating current, a fluorescent lamp illuminating on 60-Hz alternating current may cause subtle interference, making it look as if the screen were flickering slowly. To avoid this situation, the frame rate can be changed. The present invention has a capability to change frame rates.

The above capabilities are implemented by way of the switch 524. The switch 524 switches among the above capabilities when pressed more than once, following a menu on the screen 50.

Incidentally, the above items are not limited to cell phones. Needless to say, they are applicable to television sets, monitors, etc. Also, it is preferable to provide icons on the display screen to allow the user to know at a glance what display mode he/she is in. The above items similarly apply to the following.

Figure 53:
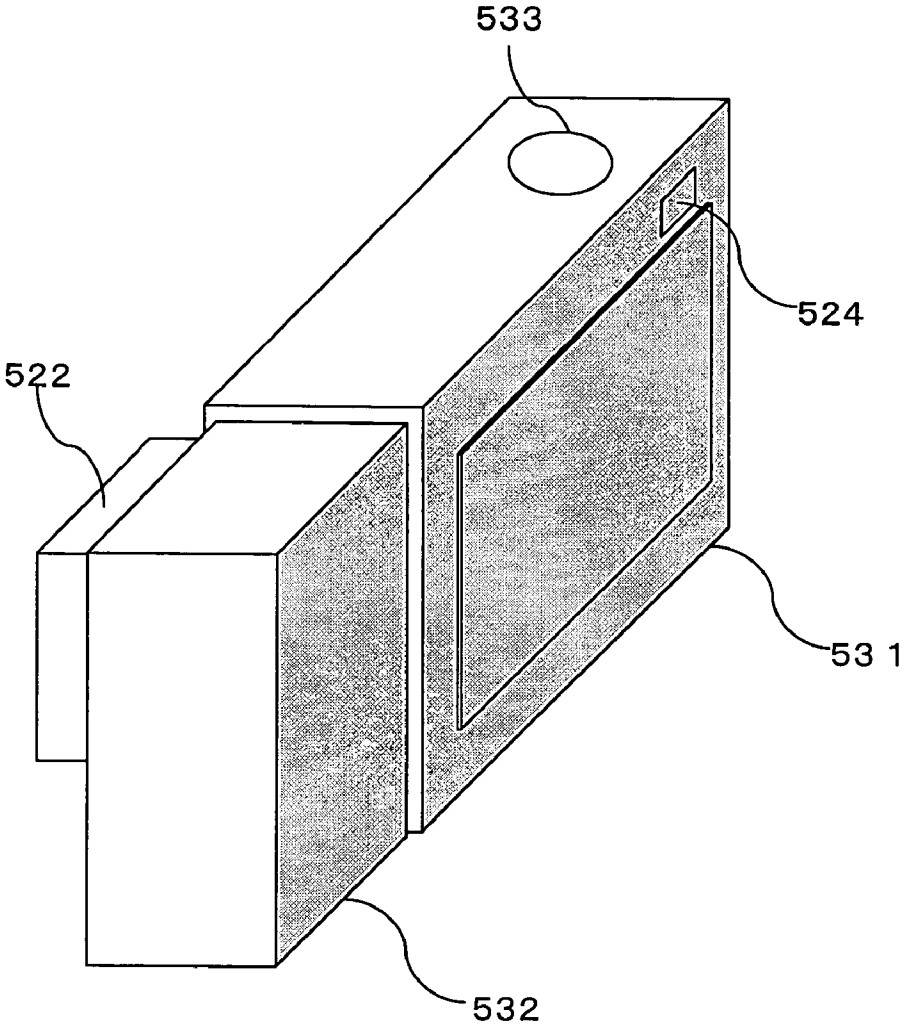
FIG. 53 is a schematic diagram of a digital camera of the present invention.

The EL display apparatus and the like according to this embodiment can be applied not only to video cameras, but also to digital cameras such as the one shown in FIG. 53, still cameras, etc. The display apparatus is used as a monitor 50 attached to a camera body 531. The camera body 531 is equipped with a switch 524 as well as a shutter 533.

Figure 54:
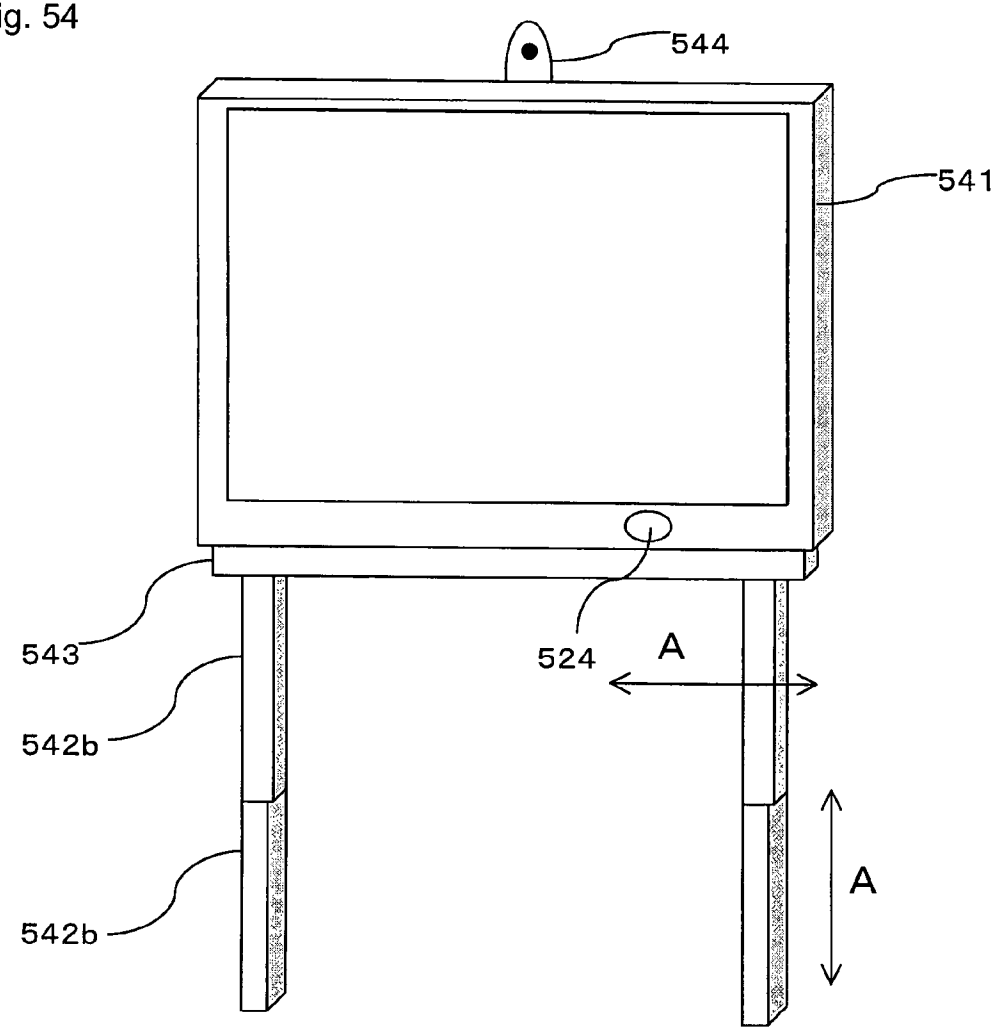
FIG. 54 is a schematic diagram of a television (monitor) of the present invention.

The display panel described above has a relatively small display area. However, with a display area of 30 inches or larger, the display screen 50 tends to flex. To deal with this situation, the present invention puts the display panel in a frame 541 and attaches a fitting 544 so that the frame 541 can be suspended as shown in FIG. 54. The display panel is mounted on a wall or the like using the fitting 544.

A large screen size increases the weight of the display panel. As a measure against this situation, the display panel is mounted on a stand 543, to which a plurality of legs 542 are attached to support the weight of the display panel.

The legs 542 can be moved from side to side as indicated by A. Also, they can be contracted as indicated by B. Thus, the display apparatus can be installed even in a small space.

A television set in FIG. 54 has a surface of its screen covered with a protective film (or a protective plate). One purpose of the protective film is to prevent the surface of the display panel from breakage by protecting from being hit by something. An AIR coat is formed on the surface of the protective film. Also, the surface is embossed to reduce glare caused by extraneous light on the display panel.

A space is formed between the protective film and display panel by spraying beads or the like. Fine projections are formed on the rear face of the protective film to maintain the space between the protective film and display panel. The space prevents impacts from being transmitted from the protective film to the display panel.

Also, it is useful to inject an optical coupling agent into the space between the protective film and display panel. The optical coupling agent may be a liquid such as alcohol or ethylene glycol, a gel such as acrylic resin, or a solid resin such as epoxy. The optical coupling agent can prevent interfacial reflection and function as a cushioning material.

The protective film may be, for example, a polycarbonate film (plate), polypropylene film (plate), acrylic film (plate), polyester film (plate), PVA film (plate), etc. Besides, it goes without saying that an engineering resin film (ABS, etc.) may be used. Also, it may be made of an inorganic material such as tempered glass. Instead of using a protective film, the surface of the display panel may be coated with epoxy resin, phenolic resin, and acrylic resin 0.5 mm to 2.0 mm thick (both inclusive) to produce a similar effect. Also, it is useful to emboss surfaces of the resin.

It is also useful to coat surfaces of the protective film or coating material with fluorine. This will make it easy to wipe dirt from the surfaces with a detergent. Also, the protective film may be made thick and used for a front light as well as for the screen surface.

The display panel according to the example of the present invention may be used in combination with the three-side free configuration. The three-side free configuration is useful especially when pixels are built using amorphous silicon technology. Also, in the case of panels formed using amorphous silicon technology, since it is difficult to control variations in the characteristics of transistor elements during production processes, it is preferable to use the N-pulse driving, reset driving, dummy pixel driving, or the like according to the present invention. That is, the transistors 11 according to the present invention are not limited to those produced by polysilicon technology, and they may be produced by amorphous silicon technology. Thus, the transistors 11 composing the pixels 16 in the display panels according to the present invention may be formed by amorphous silicon technology. Needless to say the gate driver circuits 12 and source driver circuits 14 may also be formed or constructed by amorphous silicon technology.

The technical idea described in the example of the present invention can be applied to video cameras, projectors, 3D television sets, projection television sets, etc. It can also be applied to viewfinders, cell phone monitors, PHS, personal digital assistants and their monitors, and digital cameras and their monitors.

Also, the technical idea is applicable to electrophotographic systems, head-mounted displays, direct view monitors, notebook personal computers, video cameras, electronic still cameras. Also, it is applicable to ATM monitors, public phones, videophones, personal computers, and wristwatches and its displays.

Furthermore, it goes without saying that the technical idea can be applied to display monitors of household appliances, pocket game machines and their monitors, backlights for display panels, or illuminating devices for home or commercial use. Preferably, illuminating devices are configured such that color temperature can be varied. Color temperature can be changed by forming RGB pixels in stripes or in dot matrix and adjusting currents passed through them. Also, the technical idea can be applied to display apparatus for advertisements or posters, RGB traffic lights, alarm lights, etc.

Also, organic EL display panels are useful as light sources for scanners. An image is read with light directed to an object using an RGB dot matrix as a light source. Needless to say, the light may be monochromatic. Besides, the matrix is not limited to an active matrix and may be a simple matrix. The use of adjustable color temperature will improve imaging accuracy.

Also, organic EL display panels are useful as backlights of liquid crystal display panels. Color temperature can be changed and brightness can be adjusted easily by forming RGB pixels of an EL display panel (backlight) in stripes or in dot matrix and adjusting currents passed through them. Besides, the organic EL display panel, which provides a surface light source, makes it easy to generate Gaussian distribution that makes the center of the screen brighter and perimeter of the screen darker. Also, organic EL display panels are useful as backlights of field-sequential liquid crystal display panels which scan with R, G, and B lights in turns. Also, they can be used as backlights of liquid crystal display panels for movie display by inserting black even if the backlights are turned on and off.

The program of the present invention is a program of causing a computer to perform the functions of all or a part of the instrument (or apparatuses, elements and so on) of the driving circuit of the above-mentioned self-luminous display apparatus of the present invention, which is the program of operating in cooperation with the computer.

The program of the present invention is a program of causing a computer to perform the operations of all or a part of the steps (or processes, operations, actions and so on) of the driving method of the above-mentioned self-luminous display apparatus of the present invention, which is the program of operating in cooperation with the computer.

The recording medium of the present invention is a recording medium supporting the program of causing a computer to perform all or a part of the functions of all or a part of the instrument (or apparatuses, elements and so on) of the driving circuit of the above-mentioned self-luminous display apparatus of the present invention, which is the recording medium wherein the program which is readable by and read by the computer performs the functions in cooperation with the computer.

The recording medium of the present invention is a recording medium supporting the program of causing a computer to perform all or a part of the operations of all or a part of the steps (or processes, operations, actions and so on) of the driving method of the above-mentioned self-luminous display apparatus of the present invention, which is the recording medium wherein the program which is readable by and read by the computer performs the operations in cooperation with the computer.

"A part of the instrument (or apparatuses, elements and so on) of the present invention described above means one or a few instrument out of the plurality of instrument, and "apart of the steps (or processes, operations, actions and so on)" of the present invention described above means one or a few steps out of the plurality of steps.

"The functions of the instrument (or apparatuses, elements and so on)" of the present invention described above means all or a part of the functions of the instrument, and "the operations of the steps (or processes, operations, actions and so on)" means all or a part of the operations of the steps.

One form of use of the program of the present invention may be a form recorded on a computer-readable recording medium and operating in cooperation with the computer.

One form of use of the program of the present invention may be a form transmitted in a transmission medium, read by the computer and operating in cooperation with the computer.

The recording medium may include a ROM and so on, and the transmission medium may include a transmission medium such as the Internet, light, a radio wave, a sound wave and so on.

The computer of the present invention described above is not limited to pure hardware such as a CPU, but may also include firmware, an OS and peripherals as well.

As described above, the configuration of the present invention may be implemented either software-wise or hardware-wise.

The present invention reduces the amount of current passing through the panel if the luminance of the display image is high, and increases the amount of current if the luminance is low so as to render the image brighter as a whole while protecting the organic EL element and battery. Therefore, its practical effects are high.

Also, the display panels, display apparatus, etc. of the present invention offer distinctive effects, including high quality, high movie display performance, low power consumption, low costs, high brightness, etc., according to their respective configurations.

Incidentally, the present invention does not consume much power because it can provide power-saving information display apparatus. Also, it does not waste resources because it can reduce size and weight. Furthermore, it can adequately support high-resolution display panels. Thus, the present invention is friendly to both global environmental and space environment.

The invention claimed is:

1. A driving method of a self-luminous display apparatus having a plurality of self-luminous elements comprising each of pixels placed like a matrix in a pixel row direction and a pixel line direction and driving a display portion by passing a current between an anode and a cathode of each of the self-luminous elements and thereby emitting light from each of the pixels, the driving method comprising:

a first process of acquiring a first amount of current to be passed between the anode and the cathode correspondingly to video data inputted from outside, and acquiring a predetermined single value as the first amount of current irrespective of a status of video data value distribution around the video data;

a second process of acquiring a second amount of current to be passed between the anode and the cathode correspondingly to the video data inputted from outside, where, regarding the second amount of current, a value, which has the first amount of current suppressed at a predetermined ratio according to the status of video data value distribution around the video data, is prepared, and of performing a processing in which the ratio of suppression is variable according to the status of video data value distribution, wherein the amount of current passing through each pixel line is controlled based on a result of the first or second processing instrument so as to emit light from the display portion.

2. The driving method of a self-luminous display apparatus according to claim 1, wherein the first amount of current applied between the anode and the cathode of each of the corresponding self-luminous elements is determined by the first process when a gradation value of the video data inputted from outside is on a lower gradation side of performing a black display than a first predetermined gradation value.

3. The driving method of a self-luminous display apparatus according to claim 1, wherein the second amount of current x applied between the anode and the cathode of each of the corresponding self-luminous elements is determined by the second process when a gradation value of the video data inputted from outside is on a higher gradation side of performing a white display than a first predetermined gradation value, and if the first amount of current in the case of performing the first process to the gradation value is y, the following relation holds between the first amount of current y and the second amount of current x:

$$0.20y \leqq x \leqq 0.60y.$$

4. The driving method of a self-luminous display apparatus according to claim 1, wherein the applied amount of current is determined by acquiring a current value i1 which is a maximum value of the image data inputted from outside in a first period, acquiring a proper current value i2 by calculation from the image data inputted in a second period, and sequentially calculating the amount of current applied to each of the pixels displayed based on the predetermined image data inputted in the second period based on a ratio i2/i1.

5. The driving method of a self-luminous display apparatus according to claim 1, wherein the applied amount of current is determined by acquiring a third current value i3 which is a maximum value of the inputted image data, actually applying a current between the anode and the cathode of each of the self-luminous display elements, acquiring an optimum value as a second current value i4 and multiplying the inputted image data by a ratio i4/i3 and thereby sequentially calculating the amount of current applied to each of the pixels displayed based on the predetermined image data.

6. The driving method of a self-luminous display apparatus according to claim 1, wherein the gradation value of the video data inputted from outside is on a higher gradation side of performing a white display than the first predetermined gradation value, and the amount of current applied between the anode and the cathode of each of the self-luminous elements is controlled by a black insertion rate.

7. The driving method of a self-luminous display apparatus according to claim 6, wherein the black insertion is performed from a first line to a terminal line in turn, and a black area is collectively inserted in one frame.

8. The driving method of a self-luminous display apparatus according to claim 7, wherein the black insertion is performed from the first line to the terminal line, and the black area is inserted into a plurality of areas divided in the one frame.

9. The driving method of a self-luminous display apparatus according to claim 6, wherein the black insertion is performed into a plurality of areas divided in the one frame while interchanging the turn instead of performing it from the first line to the terminal line in turn.

10. The driving method of a self-luminous display apparatus according to claim 1, wherein the gradation value of the video data inputted from outside is on a higher gradation side of performing a white display than the first predetermined gradation value, and the amount of current applied between the anode and the cathode of each of the self-luminous elements is controlled by adjusting the amount of current passing through a group of source lines.

11. The driving method of a self-luminous display apparatus according to claim 10, wherein the adjustment of the amount of current passing through the group of source lines is performed by increasing and decreasing a reference current value.

12. The driving method of a self-luminous display apparatus according to claim 10, wherein the adjustment of the amount of current passing through the group of source lines is performed by increasing and decreasing the number of gradations.

13. The driving method of a self-luminous display apparatus according to claim 1, wherein a difference between a first current passing between the anode and the cathode of each of the self-luminous elements in a first frame period and a second current passing in a second frame period following the first frame period is acquired, an n difference current value of which difference value is 1/n (n is a number of 1 or more) is calculated, and a selection value of a pixel line is determined from the n difference current value.

14. The driving method of a self-luminous display apparatus according to claim 13, wherein the value n is $4 \leqq n \leqq 256$.

15. The driving method of a self-luminous display apparatus according to claim 1, wherein a $\gamma$ constant is corrected to be optimum by the amount of current passing between the anode and the cathode of each of the self-luminous elements.

16. The driving method of a self-luminous display apparatus according to claim 15, wherein the $\gamma$ constant is a set of points on a curve configured by sequentially combining intermediate values of a plurality of $\gamma$ curves.

17. The driving method of a self-luminous display apparatus according to claim 15, wherein increase and decrease in the $\gamma$ constant is adjusted based on whether a light emission period of the self-luminous display element is long or short.

18. The driving method of a self-luminous display apparatus according to claim 1, wherein on and off of the second process is controlled by placing switching instrument for the second processing instrument so as to determine the amount of current passing between the anode and the cathode of each of the self-luminous element by combining the first process and the second process when turned on and determine it only by the first process when turned off.

19. A driving circuit of a self-luminous display apparatus having multiple self-luminous elements constituting each pixel placed like a matrix in a pixel row direction and a pixel line direction and driving a display portion by passing a current between an anode and a cathode of each self-luminous element and thereby emitting light from the pixels, the driving circuit comprising:

a first processing instrument which performs processing of setting a first amount of current which should pass between the anode and the cathode correspondingly to image data inputted from outside and setting the first amount of current at a predetermined single value independently of an image data value distribution status in the vicinity of the image data; and a second processing instrument which performs processing of setting a second amount of current which should pass between the anode and the cathode correspondingly to the image data inputted from outside and having one value of the second amount of current prepared which is a value of the first amount of current suppressed at a predetermined ratio according to the image data value distribution status in the vicinity of the image data, where the ratio of suppressing is variable according to the image data value distribution status; and a control instrument which controls the amount of current passing through each of the pixel lines based on results of the first and second processing instrument.

20. The driving circuit of the self-luminous display apparatus according to claim 19, in which the second processing instrument performs processing of deciding the second amount of current for each of the pixel lines by arithmetic processing based on the image data inputted from outside.

21. The driving circuit of the self-luminous display apparatus according to claim 20, in which the arithmetic processing is a process of obtaining a current value i1 which is a maximum value of the image data inputted from outside in a first period, acquiring a proper current value i2 by calculation from the image data inputted from outside in a second period, and sequentially calculating an amount of current applied to each of the pixels displayed based on the predetermined image data inputted from outside in the second period based on a ratio i2/i1.

22. The driving circuit of the self-luminous display apparatus according to claim 19, in which the second processing instrument includes an instrument that measures the image data inputted from outside and performs the arithmetic processing of deciding the second amount of current for each of the pixel lines based on the measurement result.

23. The driving circuit of the self-luminous display apparatus according to claim 22, in which the arithmetic processing is a process of obtaining a third current value i3 which is a maximum value of the image data inputted from outside, actually applying a current between the anode and the cathode of each of the self-luminous display elements, and acquiring an optimum value as a second current value i4 and multiplying the inputted image data by a ratio i4/i3 so as to sequentially calculate the amount of current applied to each of the pixels displayed based on the predetermined image data.

24. The driving circuit of the self-luminous display apparatus according to claim 19, further comprising a switching instrument for the second processing instrument which has operations effected only by the first processing instrument.

25. A controller of a self-luminous display apparatus having the driving circuit according to claim 19.

26. A self-luminous display apparatus comprising the driving circuit according to claim 19, in which the self-luminous elements are formed or placed in a matrix in a pixel row direction and a pixel line direction.

27. A driving method of a self-luminous display apparatus having a plurality of self-luminous elements comprising each of pixels placed in a matrix in a pixel row direction and a pixel line direction and driving a display portion by passing a current between an anode and a cathode of each of the self-luminous elements and thereby emitting light from each of the pixels, wherein the method comprises:

emitting the light from the display portion by controlling an amount of current passing each of pixel lines based on results of (1) a first process of acquiring a first amount of current to be passed between the anode and the cathode correspondingly to video data inputted from outside, and acquiring a predetermined single value as the first amount of current irrespective of a status of video data value distribution around the video data, or (2) a second process of acquiring a second amount of current to be passed between the anode and the cathode correspondingly to the video data inputted from outside; and preparing as the second amount of current a value having the first amount of current suppressed at a predetermined ratio according to the status of video data value distribution around the video data while the ratio of suppression being variable according to the status of video data value distribution, and in the case where the amount of current equivalent to displaying white is represented as 100, and if a gradation of a low-current region having the predetermined amount of current represented as 30 or less is given a positive number which is $N1>1$, $N2>0$ and $N1 \geqq N2$ as a coefficient, W as the predetermined amount of current, I org as a current value at the time, and T org as a light emitting period, applying the amount of current satisfying the current value of $I\,org \times N1$ and the light emitting period of $T\,org \times 1/N2$ instead of the predetermined amount of current.

* * * * *